US006489071B2

(12) United States Patent
Miyamoto et al.

(10) Patent No.: US 6,489,071 B2
(45) Date of Patent: Dec. 3, 2002

(54) ELECTROPHOTOSENSITIVE MATERIAL

(75) Inventors: Eiichi Miyamoto, Osaka (JP); Yoshio Inagaki, Osaka (JP); Hideaki Fukunaga, Yokaichi (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/910,916

(22) Filed: Jul. 24, 2001

(65) Prior Publication Data

US 2002/0051918 A1 May 2, 2002

(30) Foreign Application Priority Data

| | | |
|---|---|---|
| Jul. 25, 2000 | (JP) | 2000-224240 |
| Aug. 10, 2000 | (JP) | 2000-243150 |
| Aug. 22, 2000 | (JP) | 2000-250409 |
| Sep. 18, 2000 | (JP) | 2000-281051 |
| Oct. 12, 2000 | (JP) | 2000-311421 |
| Nov. 22, 2000 | (JP) | 2000-355340 |
| Dec. 1, 2000 | (JP) | 2000-366431 |
| Jan. 30, 2001 | (JP) | 2001-020876 |

(51) Int. Cl.[7] ..... G03G 5/047; G03G 5/147
(52) U.S. Cl. ..... 430/58.65; 430/66; 430/67
(58) Field of Search ..... 430/58.65, 66, 430/58.75, 58.85, 58.4, 58.8, 67

(56) References Cited

U.S. PATENT DOCUMENTS

| | | | | |
|---|---|---|---|---|
| 5,059,502 A | | 10/1991 | Kojima et al. | 430/66 |
| 5,256,509 A | | 10/1993 | Hayashi et al. | 430/66 |
| 5,308,727 A | | 5/1994 | Osawa et al. | 430/58 |
| 5,344,733 A | * | 9/1994 | Suzuki et al. | 430/67 |
| 5,849,443 A | | 12/1998 | Visser et al. | 430/31 |
| 6,020,097 A | | 2/2000 | Visser et al. | 430/66 |

* cited by examiner

*Primary Examiner*—John Goodrow
(74) *Attorney, Agent, or Firm*—Smith, Gambrell & Russell

(57) ABSTRACT

The invention relates to an electrophotosensitive material comprising an organic photosensitive layer and an inorganic surface protective layer, wherein at least an outermost part of the organic photosensitive layer contains a diphenylamine compound represented by a formula (1):

(1)

wherein 'A' denotes a groups combined with two phenyl groups in the formula in a manner to jointly form a π-electron conjugated system.

The electrophotosensitive material features more excellent durability because the compound functions as a binder for combining the organic photosensitive layer with the inorganic surface protective layer so that the surface protective layer is less prone to suffer cracks or delamination.

18 Claims, No Drawings

ELECTROPHOTOSENSITIVE MATERIAL

TECHNICAL FIELD

The present invention relates to an electrophotosensitive material.

BACKGROUND OF THE INVENTION

As an electrophotosensitive material for use in image forming apparatuses such as electrostatic copiers, laser beam printers, plain paper facsimiles and the like, a so-called organic electrophotosensitive material is widespread which comprises a combination of the following components:

- a charge generating material for generating an electric charge (positive hole and electron) when exposed to light;
- a charge transport material for transporting the generated electric charge; and
- a binder resin.

The charge transport materials fall into two broad categories which include a positive-hole transport material for transporting positive holes of the electric charge, and an electron transport material for transporting electrons.

The organic electrophotosensitive material has an advantage over an inorganic electrophotosensitive material employing an inorganic semiconductor material in that the organic electrophotosensitive material is fabricated more easily at less production costs than the latter.

In addition, the organic electrophotosensitive material also has a merit of greater freedom of function design by virtue of a wide variety of options for materials including charge generating materials, charge transport materials, binder resins and the like.

The organic electrophotosensitive material is constructed by forming a single-layer or multi-layer photosensitive layer over a conductive substrate.

The single-layer photosensitive layer is formed by dispersing a charge generating material and a charge transport material (a positive-hole transport material and/or an electron transport material) in a binder resin.

The multi-layer photosensitive layer is formed by forming a lamination of the charge generating layer containing the charge generating material and the charge transport layer containing the charge transport material (the positive-hole transport material or the electron transport material).

Despite the aforementioned various merits, the organic electrophotosensitive material is susceptible to scratches, mars and the like in an actual use environment, thus suffering a smaller durability than the inorganic electrophotosensitive material.

With an aim at increasing the durability of the organic electrophotosensitive material by solving the above problem, study has been made on an approach to overlay a surface protective layer on an outermost layer.

The widely used surface protective layer is exemplified by an organic layer which is preferable in the light of adhesion to and affinity with the organic photosensitive layer, integrity as a lamination, and consistency in the film forming process. A usable surface protective layer includes, for example, a layer of binder resin, and a layer of binder resin having conductive particles, such as of metal oxides, dispersed therein.

However, the electrophotosensitive material employing such an organic layer as the surface protective layer suffers the drawbacks of an increased residual potential and a lowered chargeability when repeatedly used for image forming processes, and of significant variations in the photosensitivity characteristics due to environmental changes (temperature, humidity and the like).

In this connection, more recent years have seen investigations made on the use of an inorganic layer as the surface protective layer, the inorganic layer comprising an inorganic material such as metallic elements, carbon and inorganic compounds containing any of these elements, and having high hardness and wear resistance. The inorganic surface protective layer may be laid over the organic photosensitive layer by, for example, the vapor deposition methods such as sputtering, plasma CVD, photo CVD or the like.

The inorganic surface protective layer is employed for the purposes of protecting the organic photosensitive layer and overcoming the above problem. Specifically, the electrophotosensitive material with the inorganic surface protective layer laid over the organic photosensitive layer has functions associated with the characteristics of the individual layers thereof, the organic photosensitive layer involved in the generation and transport of the electric charge, the surface protective layer responsible for ensuring the good durability and environmental resistance.

As compared with the organic surface protective layer, however, the inorganic surface protective layer has a lower ability to achieve a sufficient adhesion to the organic photosensitive layer. Even if adjustments for the deposition process or the deposition conditions may provide the inorganic layer with a sufficient initial adhesion to the organic layer, the inorganic layer is prone to suffer cracks or delamination due to various stresses imposed thereon under the actual use environment or during the long-term storage thereof.

In the combination of the organic photosensitive layer and the inorganic surface protective layer, which are formed of different materials, there are not attained as good adhering relation, affinity and integrity as in the combination of the organic layers or of the inorganic layers. That is, the organic layer and the inorganic layer are often merely combined with each other through a very small binding strength.

Accordingly, when subjected to mechanical stresses such as of contact pressure from a cleaning blade of the image forming apparatus, or thermal stresses due to repeated cycles of heating during the operation of the apparatus and cooling during the nonoperation thereof, or temperature changes during storage, the electrophotosensitive material will suffer cracks in the inorganic surface protective layer or delamination of the surface protective layer from the organic photosensitive layer as a result of increased differences between the hardnesses, flexibilities, expansion/shrinkage properties or the like of these layers.

In the present conditions, therefore, the conventional inorganic surface protective layer is yet to be put to practical use because it has not achieved a sufficient effect to increase the durability of the organic photosensitive layer.

SUMMARY OF THE INVENTION

It is an object of the invention to provide an organic electrophotosensitive material comprising an inorganic surface protective layer less prone to suffer cracks or delamination and excellent in physical stability, thereby achieving a greater durability as compared with the prior-art products.

For achieving the above object, the inventors have analyzed and investigated the film forming process for the inorganic surface protective layer.

As a result, the inventors have discovered that a condition of the surface protective layer initially deposited on the outermost part of the organic photosensitive layer has a significant influence on the physical stability of the surface protective layer subsequently deposited.

At an initial stage of the film formation, the inorganic material forming the surface protective layer is somehow combined with a part of the material of the organic photosensitive layer that is exposed at the outermost part thereof, thereby forming a nucleus for film growth. A film of the inorganic material grows about the resultant nucleus and thus, the surface protective layer is formed. In the surface protective layer thus formed, the nucleus portion functions as a binding point with the organic photosensitive layer, ensuring the good adhesion between these layers.

Therefore, the magnitude of binding strength between the organic photosensitive layer and the inorganic material at individual binding points as well as the per-area number of binding points namely the density of the binding points at an interface between the organic photosensitive layer and the surface protective layer give significant influences on the adhesion of the surface protective layer to the organic photosensitive layer and the physical stability of the surface protective layer.

Specifically, with increase in the binding strength between the organic photosensitive layer and the inorganic material and also in the density of the binding points at the interface between these layers, the surface protective layer is accordingly increased in the adhesion to the organic photosensitive layer, resulting in the greater physical stability.

As mentioned supra, the typical organic photosensitive layer has a structure wherein low molecular weight functional materials including the charge generating material, charge transport material and the like are dispersed in the binder resin forming the layer.

From the standpoint of the findings regarding the binding points, it is thought ideal that the binder resin, forming the layer and accounting for a major part thereof, act as the nucleus of film growth so as to be combined with the inorganic material forming the surface protective layer.

In the actual process, however, because of the stability and reactivity of the molecules per se or of the reaction site, the formation of the surface protective layer proceeds with some of the low molecular weight materials, that is exposed at the outermost part of the organic photosensitive layer, functioning as the nuclei of film growth, the low-molecular weight materials including the charge generating material, charge transport material and the like which are dispersed in the layer.

Hence, the properties of the low molecular weight materials, which include the reactivity and binding strength with the inorganic material, the degrees of the compatibility and affinity with the binder resin forming the organic photosensitive layer, the dimensions of the materials themselves (including not only the molecular weight but also the molecular or spatial extent), also significantly affect the adhesion to the organic photosensitive layer and the physical stability of the surface protective layer.

That is, as the low molecular-weight materials are increased in the reactivity and binding strength with the inorganic material, the surface protective layer is accordingly improved in the adhesion to the organic photosensitive layer and in the physical stability thereof.

Furthermore, as the low molecular weight materials are increased in the compatibility and affinity with the binder resin forming the organic photosensitive layer as well as in the dimensions thereof, a so-called anchor effect is accordingly increased so that the surface protective layer is also improved in the adhesion to the organic photosensitive layer and the physical stability thereof.

As to the combined form between the low molecular weight materials and the inorganic material, the most preferred is molecular bond in the light of the magnitude of the binding strength. However, if this bond should change the molecular structure to cause the production of an electric charge trap, the photosensitivity of the electrophotosensitive material might be decreased.

Therefore, an important consideration in the use of the low-molecular weight materials influence the need to prevent the reaction from transforming the molecular structure to a state reduced in the electrical properties.

Thus, the inventors have found that an electrophotosensitive material capable of forming preferable images cannot be obtained simply by overlaying on the conventional organic photosensitive layer a surface protective layer containing an inorganic material of a greater hardness.

Only after the fabrication of electrophotosensitive materials satisfying the various conditions described above, the inventors have finally discovered that the inorganic surface protective layer contributes to the improvement of the durability and environmental resistance of the electrophotosensitive material while maintaining the electrical characteristics of the organic photosensitive layer as they are.

Taking these findings into consideration, the inventors have made investigation into the various materials for forming the organic photosensitive layer. The invention has been achieved by the inventors' study that a suitable material satisfying these requirements is a diphenylamine compound used as the positive-hole transport material and represented by the following formula (1):

(1)

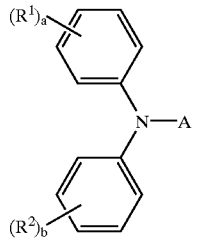

wherein 'A' denotes a group having at least one of aromatic groups, heterocyclic groups, double bond groups and conjugated double bond groups combined with two phenyl groups in the formula in a manner to jointly form a π-electron conjugated system, provided that when 'A' is the only one phenyl group that is directly combined with nitrogen atom in the formula, this phenyl group further possesses a group including one or more aromatic groups, heterocyclic groups, double bond groups or conjugated double bond groups which form the π-electron conjugated system jointly with these groups, or that when 'A' possesses a double bond group directly combined with nitrogen atom in the formula and one phenyl group attached to its end, this phenyl group further possesses a group including one or more aromatic groups, heterocyclic groups, double bond groups or conjugated double bond groups which form the π-electron conjugated system jointly with these groups; $R^1$ and $R^2$ are the same or different and each denote a hydrogen atom, alkyl group, alkoxy group, aralkyl group, aromatic group or halogen atom; $R^1$ or $R^2$ may form a condensed ring jointly with the phenyl group; and 'a' and 'b' are the same or different and each denote an integer of 0 to 5.

In short, the electrophotosensitive material of the invention comprises the organic photosensitive layer and the inorganic surface protective layer laid over the conductive substrate in this order, wherein at least an outermost part of the organic photosensitive layer that contacts the surface protective layer contains the diphenylamine compound of the formula (1).

The diphenylamine compound of the formula (1) features a great reactivity with the inorganic material forming the surface protective layer because the π-electron conjugated system is spread across the molecules thereof so that the compound has a function to attract particularly a metallic element or carbon of the inorganic material at the initial stage of the film forming process.

Additionally, this function increases the ratio of the molecules of the diphenylamine compound exposed at the outermost part of the organic photosensitive layer that are combined with the inorganic material to form the nuclei of film growth. This results in a higher density of the binding points at the interface between these layers.

Furthermore, the higher the density of the binding points, the greater the film growth rate. Therefore, the time for film forming process may be reduced thereby minimizing damage on the organic photosensitive layer during the deposition of the surface protective layer by the vapor deposition methods or the like.

With a π-bond of the double bond in the molecules split off, the diphenylamine compound is rigidly combined with a metallic element, carbon or the like via molecular bond.

In addition, the diphenylamine compound has a relatively greater molecular weight among the positive-hole transport materials. Because of the π-electron conjugated system spread across the molecules, the diphenylamine compound has a molecular structure spread in a plane-like fashion as a whole, thus having a great molecular or spatial extent. Furthermore, the compound is excellent in compatibility and affinity with the binder resin, presenting a good anchor effect on the binder resin.

Therefore, a great binding strength between the organic photosensitive layer and the inorganic material results.

According to the invention, the physical stability of the inorganic surface protective layer can be improved by increasing the adhesion thereof to the organic photosensitive layer. Thus, the inorganic protective layer is prevented from suffering the occurrence of cracks and delamination in the actual use environment or during the long-term storage. As a result, an electrophotosensitive material featuring a superior durability to the conventional ones is provided.

The diphenylamine compound has a great positive-hole transportability because of the π-electron conjugated system spread across the molecules thereof. Furthermore, the compound does not produce a deep electric charge trap even when the molecular structure thereof is changed by the molecular bond with a metal or carbon. In addition, the molecular bond occurs only in a small part of the diphenylamine compound that is exposed at the outermost part of the organic photosensitive layer, so that the most of the diphenylamine compound in the organic photosensitive layer maintains the excellent positive-hole transportability as it is. Hence, there is no fear of reduced photosensitivity of the electrophotosensitive material.

Besides the above merits, the diphenylamine compound is excellent in compatibility with the binder resin so that a large amount of diphenylamine compound may be uniformly dispersed in the binder resin without producing particle aggregation. As a result, the electrophotosensitive material of the invention also features good photosensitivity characteristics.

DETAILED DESCRIPTION OF THE INVENTION

The invention will be described as below.

Diphenylamine Compound

In an electrophotosensitive material according to the invention, a diphenylamine compound contained in at least an outermost part of an organic photosensitive layer that is in contact with a surface protective layer is represented by the formula (1):

(1)

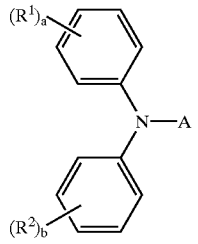

wherein 'A' denotes a group having at least one of aromatic groups, heterocyclic groups, double bond groups and conjugated double bond groups combined with two phenyl groups in the formula in a manner to jointly form a π-electron conjugated system, provided that when 'A' is the only one phenyl group that is directly combined with nitrogen atom in the formula, this phenyl group further possesses a group including one or more aromatic groups, heterocyclic groups, double bond groups or conjugated double bond groups which form the π-electron conjugated system jointly with these groups, or that when 'A' possesses a double bond group directly combined with nitrogen atom in the formula and one phenyl group attached to its end, this phenyl group further possesses a group including one or more aromatic groups, heterocyclic groups, double bond groups or conjugated double bond groups which form the π-electron conjugated system jointly with these groups; $R^1$ and $R^2$ are the same or different and each denote a hydrogen atom, alkyl group, alkoxy group, aralkyl group, aromatic group or halogen atom; $R^1$ or $R^2$ may form a condensed ring jointly with the phenyl group; and 'a' and 'b' are the same or different and each denote an integer of 0 to 5.

Examples of a suitable diphenylamine compound of the formula (1) includes compounds in which 'A' in the formula (1) is a group represented by a formula (A1):

$$—Ar^1—(R^3)_c \quad (A1)$$

wherein $Ar^1$ denotes an aromatic group, heterocyclic group or group represented by a formula (A1a):

$$—Ar^2—CH{=}CH—Ar^3—CH{=}E— \quad (A1a)$$

in which formula (A1a), $Ar^2$ and $Ar^3$ are the same or different and each denote an aromatic group, and 'E' denotes a nitrogen atom or a group represented by a formula (A1b):

$$={}CH—Ar^4— \quad (A1b)$$

in which formula (A1b), $Ar^4$ denotes an aromatic group; $R^3$ denotes a hydrogen atom, aromatic group, heterocyclic group or group represented by a formula (A1c);

(A1c)

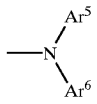

provided that when $Ar^1$ is an aromatic group derived from a benzene ring, $R^3$ is not a hydrogen atom; 'c' is an integer of 1 or 2; $Ar^5$ and $Ar^6$ in the formula (A1c) are the same or different and each denote an aromatic group.

Examples of another suitable diphenylamine compound of the formula (1) include compounds in which 'A' in the formula (1) is a group represented by a formula (A2):

(A2)

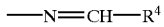

wherein $R^4$ denotes an aromatic group having 7 to 16 carbon atoms, heterocyclic group or group represented by a formula (A2a):

(A2a)

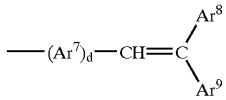

in which formula (A2a), $Ar^7$ denotes an aromatic group or two or more aromatic groups forming a π-electron conjugated system, $Ar^8$ and $Ar^9$ are the same or different and each denote an aromatic group; and 'd' denotes an integer of 0 or 1.

Examples of the aromatic group in the above formulas include groups derived from aromatic compounds such as benzene, toluene, xylene, biphenyl, o-terphenyl, m-terphenyl, p-terphenyl, naphthalene, anthracene, phenanthrene, pyrene, indene, azulene, heptalene, biphenylene, fluorene and the like.

Examples of the heterocyclic group include groups derived from heterocyclic compounds such as indole, quinoline, benzopyran, quinazoline, xanthene, carbazole, phenanthridine and the like.

Examples of the double bond group include —CH═CH—, —CH═N—, —N═N— and the like.

A specific example of the conjugated double bond group is exemplified by a group comprising two or more of one type or more than one types selected from the above double bond groups and combined in a manner to form the π-electron conjugated system.

These groups may optionally have a substituent. Examples of a suitable substituent include alkyl groups, alkoxy groups, aralkyl groups, aromatic groups, halogen atoms and the like.

Examples of the alkyl group equivalent to the above substituent or the groups $R^1$, $R^2$ include alkyl groups having 1 to 12 carbon atoms, such as methyl, ethyl, n-propyl(n-Pr), isopropyl(i-Pr), n-butyl(n-Bu), isobutyl(i-Bu), sec-butyl(s-Bu), tert-butyl(t-Bu), pentyl, isopentyl, neopentyl, hexyl, heptyl, octyl, nonyl, decyl, undecyl, dodecyl and the like.

Examples of the alkoxy group include alkoxy groups having 1 to 12 carbon atoms, such as methoxy, ethoxy, n-propoxy, isopropoxy, n-butoxy, isobutoxy, sec-butoxy, tert-butoxy, pentyloxy, isopentyloxy, neopentyloxy, hexyloxy, heptyloxy, octyloxy, nonyloxy, decyloxy, undecyloxy, dodecyloxy and the like.

Examples of the aralkyl group include aralkyl groups having 4 to 10 carbon atoms in its aryl potion, such as benzyl, benzhydryl, triphenylmethyl, phenethyl, thenyl, furfuryl and the like.

Examples of the aromatic group include the same groups as those mentioned supra.

Other usable substituents include, for example, hydroxyalkyl groups; alkoxyalkyl groups; monoalkyl aminoalkyl groups; dialkyl aminoalkyl groups; halogenated alkyl groups; alkoxycarbonylalkyl groups; carboxyalkyl groups; alkanoyloxyalkyl groups; aminoalkyl groups; amino group; hydroxy group; optionally esterified carboxyl groups; cyano group and the like.

Specific examples of the group represented by the formula (1) with 'A' denotes the formula (A1) include the following compounds.

Diphenylamine Compound (1-1)

(1-1)

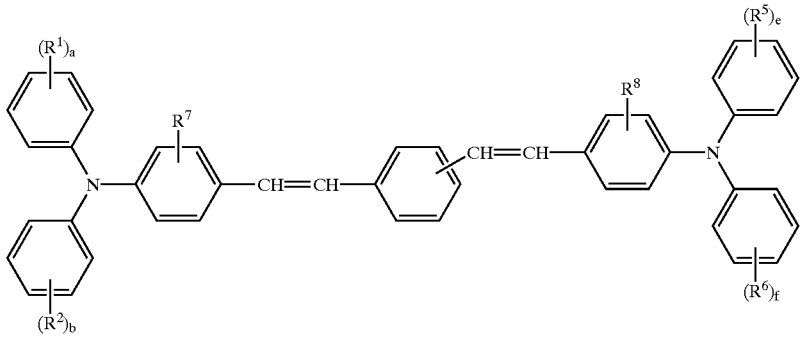

This compound is equivalent to a compound of the formula (1) wherein 'A' is represented by the formula (A1) in which $Ar^1$ is represented by the formula (A1a), $R^3$ is represented by the formula (A1c) and 'c' is 1; in which formula (A1a), 'E' is represented by the formula (A1b); wherein $Ar^2$, $Ar^3$ and $Ar^4$ each denote a divalent aromatic group derived from a benzene ring; wherein $Ar^5$ and $Ar^6$ each denote a phenyl group. The groups $R^1$, $R^2$ and the symbols 'a', 'b' are the same as defined in the foregoing. The groups $R^5$ and $R^6$ are the same or different and each denote a hydrogen atom, alkyl group, alkoxy group, aralkyl group, aromatic group or halogen atom. The symbols 'e' and 'f' are the same or different and each denote an integer of 0 to 5. The groups $R^7$ and $R^8$ are the same or different and each denote a hydrogen atom or alkyl group.

The compound of the formula (1-1) is rigidly combined with a metal or carbon via molecular bond because the double bond in the molecule, particularly a π-bond of the —CH═CH— bond is split off. Among the diphenylamine compounds of the formula (1), this compound has not only a greater molecular weight but also a greater molecular or spatial extent because of its molecular structure with seven benzene rings spread in a plane-like fashion. Therefore, the compound exhibits a particularly preferable anchor effect on the binder resin. Thus, the compound of the formula (1-1) further features a good effect to increase the binding strength between the organic photosensitive layer and the inorganic material in addition to the aforesaid effects.

The compound of the formula (1-1) is classified into three types of compounds respectively having two —CH═CH— groups in an ortho(o-) position, a meta(m-) position, and a para(p-) position relative to the benzene ring in the molecular center. Any of these compounds are usable in the invention.

Specific examples of the compound of the formula (1-1) include compounds represented by formulas (1-1-1) to (1-1-31).

(1-1-1)

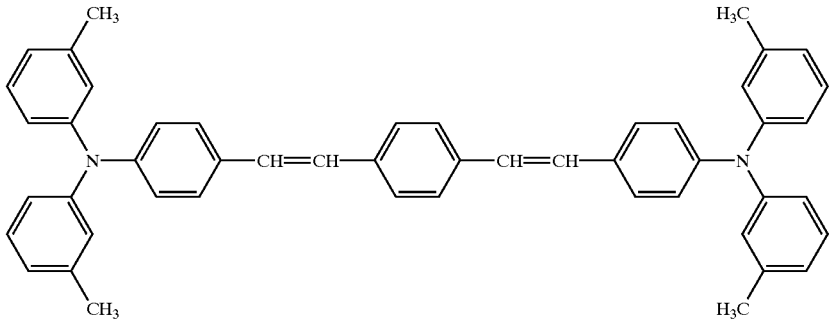

(1-1-2)

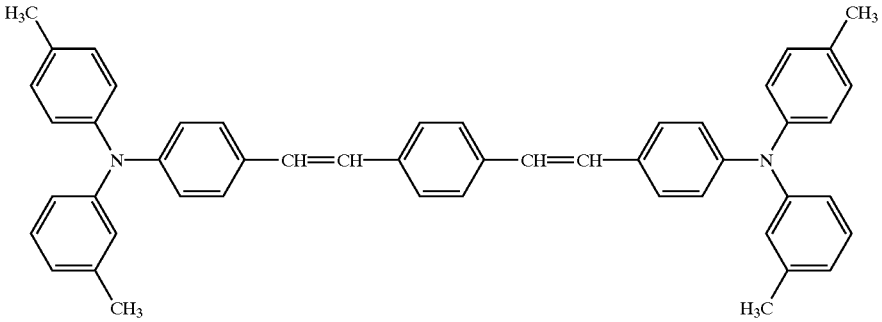

(1-1-3)

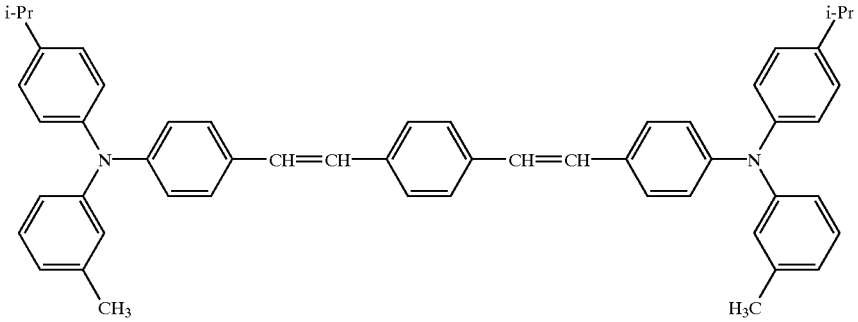

(1-1-4)

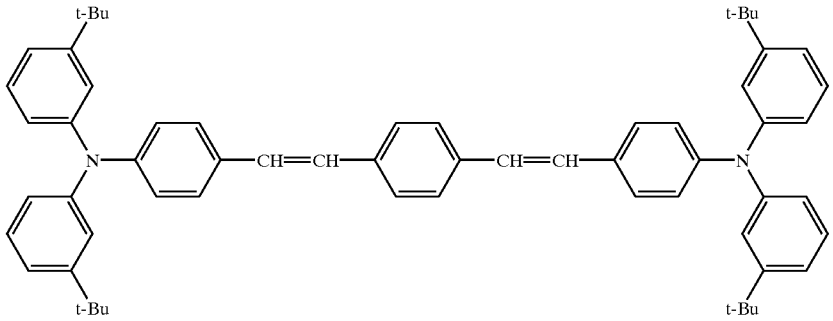

-continued
(1-1-5)
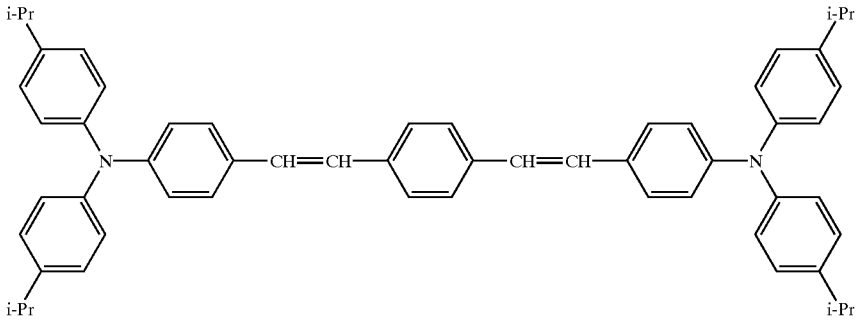
(1-1-6)
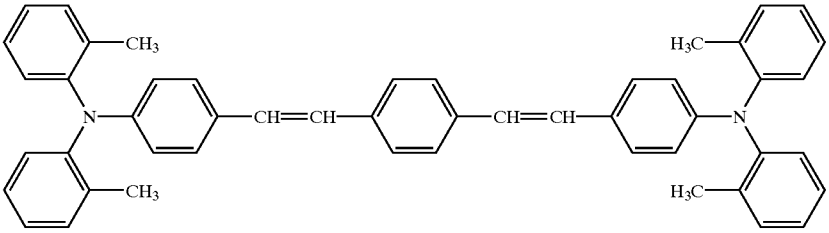
(1-1-7)
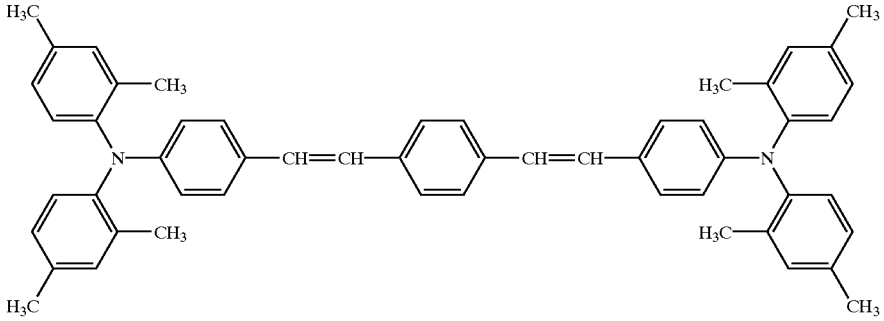
(1-1-8)
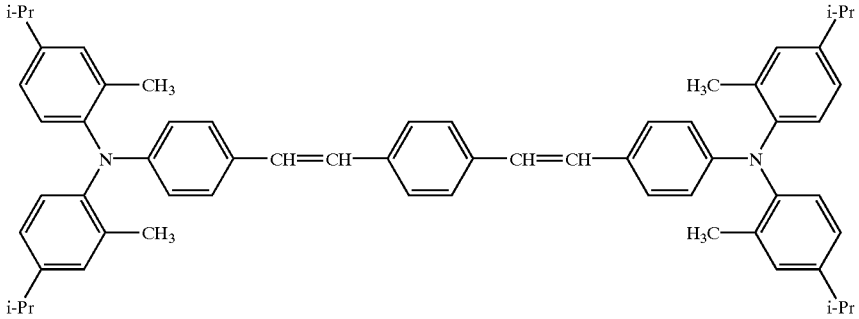
(1-1-9)
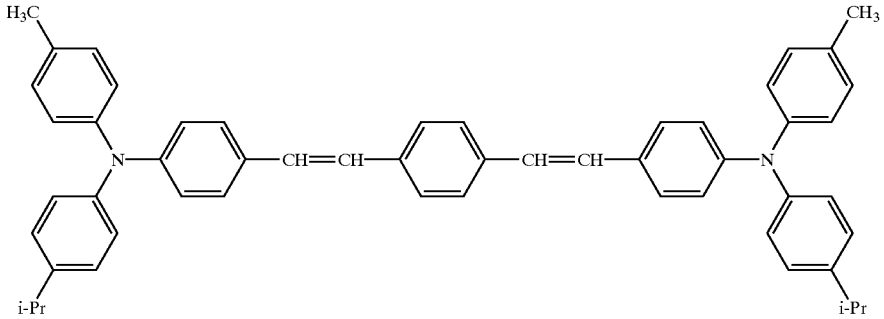

-continued
(1-1-10)
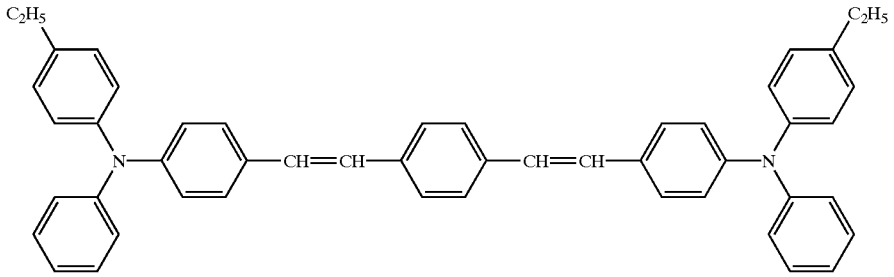
(1-1-11)
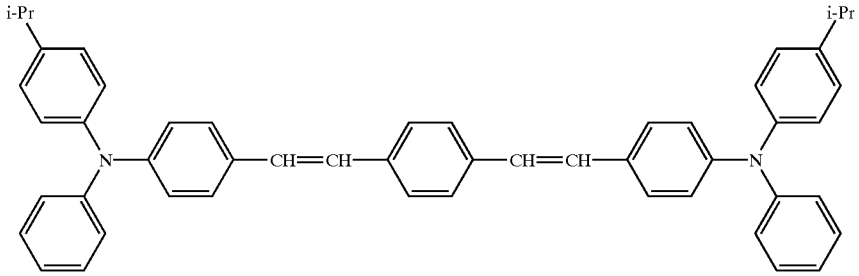
(1-1-12)
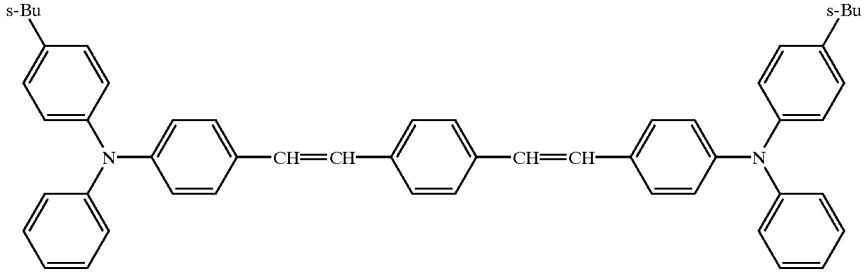
(1-1-13)
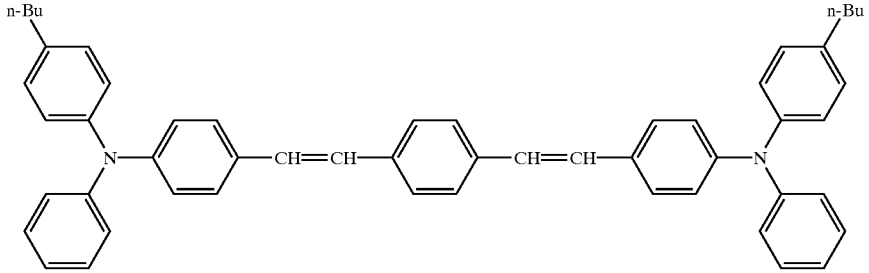
(1-1-14)
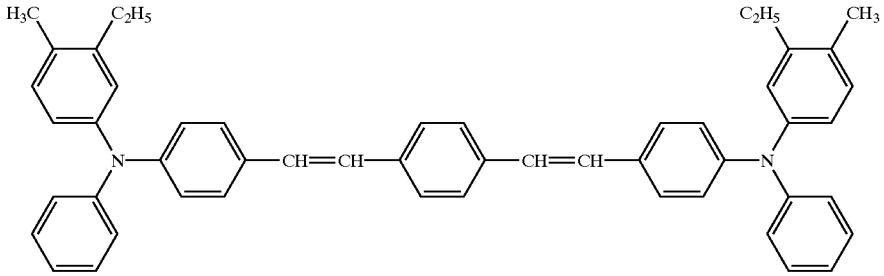

-continued
(1-1-15)
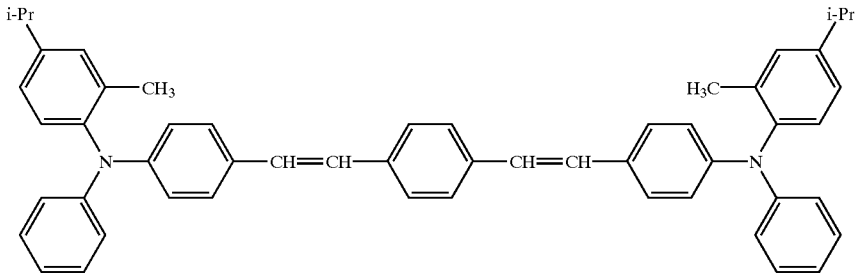
(1-1-16)
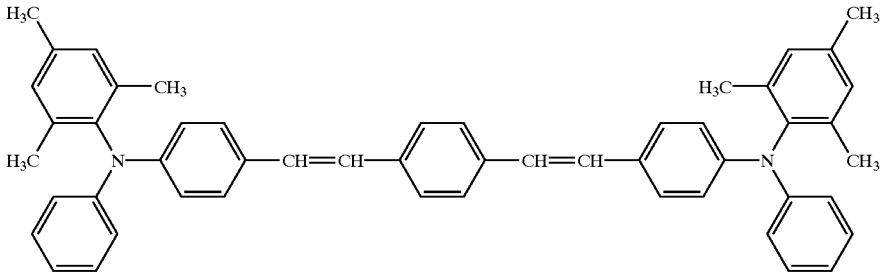
(1-1-17)
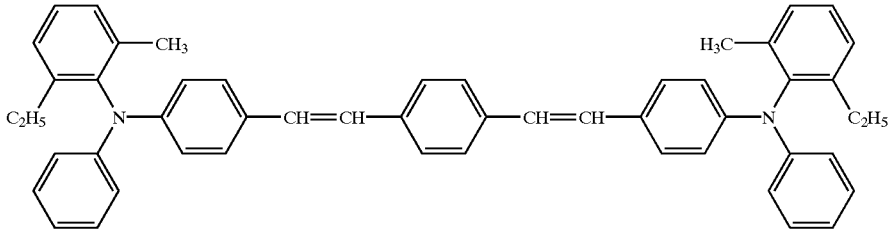
(1-1-18)
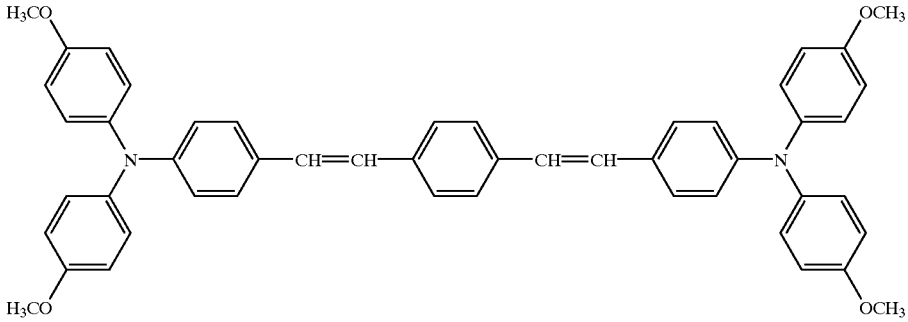
(1-1-19)
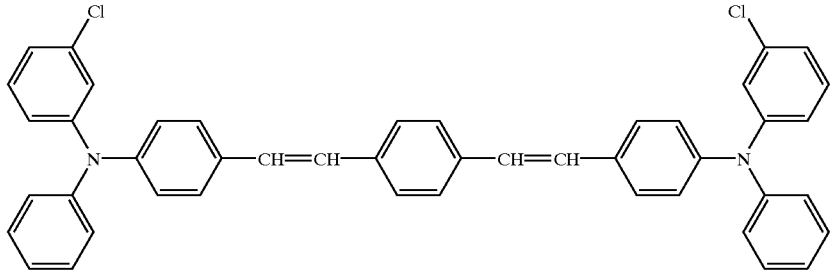

-continued
(1-1-20)
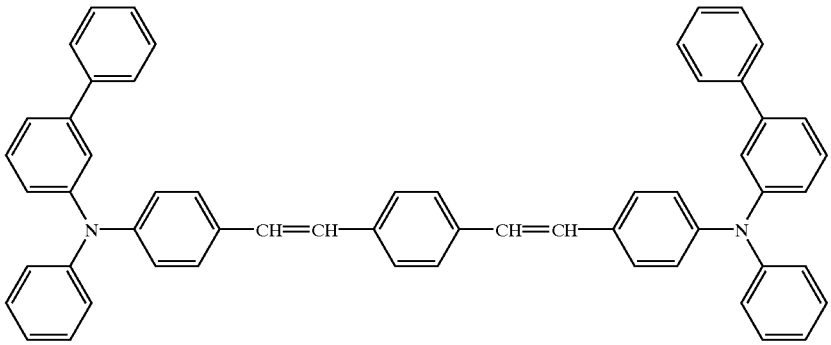
(1-1-21)
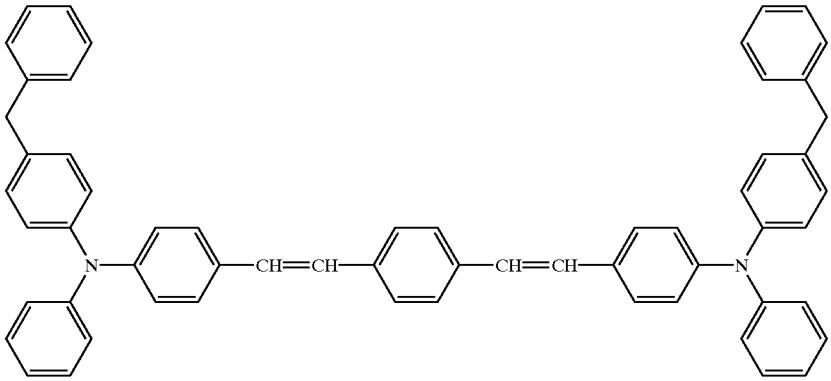
(1-1-22)
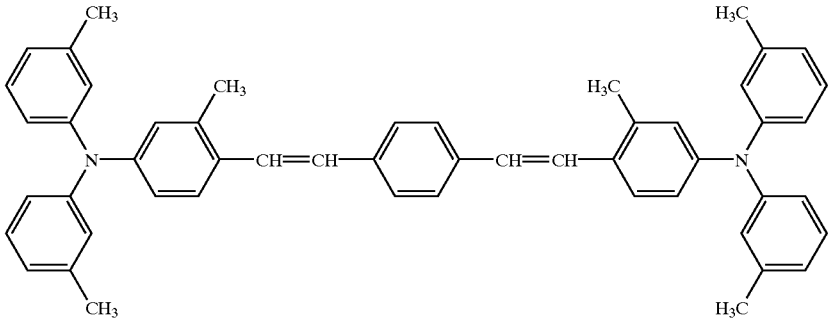
(1-1-23)
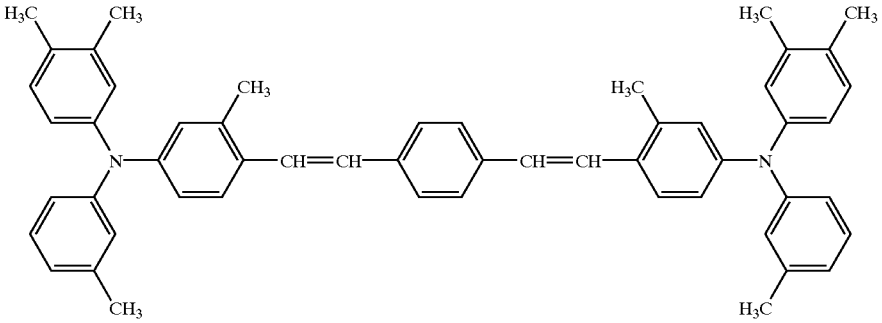

-continued
(1-1-24)
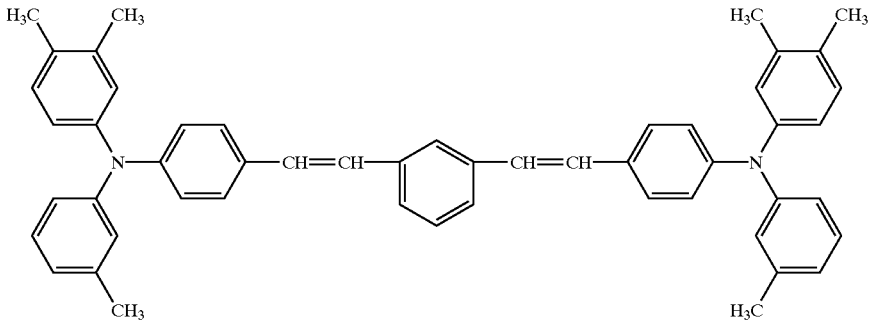
(1-1-25)
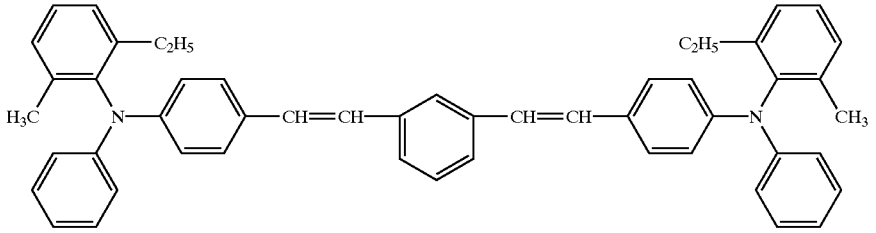
(1-1-26)
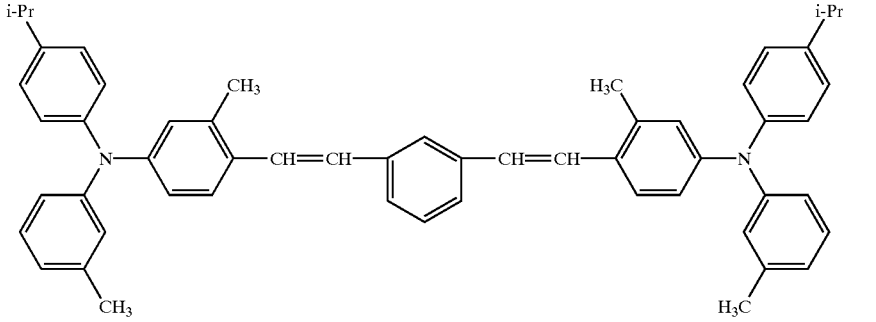
(1-1-27)
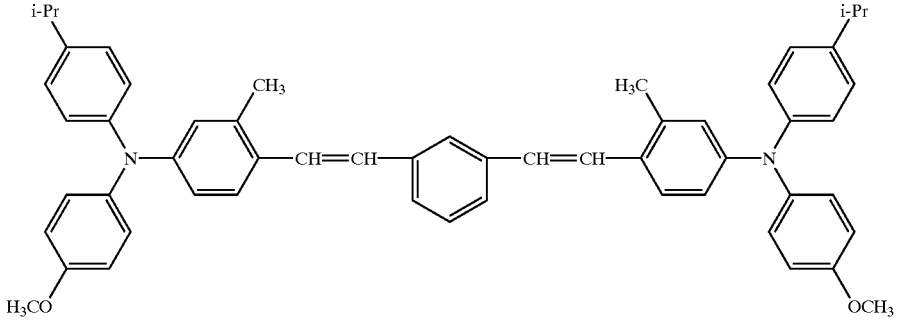
(1-1-28)
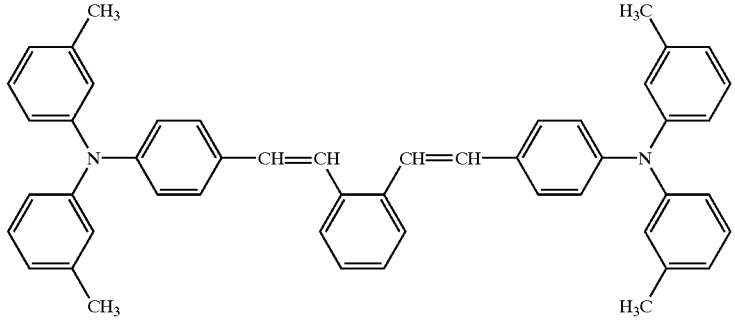

-continued (1-1-29)

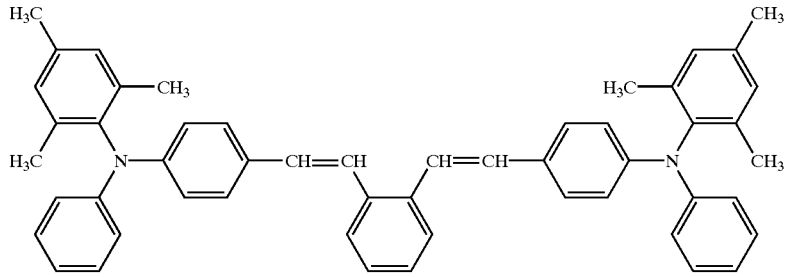

(1-1-30)

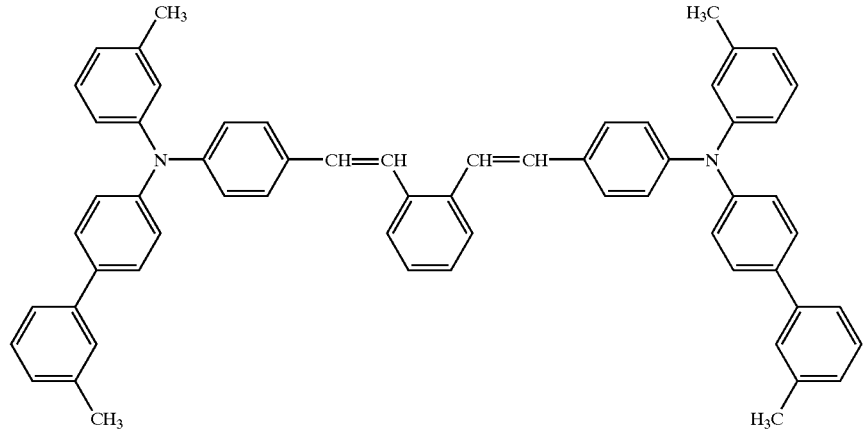

(1-1-31)

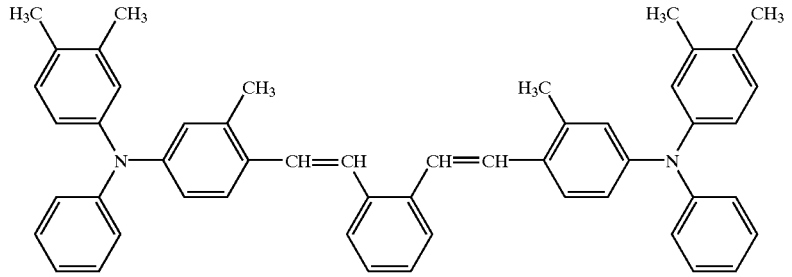

(1-2)

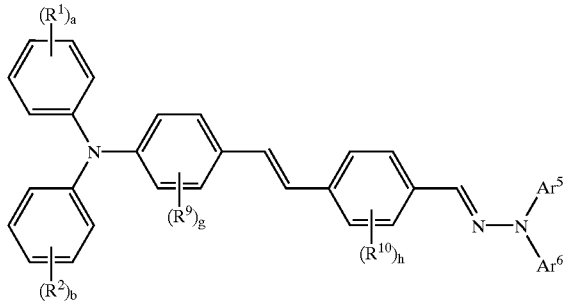

This compound is equivalent to a compound of the formula (1) wherein 'A' is represented by the formula (A1) in which $Ar^1$ is represented by the formula (A1a), $R^3$ is represented by the formula (A1c), and 'c' is 1; in which formula (A1a), 'E' is represented by the formula (A1b), and $Ar^2$ and $Ar^3$ each denote a divalent aromatic group derived from a benzene ring. The groups $R^1$, $R^2$, $Ar^5$ and $Ar^6$ and the symbols 'a' and 'b' are the same as defined in the foregoing. The groups $R^9$ and $R^{10}$ are the same or different and each denote a hydrogen atom, alkyl group, alkoxy group, aralkyl group, aromatic group or halogen atom. The symbols 'g' and 'h' are the same or different and each denote an integer of 0 to 4.

The compound of the formula (1-2) is rigidly combined with a metal or carbon via molecular bond because the double bond in the molecule, particularly the π-bond of the —CH═CH— bond is split off. Among the diphenylamine compounds of the formula (1), this compound has not only a greater molecular weight but also a greater molecular or spatial extent because of its molecular structure with four benzene rings and two aromatic rings spread in a plane-like fashion. Therefore, the compound exhibits a particularly preferable anchor effect on the binder resin. Thus, the compound of the formula (1-2) further features a good effect to increase the binding strength between the organic photosensitive layer and the inorganic material in addition to the aforesaid effects.

Specific examples of the compound of the formula (1-2) include compounds represented by formulas (1-2-1) to (1-2-18).

(1-2-1)
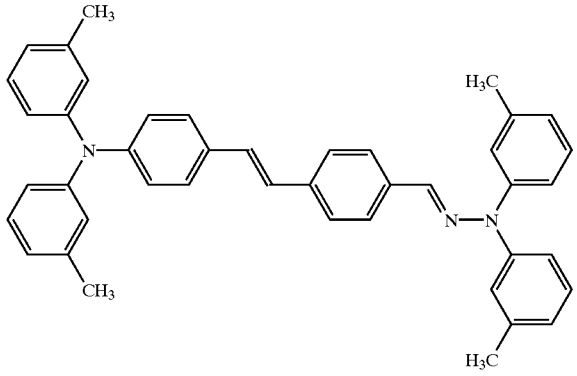
(1-2-2)
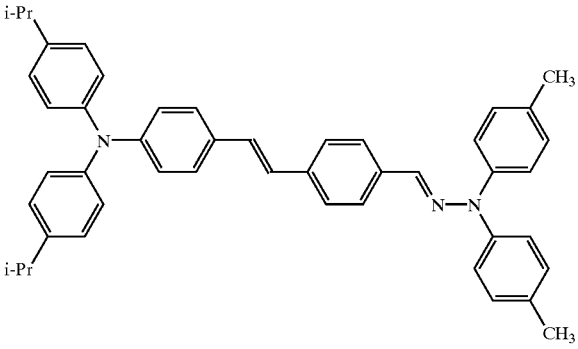
(1-2-3)
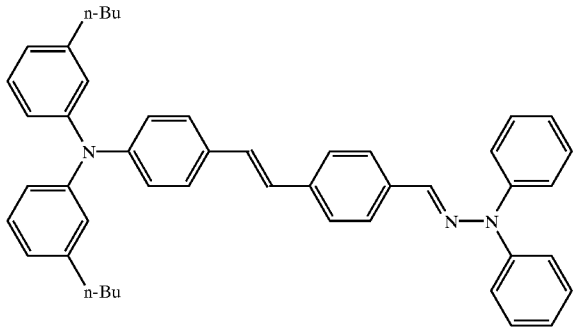
(1-2-4)
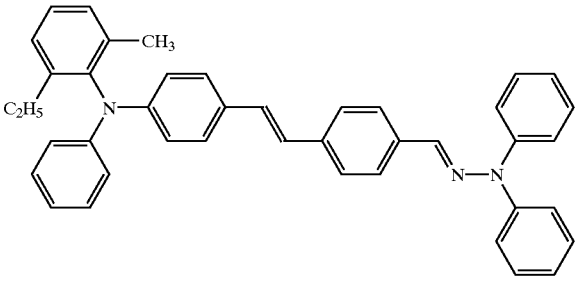
-continued
(1-2-5)
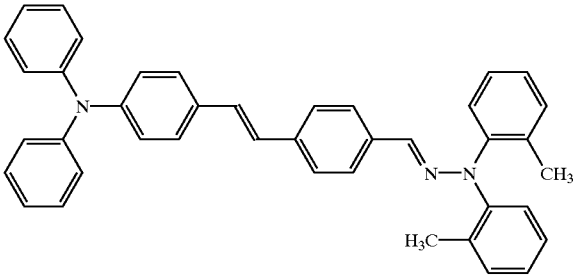
(1-2-6)
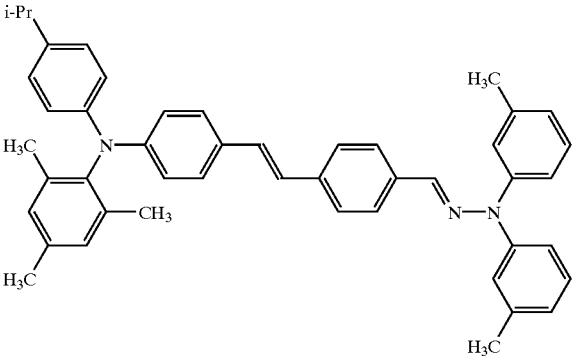
(1-2-7)
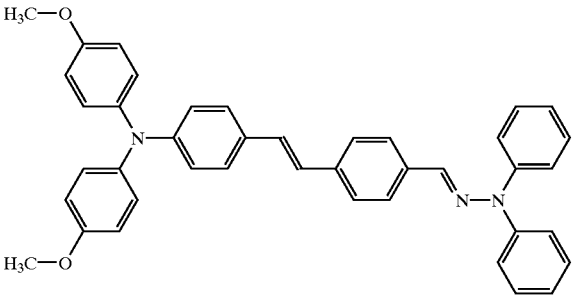
(1-2-8)
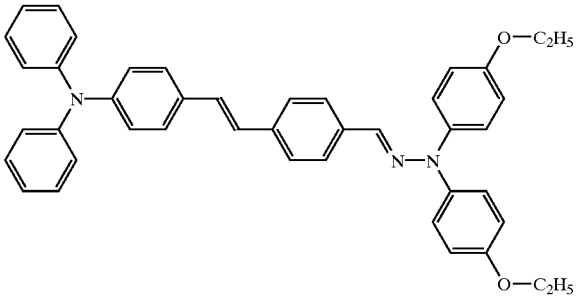

-continued
(1-2-9)
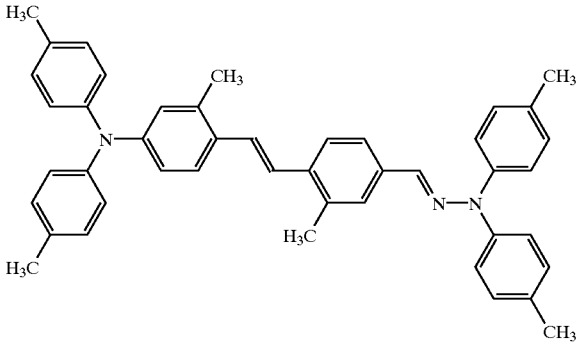
(1-2-10)
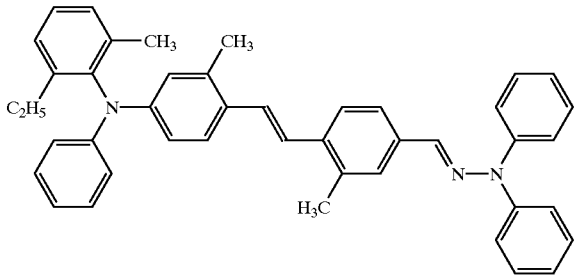
(1-2-11)
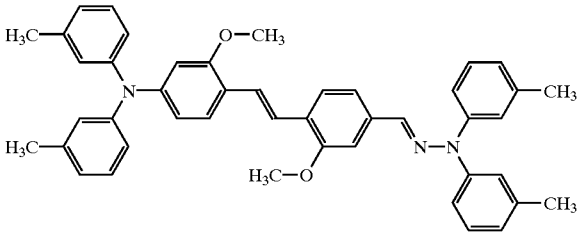
(1-2-12)
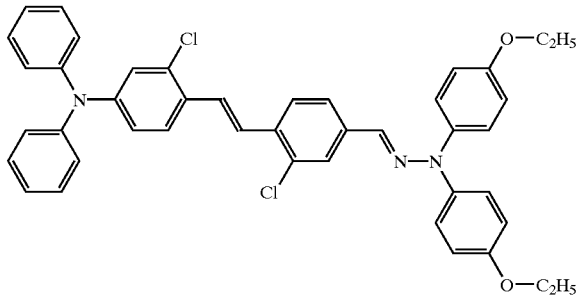
(1-2-13)
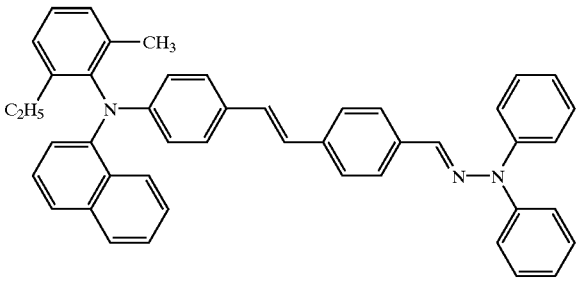
-continued
(1-2-14)
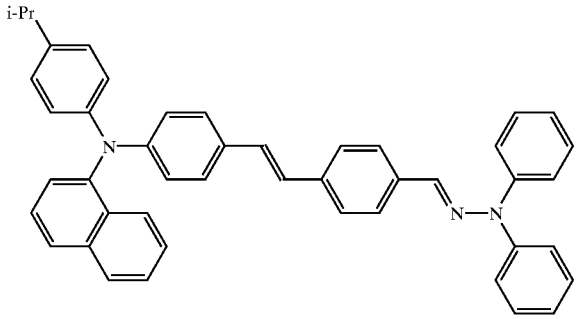
(1-2-15)
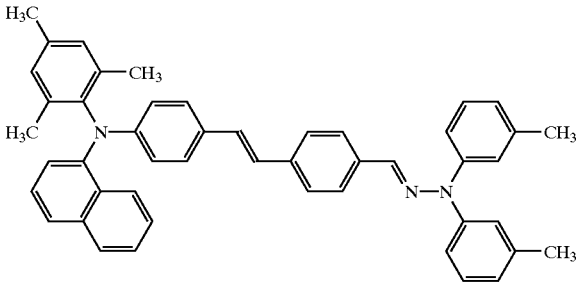
(1-2-16)
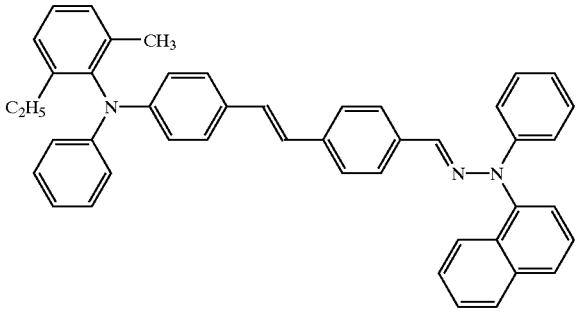
(1-2-17)
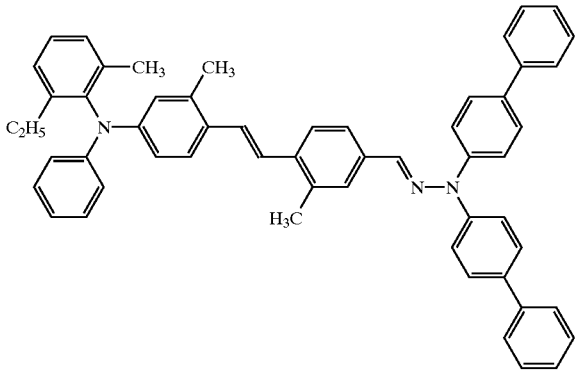

-continued (1-2-18)

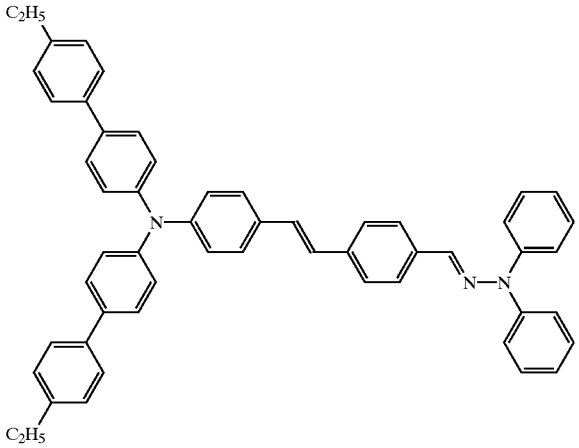

Diphenylamine Compound (1-3)

(1-3)

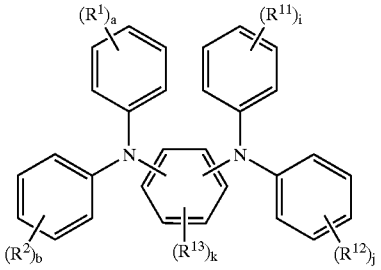

This compound is equivalent to a compound of the formula (1) wherein 'A' is represented by the formula (A1) in which $Ar^1$ is a divalent aromatic group derived from a benzene ring, $R^3$ is represented by the formula (A1c), and 'c' is 1; and wherein $Ar^5$ and $Ar^6$ each denote a phenyl group. The groups $R^1$, $R^2$ and the symbols 'a', 'b' are the same as defined in the foregoing. The groups $R^{11}$, $R^{12}$ and $R^{13}$ are the same or different and each denote a hydrogen atom, alkyl group, alkoxy group, aralkyl group, aromatic group or halogen atom. The symbols 'i' and 'j' are the same or different and each denote an integer of 0 to 5, whereas 'k' denotes an integer of 0 to 4.

Among the diphenylamine compounds of the formula (1), the compound of the formula (1-3) is molecularly stronger and has a good stability against thermally or electrically accelerated atoms or ions, plasma, light rays, heat radiation and the like, and more particularly against plasma-excited light and activated ions. Therefore, the compound is unsusceptible to decomposition or change in properties when exposed to such an atmosphere during the deposition of the inorganic surface protective layer by the CVD method or the like. Thus, the compound of the formula (1-3) features, in addition to the aforesaid effects, a good effect to increase the binding strength between the organic photosensitive layer and the inorganic material and to maintain such a strength at high level.

Furthermore, the compound of the formula (1-3) is molecularly strong enough to be unsusceptible to decomposition or change in properties and hence is unlikely to produce the deep electric charge trap. Accordingly, the compound contributes to the improvement of the photosensitivity characteristics of the electrophotosensitive material.

The compound of the formula (1-3) is classified into three types of compounds respectively having two nitrogen atoms in an ortho(o-) position, a meta(m-) position, and a para(p-) position relative to the benzene ring in the molecular center. Any of these compounds are usable in the invention.

Specific examples of the compound of the formula (1-3) include compounds represented by formulas (1-3-1) to (1-3-27).

(1-3-1)

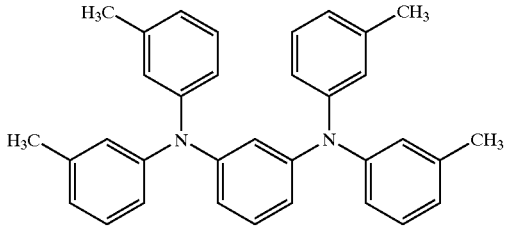

(1-3-2)

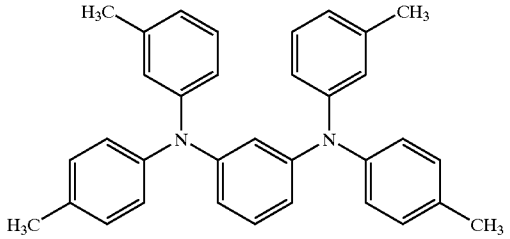

(1-3-3)

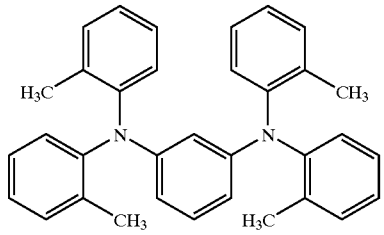

(1-3-4)

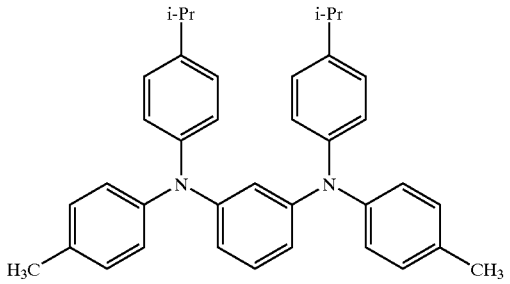

(1-3-5)

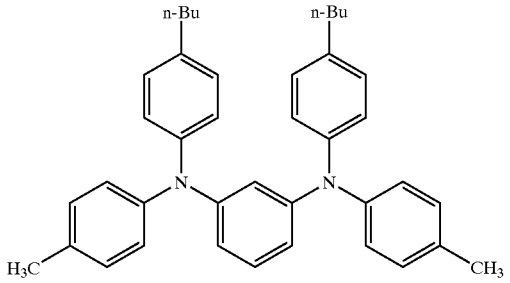

-continued
(1-3-6)
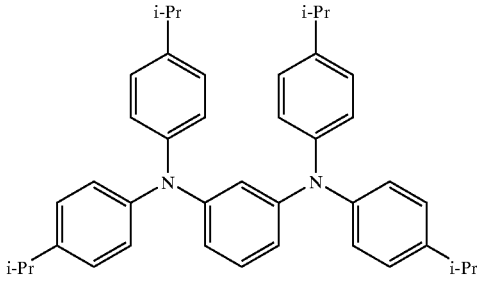
(1-3-7)
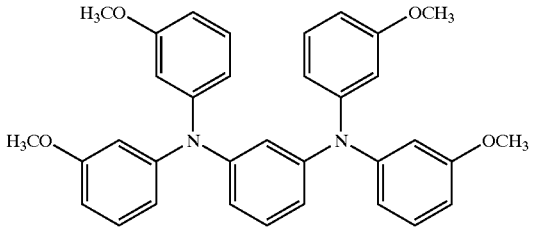
(1-3-8)
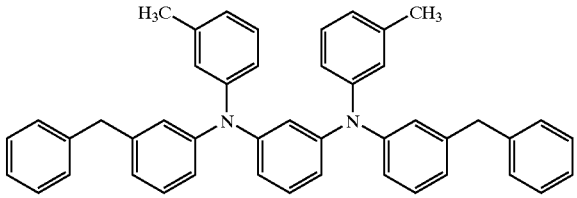
(1-3-9)
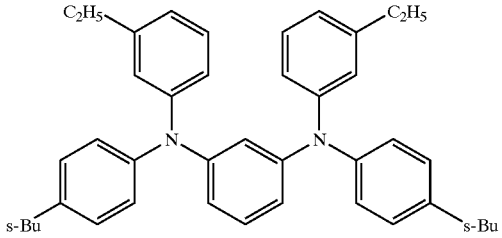
(1-3-10)
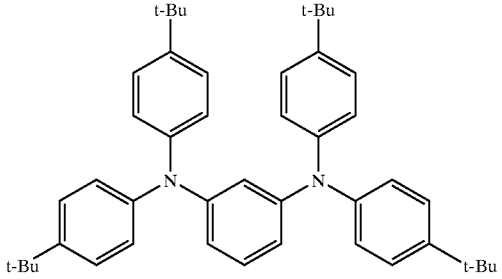
-continued
(1-3-11)
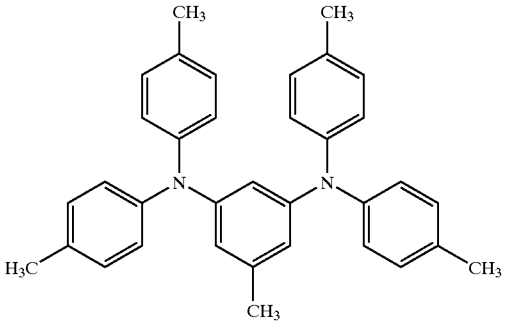
(1-3-12)
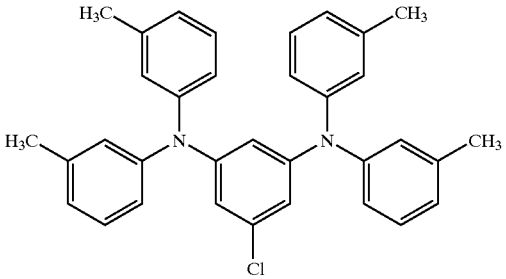
(1-3-13)
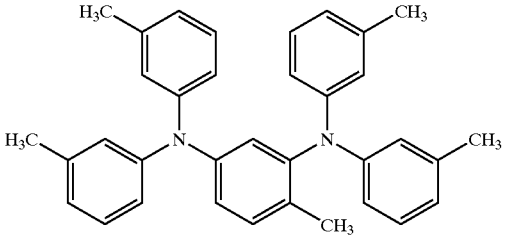
(1-3-14)
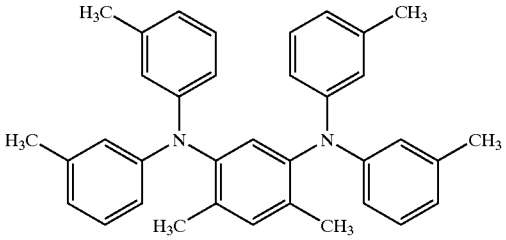
(1-3-15)
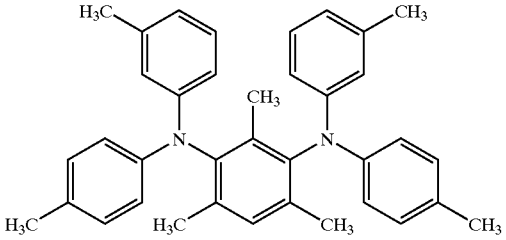

-continued
(1-3-16)
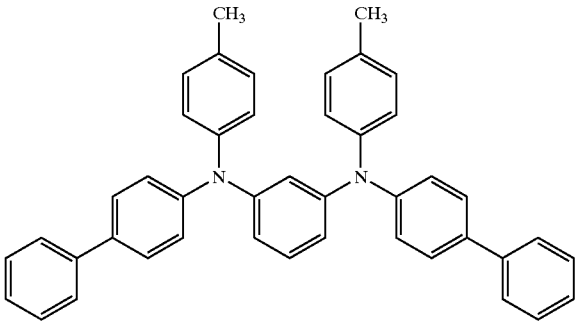
(1-3-17)
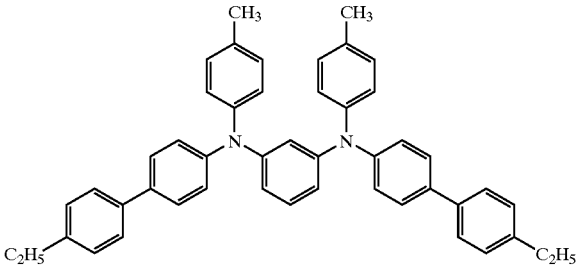
(1-3-18)
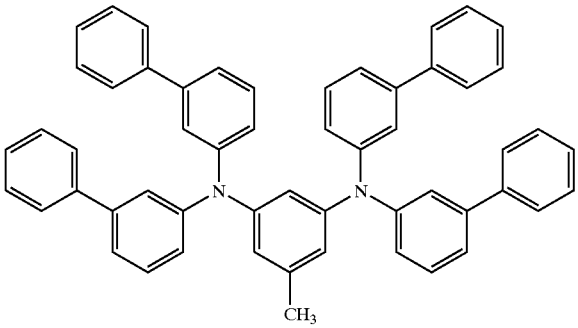
(1-3-19)
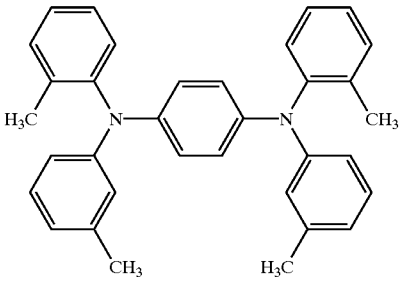
(1-3-20)
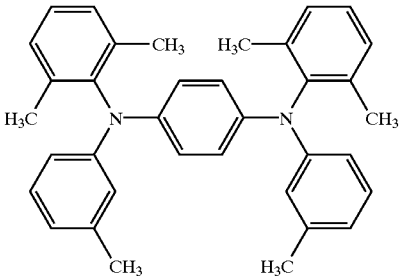
-continued
(1-3-21)
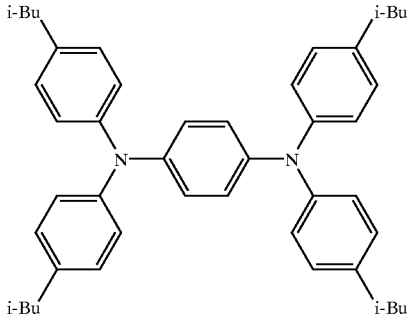
(1-3-22)
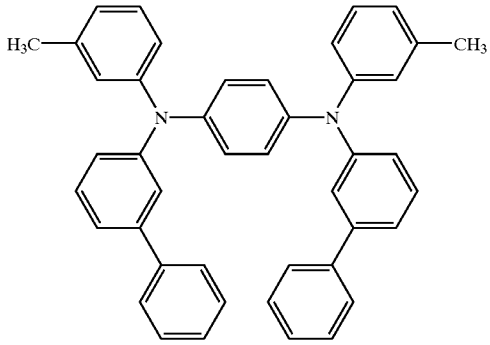
(1-3-23)
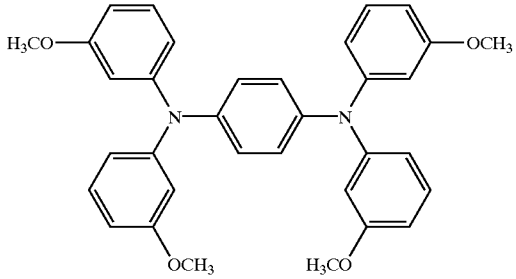
(1-3-24)
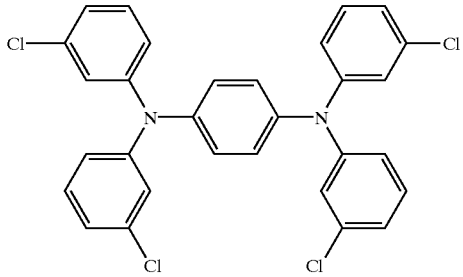
(1-3-25)
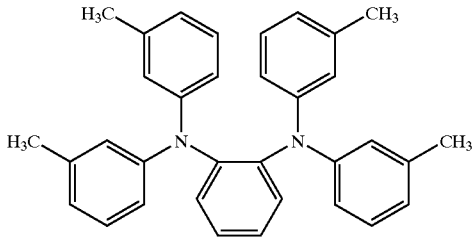

-continued (1-3-26)

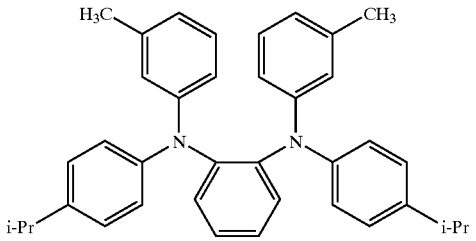

(1-3-27)

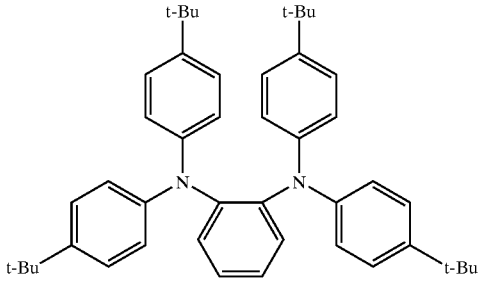

Diphenylamine Compound (1-4)

(1-4)

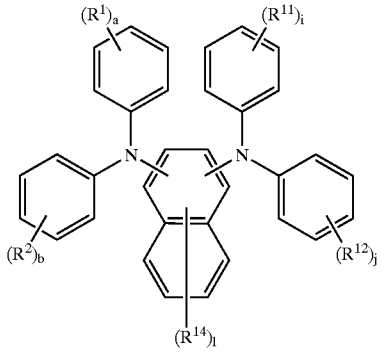

This compound is equivalent to a compound of the formula (1) wherein 'A' is represented by the formula (A1), in which $Ar^1$ is a divalent aromatic group derived from a naphthalene ring, $R^3$ is represented by the formula (A1c), and 'c' is 1; wherein $Ar^5$ and $Ar^6$ each denote a phenyl group. The groups $R^1$, $R^2$, $R^{11}$ and $R^{12}$ and the symbols 'a', 'b', 'i' and 'j' are the same as defined in the foregoing. The group $R^{14}$ denotes a hydrogen atom, alkyl group, alkoxy group, aralkyl group, aromatic group or halogen atom. The symbol '1' denotes an integer of 0 to 6.

Among the diphenylamine compounds of the formula (1), the compound of the formula (1-4) has not only a greater molecular weight but also a greater molecular or spatial extent because of its molecular structure with four benzene rings and one naphthalene ring spread in a plane-like fashion. Therefore, the compound exhibits a particularly preferable anchor effect on the binder resin. Thus, the compound of the formula (1-4) further features a good effect to increase the binding strength between the organic photosensitive layer and the inorganic material in addition to the aforesaid effects. The compound of the formula (1-4) include those with two nitrogen atoms attached to any positions of either one ring of the naphthalene ring at the center. Any of those compounds are usable in the invention. Examples of a usable compound include 2,3-compound with two nitrogen atoms attached to the 2- and 3-positions of its naphthalene ring; 1,2-compound with two nitrogen atoms attached to the 1- and 2-positions of its naphthalene ring; 1,3-compound with two nitrogen atoms attached to the 1- and 3-positions of its naphthalene ring; 1,4-compound with two nitrogen atoms attached to the 1- and 4-positions of its naphthalene ring, and the like.

Specific examples of the 2,3-compound include those represented by formulas (1-4a-1) to (1-4a-27).

(1-4a-1)

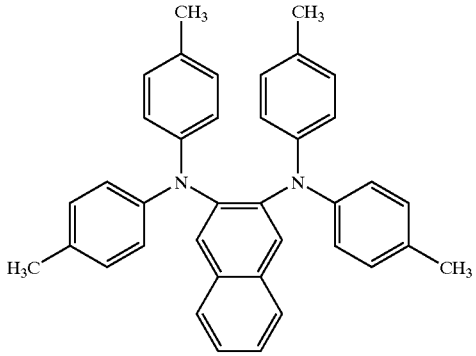

(1-4a-2)

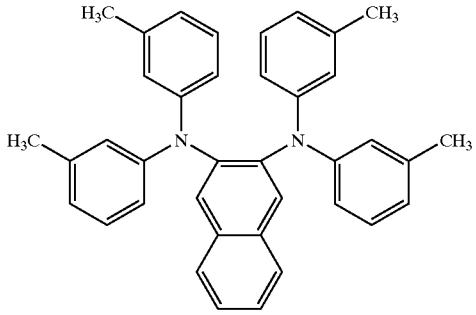

(1-4a-3)

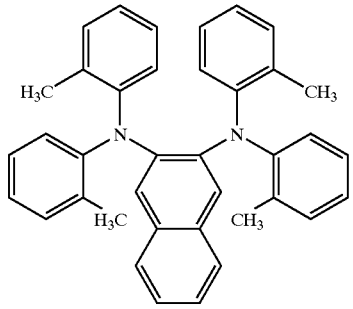

(1-4a-4)

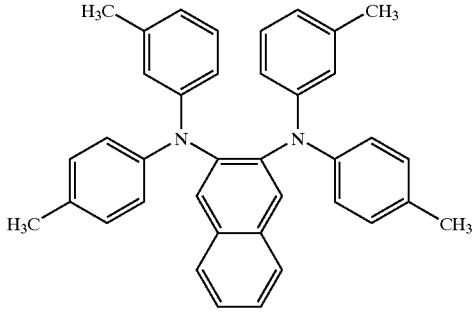

-continued
(1-4a-5)
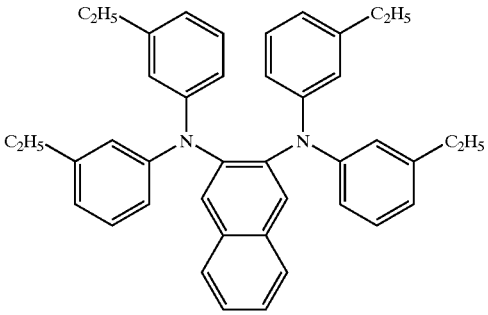
(1-4a-6)
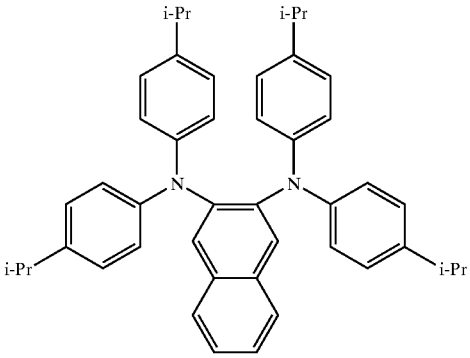
(1-4a-7)
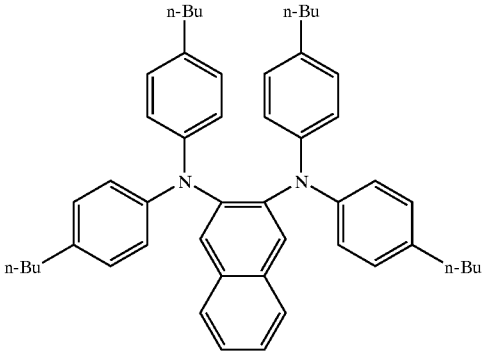
(1-4a-8)
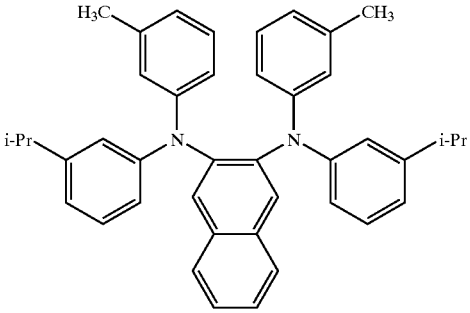
-continued
(1-4a-9)
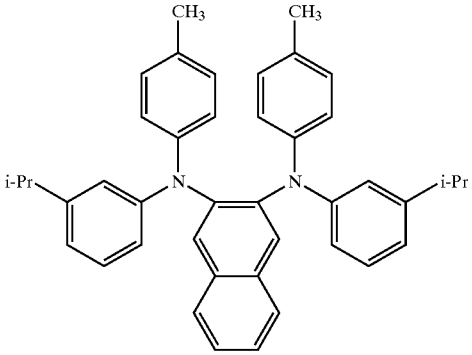
(1-4a-10)
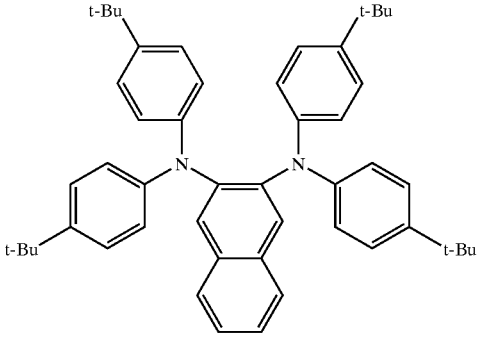
(1-4a-11)
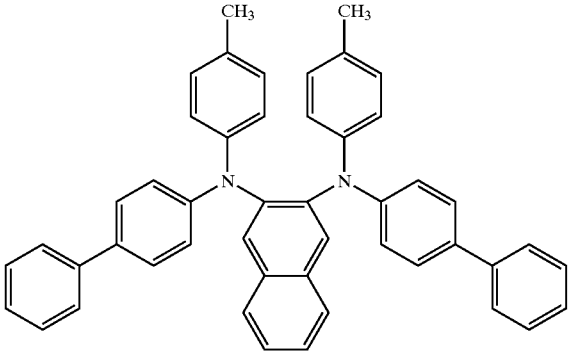
(1-4a-12)
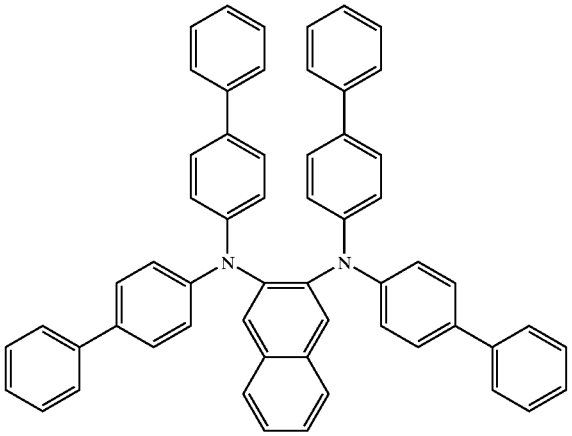

-continued
(1-4a-13)
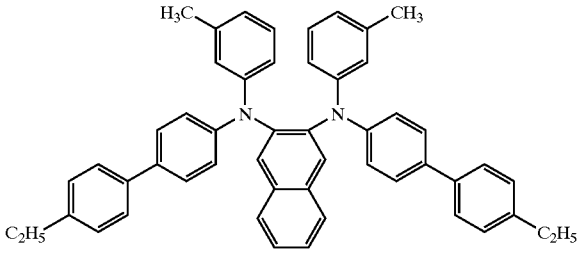
(1-4a-14)
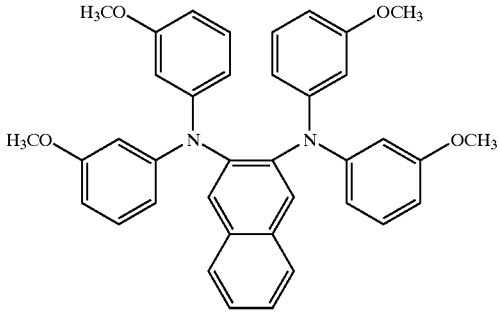
(1-4a-15)
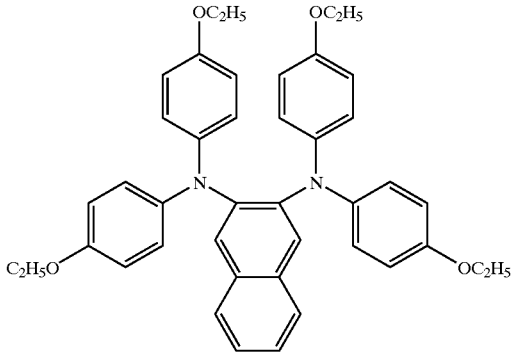
(1-4a-16)
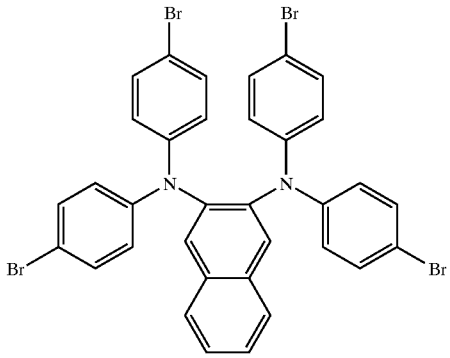
-continued
(1-4a-17)
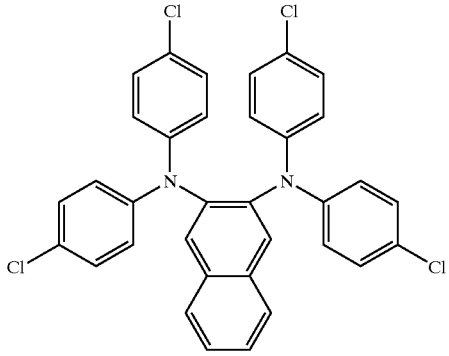
(1-4a-18)
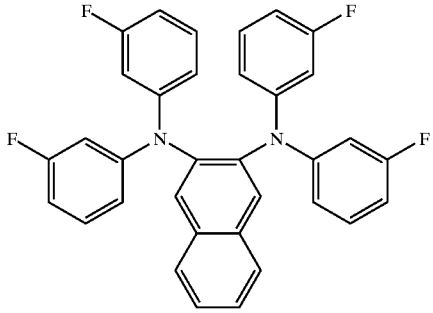
(1-4a-19)
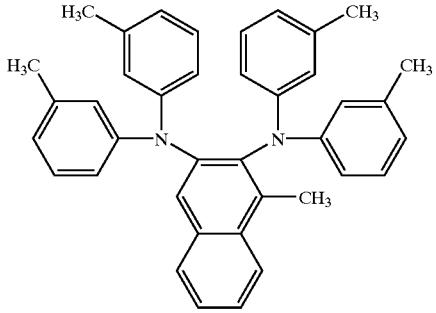
(1-4a-20)
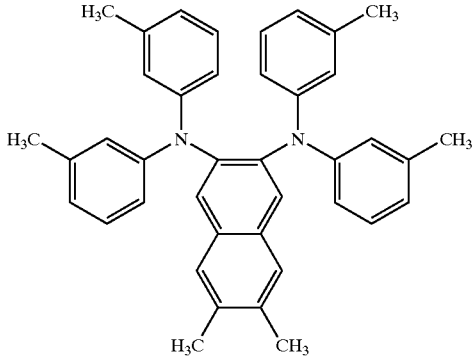

-continued
(1-4a-21)
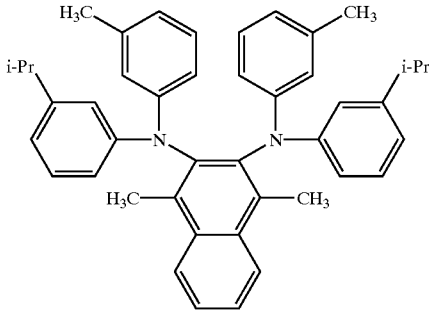
(1-4a-22)
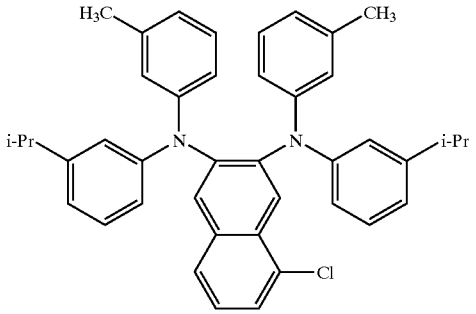
(1-4a-23)
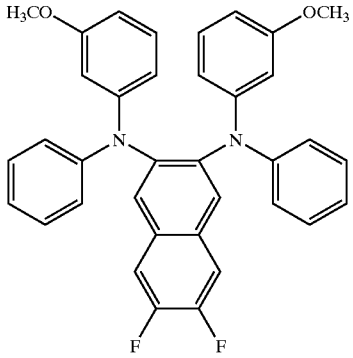
(1-4a-24)
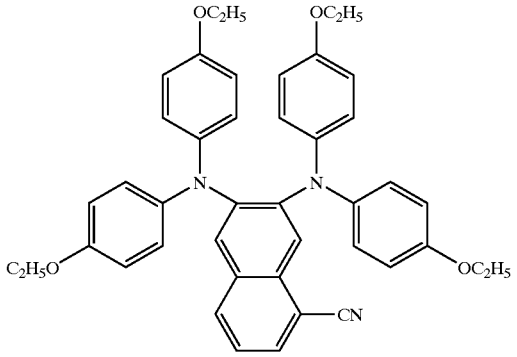
-continued
(1-4a-25)
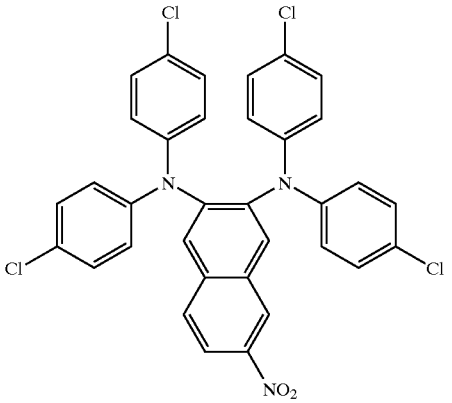
(1-4a-26)
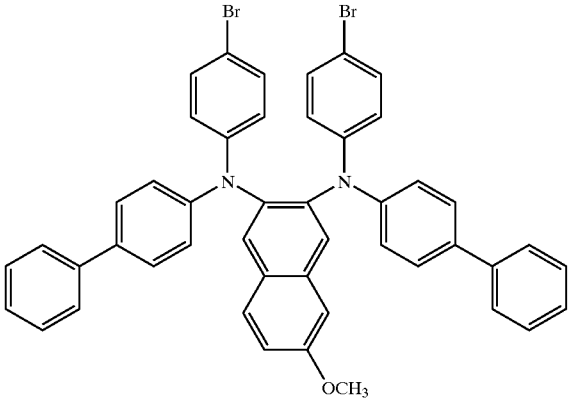
(1-4a-27)
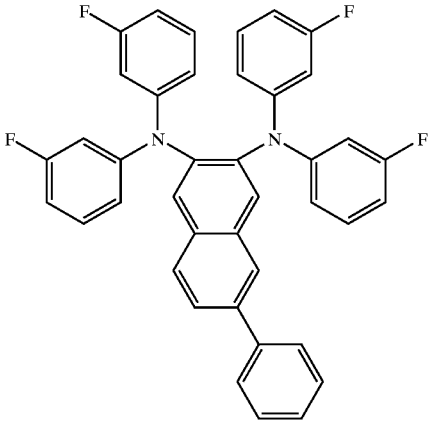
Specific examples of the 1,3-compound include those represented by formulas (1-4b-1) to (1-4b-26).

(1-4b-1)
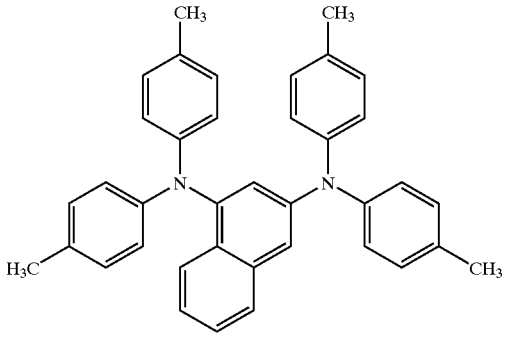
(1-4b-2)
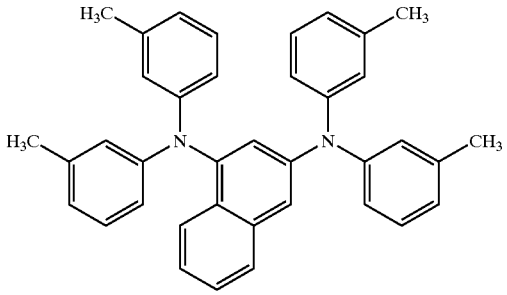
(1-4b-3)
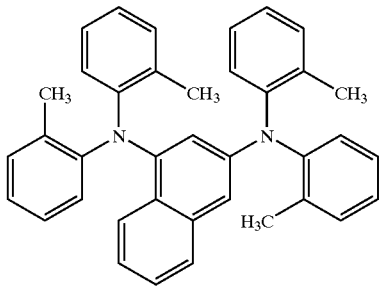
(1-4b-4)
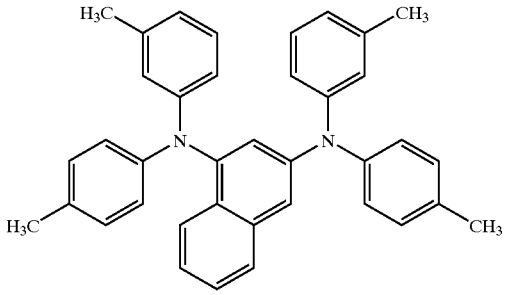
-continued
(1-4b-5)
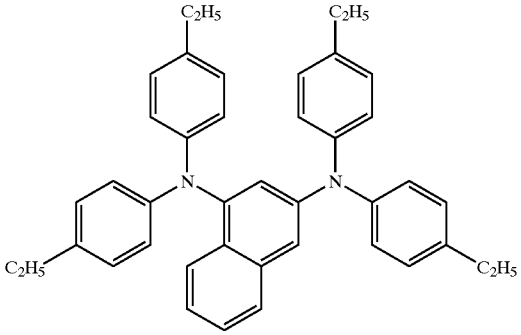
(1-4b-6)
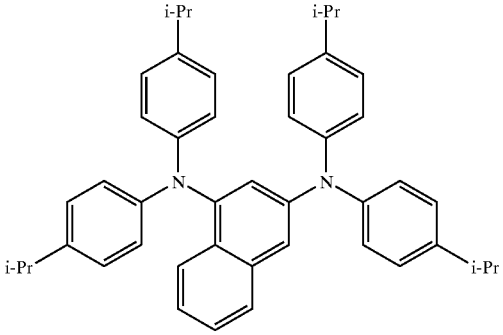
(1-4b-7)
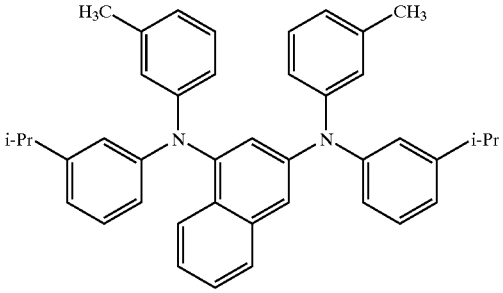
(1-4b-8)
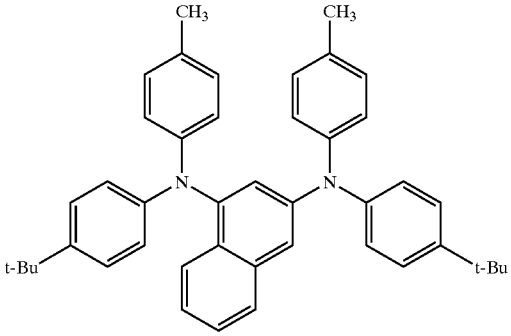

-continued
(1-4b-9)
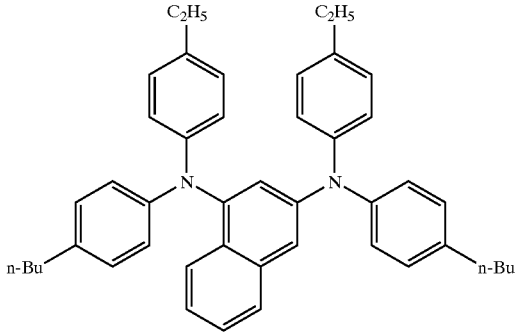
(1-4b-10)
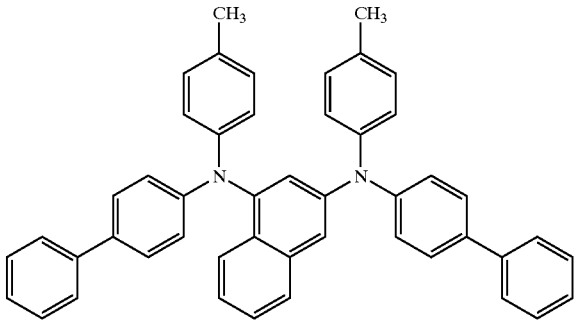
(1-4b-11)
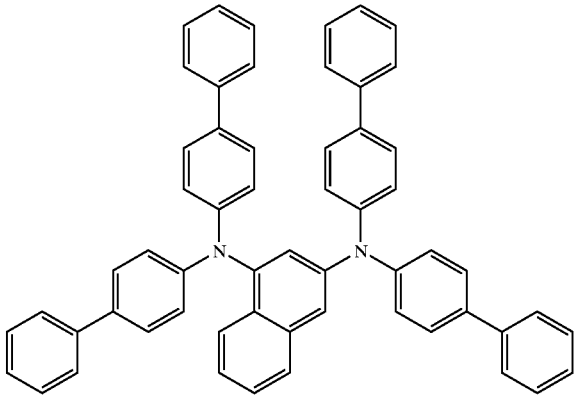
(1-4b-12)
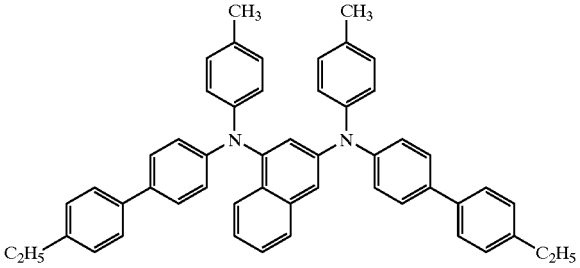
-continued
(1-4b-13)
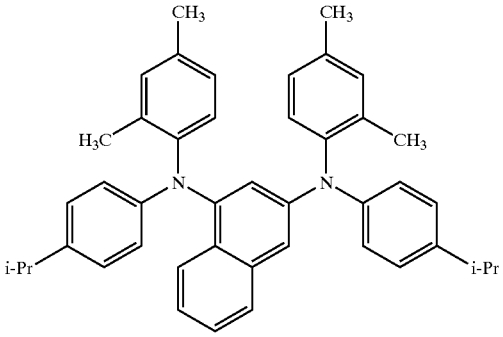
(1-4b-14)
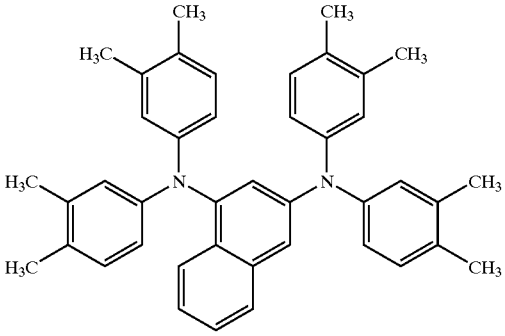
(1-4b-15)
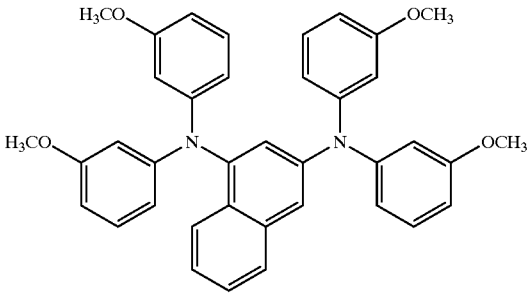
(1-4b-16)
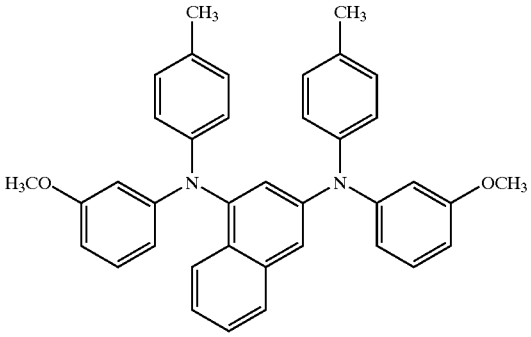

-continued
(1-4b-17)
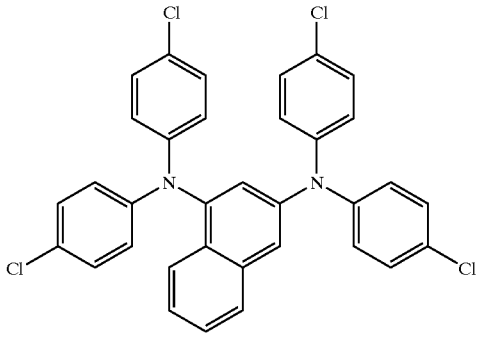
(1-4b-18)
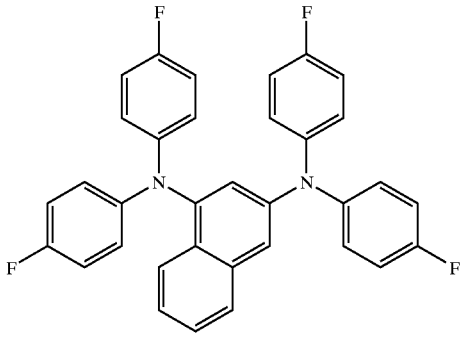
(1-4b-19)
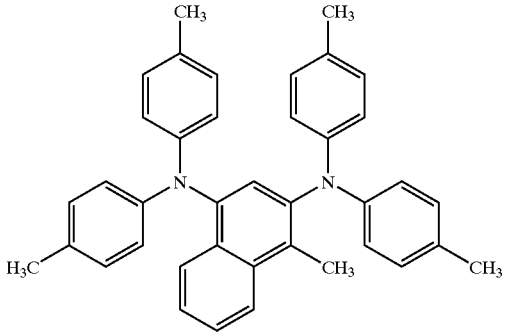
(1-4b-20)
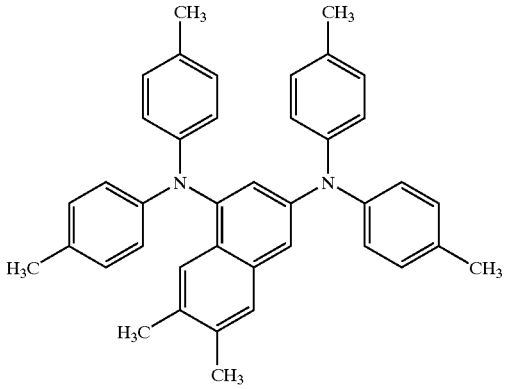
-continued
(1-4b-21)
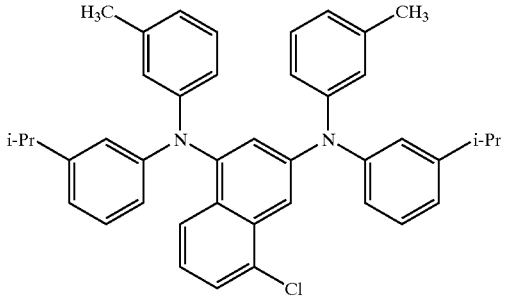
(1-4b-22)
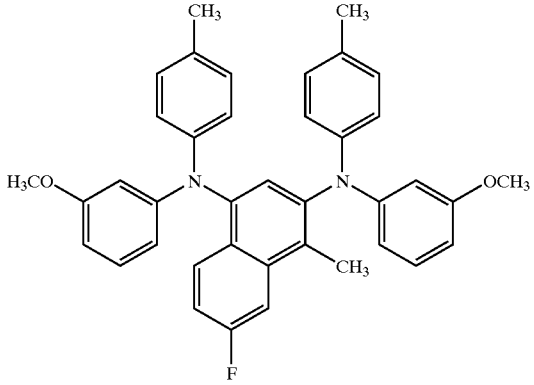
(1-4b-23)
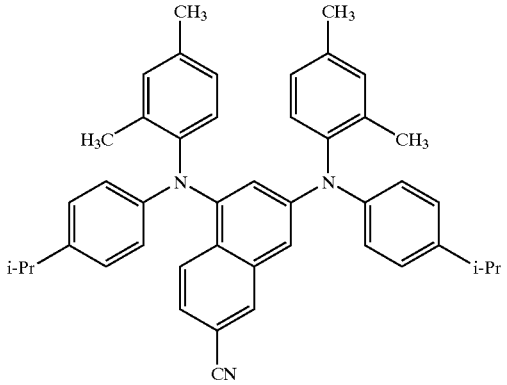
(1-4b-24)
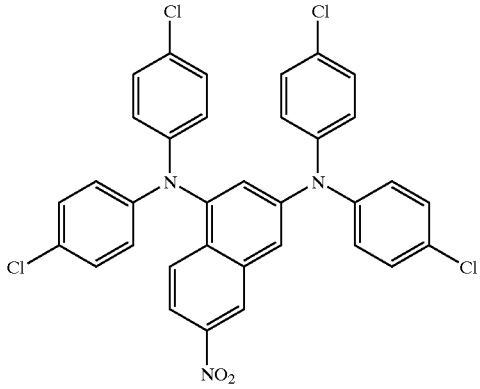

-continued (1-4b-25)

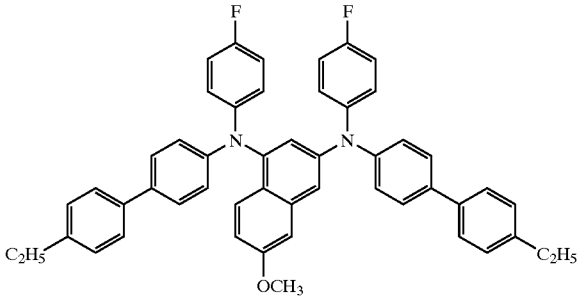

(1-4b-26)

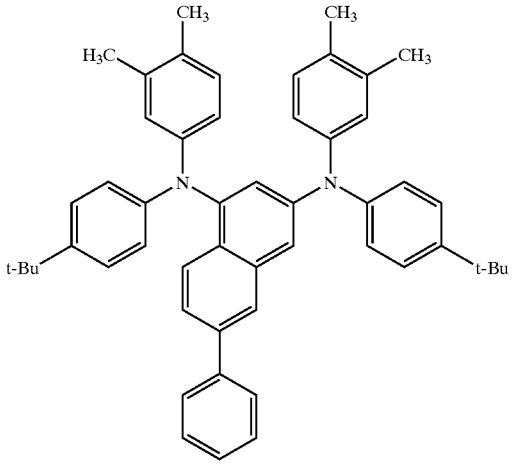

Diphenylamine Compound (1-5)

(1-5)

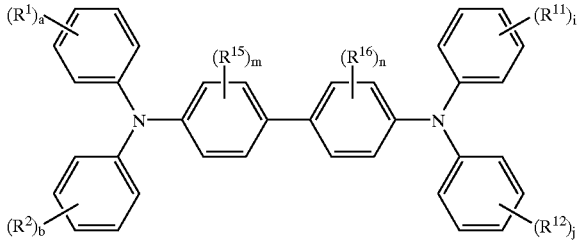

This compound is equivalent to a compound of the formula (1) wherein 'A' is represented by the formula (A1) in which $Ar^1$ is a divalent aromatic group derived from biphenyl, $R^3$ is represented by the formula (A1c), and 'c' is 1; wherein $Ar^5$ and $Ar^6$ each denote a phenyl group. The groups $R^1$, $R^2$, $R^{11}$ and $R^{12}$ and the symbols 'a', 'b', 'i' and 'j' are the same as defined in the foregoing. The groups $R^{15}$ and $R^{16}$ are the same or different and each denote a hydrogen atom, alkyl group, alkoxy group, aralkyl group, aromatic group or halogen atom. The symbols 'm' and 'n' are the same or different and each denote an integer of 0 to 4.

Among the diphenylamine compounds of the formula (1), the compound of the formula (1-5) has not only a greater molecular weight but also a greater molecular or spatial extent because of its molecular structure with six benzene rings spread in a plane-like fashion. Therefore, the compound exhibits a particularly preferable anchor effect on the binder resin. Thus, the compound of the formula (1-5) further features a good effect to increase the binding strength between the organic photosensitive layer and the inorganic material, in addition to the aforesaid effects.

Specific examples of the compound of the formula (1-5) include those represented by formulas (1-5-1) to (1-5-21).

(1-5-1)

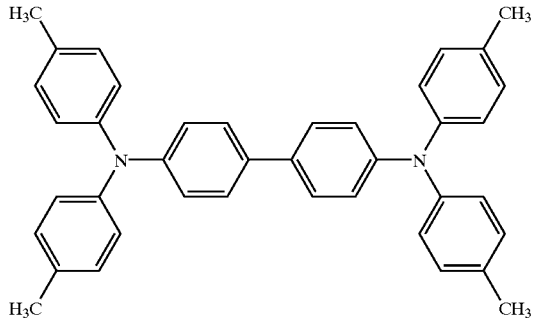

(1-5-2)

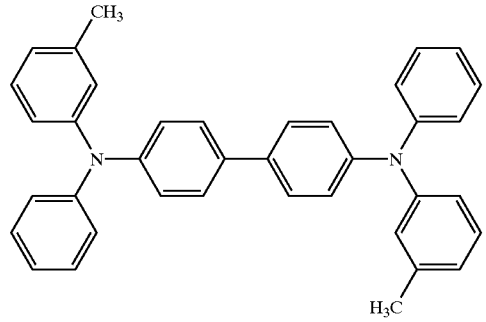

(1-5-3)

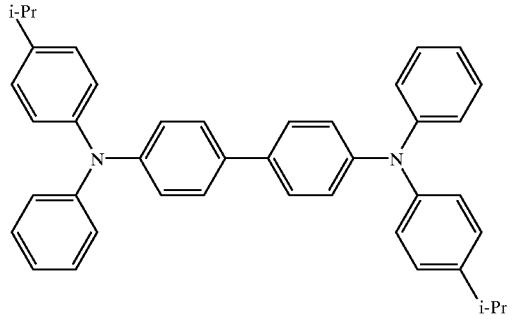

(1-5-4)

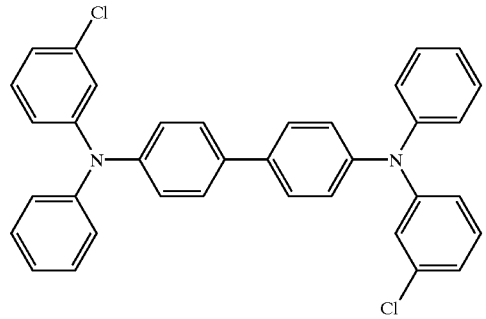

-continued
(1-5-5)
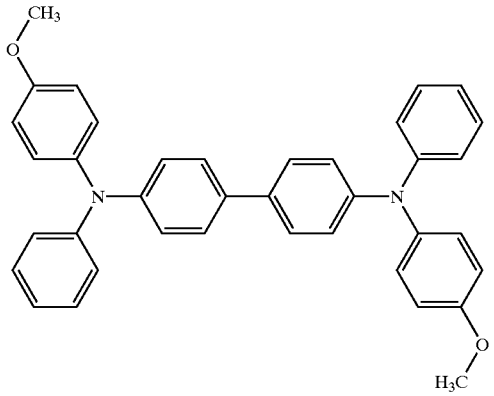
(1-5-6)
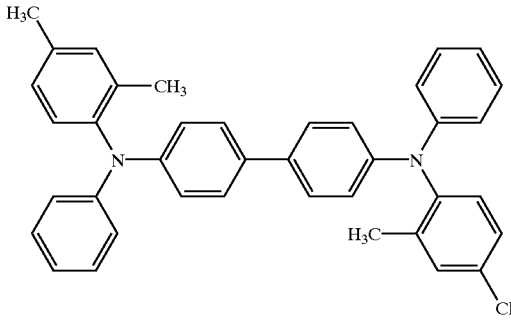
(1-5-7)
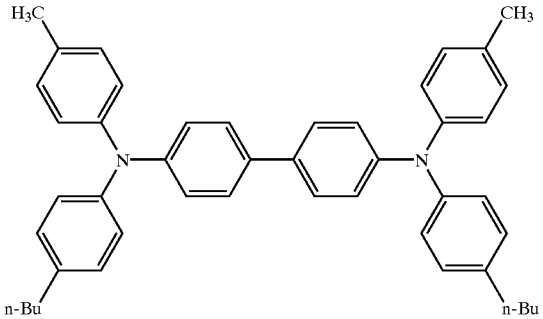
(1-5-8)
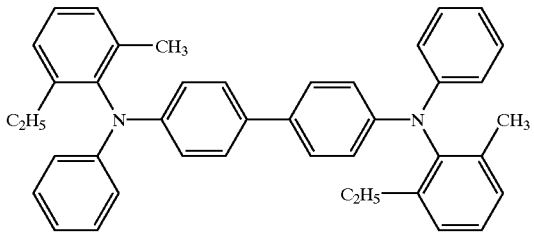
-continued
(1-5-9)
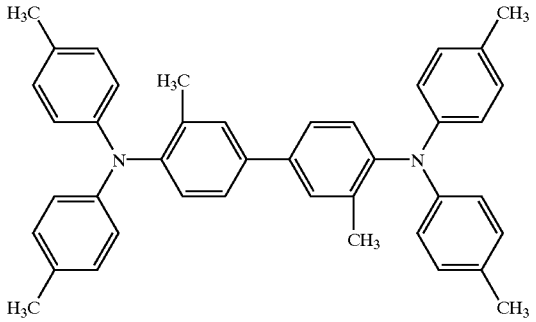
(1-5-10)
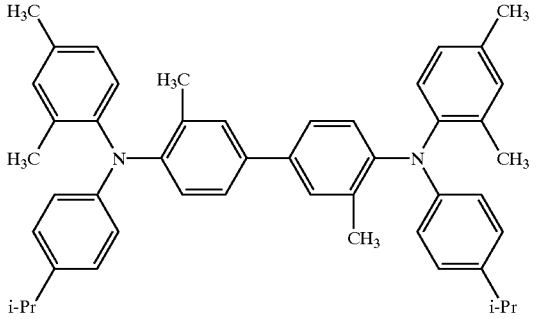
(1-5-11)
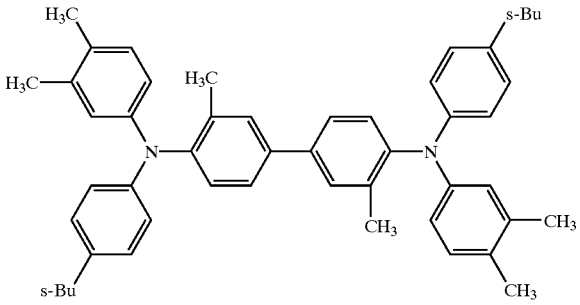
(1-5-12)
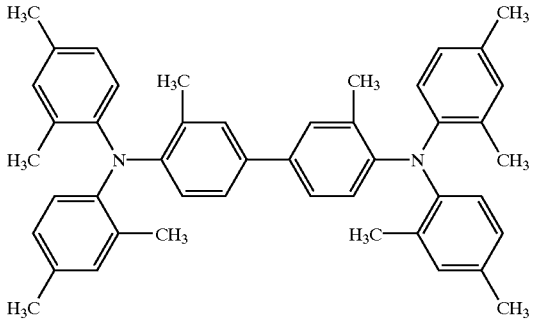

-continued
(1-5-13)
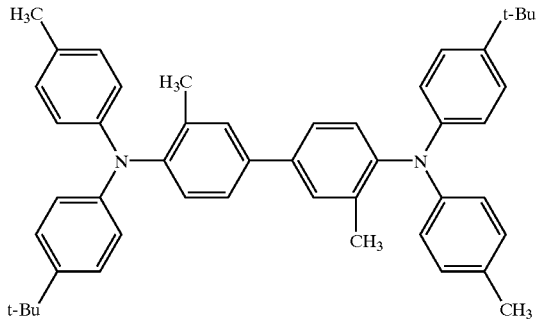
(1-5-14)
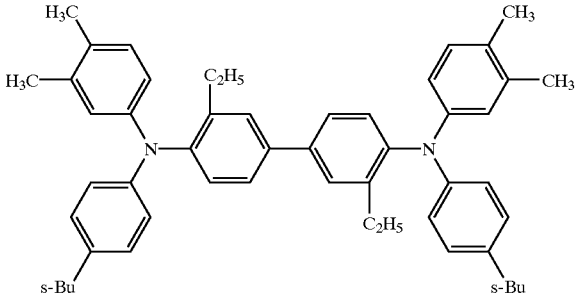
(1-5-15)
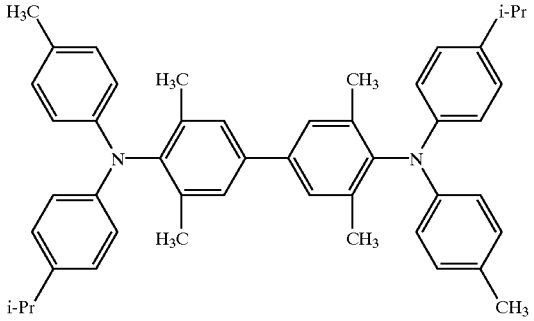
(1-5-16)
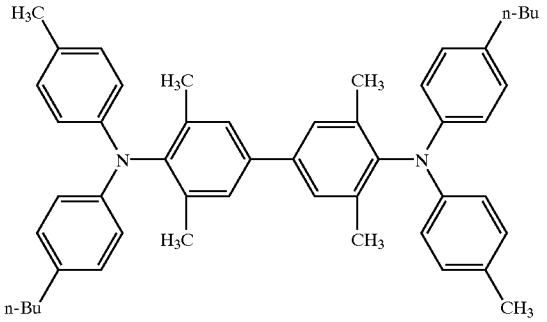
-continued
(1-5-17)
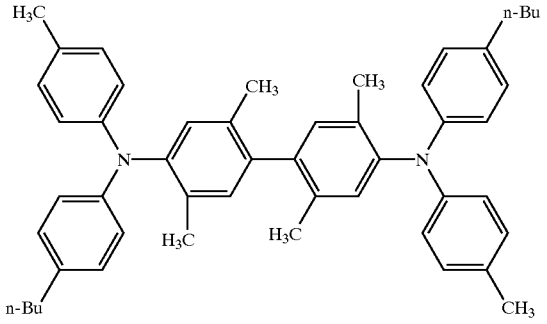
(1-5-18)
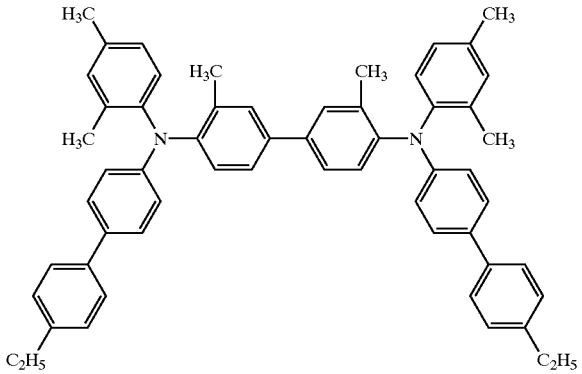
(1-5-19)
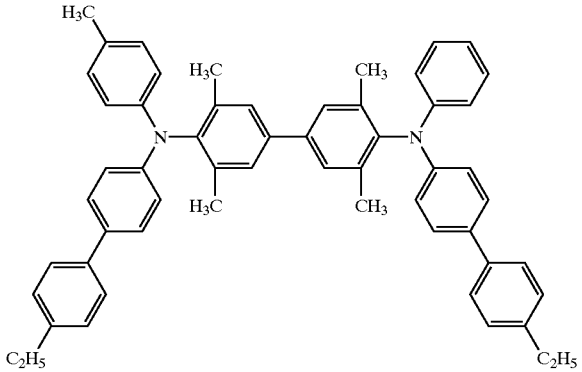
(1-5-20)
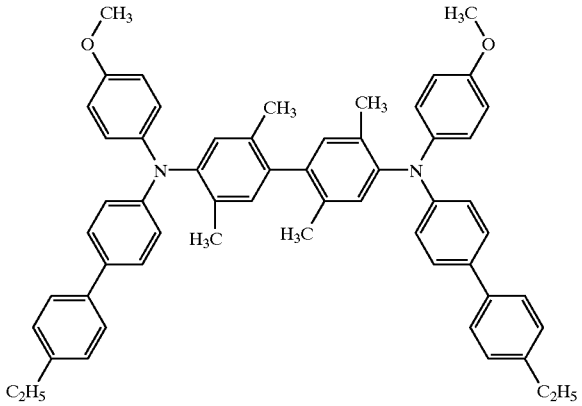

-continued (1-5-21)

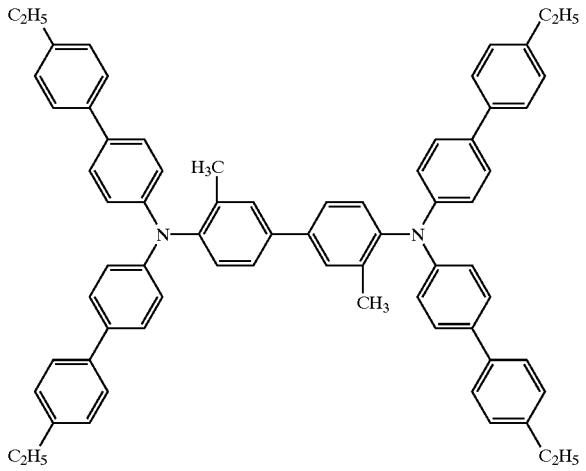

Diphenylamine Compound (1-6)

(1-6)

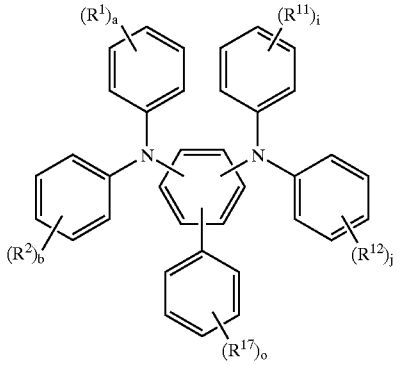

This compound is equivalent to a compound of the formula (1) wherein 'A' is represented by the formula (A1) in which $Ar^1$ is a divalent aromatic group derived from biphenyl, $R^3$ is represented by the formula (A1c), and 'c' is 1; wherein $Ar^5$ and $Ar^6$ each denote a phenyl group. The groups $R^1$, $R^2$, $R^{11}$ and $R^{12}$ and the symbols 'a', 'b', 'i' and 'j' are the same as defined in the foregoing. The group $R^{17}$ denotes a hydrogen atom, alkyl group, alkoxy group, aralkyl group, aromatic group or halogen atom. The symbol 'o' denotes an integer of 0 to 5.

Among the diphenylamine compounds of the formula (1), the compound of the formula (1-6) is molecularly stronger and has a good stability against thermally or electrically accelerated atoms or ions, plasma, light rays, heat radiation and the like, and more particularly against plasma-excited light and activated ions. Therefore, the compound is unsusceptible to decomposition or change in properties when exposed to such an atmosphere during the deposition of the inorganic surface protective layer by the CVD method or the like. Thus, the compound of the formula (1-6) features, in addition to the aforesaid effects, a good effect to increase the binding strength between the organic photosensitive layer and the inorganic material and to maintain such a strength at high level.

Furthermore, this compound has a function to increase the glass transition temperature of the photosensitive layer with the assistance of a biphenyl skeleton thereof thereby improving heat resistance of the photosensitive layer. This results in a further increase in the rigid bind as mentioned above and the effect of preventing cracks.

The compound of the formula (1-6) is classified into three types of compounds respectively having two nitrogen atoms in an ortho(o-) position, a meta(m-) position, and a para(p-) position relative to the benzene ring in the molecular center. Any of these compounds are usable in the invention.

Specific examples of the compound of the formula (1-6) include those represented by formulas (1-6-1) to (1-6-11).

(1-6-1)

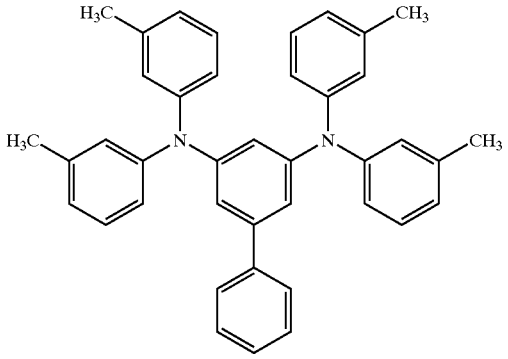

(1-6-2)

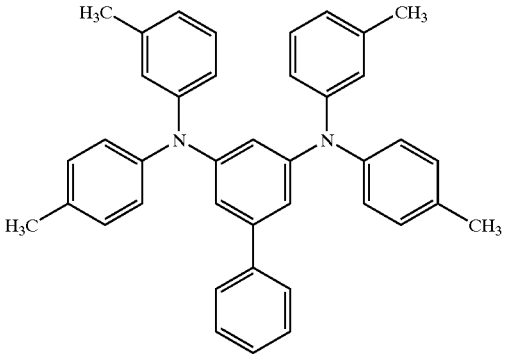

-continued
(1-6-3)
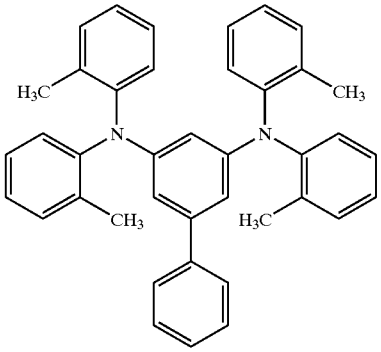
(1-6-4)
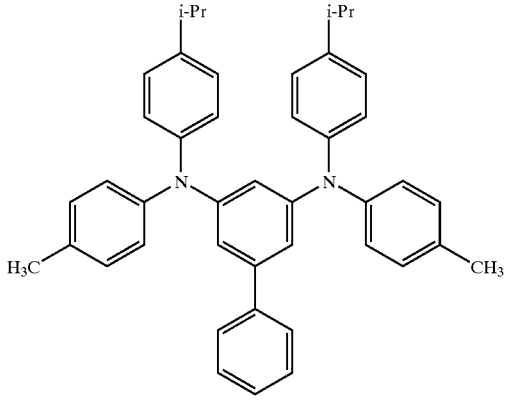
(1-6-5)
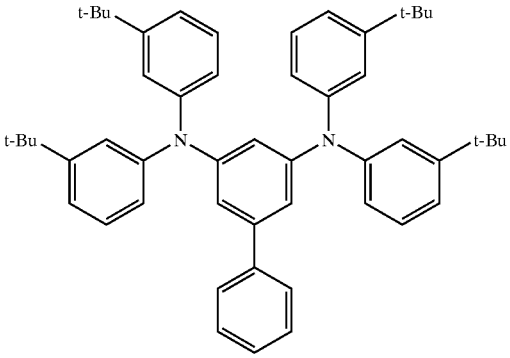
(1-6-6)
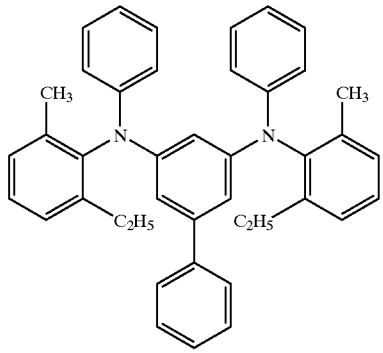
(1-6-7)
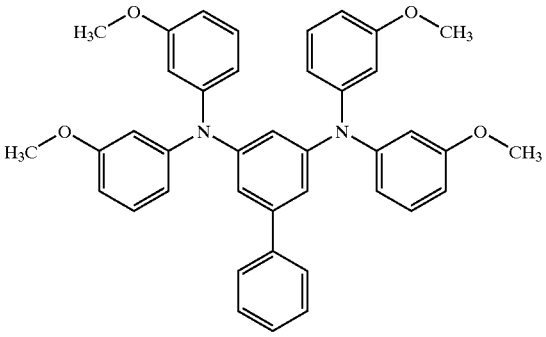
(1-6-8)
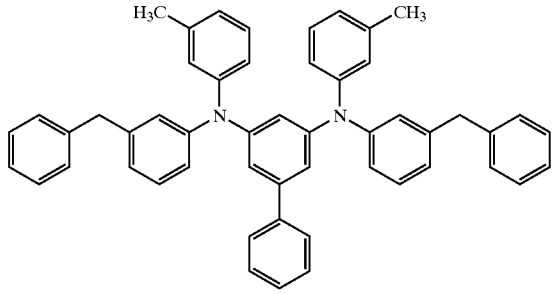

-continued
(1-6-9)
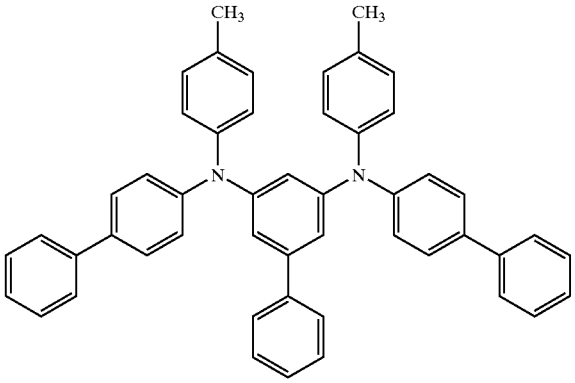
(1-6-10)
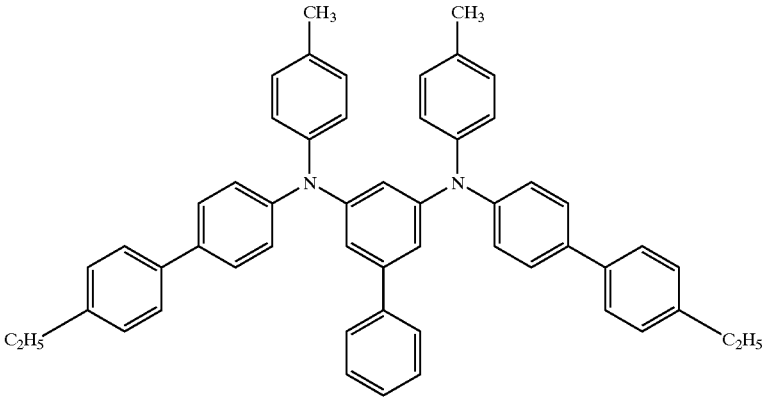
(1-6-11)
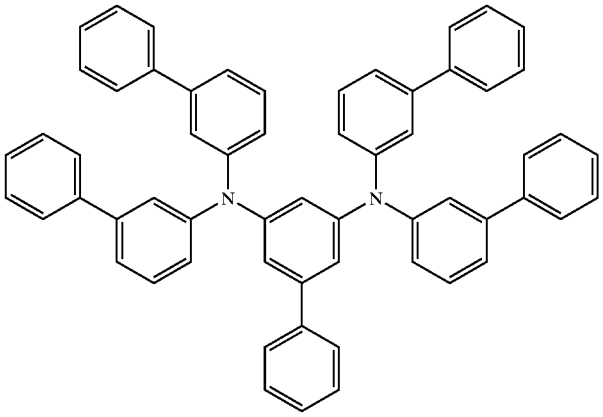

Diphenylamine Compound (1-7)

(1-7)

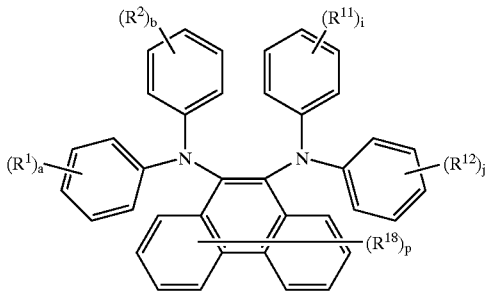

This compound is equivalent to a compound of the formula (1) wherein 'A' is represented by the formula (A1) in which $Ar^1$ is a divalent aromatic group derived from phenanthrene, $R^3$ is represented by the formula (A1c), and 'c' is 1; wherein $Ar^5$ and $Ar^6$ each denote a phenyl group. The groups $R^1$, $R^2$, $R^{11}$ and $R^{12}$ and the symbols 'a', 'b', 'i' and 'j' are the same as defined in the foregoing. The group $R^{18}$ denotes a hydrogen atom, alkyl group, alkoxy group, aralkyl group, aromatic group or halogen atom. The symbol 'p' denotes an integer of 0 to 8.

Among the diphenylamine compounds of the formula (1), the compound of the formula (1-7) has not only a greater molecular weight but also a greater molecular or spatial extent because of its molecular structure with four benzene rings and one phenanthrene ring spread in a plane-like fashion. Therefore, the compound exhibits a particularly preferable anchor effect on the binder resin. Thus, the compound of the formula (1-7) further features a good effect to increase the binding strength between the organic photosensitive layer and the inorganic material, in addition to the aforesaid effects.

Specific examples of the compound of the formula (1-7) include those represented by formulas (1-7-1) to (1-7-26).

(1-7-1)

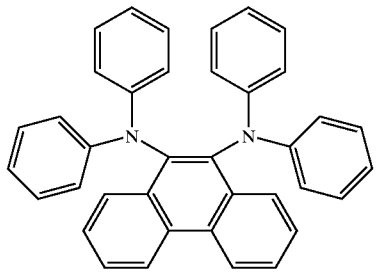

(1-7-2)

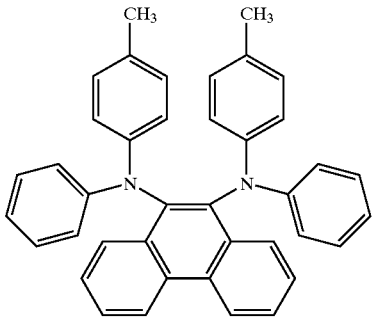

(1-7-3)

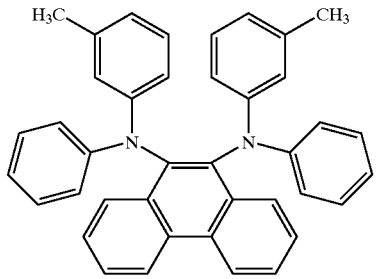

(1-7-4)

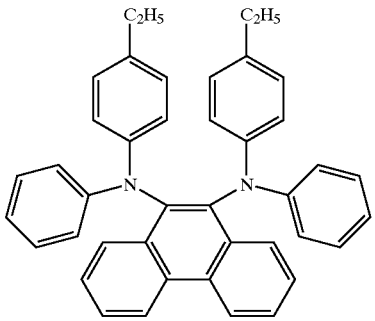

(1-7-5)

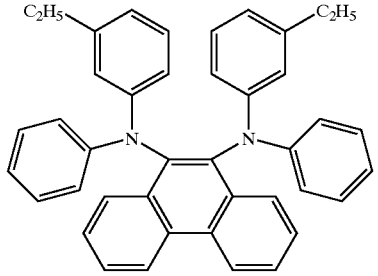

(1-7-6)

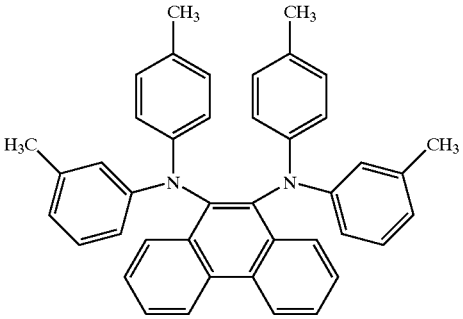

-continued
(1-7-7)
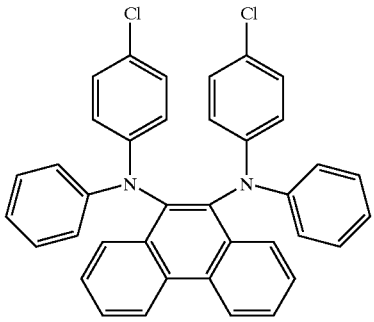
(1-7-8)
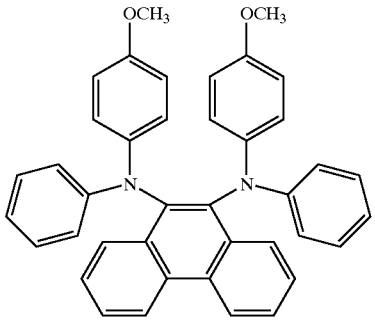
(1-7-9)
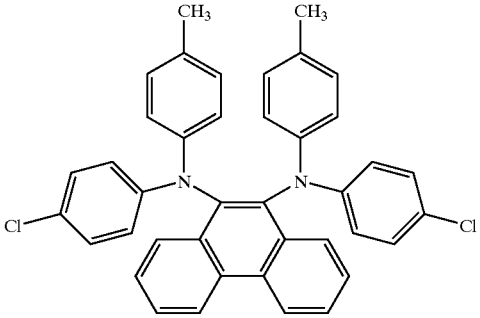
(1-7-10)
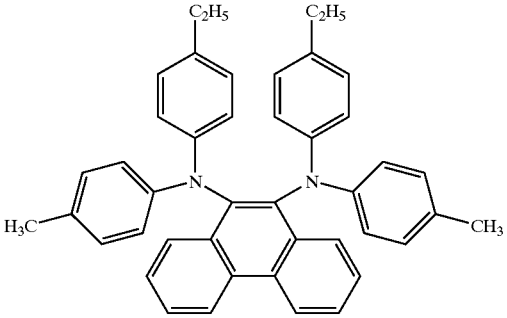
(1-7-11)
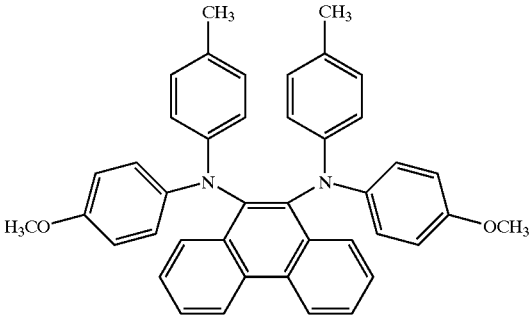
(1-7-12)
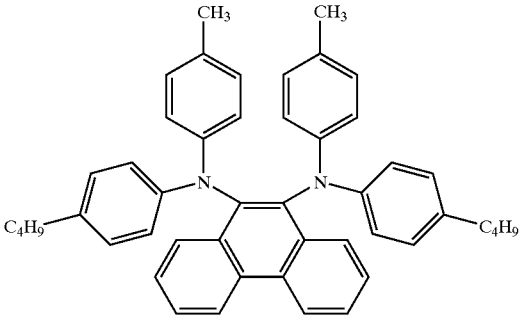
(1-7-13)
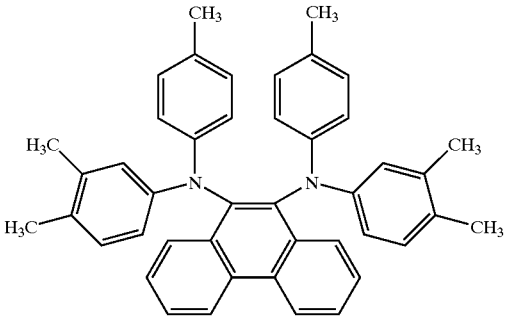
(1-7-14)
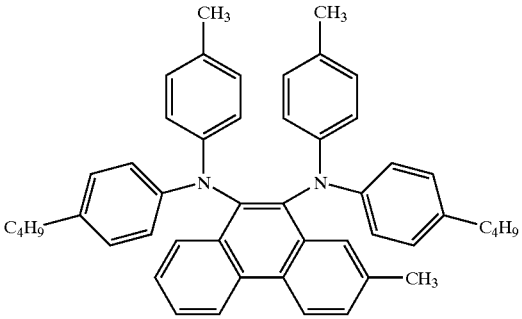

-continued
(1-7-15)
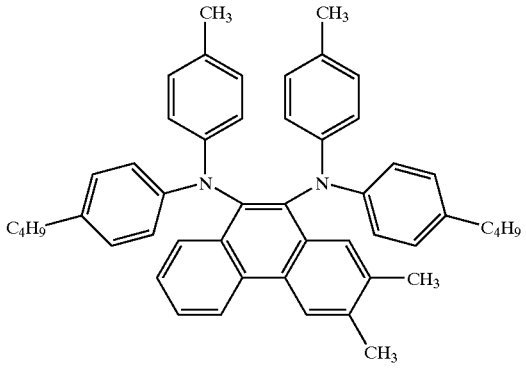
(1-7-16)
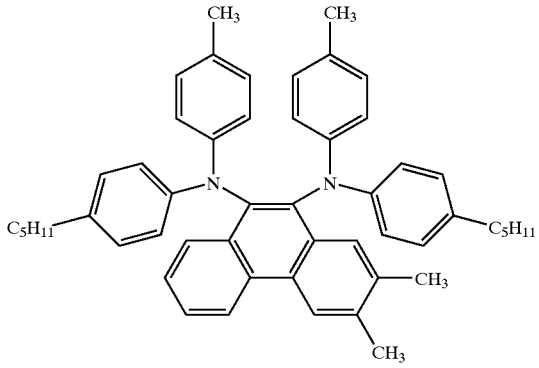
(1-7-17)
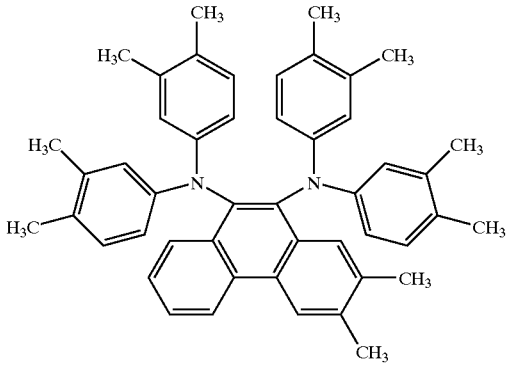
(1-7-18)
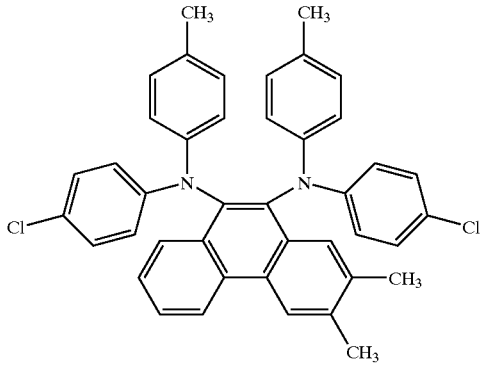
(1-7-19)
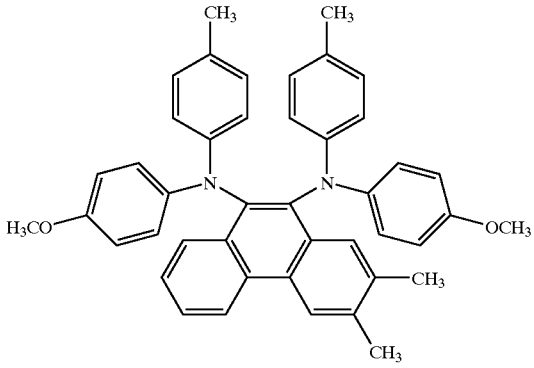
(1-7-20)
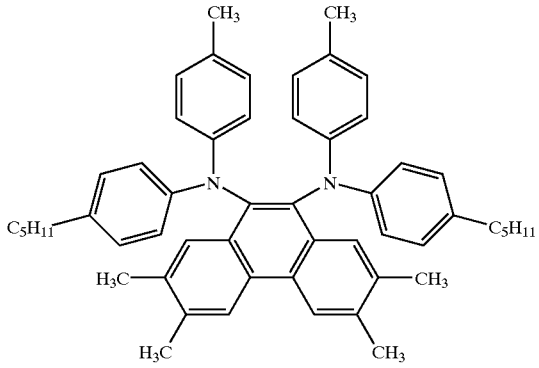
(1-7-21)
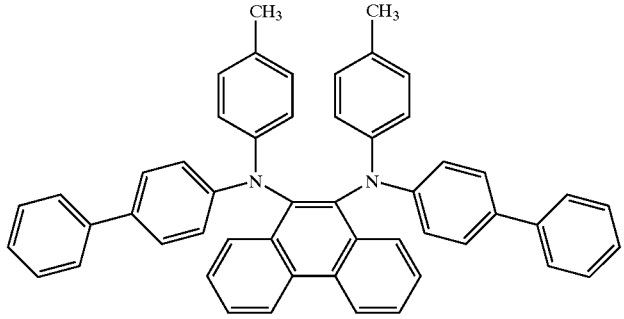

-continued
(1-7-22)
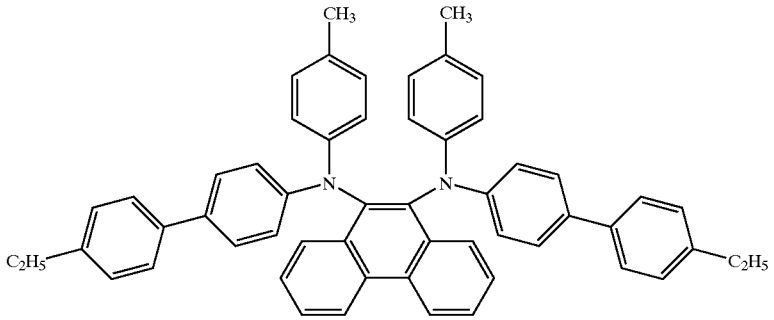
(1-7-23)
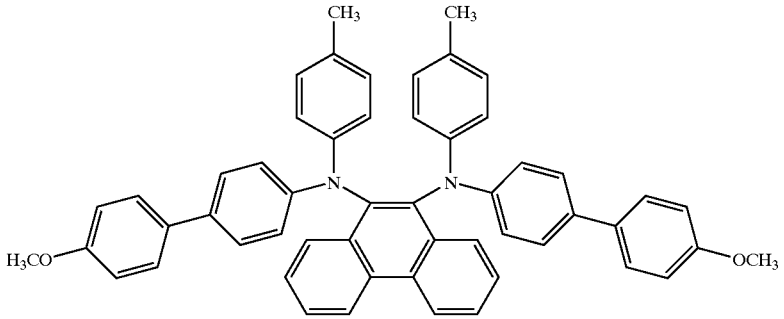
(1-7-24)
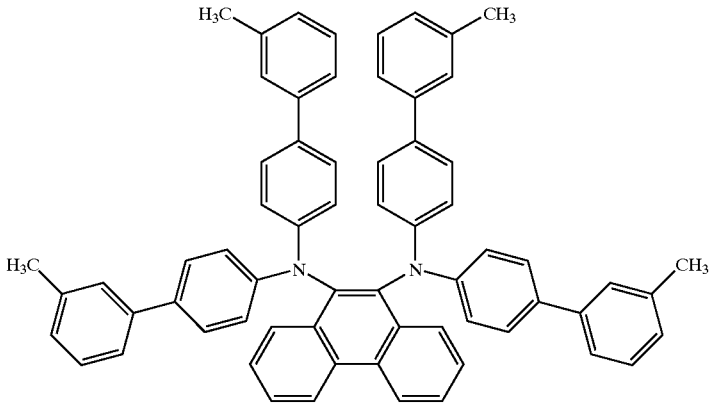
(1-7-25)
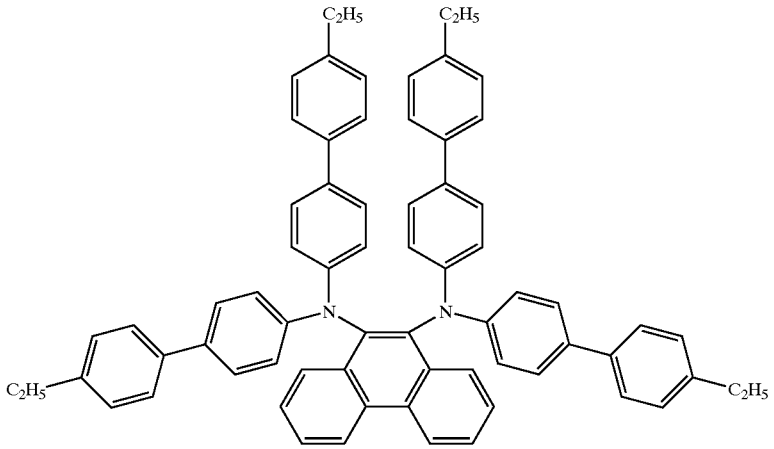

-continued (1-7-26)

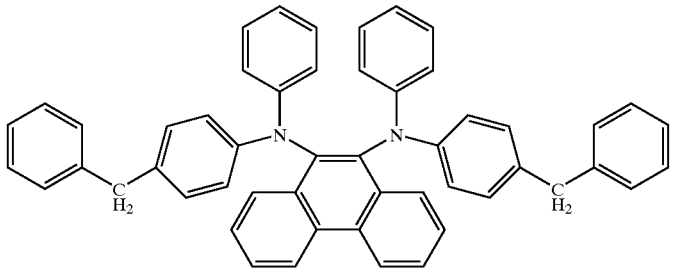

Diphenylamine Compound (1-8)

(1-8)

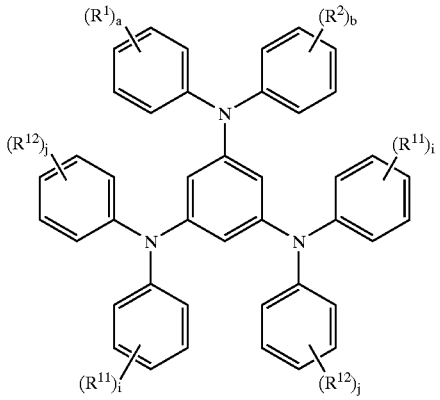

This compound is equivalent to a compound of the formula (1) wherein 'A' is represented by the formula (A1), in which $Ar^1$ is a trivalent aromatic group derived from benzene ring, $R^3$ is represented by the formula (A1c), and 'c' is 2; wherein $Ar^5$ and $Ar^6$ each denote a phenyl group. The groups $R^1$, $R^2$, $R^{11}$ and $R^{12}$ and the symbols 'a', 'b', 'i' and 'j' are the same as defined in the foregoing. The two groups $R^{11}$ and $R^{12}$ or symbols 'i' and 'j' of the formula (A1c) may be the same or different.

Among the diphenylamine compounds of the formula (1), the compound of the formula (1-8) has not only a greater molecular weight but also a greater molecular or spatial extent because of its molecular structure with seven benzene rings spread in a plane-like fashion. Therefore, the compound exhibits a particularly preferable anchor effect on the binder resin. Thus, the compound of the formula (1-8) further features a good effect to increase the binding strength between the organic photosensitive layer and the inorganic material, in addition to the aforesaid effects.

Specific examples of the compound of the formula (1-8) include those represented by formulas (1-8-1) to (1-8-6).

(1-8-1)

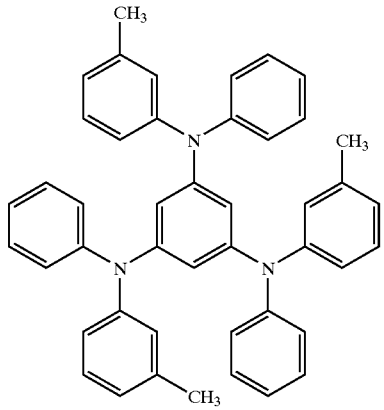

(1-8-2)

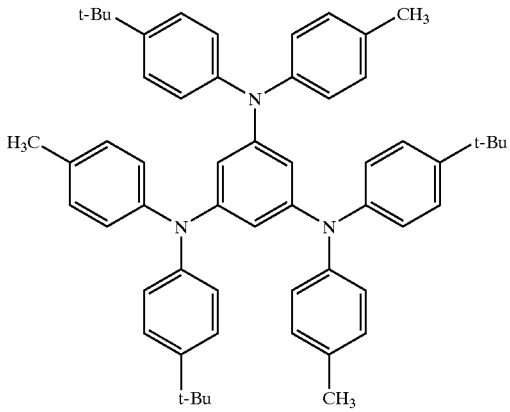

(1-8-3)

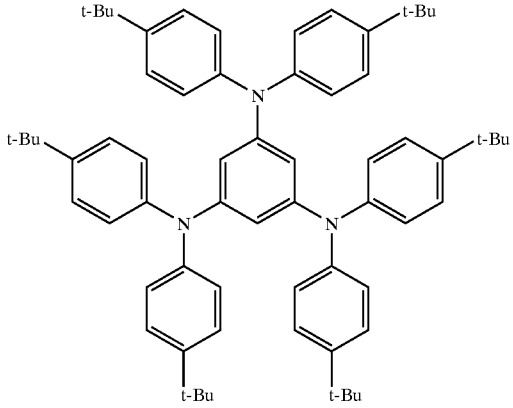

-continued (1-8-4)

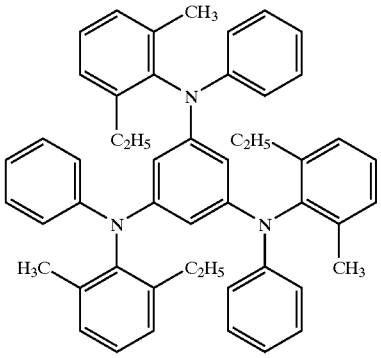

(1-8-5)

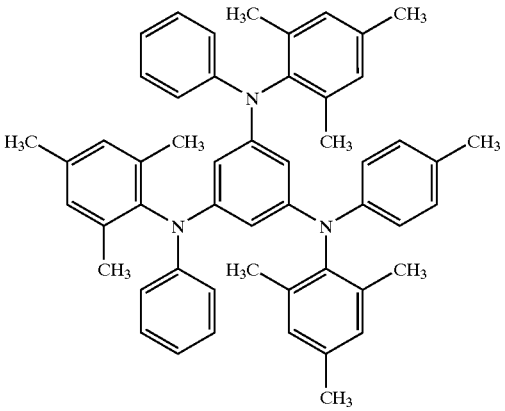

(1-8-6)

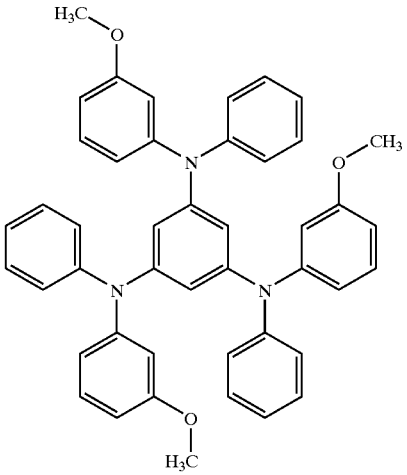

Diphenylamine Compound (1-9)

This compound is equivalent to a compound of the formula (1) wherein 'A' is represented by the formula (A1), in which $Ar^1$ denotes an aromatic group or heterocyclic group, $R^3$ denotes a hydrogen atom, aromatic group or heterocyclic group, and 'c' is 1; provided that when $Ar^1$ is an aromatic group derived from benzene ring, $R^3$ is not a hydrogen atom but either an aromatic group or a heterocyclic group; otherwise or when $Ar^1$ is either an aromatic group or heterocyclic group having 7 or more carbon atoms, $R^3$ is not limited to the above and may be a hydrogen atom, aromatic group or heterocyclic group. The groups $R^1$, $R^2$ and the symbols 'a', 'b' are the same as defined in the foregoing.

Specific examples of the compound of the formula (1-9) include those represented by formulas (1-9-1) to (1-9-31).

(1-9-1)

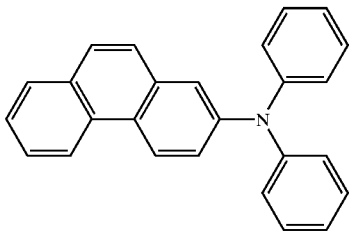

(1-9-2)

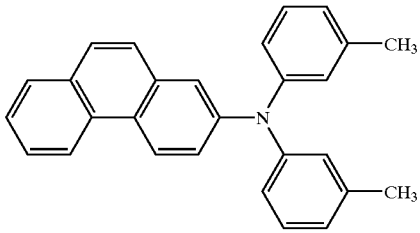

(1-9-3)

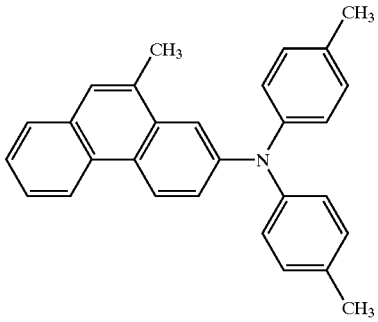

(1-9-4)

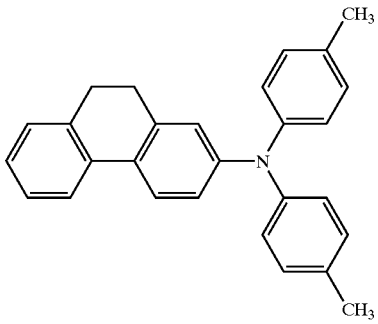

(1-9-5)

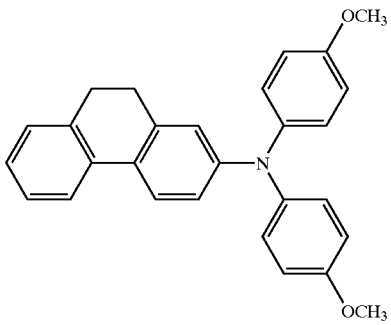

-continued
(1-9-6)
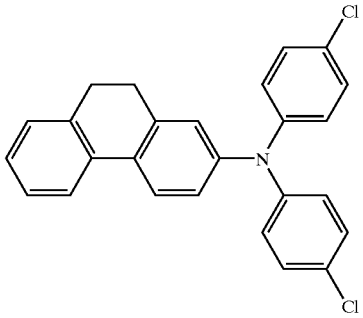
(1-9-7)
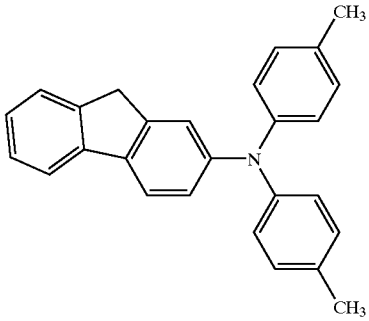
(1-9-8)
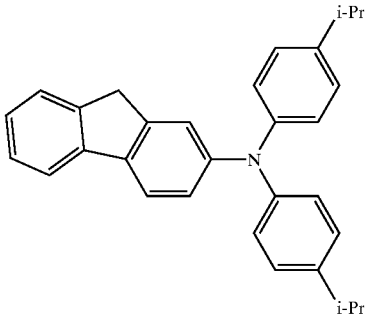
(1-9-9)
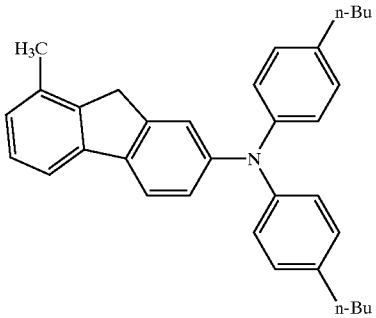
(1-9-10)
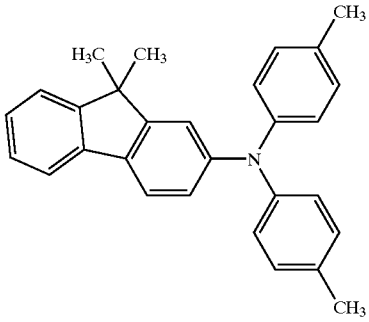
-continued
(1-9-11)
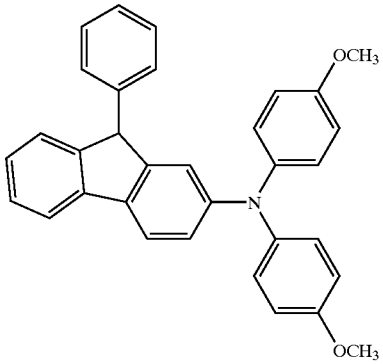
(1-9-12)
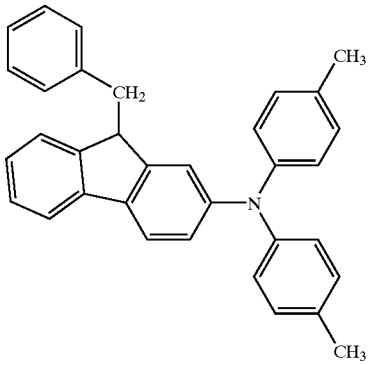
(1-9-13)
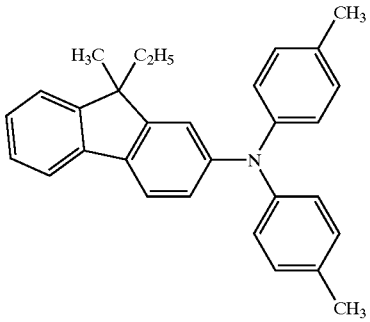
(1-9-14)
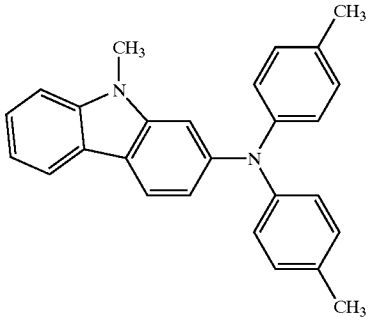

-continued
(1-9-15)
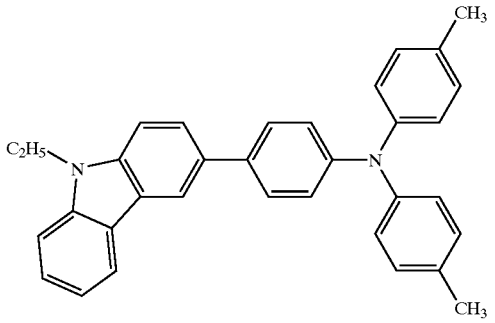
(1-9-16)
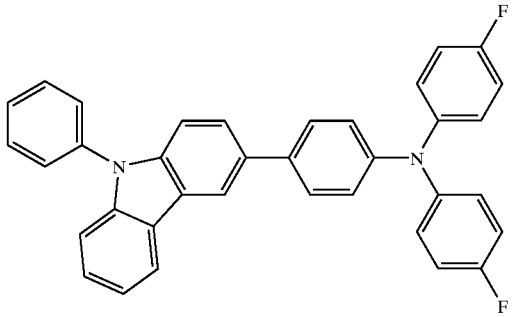
(1-9-17)
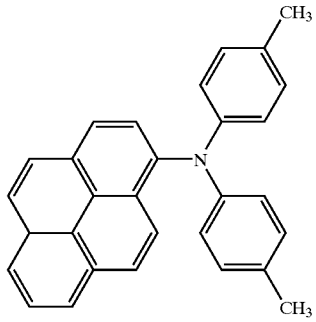
(1-9-18)
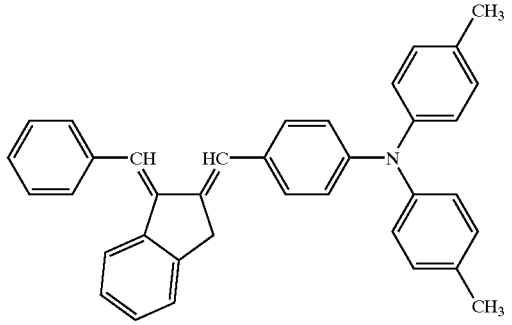
-continued
(1-9-19)
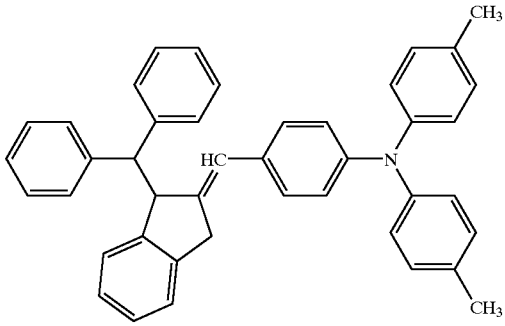
(1-9-20)
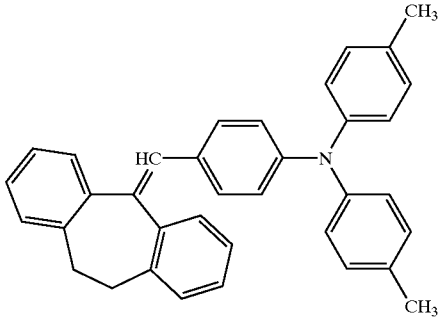
(1-9-21)
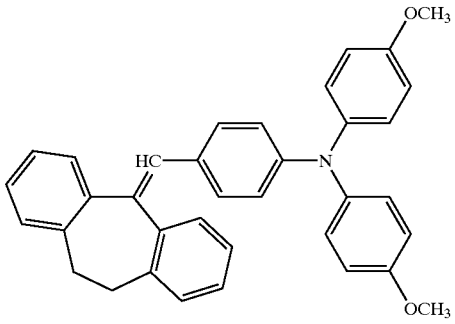
(1-9-22)
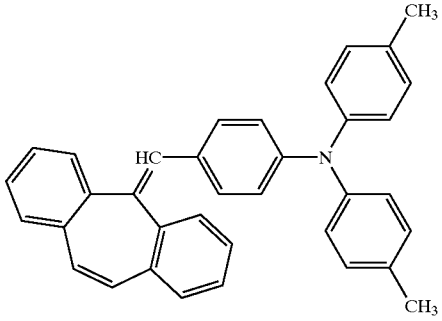

-continued (1-9-23)

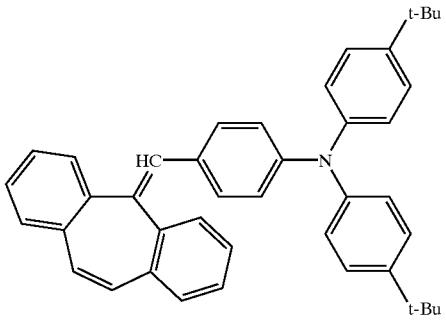

(1-9-24)

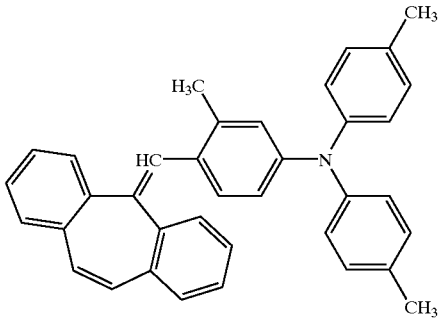

(1-9-25)

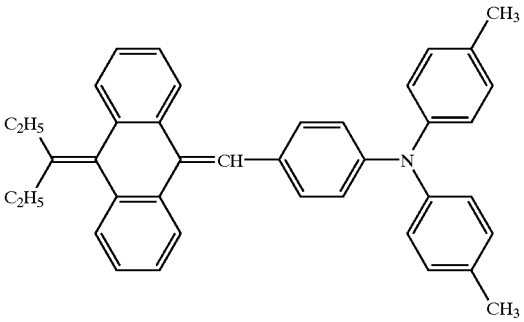

(1-9-26)

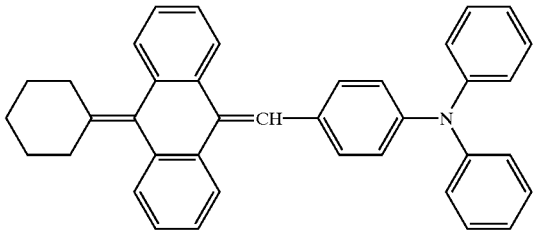

(1-9-27)

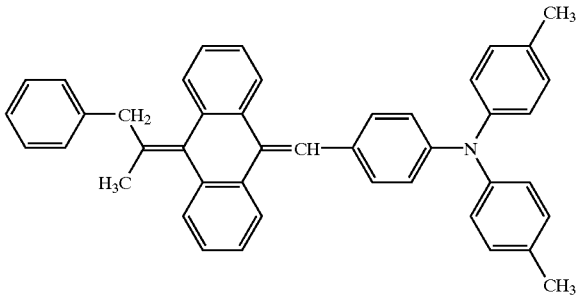

-continued (1-9-28)

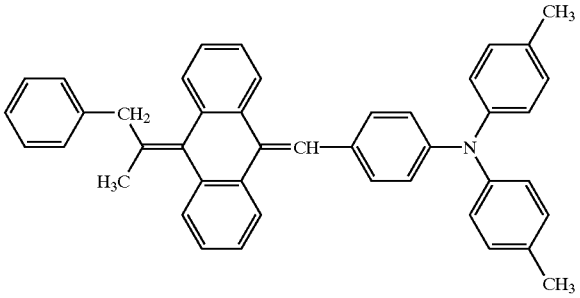

(1-9-29)

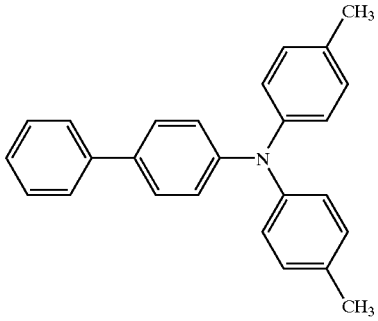

(1-9-30)

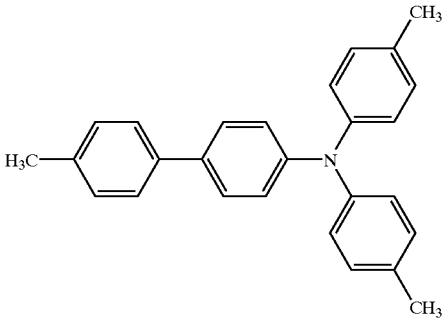

(1-9-31)

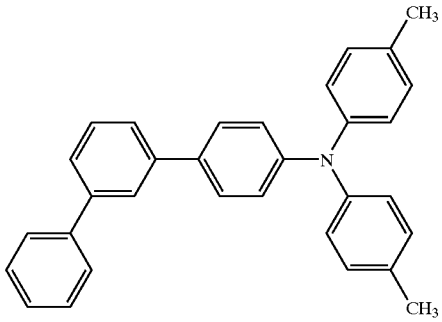

Diphenylamine Compound (1-10)

This compound is equivalent to a compound of the formula (1) wherein 'A' is represented by the formula (A2), in which $R^4$ denotes an aromatic group, heterocyclic group, or group represented by the formula (A2a), in which formula (A2a), 'd' is 0. The groups $R^1$, $R^2$, $Ar^8$ and $Ar^9$ and the symbols 'a' and 'b' are the same as defined in the foregoing.

Specific examples of the compound of the formula (1-10) include those represented by formulas (1-10-1) to (1-10-10).

(1-10-1)
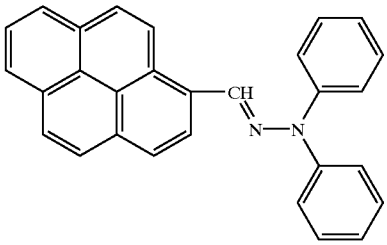
(1-10-2)
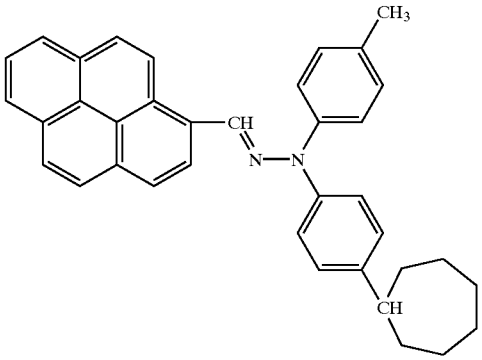
(1-10-3)
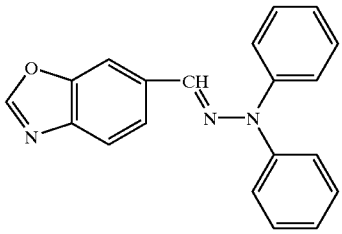
(1-10-4)
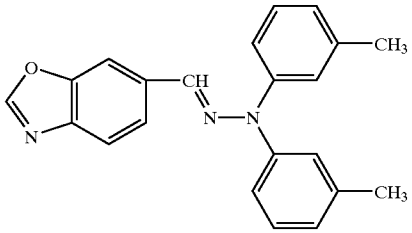
(1-10-5)
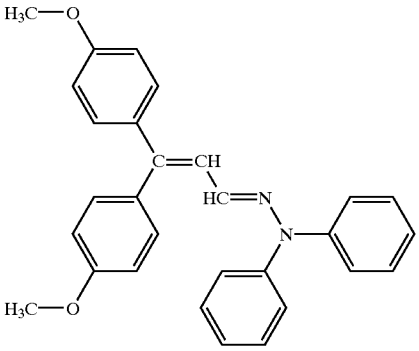
-continued
(1-10-6)
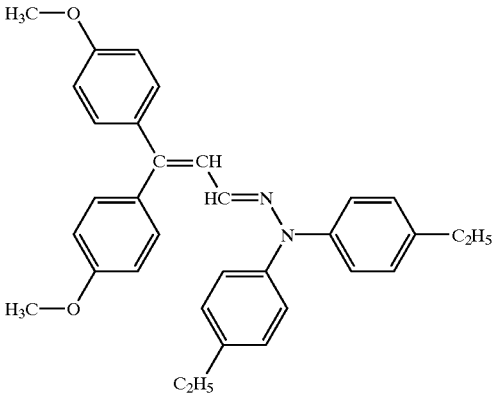
(1-10-7)
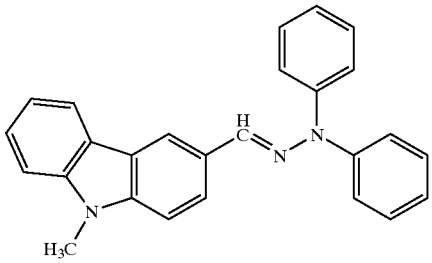
(1-10-8)
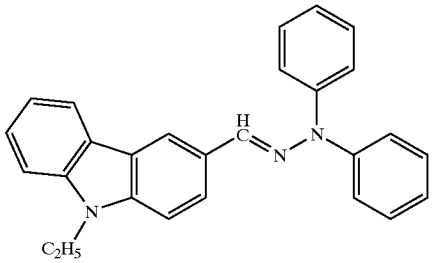
(1-10-9)
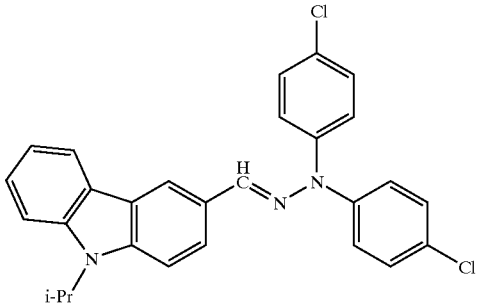
(1-10-10)
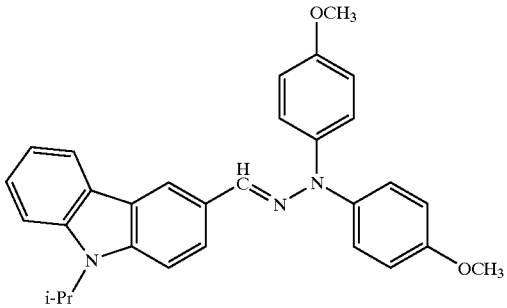

Diphenylamine Compound (1-11)

This compound is equivalent to a compound of the formula (1) wherein 'A' is represented by the formula (A2), in which $R^4$ is a group represented by the formula (A2a), in which formula (A2a), 'd' is 1. The groups $R^1$, $R^2$, $Ar^7$, $Ar^8$ and $Ar^9$ and the symbols 'a', 'b' are the same as defined in the foregoing.

Specific examples of the compound of the formula (1-11) include those represented by formulas (1-11-1) to (1-11-23).

(1-11-1)

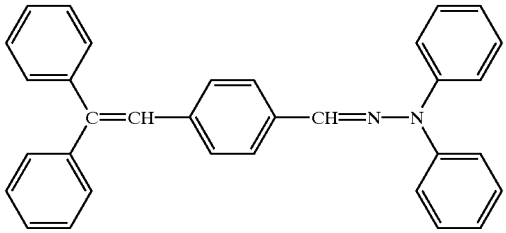

(1-11-2)

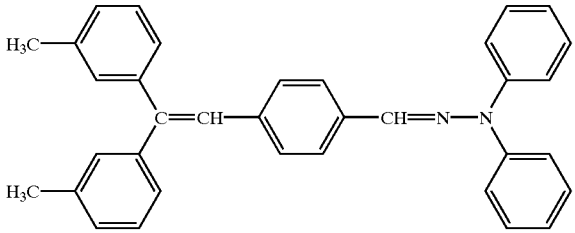

(1-11-3)

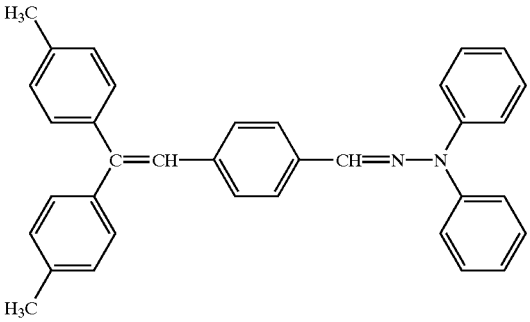

(1-11-4)

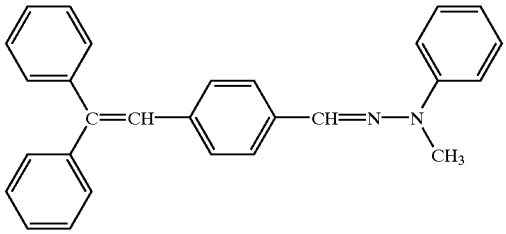

(1-11-5)

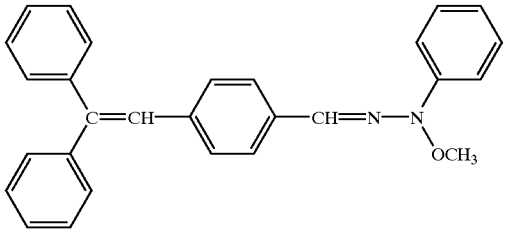

-continued (1-11-6)

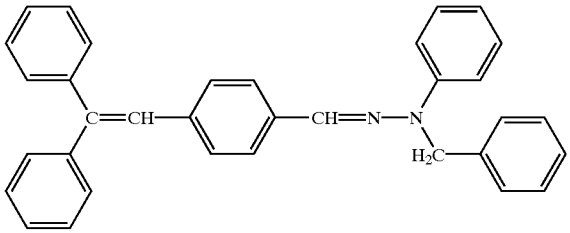

(1-11-7)

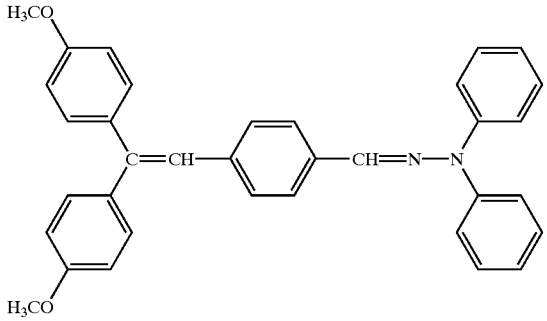

(1-11-8)

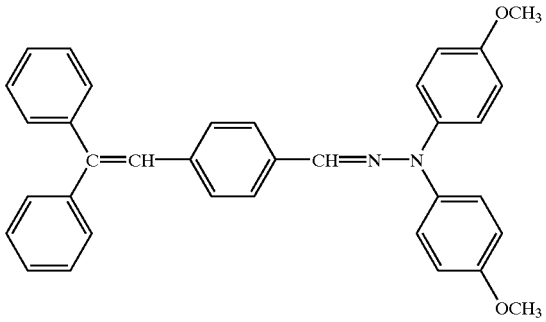

(1-11-9)

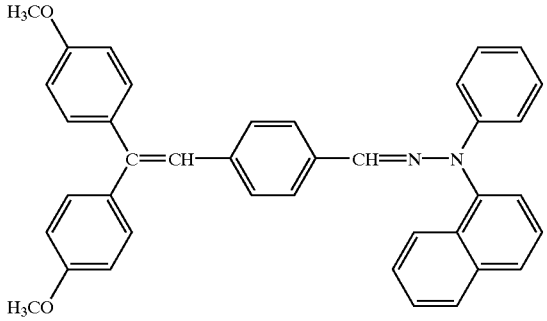

(1-11-10)

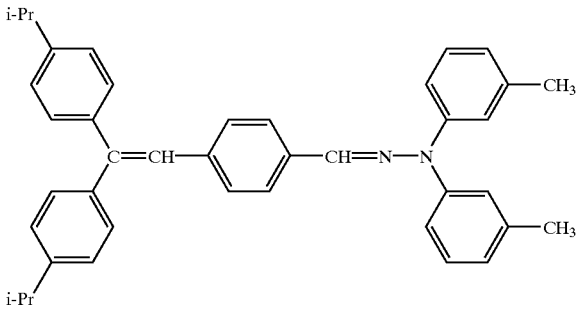

-continued
(1-11-11)
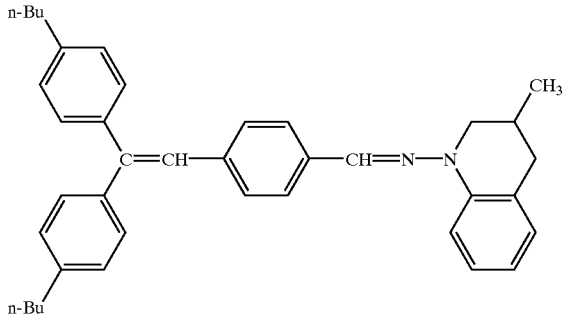
(1-11-12)
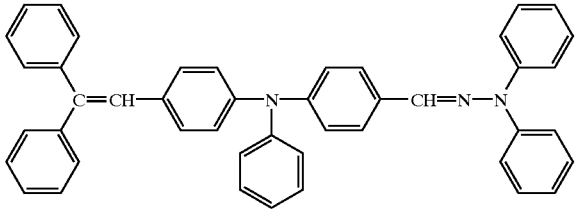
(1-11-13)
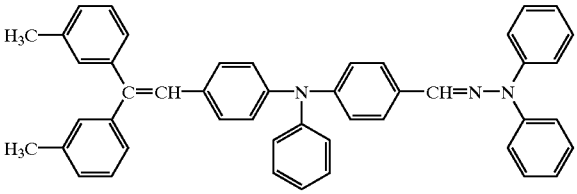
(1-11-14)
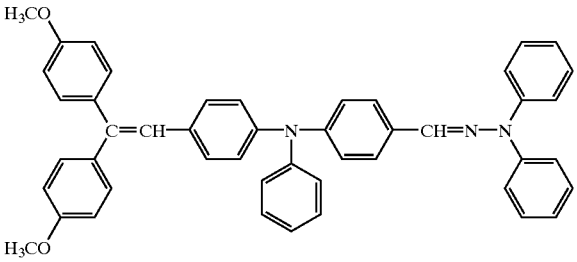
(1-11-15)
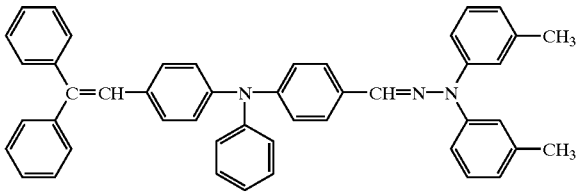
(1-11-16)
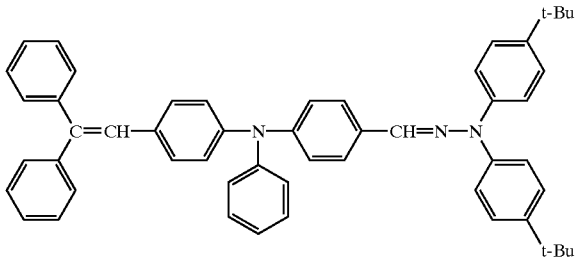
-continued
(1-11-17)
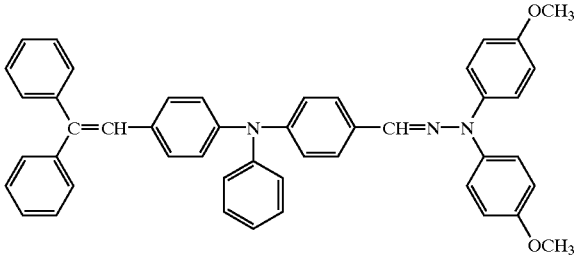
(1-11-18)
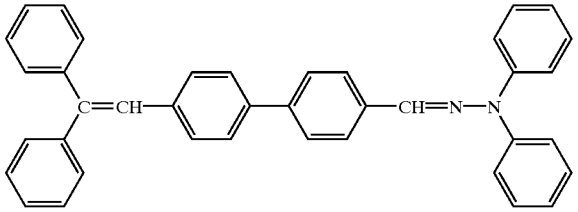
(1-11-19)
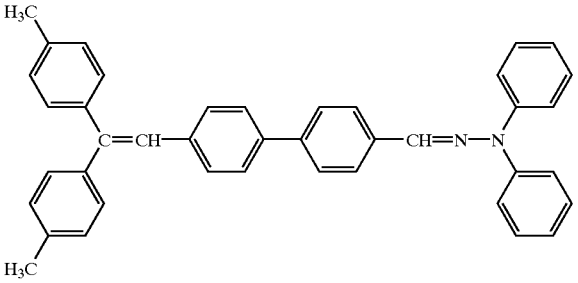
(1-11-20)
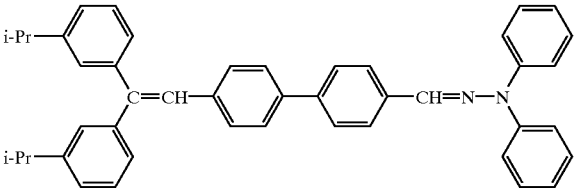
(1-11-21)
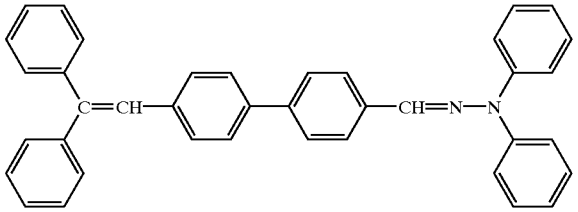
(1-11-22)
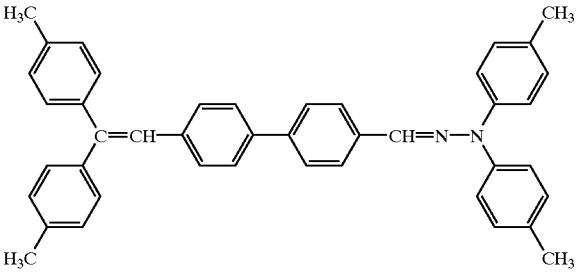

-continued (1-11-23)

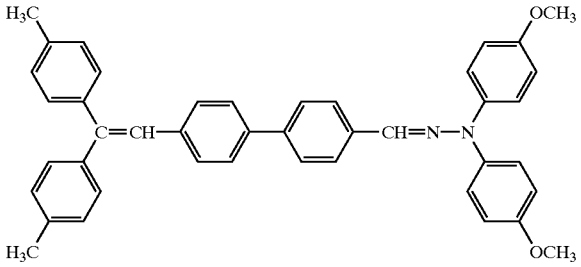

The above diphenylamine compounds may be used alone or in combination with two or more types thereof.

Organic Photosensitive Layer

The organic photosensitive layer includes a single layer type and a multi-layer type, and the invention may be applicable to these types.

The single-layer photosensitive layer is formed by the steps of applying a coating solution to a conductive substrate and drying the solution, the coating solution prepared by dissolving or dispersing in a suitable organic solvent, any one of the diphenylamine compounds of the formula (1) serving as the positive-hole transport material, the charge generating material and the binder resin.

The single-layer photosensitive layer features a simple layer construction and good productivity.

The single-layer photosensitive layer may also contain the electron transport material. A photosensitive layer employing charge transport materials of opposite polarities is advantageous in that the single layer construction is positively and negatively chargeable.

The multi-layer photosensitive layer is formed by the steps of overlaying on the conductive substrate the charge generating layer containing the charge generating material, applying a coating solution containing the charge transport material and the binder resin onto the resultant charge generating layer, and drying the solution thereby forming the charge transport layer. Otherwise, the multi-layer photosensitive layer may also be obtained by forming the charge transport layer over the conductive substrate, followed by forming thereover the charge generating layer.

The charge generating layer may further contain a charge transport material of the opposite polarity to that of the charge transport layer.

There are a great variety of multi-layer photosensitive layers in correspondence to combinations of the orders of the formation of the charge generating layer and charge transport layer and the polarities of the charge transport materials contained in these layers.

It is to be noted in the invention that the upper layer defining the outermost part in contact with the surface protective layer must contain the diphenylamine compound of the formula (1) serving as the positive-hole transport material.

Accordingly, specific examples of the multi-layer photosensitive layer include the following two types:

(a) a negative-charge multi-layer photosensitive layer wherein the charge generating layer containing the charge generating material and, as required, the electron transport material is formed over the conductive substrate and then the charge transport layer containing the diphenylamine compound of the formula (1) is laid over the charge generating layer; and (b) a negative-charge multi-layer photosensitive layer wherein the charge transport layer containing the electron transport material is formed over the conductive substrate, and then the charge generating layer containing the charge generating material and the diphenylamine compound of the formula (1) is laid over the charge transport layer.

It is noted that the charge generating layer has quite a small thickness as compared with the charge transport layer and hence, the construction (a) with the charge transport layer laid on the upper side is more preferred.

Examples of a usable charge generating material include powders of inorganic photoconductive materials such as selenium, selenium-tellurium, selenium-arsenic, cadmium sulfide, α-silicon and the like;

a variety of known pigments including phthalocyanine pigments comprising crystalline phthalocyanine compounds of various crystalline forms such as metal-free phthalocyanine represented by a formula CG-1;

(CG-1)

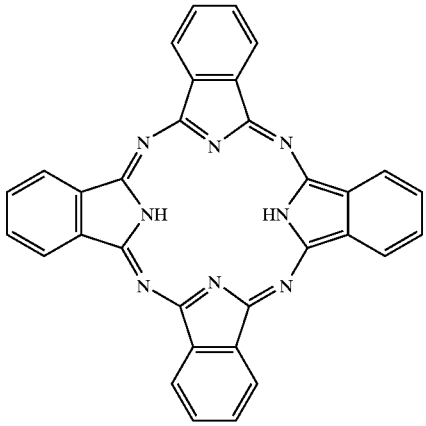

titanyl phthalocyanine represented by a formula CG-2;

(CG-2)

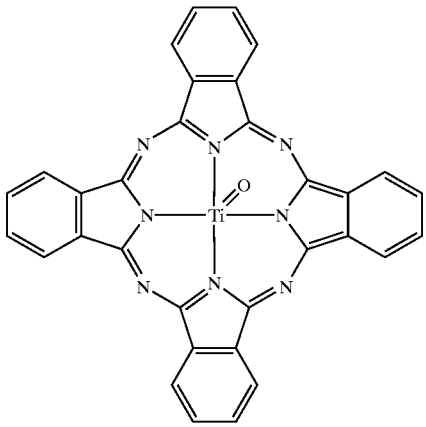

azo pigments, bisazo pigments, perylene pigments, anthanthrone pigments, indigo pigments, triphenylmethane pigments, threne pigments, toluidine pigments, pyrazoline pigments, quinacridone pigments, dithioketopyrolopyrrole pigments and the like.

The charge generating materials may be used alone or in combination of two or more types such that the photosensitive layer may have sensitivity at a desired wavelength range.

Particularly, a electrophotosensitive material having photosensitivity in the wavelength range of 700 nm or more is required by digital-optical image forming apparatuses such as laser beam printers, plain paper facsimiles and the like which utilize infrared light such as semiconductor laser beam. Accordingly, phthalocyanine pigments out of the above exemplary compounds are preferably employed as the charge generating material.

Any of the various known electron-transporting compounds may be used as the electron transport material.

A preferred electron transport material include electron-attracting compounds which include, for example, benzoquinone compounds, diphenoquinone compounds such as 2,6-dimethyl-2',6'-t-butylbenzoquinone represented by a formula (ET-1);

(ET-1)

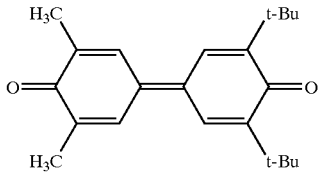

naphthoquinone compounds, malononitrile, thiopyran compounds, tetracyanoethylene, 2,4,8-trinitrilothioxanthone, fluorenone compounds such as 2,4,7-trinitrilo-9-fluorenone, dinitrobenzene, dinitroanthracene, dinitroacridine, nitroanthraquinone, succinic anhydride, maleic anhydride, dibromomaleic anhydride, 2,4,7-trinitrofluorenoneimine compounds, ethylated nitrofluorenoneimine compounds, tryptanthrin compounds, tryptanthrinimine compounds, azafluorenone compounds, dinitropyridoquinazoline compounds, thioxanthene compounds, 2-phenyl-1,4-benzoquinone compounds, 2-phenyl-1,4-naphthoquinone compounds, 5,12-naphthacenequinone compounds, α-cyanostilbene compounds, 4'-nitrostilbene compounds, salts formed by reaction between anionic radicals of benzoquinone compounds and cations.

These materials may be used alone or in combination of two or more types.

According to the invention, the diphenylamine compound of the formula (1), as the positive-hole transport material, may be used in combination with another positive-hole transport material.

Any of the various known positive-hole transporting compounds may be used as the additional positive-hole transport material.

Examples of a suitable positive-hole transport material include benzidine compounds, phenylenediamine compounds, naphthylenediamine compounds, phenantolylenediamine compounds, oxadiazole compounds such as 2,5-di(4-methylaminophenyl)-1,3,4-oxadiazole, styryl compounds such as 9-(4-diethylaminostyryl)anthracene, carbazole compounds such as poly-N-vinylcarbazole having a repeated unit represented by a formula (HT-1);

(HT-1)

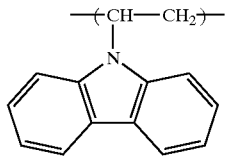

organic polysilane compounds having a repeated unit represented by a formula (HT-2);

(HT-2)

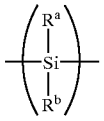

wherein $R^a$ and $R^b$ are the same or different and each denote an alkyl group, alkoxy group, aryl group or aralkyl group, pyrazoline compounds such as 1-phenyl-3-(p-dimethylaminophenyl)pyrazoline, hydrazone compounds such as diethylaminobenzaldehyde diphenylhydrazone represented by a formula (HT-3);

(HT-3)

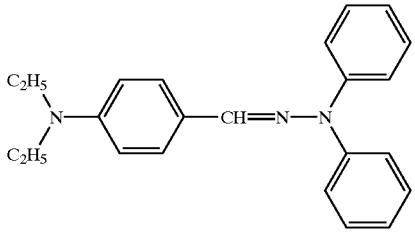

triphenylamine compounds such as tris(3-methylphenyl) amine represented by a formula (HT-4);

(HT-4)

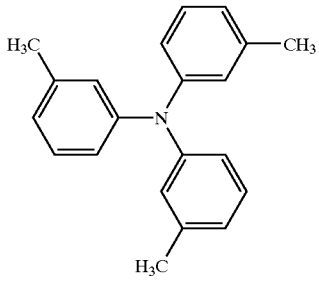

indole compounds, oxazole compounds, isooxazole compounds, thiazole compounds, thiadiazole compounds, imidazole compounds, pyrazole compounds, triazole compounds, butadiene compounds, pyrene-hydrazone compounds, acrolein compounds, carbazole-hydrazone compounds, quinoline-hydrazone compounds, stilbene-hydrazone compounds, diphenylenediamine compounds and the like.

These compounds may be used alone or in combination of two or more types.

Examples of a usable binder resin include thermoplastic resins such as styrene polymers, styrene-butadiene copolymers, styrene-acrylonitrile copolymers, styrene-maleic acid copolymers, acrylic polymers, styrene-acryl copolymers, polyethylene, ethylene-vinyl acetate copolymers, chlorinated polyethylene, polyvinyl chloride, polypropylene, copolymers of vinyl chloride and vinyl acetate, polyester, alkyd resins, polyamide, polyurethane, polycarbonate, polyarylate, polysulfone, diarylphthalate resins, ketone resins, polyvinylbutyral resins, polyether resins and the like;

crosslinking thermosetting resins such as silicone resins, epoxy resins, phenol resins, urea resins, melamine resins and the like; and photosetting resins such as epoxy-acrylate, urethane-acrylate and the like.

These resins may be used alone or in combination of two or more types.

Where a high-molecular positive-hole transport material such as poly-N-vinylcarbazole or the organic polysilane compound described above is used in combination with the diphenylamine compound of the formula (1), the aforesaid binder resin may be dispensed with because the former compound serves as the binder resin, as well.

Additionally to the above components, the photosensitive layer may further contain any of the various additives such as fluorene, ultraviolet absorber, plasticizer, surfactant, leveling agent and the like. For an increased photosensitivity of the electrophotosensitive material, there may be further added a sensitizer such as terphenyl, halonaphthoquinone, acenaphthylene or the like.

The single-layer photosensitive layer may preferably contain 0.1 to 50 parts by weight or particularly 0.5 to 30 parts by weight of charge generating material, and 5 to 500 parts by weight or particularly 25 to 200 parts by weight of positive-hole transport material, based on 100 parts by weight of binder resin.

Where the diphenylamine compound of the formula (1) is used alone, the mixing ratio of the positive-hole transport material means that of the diphenylamine compound. Where the diphenylamine compound is used in combination with another positive-hole transport material, the mixing ratio of the positive-hole transport material means the combined ratio of the diphenylamine compound and the additional positive-hole transport material.

Where the diphenylamine compound is used in combination with another positive-hole transport material, the additional positive-hole transport material may preferably be present in such a small amount that the aforesaid effect of the diphenylamine compound may not be decreased. More specifically, the additional positive-hole transport material may be present in concentrations of not more than 30 parts by weight based on 100 parts by weight of diphenylamine compound.

Where the electron-transport material is used in combination with the diphenylamine compound, the electron-transport material may preferably be present in concentrations of 5 to 100 parts by weight or particularly 10 to 80 parts by weight based on 100 parts by weight of binder resin. In this case, the total amount of the positive-hole transport material and the electron-transport material may preferably be in the range of 20 to 500 parts by weight or particularly 30 to 200 parts by weight based on 100 parts by weight of binder resin.

The single-layer photosensitive layer may preferably have a thickness of 5 to 100 $\mu$m or particularly 10 to 50 $\mu$m.

The charge generating layer of the multi-layer photosensitive layer may be formed from the charge generating material alone or formed from the binder resin in which the charge generating material and, as required, the electron transport material are dispersed. In the latter case, it is preferred to employ 5 to 1,000 parts by weight or particularly 30 to 500 parts by weight of charge generating material and 1 to 200 parts by weight or particularly 5 to 100 parts by weight of electron transport material based on 100 parts by weight of binder resin.

The charge transport layer may preferably contain the positive-hole transport material in concentrations of 10 to 500 parts by weight or particularly 15 to 200 parts by weight based on 100 parts by weight of binder resin.

Similarly to the single-layer photosensitive layer, the mixing ratio of the positive-hole transport material means that of the diphenylamine compound of the formula (1) when the diphenylamine compound is used alone. Where the diphenylamine compound is used in combination with another positive-hole transport material, the mixing ratio of the positive-hole transport material means the combined ratio of the diphenylamine compound and the additional positive-hole transport material.

Where the diphenylamine compound is used in combination with another positive-hole transport material, the additional positive-hole transport material may preferably be present in such a small amount that the aforesaid effect of the diphenylamine compound may not be decreased. More specifically, the additional positive-hole transport material may be present in concentrations of not more than 30 parts by weight based on 100 parts by weight of diphenylamine compound.

As to the thickness of the multi-layer photosensitive layer, the charge generating layer may preferably have a thickness of 0.01 to 5 $\mu$m or particularly 0.1 to 3 $\mu$m, whereas the charge transport layer may preferably have a thickness of 2 to 100 $\mu$m or particularly 5 to 50 $\mu$m.

An intermediate layer or barrier layer may be formed between the organic photosensitive layer of the single-layer type or multi-layer type and the conductive substrate or between the charge generating layer and the charge transport layer of the multi-layer photosensitive layer, so long as such a layer does not decrease the effect of the characteristics of the electrophotosensitive material.

Where each layer forming the electrophotosensitive material is formed by the coating method, the charge generating material, charge transport material, and binder resin may be dispersed, by mixing, into an organic solvent using a roll mill, ball mill, attritor, paint shaker, ultrasonic disperser or the like, thereby to prepare a coating solution, which may be applied and dried by the known means.

Examples of a usable organic solvent include alcohols such as methanol, ethanol, isopropanol, butanol and the like;

aliphatic hydrocarbons such as n-hexane, octane, cyclohexane and the like;

aromatic hydrocarbons such as benzene, toluene, xylene and the like;

halogenated hydrocarbons such as dichloromethane, dichloroethane, carbon tetrachloride, chlorobenzene and the like;

ethers such as dimethyl ether, diethyl ether, tetrahydrofuran, 1,4-dioxane, ethyleneglycol dimethyl ether, diethyleneglycol dimethyl ether and the like;

ketones such as acetone, methyl ethyl ketone, cyclohexanone and the like;

esters such as ethyl acetate, methyl acetate and the like; and dimethylformaldehyde, dimethylformamide, dimethyl sulfoxide and the like. These solvents may be used alone or in combination of two or more types.

The coating solution may further contain a surfactant, leveling agent or the like for increasing the dispersibility of the charge generating material and charge transport material, and the surface smoothness of the photosensitive layer.

Surface Protective Layer

The inorganic surface protective layer is exemplified by a variety of surface protective layers comprising at least one element selected from the group consisting of metallic elements (the elements on the left side of a line interconnecting boron (B) and astatine (At) in the long-form periodic table) and carbon, or an inorganic compound containing any of these elements.

The surface protective layer may be formed by any of the various known vapor deposition methods including the chemical vapor deposition methods such as plasma CVD, photo CVD and the like, and the physical vapor deposition methods such as sputtering, vacuum deposition, ion plating and the like.

In the chemical vapor deposition method such as plasma CVD, there are formed:

1. a film comprising carbon (C) and/or silicon (Si) of the 14-group elements, that is, carbon (C) film, silicon (Si) film and silicon-carbon (Si—C) composite film;
2. a film comprising a compound containing the aforesaid carbon (C) and/or silicon (Si) and at least one element selected from the group consisting of boron (B) and aluminum (Al) of the 13-group elements; nitrogen (Ni) and phosphorus (P) of the 15-group elements; oxygen (O) and sulfur (S) of the 16-group elements; fluorine (F), chlorine (Cl) and bromine (Br) of the 17-group elements; the film including, for example, silicon-nitrogen (SiN) composite film, silicon-oxygen (SiO) composite film, carbon-fluorine (CF) composite film, carbon-nitrogen (CN) composite film, carbon-boron (CB) composite film, carbon-oxygen (CO) composite film and the like; and
3. a film comprising a compound containing boron (B) and/or aluminum (Al) of the 13-group elements and at least one selected from the group consisting of the aforesaid elements including nitrogen (N), phosphorus (P), oxygen (O), sulfur (S), fluorine (F), chlorine (Cl) and bromine (Br), the film including, for example, boron-nitrogen (BN) composite film, aluminum-nitrogen (AlN) composite film and the like.

These films may contain a fractional amount of hydrogen (H) for an improved electrical characteristics of the surface protective layer.

In the chemical vapor deposition method, a usable raw material gas for introduction of a constituent element of the surface protective layer include the molecules of the constituent elements, and compounds thereof such as oxides, hydrides, nitrides and halides thereof, the compounds capable of presenting a gaseous state under normal temperature and pressure conditions or of being readily gassified under film forming conditions. As required, these compounds may be diluted with a gas such as hydrogen gas ($H_2$), helium gas, argon gas, neon gas or the like.

Specific examples of the raw material gas include:

silane gas ($SiH_4$) and disilane gas ($Si_2H_6$) for silicon introduction;

methane gas ($CH_4$), ethane gas ($C_2H_6$), propane gas ($C_3H_8$) and ethylene gas ($C_2H_4$) for carbon introduction;

fluorine gas ($F_2$), bromine monofluoride gas (BrF), chlorine difluoride gas ($ClF_2$), carbon tetrafluoride gas ($CF_4$) and silicon tetrafluoride gas ($SiF_4$) for fluorine introduction;

nitrogengas ($N_2$), ammoniagas ($NH_3$), nitrogenoxide gas ($NO_x$) for nitrogen introduction;

and boron hydride gas such as diborane gas ($B_2H_6$), and tetraborane gas ($B_4H_{10}$) for boron introduction; and the like.

Similarly, the introduction of the other constituent elements may employ compounds capable of presenting a gaseous state under normal temperature and pressure conditions or of being readily gassified under film forming conditions.

In the physical vapor deposition method, or particularly in the sputtering or ion plating method, there are formed films, besides the aforesaid films, which each comprise one or more than one metallic elements selected from the group consisting of, for example, gallium (Ga), indium (In) and the like of the 13-group elements; germanium (Ge), tin (Sn), lead (Pb) and the like of the 14-group elements; arsenic (As), antimony (Sb) and the like of the 15-group elements; selenium (Se) and the like of the 16-group elements, or which each comprise an inorganic compound comprising any of the above elements.

Preferred as the inorganic surface protective layer are, for example, the carbon (C) film, silicon-carbon (SiC) composite film and the like.

The thickness of the inorganic surface protective layer may preferably be in the range of 0.01 to 30 $\mu$m or particularly of 0.1 to 10 $\mu$m.

The inorganic film defining the surface protective layer may be in any of the amorphous form, microcrystalline form, and crystalline form. Further, the film may comprise a mixture of amorphous and crystalline particles.

Conductive Substrate

The conductive substrate may employ substrates formed from various materials having conductivity. Examples of a usable conductive substrate include those formed from metals such as iron, aluminum, copper, tin, platinum, silver, vanadium, molybdenum, chromium, cadmium, titanium, nickel, palladium, indium, stainless steel, brass and the like; those formed from a plastic material on which any of the above metals is deposited or laminated; and glass substrate coated with aluminum iodide, tin oxide, indium oxide or the like.

In short, the substrate itself may have the conductivity or the surface thereof may have the conductivity. It is preferred that the conductive substrate has a sufficient mechanical strength in use.

The conductive substrate may have any form, such as sheet, drum and the like, according to the construction of the image forming apparatus to which the conductive substrate is applied.

EXAMPLES

The invention will hereinbelow be described by way of reference to examples and comparative examples thereof.

Single-Layer Electrophotosensitive Material

Example 1-1

Forming Single-Layer Photosensitive Layer

A ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-1-2); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on an aluminum tube as the conductive substrate and then was air dried at 100° C. for 30 minutes. Thus was obtained a single-layer photosensitive layer having a thickness of 25 $\mu$m.

Forming Surface Protective Layer

The aluminum tube formed with the single-layer photosensitive layer was placed in a chamber of a plasma CVD system. The air within the chamber was evacuated to reach a degree of vacuum of 0.67 Pa while a heater of the system was operated to adjust the temperature of the tube substrate to 50° C.

Subsequently, methane gas ($CH_4$), silane gas ($SiH_4$) and hydrogen gas ($H_2$) were fed into the chamber at respective flow rates listed below, thereby to adjust the degree of vacuum to 0.47 hPa.

Methane gas: 208 SCCM
Silane gas: 2.5 SCCM
Hydrogen gas: 300 SCCM

In this state, a high-frequency electric field having a frequency of 13.56 MHz and an output of 133 W was applied for causing glow discharge in the chamber. The plasma CVD process was performed for depositing an amorphous silicon-carbon (SiC) composite film at a film growth rate of 0.2 $\mu$m/hr, thereby laying a surface protective layer having a thickness of 0.5 $\mu$m over the surface of the single-layer photosensitive layer. Thus was fabricated an electrophotosensitive material of Example 1-1.

The surface protective layer had a dynamic indentation hardness of 3645.6 Mpa.

Examples 1-2 to 1-12

Electrophotosensitive materials of Examples 1-2 to 1-12 were fabricated the same way as in Example 1-1, except that each of the examples used 100 parts by weight of diphenylamine compound of the formula of a number listed in the following Table 1 as the positive-hole transport material.

Comparative Example 1-1

An electrophotosensitive material of Comparative Example 1-1 was fabricated the same way as in Example 1-1, except that 200 parts by weight of polyvinylcarbazole (number-average molecular weight Mn=9,500) was used instead of 100 parts by weight of diphenylamine compound and 100 parts by weight of Z-type polycarbonate, the polyvinylcarbazole serving not only as the positive-hole transport material but also as the binder resin, and having the repeated unit represented by the formula (HT-1).

Comparative Example 1-2

An electrophotosensitive material of Comparative Example 1-2 was fabricated the same way as in Example 1-1, except that 100 parts by weight of diethylaminobenzaldehyde diphenylhydrazone represented by the formula (HT-3) was used as the positive-hole transport material.

Photosensitivity Test I

Each of the electrophotosensitive materials of the above examples and comparative examples was charged at +800±20V and the surface potential $V_0$(V) thereof was measured using a drum sensitivity tester available from GENTEC Co.

A bandpass filter was used to extract monochromatic light from white light from a halogen lamp as a light source of the tester, the monochromatic light having a wavelength of 780 nm and a half width of 20 nm. The surface of the above electrophotosensitive material was irradiated with the monochromatic light at a light intensity of 10 $\mu$W/cm$^2$ for 1.0 second while the half-life exposure $E_{1/2}$ ($\mu$J/cm$^2$) was determined by measuring the time elapsed before the surface potential $V_0$(V) decreased to half. On the other hand, the residual potential $V_r$(V) was determined by measuring a surface potential after a lapse of 0.5 seconds from the start of the light exposure.

Durability Test I

The electrophotosensitive materials of the above examples and comparative examples were each mounted in an electrostatic copier [commercially available from KYOCERA MITA CORPORATION as "Creage 7350"] for continuous production of 100,000 copies, during which the surface protective layer was visually observed after respective productions of 10,000 copies, 20,000 copies, 50,000 copies and 100,000 copies. The durability of each electrophotosensitive material was evaluated based on the following criteria:

○: a electrophotosensitive material having a good durability, suffering no cracks nor delamination of the surface protective layer;

Δ: a electrophotosensitive material more or less lower in durability, suffering cracks spread in the overall surface of the surface protective layer which, however, sustained no delamination; and X: a electrophotosensitive material of an unacceptable durability, suffering the delamination of the surface protective layer.

The results are listed in Table 1.

TABLE 1

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 1-1 | a-SiC | 1-1-2 | 790 | 125 | 0.938 | ○ | ○ | ○ | ○ |
| Ex. 1-2 | a-SiC | 1-1-8 | 788 | 138 | 1.001 | ○ | ○ | ○ | ○ |
| Ex. 1-3 | a-SiC | 1-1-12 | 801 | 121 | 0.834 | ○ | ○ | ○ | ○ |
| Ex. 1-4 | a-SiC | 1-1-16 | 817 | 110 | 0.751 | ○ | ○ | ○ | ○ |
| Ex. 1-5 | a-SiC | 1-1-17 | 785 | 105 | 0.751 | ○ | ○ | ○ | ○ |
| Ex. 1-6 | a-SiC | 1-1-18 | 782 | 130 | 0.938 | ○ | ○ | ○ | ○ |
| Ex. 1-7 | a-SiC | 1-1-21 | 780 | 127 | 0.883 | ○ | ○ | ○ | ○ |
| Ex. 1-8 | a-SiC | 1-1-22 | 780 | 127 | 0.938 | ○ | ○ | ○ | ○ |
| Ex. 1-9 | a-SiC | 1-1-25 | 804 | 152 | 1.072 | ○ | ○ | ○ | ○ |
| Ex. 1-10 | a-SiC | 1-1-27 | 782 | 156 | 1.154 | ○ | ○ | ○ | ○ |
| Ex. 1-11 | a-SiC | 1-1-29 | 780 | 161 | 1.155 | ○ | ○ | ○ | ○ |
| Ex. 1-12 | a-SiC | 1-1-30 | 790 | 161 | 1.154 | ○ | ○ | ○ | ○ |
| C. Ex. 1-1 | a-SiC | HT-1 | 817 | 205 | 1.500 | ○ | x | — | — |
| C. Ex. 1-2 | a-SiC | HT-3 | 804 | 232 | 1.667 | ○ | x | — | — |

SPL: Surface Protective Layer
P-H TM: Positive-hole Transport Material
SP: Surface Potential
RP: Residual Potential
HLE: Half-life Exposure It was confirmed from the table that both the electrophotosensitive materials of Comparative Examples 1-1, 1-2 suffered the delamination of the surface protective layer after the continuous production of 20,000 copies. This indicates that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 1-1 to 1-12 suffered no cracks nor delamination after the continuous production of 100,000 copies. It was thus confirmed that the use of the diphenylamine compound of the formula (1-1) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 1-13 to 1-24, Comparative Examples 1-3, 1-4

Electrophotosensitive materials of Examples 1-13 to 1-24 and of Comparative Examples 1-3, 1-4 were fabricated the same way as in Examples 1-1 to 1-12 and Comparative Examples 1-1, 1-2, except that the following procedure was taken to form a surface protective layer of amorphous carbon (C) having a thickness of 0.5 $\mu$m, instead of the silicon-carbon composite film, over the surface of the single-layer photosensitive layer.

Forming Surface Protective Layer

The aluminum tube formed with the single-layer photosensitive layer was placed in the chamber of the plasma CVD system. The air within the chamber was evacuated to reach a degree of vacuum of 0.67 Pa while the heater of the system was operated to adjust the temperature of the tube substrate to 50° C.

Subsequently, methane gas ($CH_4$) and hydrogen gas ($H_2$) were fed into the chamber at respective flow rates listed below, thereby to adjust the degree of vacuum to 0.47 hPa.

Methane gas: 300 SCCM

Hydrogen gas: 300 SCCM

In this state, a high-frequency electric field having a frequency of 13.56 MHz and an output of 200 W was applied for causing glow discharge in the chamber. The plasma CVD process was performed for depositing a film of amorphous carbon (C) at a film growth rate of 0.15 $\mu$m/hr, thereby forming the surface protective layer of the aforesaid thickness over the surface of the single-layer photosensitive layer.

The electrophotosensitive materials of the above examples and comparative examples were subjected to the same photosensitivity test I and durability test I as described above and evaluated for the characteristics thereof. The results are listed in Table 2.

TABLE 2

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 1-13 | a-C | 1-1-2 | 793 | 136 | 0.950 | ○ | ○ | ○ | ○ |
| Ex. 1-14 | a-C | 1-1-8 | 793 | 144 | 1.028 | ○ | ○ | ○ | ○ |
| Ex. 1-15 | a-C | 1-1-12 | 780 | 114 | 0.844 | ○ | ○ | ○ | ○ |
| Ex. 1-16 | a-C | 1-1-16 | 809 | 101 | 0.743 | ○ | ○ | ○ | ○ |
| Ex. 1-17 | a-C | 1-1-17 | 788 | 101 | 0.758 | ○ | ○ | ○ | ○ |
| Ex. 1-18 | a-C | 1-1-18 | 798 | 137 | 0.975 | ○ | ○ | ○ | ○ |
| Ex. 1-19 | a-C | 1-1-21 | 785 | 125 | 0.883 | ○ | ○ | ○ | ○ |
| Ex. 1-20 | a-C | 1-1-22 | 780 | 136 | 0.987 | ○ | ○ | ○ | ○ |
| Ex. 1-21 | a-C | 1-1-25 | 780 | 140 | 1.057 | ○ | ○ | ○ | ○ |
| Ex. 1-22 | a-C | 1-1-27 | 801 | 168 | 1.230 | ○ | ○ | ○ | ○ |
| Ex. 1-23 | a-C | 1-1-29 | 809 | 154 | 1.137 | ○ | ○ | ○ | ○ |
| Ex. 1-24 | a-C | 1-1-30 | 796 | 153 | 1.154 | ○ | ○ | ○ | ○ |
| C. Ex. 1-3 | a-C | HT-1 | 793 | 208 | 1.563 | ○ | x | — | — |
| C. Ex. 1-4 | a-C | HT-3 | 788 | 222 | 1.667 | Δ | x | — | — |

It was confirmed from the table that if the type of the surface protective layer was changed, the same results as the above were obtained according to the compositions of the single-layer photosensitive layer as the base.

Specifically, it was found that both the electrophotosensitive materials of Comparative Examples 1-3, 1-4 suffered the delamination of the surface protective layer after the continuous production of 20,000 copies. Particularly in the electrophotosensitive material of Comparative Example 1-4, cracks over the whole surface protective layer were already observed at completion of the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 1-13 to 1-24 suffered no cracks nor delamination after the continuous production of 100,000 copies. It was thus confirmed that the use of the diphenylamine compound of the formula (1-1) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 1-25, 1-26, Comparative Example 1-5

Electrophotosensitive materials of Examples 1-25, 1-26 and of Comparative Example 1-5 were fabricated the same way as in Examples 1-4, 1-5 and Comparative Examples 1-2, except that the following procedure was taken to form a surface protective layer of amorphous silicon-nitrogen (SiN) composite film having a thickness of 0.5 μm, instead of the silicon-carbon composite film, over the surface of the single-layer photosensitive layer.

Forming Surface Protective Layer

The aluminum tube formed with the single-layer photosensitive layer was placed in the chamber of the plasma CVD system. The air within the chamber was evacuated to reach a degree of vacuum of 0.67 Pa while the heater of the system was operated to adjust the temperature of the tube substrate to 50° C.

Subsequently, silane gas ($SiH_4$), nitrogen gas ($N_2$) and hydrogen gas ($H_2$) were fed into the chamber at respective flow rates listed below, thereby to adjust the degree of vacuum to 0.47 hPa.

Silane gas: 153 SCCM

Nitrogen gas: 150 SCCM

Hydrogen gas: 75 SCCM

In this state, a high-frequency electric field having a frequency of 13.56 MHz and an output of 150 W was applied for causing glow discharge in the chamber. The plasma CVD process was performed for depositing a silicon-nitrogen (SiN) composite film at a film growth rate of 0.75 μm/hr, thereby forming the surface protective layer of the aforesaid thickness over the surface of the single-layer photosensitive layer.

Examples 1-27, 1-28, Comparative Example 1-6

Electrophotosensitive materials of Examples 1-27, 1-28 and of Comparative Example 1-6 were fabricated the same way as in Examples 1-4, 1-5 and Comparative Examples 1-2, except that the following procedure was taken to form a surface protective layer of amorphous carbon-nitrogen (CN) composite film having a thickness of 0.5 μm, instead of the silicon-carbon composite film, over the surface of the single-layer photosensitive layer.

Forming Surface Protective Layer

The aluminum tube formed with the single-layer photosensitive layer was placed in the chamber of the plasma CVD system. The air within the chamber was evacuated to reach a degree of vacuum of 0.67 Pa while the heater of the system was operated to adjust the temperature of the tube substrate to 50° C.

Subsequently, methane gas ($CH_4$), nitrogen gas ($N_2$) and hydrogen gas ($H_2$) were fed into the chamber at respective flow rates listed below, thereby to adjust the degree of vacuum to 0.47 hPa.

Methane gas: 100 SCCM

Nitrogen gas: 150 SCCM

Hydrogen gas: 100 SCCM

In this state, a high-frequency electric field having a frequency of 13.56 MHz and an output of 150 W was applied for causing glow discharge in the chamber. The plasma CVD process was performed for depositing a carbon-nitrogen (CN) composite film at a film growth rate of 0.10 μm/hr, thereby forming the surface protective layer of the aforesaid thickness over the surface of the single-layer photosensitive layer.

Examples 1-29, 1-30, Comparative Example 1-7

Electrophotosensitive materials of Examples 1-29, 1-30 and of Comparative Example 1-7 were fabricated the same way as in Examples 1-4, 1-5 and Comparative Examples 1-2, except that the following procedure was taken to form a surface protective layer of amorphous carbon-boron (CB) composite film having a thickness of 0.5 μm, instead of the silicon-carbon composite film, over the surface of the single-layer photosensitive layer.

Forming Surface Protective Layer

The aluminum tube formed with the single-layer photosensitive layer was placed in the chamber of the plasma CVD system. The air within the chamber was evacuated to reach a degree of vacuum of 0.67 Pa while the heater of the system was operated to adjust the temperature of the tube substrate to 50° C.

Subsequently, methane gas ($CH_4$), diborane gas ($B_2H_6$) and hydrogen gas ($H_2$) were fed into the chamber at respective flow rates listed below, thereby to adjust the degree of vacuum to 0.47 hPa.

Methane gas: 100 SCCM

Diborane gas: 200 SCCM

Hydrogen gas: 100 SCCM

In this state, a high-frequency electric field having a frequency of 13.56 MHz and an output of 150 W was applied for causing glow discharge in the chamber. The plasma CVD process was performed for depositing a carbon-boron (CB) composite film at a film growth rate of 0.10 μm/hr, thereby forming the surface protective layer of the aforesaid thickness over the surface of the single-layer photosensitive layer.

Examples 1-31, 1-32, Comparative Example 1-8

Electrophotosensitive materials of Examples 1-31, 1-32 and of Comparative Example 1-8 were fabricated the same way as in Examples 1-4, 1-5 and Comparative Examples 1-2, except that the following procedure was taken to form a surface protective layer of amorphous carbon-fluorine (CF) composite film having a thickness of 0.5. m, instead of the silicon-carbon composite film, over the surface of the single-layer photosensitive layer.

Forming Surface Protective Layer

The aluminum tube formed with the single-layer photosensitive layer was placed in the chamber of the plasma CVD system. The air within the chamber was evacuated to reach a degree of vacuum of 0.67 Pa while the heater of the system was operated to adjust the temperature of the tube substrate to 50° C.

Subsequently, methane gas ($CH_4$), carbon tetrafluoride gas ($CF_4$) and hydrogen gas ($H_2$) were fed into the chamber at respective flow rates listed below, thereby to adjust the degree of vacuum to 0.47 hPa.

Methane gas: 100 SCCM

Carbon tetrafluoride gas: 100 SCCM

Hydrogen gas: 100 SCCM

In this state, a high-frequency electric field having a frequency of 13.56 MHz and an output of 150 W was applied for causing glow discharge in the chamber. The plasma CVD process was performed for depositing a carbon-fluorine (CF) composite film at a film growth rate of 0.10 μm/hr, thereby forming the surface protective layer of the aforesaid thickness over the surface of the single-layer photosensitive layer.

Examples 1-33, 1-34, Comparative Example 1-9

Electrophotosensitive materials of Examples 1-33, 1-34 and of Comparative Example 1-9 were fabricated the same way as in Examples 1-4, 1-5 and Comparative Examples 1-2, except that the following procedure was taken to form a surface protective layer of amorphous boron-nitrogen (BN) composite film having a thickness of 0.5 μm, instead of the silicon-carbon composite film, over the surface of the single-layer photosensitive layer.

Forming Surface Protective Layer

The aluminum tube formed with the single-layer photosensitive layer was placed in the chamber of the plasma CVD system. The air within the chamber was evacuated to reach a degree of vacuum of 0.67 Pa while the heater of the system was operated to adjust the temperature of the tube substrate to 50° C.

Subsequently, diborane gas ($B_2H_6$), nitrogen gas ($N_2$) and hydrogen gas ($H_2$) were fed into the chamber at respective flow rates listed below, thereby to adjust the degree of vacuum to 0.47 hPa.

Diborane gas: 200 SCCM
Nitrogen gas: 150 SCCM
Hydrogen gas: 150 SCCM

In this state, a high-frequency electric field having a frequency of 13.56 MHz and an output of 150 W was applied for causing glow discharge in the chamber. The plasma CVD process was performed for depositing a boron-nitrogen (BN) composite film at a film growth rate of 0.08 μm/hr, thereby forming the surface protective layer of the aforesaid thickness over the surface of the single-layer photosensitive layer.

The electrophotosensitive materials of the above examples and comparative examples were subjected to the same photosensitivity test I and durability test I as described above and evaluated for the characteristics thereof. The results are listed in Table 3.

TABLE 3

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 1-25 | a-SiN | 1-1-16 | 798 | 111 | 0.816 | ○ | ○ | ○ | ○ |
| Ex. 1-26 | a-SiN | 1-1-17 | 798 | 110 | 0.807 | ○ | ○ | ○ | ○ |
| C. Ex. 1-5 | a-SiN | HT-3 | 812 | 245 | 1.787 | ○ | x | — | — |
| Ex. 1-27 | a-CN | 1-1-16 | 801 | 114 | 0.844 | ○ | ○ | ○ | ○ |
| Ex. 1-28 | a-CN | 1-1-17 | 780 | 113 | 0.834 | ○ | ○ | ○ | ○ |
| C. Ex. 1-6 | a-CN | HT-3 | 790 | 252 | 1.875 | ○ | x | — | — |
| Ex. 1-29 | a-CB | 1-1-16 | 798 | 105 | 0.715 | ○ | ○ | ○ | ○ |
| Ex. 1-30 | a-CB | 1-1-17 | 806 | 107 | 0.728 | ○ | ○ | ○ | ○ |
| C. Ex. 1-7 | a-CB | HT-3 | 801 | 222 | 1.667 | Δ | x | — | — |
| Ex. 1-31 | a-CF | 1-1-16 | 782 | 105 | 0.751 | ○ | ○ | ○ | ○ |
| Ex. 1-32 | a-CF | 1-1-17 | 790 | 103 | 0.736 | ○ | ○ | ○ | ○ |
| C. Ex. 1-8 | a-CF | HT-3 | 788 | 232 | 1.745 | Δ | x | — | — |
| Ex. 1-33 | a-BN | 1-1-16 | 788 | 90 | 0.682 | ○ | ○ | ○ | ○ |
| Ex. 1-34 | a-BN | 1-1-17 | 785 | 92 | 0.695 | ○ | ○ | ○ | ○ |
| C. Ex. 1-9 | a-BN | HT-3 | 785 | 203 | 1.595 | ○ | x | — | — |

It was confirmed from the table that if the type of the surface protective layer was changed, the same results as the above were obtained according to the compositions of the single-layer photosensitive layer as the base.

Specifically, it was found that all the electrophotosensitive materials of Comparative Examples 1-5 to 1-9 suffered the delamination of the surface protective layer after the continuous production of 20,000 copies. Particularly in the electrophotosensitive materials of Comparative Examples 1-7, 1-8, cracks over the whole surface protective layer were already observed at completion of the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 1-25 to 1-34 suffered no cracks nor delamination after the continuous production of 100,000 copies. It was thus confirmed that the use of the diphenylamine compound of the formula (1-1) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 1-1 to 1-34 but no surface protective layer, as well as on those of Examples 1-1 to 1-34, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

Similarly, the durability test I was conducted on electrophotosensitive materials having the same photosensitive layers as Comparative Examples 1-1 to 1-9 but no surface protective layer. The electrophotosensitive materials with the same photosensitive layer as Comparative Examples 1-1, 1-3 provided images which were decreased in image density after the production of 20,000 copies or so, whereas the other electrophotosensitive materials provided such images after the production of 30,000 to 50,000 copies. Such copies sustained white spots in solid black image areas. By comparing these results with the results of the durability test I on the corresponding comparative examples, it was found that the surface protective layers over the photosensitive layers of the comparative examples contributed no increase in the durability or rather reduce the durability.

In other words, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 1-1 to 1-34 wherein the single-layer photosensitive layers contain the diphenylamine compound of the formula (1-1) accomplish a notable increase in the durability by virtue of the formation of the surface protective layer.

Multi-Layer Electrophotosensitive Material

Example 1-35

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 $\mu$m.

The ball mill was operated for dispersing by mixing 1 part by weight of diphenylamine compound as the positive-hole transport material represented by the formula (1-1-2), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 $\mu$m. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 $\mu$m. Thus was fabricated an electrophotosensitive material of Example 1-35.

Examples 1-36 to 1-46

Electrophotosensitive materials of Examples 1-36 to 1-46 were fabricated the same way as in Example 1-35 except that each of the examples used 1 part by weight of diphenylamine compound of the formula of a number listed in the following Table 4 as the positive-hole transport material.

Comparative Example 1-10

An electrophotosensitive material of Comparative Example 1-10 was fabricated the same way as in Example 1-35, except that 2 parts by weight of polyvinylcarbazole (number-average molecular weight Mn=9,500) having the repeated unit represented by the formula (HT-1) was used instead of 1 part by weight of diphenylamine compound as the positive-hole transport material and 1 part by weight of Z-type polycarbonate as the binder resin.

Comparative Example 1-11

An electrophotosensitive material of Comparative Example 1-11 was fabricated the same way as in Example 1-35, except that 1 part by weight of diethylaminobenzaldehyde diphenylhydrazone represented by the formula (HT-3) was used as the positive-hole transport material.

Photosensitivity Test II

Each of the electrophotosensitive materials of the above examples and comparative examples was charged at −800±20V and the surface potential $V_0$(V) thereof was measured using a drum sensitivity tester available from GENTEC Co.

A bandpass filter was used to extract monochromatic light from white light from a halogen lamp as a light source of the tester, the monochromatic light having a wavelength of 780 nm and a half width of 20 nm. The surface of the above electrophotosensitive material was irradiated with the monochromatic light at a light intensity of 10 $\mu$W/cm$^2$ for 1.0 second while the half-life exposure $E_{1/2}$ ($\mu$J/cm$^2$) was determined by measuring the time elapsed before the surface potential $V_0$(V) decreased to half. On the other hand, the residual potential $V_r$(V) was determined by measuring a surface potential after a lapse of 0.5 seconds from the start of the light exposure.

Durability Test II

The electrophotosensitive materials of the above examples and comparative examples were each mounted in an electrostatic copier [commercially available from KYOCERA MITA CORPORATION as "Vi 7360"] for continuous production of 100,000 copies, during which the surface protective layer was visually observed after respective productions of 10,000 copies, 20,000 copies, 50,000 copies and 100,000 copies. The durability of each electrophotosensitive material was evaluated based on the following criteria:

○: a electrophotosensitive material having a good durability, suffering no cracks nor delamination of the surface protective layer;

Δ: a electrophotosensitive material more or less lower in durability, suffering cracks spread in the overall surface of the surface protective layer which, however, sustained no delamination; and X: a electrophotosensitive material of an unacceptable durability, suffering the delamination of the surface protective layer.

The results are listed in Table 4.

TABLE 4

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 1-35 | a-SiC | 1-1-2 | −782 | −86 | 0.577 | ○ | ○ | ○ | ○ |
| Ex. 1-36 | a-SiC | 1-1-8 | −804 | −81 | 0.608 | ○ | ○ | ○ | ○ |

TABLE 4-continued

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 1-37 | a-SiC | 1-1-12 | −812 | −78 | 0.512 | ○ | ○ | ○ | ○ |
| Ex. 1-38 | a-SiC | 1-1-16 | −804 | −67 | 0.450 | ○ | ○ | ○ | ○ |
| Ex. 1-39 | a-SiC | 1-1-17 | −790 | −71 | 0.460 | ○ | ○ | ○ | ○ |
| Ex. 1-40 | a-SiC | 1-1-18 | −809 | −76 | 0.577 | ○ | ○ | ○ | ○ |
| Ex. 1-41 | a-SiC | 1-1-21 | −809 | −73 | 0.536 | ○ | ○ | ○ | ○ |
| Ex. 1-42 | a-SiC | 1-1-22 | −780 | −80 | 0.600 | ○ | ○ | ○ | ○ |
| Ex. 1-43 | a-SiC | 1-1-25 | −814 | −90 | 0.644 | ○ | ○ | ○ | ○ |
| Ex. 1-44 | a-SiC | 1-1-27 | −806 | −101 | 0.727 | ○ | ○ | ○ | ○ |
| Ex. 1-45 | a-SiC | 1-1-29 | −790 | −94 | 0.692 | ○ | ○ | ○ | ○ |
| Ex. 1-46 | a-SiC | 1-1-30 | −798 | −94 | 0.693 | ○ | ○ | ○ | ○ |
| C.Ex.1-10 | a-SiC | HT-1 | −806 | −165 | 0.938 | ○ | x | — | — |
| C.Ex.1-11 | a-SiC | HT-3 | −814 | −147 | 1.024 | Δ | x | — | — |

It is confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, it was found that both the electrophotosensitive materials of Comparative Examples 1-10, 1-11 suffered the delamination of the surface protective layer after the continuous production of 20,000 copies. Particularly in the electrophotosensitive material of Comparative Example 1-11, cracks over the whole surface protective layer were already observed at completion of the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 1-35 to 1-46 suffered no cracks nor delamination after the continuous production of 100,000 copies. It was thus confirmed that the use of the diphenylamine compound of the formula (1-1) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 1-47 to 1-58, Comparative Examples 1-12, 1-13

Electrophotosensitive materials of these examples and comparative examples were fabricated the same way as in Examples 1-35 to 1-46 and Comparative Examples 1-10, 1-11 except that the same procedure as in Examples 1-13 to 1-24 and Comparative Examples 1-3, 1-4 was taken to form a surface protective layer of amorphous carbon (C) having a thickness of 0.5. m, instead of the silicon-carbon composite film, over a surface of the multi-layer photosensitive layer.

The electrophotosensitive materials of the above examples and comparative examples were subjected to the same photosensitivity test II and durability test II as described above and were evaluated for the characteristics thereof. The results are listed in Table 5.

TABLE 5

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 1-47 | a-C | 1-1-2 | −790 | −75 | 0.570 | ○ | ○ | ○ | ○ |
| Ex. 1-48 | a-C | 1-1-8 | −806 | −85 | 0.601 | ○ | ○ | ○ | ○ |
| Ex. 1-49 | a-C | 1-1-12 | −793 | −76 | 0.518 | ○ | ○ | ○ | ○ |
| Ex. 1-50 | a-C | 1-1-16 | −812 | −68 | 0.442 | ○ | ○ | ○ | ○ |
| Ex. 1-51 | a-C | 1-1-17 | −798 | −61 | 0.460 | ○ | ○ | ○ | ○ |
| Ex. 1-52 | a-C | 1-1-18 | −793 | −77 | 0.585 | ○ | ○ | ○ | ○ |
| Ex. 1-53 | a-C | 1-1-21 | −814 | −75 | 0.530 | ○ | ○ | ○ | ○ |
| Ex. 1-54 | a-C | 1-1-22 | −809 | −88 | 0.592 | ○ | ○ | ○ | ○ |
| Ex. 1-55 | a-C | 1-1-25 | −793 | −96 | 0.653 | ○ | ○ | ○ | ○ |
| Ex. 1-56 | a-C | 1-1-27 | −817 | −105 | 0.715 | ○ | ○ | ○ | ○ |
| Ex. 1-57 | a-C | 1-1-29 | −780 | −100 | 0.682 | ○ | ○ | ○ | ○ |
| Ex. 1-58 | a-C | 1-1-30 | −812 | −98 | 0.704 | ○ | ○ | ○ | ○ |
| C.Ex.1-12 | a-C | HT-1 | −785 | −172 | 1.216 | ○ | x | — | — |
| C.Ex.1-13 | a-C | HT-3 | −817 | −146 | 1.098 | Δ | x | — | — |

It is confirmed from the table that if the type of the surface protective layer is changed, the same results as the above are obtained according to the compositions of the charge-transport layer of the multi-layer photosensitive layer as the base.

Specifically, it was found that both the electrophotosensitive materials of Comparative Examples 1-12, 1-13 suffered the delamination of the surface protective layer after the continuous production of 20,000 copies. Particularly in the electrophotosensitive material of Comparative Example 1-13, cracks over the whole surface protective layer were already observed at completion of the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 1-47 to 1-58 suffered no cracks nor delamination after the continuous production of 100,000 copies. It was thus confirmed that the use of the diphenylamine compound of the formula (1-1) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 1-59, 1-60, Comparative Example 1-14

Electrophotosensitive materials of these examples and comparative example were fabricated the same way as in Examples 1-38, 1-39 and Comparative Example 1-11 except that the same procedure as in Examples 1-25, 1-26 and Comparative Example 1-5 was taken to form a surface protective layer of amorphous silicon-nitrogen (SiN) composite film having a thickness of 0.51 μm, instead of the silicon-carbon composite film, over the surface of the multi-layer photosensitive layer.

Examples 1-61, 1-62, Comparative Example 1-15

Electrophotosensitive materials of these examples and comparative example were fabricated the same way as in Examples 1-38, 1-39 and Comparative Example 1-11 except that the same procedure as in Examples 1-27, 1-28 and Comparative Example 1-6 was taken to form a surface protective layer of amorphous carbon-nitrogen (CN) composite film having a thickness of 0.5 μm, instead of the silicon-carbon composite film, over the surface of the multi-layer photosensitive layer.

Examples 1-63, 1-64, Comparative Example 1-16

Electrophotosensitive materials of these examples and comparative example were fabricated the same way as in Examples 1-38, 1-39 and Comparative Example 1-11 except that the same procedure as in Examples 1-29, 1-30 and Comparative Example 1-7 was taken to form a surface protective layer of amorphous carbon-boron (CB) composite film having a thickness of 0.5 μm, instead of the silicon-carbon composite film, over the surface of the multi-layer photosensitive layer.

Examples 1-65, 1-66, Comparative Example 1-17

Electrophotosensitive materials of these examples and comparative example were fabricated the same way as in Examples 1-38, 1-39 and Comparative Example 1-11 except that the same procedure as in Examples 1-31, 1-32 and Comparative Example 1-8 was taken to form a surface protective layer of amorphous carbon-fluorine (CF) composite film having a thickness of 0.5 μm, instead of the silicon-carbon composite film, over the surface of the multi-layer photosensitive layer.

Examples 1-67, 1-68, Comparative Example 1-18

Electrophotosensitive materials of these examples and comparative example were fabricated the same way as in Examples 1-38, 1-39 and Comparative Example 1-1 except that the same procedure as in Examples 1-33, 1-34 and Comparative Example 1-9 was taken to form a surface protective layer of amorphous boron-nitrogen (BN) composite film having a thickness of 0.5 μm, instead of the silicon-carbon composite film, over the surface of the multi-layer photosensitive layer.

The electrophotosensitive materials of the above examples and comparative examples were subjected to the same photosensitivity test II and durability test II as the above and were evaluated for the characteristics thereof. The results are listed in Table 6.

TABLE 6

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 1-59 | a-SiN | 1-1-16 | −788 | −70 | 0.495 | ○ | ○ | ○ | ○ |
| Ex. 1-60 | a-SiN | 1-1-17 | −793 | −63 | 0.479 | ○ | ○ | ○ | ○ |
| C.Ex.1-14 | a-SiN | HT-3 | −785 | −156 | 1.095 | ○ | x | — | — |
| Ex. 1-61 | a-CN | 1-1-16 | −801 | −76 | 0.501 | ○ | ○ | ○ | ○ |
| Ex. 1-62 | a-CN | 1-1-17 | −804 | −75 | 0.511 | ○ | ○ | ○ | ○ |
| C.Ex.1-15 | a-CN | HT-3 | −793 | −153 | 1.154 | Δ | x | — | — |
| Ex. 1-63 | a-CB | 1-1-16 | −798 | −66 | 0.425 | ○ | ○ | ○ | ○ |
| Ex. 1-64 | a-CB | 1-1-17 | −806 | −60 | 0.437 | ○ | ○ | ○ | ○ |
| C.Ex.1-16 | a-CB | HT-3 | −793 | −137 | 0.979 | Δ | x | — | — |
| Ex. 1-65 | a-CF | 1-1-16 | −790 | −70 | 0.455 | ○ | ○ | ○ | ○ |

TABLE 6-continued

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 1-66 | a-CF | 1-1-17 | −782 | −65 | 0.437 | ○ | ○ | ○ | ○ |
| C.Ex.1-17 | a-CF | HT-3 | −793 | −141 | 1.020 | Δ | x | — | — |
| Ex. 1-67 | a-BN | 1-1-16 | −790 | −54 | 0.406 | ○ | ○ | ○ | ○ |
| Ex. 1-68 | a-BN | 1-1-17 | −806 | −57 | 0.414 | ○ | ○ | ○ | ○ |
| C.Ex.1-18 | a-BN | HT-3 | −780 | −122 | 0.903 | ○ | x | — | — |

It was confirmed from the table that if the type of the surface protective layer is changed, the same results as the above are obtained according to the compositions of the charge-transport layer of the multi-layer photosensitive layer as the base.

Specifically, it was found that both the electrophotosensitive materials of Comparative Examples 1-14 to 1-18 suffered the delamination of the surface protective layer after the continuous production of 20,000 copies. Particularly in the electrophotosensitive material of Comparative Examples 1-15 to 1-17, cracks over the whole surface protective layer were already observed at completion of the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 1-59 to 1-68 suffered no cracks nor delamination after the continuous production of 100,000 copies. It was thus confirmed that the use of the diphenylamine compound of the formula (1-1) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 1-35 to 1-68 but no surface protective layer, as well as on those of Examples 1-35 to 1-68, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

Similarly, the durability test II was conducted on electrophotosensitive materials having the same photosensitive layers as Comparative Examples 1-10 to 1-18 but no surface protective layer. The electrophotosensitive materials with the same photosensitive layers as Comparative Examples 1-10, 1-12 provided images which were decreased in image density after the production of 20,000 copies whereas the other electrophotosensitive materials provided such images after the production of 30,000 to 50,000 copies. Such copies sustained white spots in solid black image areas. By comparing these results with the results of the durability test II on the corresponding comparative examples, it is found that the surface protective layers over the photosensitive layers of the comparative examples contribute no increase in the durability or rather reduce the durability.

In other words, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layers, the electrophotosensitive materials of Examples 1-35 to 1-68 wherein the multi-layer photosensitive layers contain the diphenylamine compound of the formula (1-1) accomplish a notable increase in the durability by virtue of the formation of the surface protective layer.

Single-Layer Electrophotosensitive Material

Example 2-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-2-2); 80 parts by weight of 2,6-dimethyl-2',6'-t-butylbenzoquinone; and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 $\mu$m.

Forming Surface Protective Layer

The plasma CVD process was performed under the same conditions as in Example 1-1, thereby forming a surface protective layer of amorphous silicon-carbon (SiC) composite film having a thickness of 0.5 m over the surface of the single-layer photosensitive layer. Thus was fabricated an electrophotosensitive material of Example 2-1.

Examples 2-2 to 2-4

Electrophotosensitive materials of Examples 2-2 to 2-4 were fabricated the same way as in Example 2-1 except that each of the examples used 100 parts by weight of diphenylamine compound of the formula of a number listed in the following Table 7 as the positive-hole transport material.

Comparative Example 2-1

An electrophotosensitive material of Comparative Example 2-1 was fabricated the same way as in Example 2-1, except that 200 parts by weight of polyvinylcarbazole (number-average molecular weight Mn=9,500) was used instead of 100 parts by weight of diphenylamine compound and 100 parts by weight of Z-type polycarbonate, the polyvinylcarbazole serving not only as the positive-hole transport material but also as the binder resin and having the repeated unit represented by the formula (HT-1).

Comparative Example 2-2

An electrophotosensitive material of Comparative Example 2-2 was fabricated the same way as in Example 2-1, except that 100 parts by weight of diethylaminobenzaldehyde diphenylhydrazone represented by the formula (HT-3) was used as the positive-hole transport material.

The electrophotosensitive materials of the examples and comparative examples were subjected to the same photosensitivity test I and durability test I as the above and were evaluated for the characteristics thereof. The results are listed in Table 7.

TABLE 7

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 2-1 | a-SiC | 1-2-2 | ET-1 | 780 | 83 | 0.611 | ○ | ○ | ○ | ○ | ○ |
| Ex. 2-2 | a-SiC | 1-2-4 | ET-1 | 806 | 82 | 0.551 | ○ | ○ | ○ | ○ | ○ |
| Ex. 2-3 | a-SiC | 1-2-13 | ET-1 | 801 | 83 | 0.574 | ○ | ○ | ○ | ○ | ○ |
| Ex. 2-4 | a-SiC | 1-2-18 | ET-1 | 798 | 81 | 0.599 | ○ | ○ | ○ | ○ | ○ |
| C. Ex. 2-1 | a-SiC | HT-1 | ET-1 | 814 | 154 | 1.112 | ○ | Δ | x | — | — |
| C. Ex. 2-2 | a-SiC | HT-3 | ET-1 | 780 | 180 | 1.226 | ○ | x | — | — | — |

ETM: Electron Transport Material

It was confirmed from the table that the electrophotosensitive materials of Comparative Examples 2-1, 2-2 suffered the delamination of the surface protective layer after the continuous productions of 30,000 copies and 20,000 copies, respectively. This indicates that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 2-1 to 2-4 suffered no cracks nor delamination after the continuous production of 100,000 copies. It was thus confirmed that the use of the diphenylamine compound of the formula (1-2) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 2-5 to 2-8, Comparative Examples 2-3, 2-4

Electrophotosensitive materials of Examples 2-5 to 2-8 and Comparative Examples 2-3, 2-4 were fabricated the same way as in Examples 2-1 to 2-4 and Comparative Examples 2-1, 2-2 except that the same procedure as in Examples 1-13 to 1-24 and Comparative Examples 1-3, 1-4 was taken to form a surface protective layer of amorphous carbon (C) having a thickness of 0.5 $\mu$m, instead of the silicon-carbon composite film over the surface of the single-layer photosensitive layer.

The electrophotosensitive materials of these examples and comparative examples were subjected to the same photosensitivity test I and durability test I as the above and were evaluated for the characteristics thereof. The results are listed in Table 8.

TABLE 8

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 2-5 | a-C | 1-2-2 | ET-1 | 798 | 88 | 0.f47 | ○ | ○ | ○ | ○ | ○ |
| Ex. 2-6 | a-C | 1-2-4 | ET-1 | 782 | 81 | 0.579 | ○ | ○ | ○ | ○ | ○ |
| Ex. 2-7 | a-C | 1-2-13 | ET-1 | 804 | 85 | 0.612 | ○ | ○ | ○ | ○ | ○ |
| Ex. 2-8 | a-C | 1-2-18 | ET-1 | 788 | 85 | 0.626 | ○ | ○ | ○ | ○ | ○ |
| C. Ex. 2-3 | a-C | HT-1 | ET-1 | 788 | 157 | 1.150 | ○ | Δ | x | — | — |
| C. Ex. 2-4 | a-C | HT-3 | ET-1 | 809 | 167 | 1.218 | ○ | Δ | x | — | — |

It was confirmed from the table that if the type of the surface protective layer is changed, the same results as the above are obtained according to the compositions of the single-layer photosensitive layer as the base.

Specifically, cracks over the whole surface protective layer were already observed in both the electrophotosensitive materials of Comparative Examples 2-3, 2-4 after the continuous production of 20,000 copies. These electrophotosensitive materials suffered the delamination of the surface protective layer after the continuous production of 30,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 2-5 to 2-8 suffered no cracks nor delamination after the continuous production of 100,000 copies. It was thus confirmed that the use of the diphenylamine compound of the formula (1-2) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 2-9, 2-10, Comparative Example 2-5

Electrophotosensitive materials of Examples 2-9, 2-10 and Comparative Example 2-5 were fabricated the same way as in Examples 2-2 to 2-3 and Comparative Examples 2-2 except that the same procedure as in Examples 1-25, 1-26 and Comparative Examples 1-5 was taken to form a surface protective layer of amorphous silicon-nitrogen (SiN) composite film having a thickness of 0.5 μm, instead of the silicon-carbon composite film, over the surface of the single-layer photosensitive layer.

Examples 2-11, 2-12, Comparative Example 2-6

Electrophotosensitive materials of Examples 2-11, 2-12 and Comparative Example 2-6 were fabricated the same way as in Examples 2-2 to 2-3 and Comparative Examples 2-2 except that the same procedure as in Examples 1-27, 1-28 and Comparative Examples 1-6 was taken to form a surface protective layer of amorphous carbon-nitrogen (CN) composite film having a thickness of 0.5 μm, instead of the silicon-carbon composite film, over the surface of the single-layer photosensitive layer.

Examples 2-13, 2-14, Comparative Example 2-7

Electrophotosensitive materials of Examples 2-13, 2-14 and Comparative Example 2-7 were fabricated the same way as in Examples 2-2, 2-3 and Comparative Example 2-2 except that the same procedure as in Examples 1-29, 1-30 and Comparative Examples 1-7 was taken to form a surface protective layer of amorphous carbon-boron (CB) composite film having a thickness of 0.5 μm, instead of the silicon-carbon composite film, over the surface of the single-layer photosensitive layer.

Examples 2-15, 2-16, Comparative Example 2-8

Electrophotosensitive materials of Examples 2-15, 2-16 and Comparative Example 2-8 were fabricated the same way as in Examples 2-2, 2-3 and Comparative Example 2-2 except that the same procedure as in Examples 1-31, 1-32 and Comparative Examples 1-8 was taken to form a surface protective layer of amorphous carbon-fluorine (CF) composite film having a thickness of 0.5 μm, instead of the silicon-carbon composite film, over the surface of the single-layer photosensitive layer.

Examples 2-17, 2-18, Comparative Example 2-9

Electrophotosensitive materials of Examples 2-17, 2-18 and Comparative Example 2-9 were fabricated the same way as in Examples 2-2, 2-3 and Comparative Example 2-2 except that the same procedure as in Examples 1-33, 1-34 and Comparative Examples 1-9 was taken to form a surface protective layer of amorphous boron-nitrogen (BN) composite film having a thickness of 0.5 μm, instead of the silicon-carbon composite film, over the surface of the single-layer photosensitive layer.

The electrophotosensitive materials of these examples and comparative examples were subjected to the same photosensitivity test I and durability test I as the above and were evaluated for the characteristics thereof. The results are listed in Table 9.

TABLE 9

| | | | | | | | Durability Test | | | | |
|---|---|---|---|---|---|---|---|---|---|---|---|
| | SPL | P-H TM | ETM | SP $V_0$(V) | RP Vr(V) | HLE $E_{1/2}$(μJ/cm²) | 10,000 copies | 20,000 copies | 30,000 copies | 50,000 copies | 100,000 copies |
| Ex. 2-9 | a-SiN | 1-2-4 | ET-1 | 796 | 98 | 0.648 | ○ | ○ | ○ | ○ | ○ |
| Ex. 2-10 | a-SiN | 1-2-13 | ET-1 | 782 | 97 | 0.663 | ○ | ○ | ○ | ○ | ○ |
| C. Ex. 2-5 | a-SiN | HT-3 | ET-1 | 798 | 187 | 1.334 | ○ | Δ | x | — | — |
| Ex. 2-11 | a-CN | 1-2-4 | ET-1 | 814 | 86 | 0.562 | ○ | ○ | ○ | ○ | ○ |
| Ex. 2-12 | a-CN | 1-2-13 | ET-1 | 809 | 88 | 0.579 | ○ | ○ | ○ | ○ | ○ |
| C. Ex. 2-6 | a-CN | HT-3 | ET-1 | 801 | 194 | 1.389 | ○ | Δ | x | — | — |
| Ex. 2-13 | a-CB | 1-2-4 | ET-1 | 782 | 76 | 0.562 | ○ | ○ | ○ | ○ | ○ |
| Ex. 2-14 | a-CB | 1-2-13 | ET-1 | 817 | 86 | 0.580 | ○ | ○ | ○ | ○ | ○ |
| C. Ex. 2-7 | a-CB | HT-3 | ET-1 | 798 | 166 | 1.235 | ○ | x | — | — | — |
| Ex. 2-15 | a-CF | 1-2-4 | ET-1 | 806 | 79 | 0.561 | ○ | ○ | ○ | ○ | ○ |
| Ex. 2-16 | a-CF | 1-2-13 | ET-1 | 785 | 78 | 0.580 | ○ | ○ | ○ | ○ | ○ |

TABLE 9-continued

| | SPL | P-HTM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| C. Ex. 2-8 | a-CF | HT-3 | ET-1 | 782 | 180 | 1.284 | Δ | x | — | — | — |
| Ex. 2-17 | a-BN | 1-2-4 | ET-1 | 814 | 79 | 0.562 | ○ | ○ | ○ | ○ | ○ |
| Ex. 2-18 | a-BN | 1-2-13 | ET-1 | 801 | 86 | 0.579 | ○ | ○ | ○ | ○ | ○ |
| C. Ex. 2-9 | a-BN | HT-3 | ET-1 | 788 | 155 | 1.165 | ○ | Δ | x | — | — |

It was confirmed from the table that if the type of the surface protective layer is changed, the same results as the above are obtained according to the compositions of the single-layer photosensitive layer as the base.

Specifically, it was found that the electrophotosensitive materials of Comparative Examples 2-7, 2-8 suffered the delamination of the surface protective layer after the continuous production of 20,000 copies whereas those of Comparative Examples 2-5, 2-6, 2-9 suffered the delamination of the surface protective layer after the continuous production of 30,000 copies. Particularly in the electrophotosensitive material of Comparative Example 2-8, cracks over the whole surface protective layer were already observed after the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 2-9 to 2-18 suffered no cracks nor delamination after the continuous production of 100,000 copies. It was thus confirmed that the use of the diphenylamine compound of the formula (1-2) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 2-1 to 2-18 but no surface protective layer, as well as on those of Examples 2-1 to 2-18, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

Similarly, the durability test I was conducted on electrophotosensitive materials having the same photosensitive layers as Comparative Examples 2-1 to 2-9 but no surface protective layer. The electrophotosensitive materials with the same photosensitive layers as Comparative Examples 2-1, 2-3 provided images which were decreased in image density after the production of 20,000 copies or so, whereas the other electrophotosensitive materials provided such images after the production of 30,000 to 50,000 copies. Such copies sustained white spots in solid black image areas. By comparing these results with the results of the durability test I on the corresponding comparative examples, it is found that the surface protective layers over the photosensitive layers of the comparative examples contribute no increase in the durability or rather reduce the durability.

In other words, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 2-1 to 2-18 wherein the single-layer photosensitive layers contain the diphenylamine compound of the formula (1-2) accomplish a notable increase in the durability by virtue of the formation of the surface protective layer.

Multi-Layer Electrophotosensitive Material

Example 2-19

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 $\mu$m.

The ball mill was operated for dispersing by mixing 0.8 parts by weight of diphenylamine compound as the positive-hole transport material represented by the formula (1-2-2), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 $\mu$m. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 μm. Thus was fabricated an electrophotosensitive material of Example 2-19.

Examples 2-20 to 2-22

Electrophotosensitive materials of Examples 2-20 to 2-22 were fabricated the same way as in Example 2-19 except that each of the examples used 0.8 parts by weight of diphenylamine compound of the formula of a number listed in the following Table 10 as the positive-hole transport material.

Comparative Example 2-10

An electrophotosensitive material of Comparative Example 2-10 was fabricated the same way as in Example 2-19, except that 1 part by weight of polyvinylcarbazole (number-average molecular weight Mn=9,500) having the repeated unit represented by the formula (HT-1) was used instead of 0.8 parts by weight of diphenylamine compound as the positive-hole transport material and 1 part by weight of Z-type polycarbonate as the binder resin.

Comparative Example 2-11

An electrophotosensitive material of Comparative Example 2-11 was fabricated the same way as in Example 2-19, except that 0.8 parts by weight of diethylaminobenzaldehyde diphenylhydrazone represented by the formula (HT-3) was used as the positive-hole transport material.

The electrophotosensitive materials of the examples and comparative examples were subjected to the same photosensitivity test II and durability test II as the above and were evaluated for the characteristics thereof. The results are listed in Table 10.

TABLE 10

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 2-19 | a-SiC | 1-2-2 | −788 | −55 | 0.799 | ○ | ○ | ○ | ○ |
| Ex. 2-20 | a-SiC | 1-2-4 | −780 | −48 | 0.762 | ○ | ○ | ○ | ○ |
| Ex. 2-21 | a-SiC | 1-2-13 | −809 | −59 | 0.842 | ○ | ○ | ○ | ○ |
| Ex. 2-22 | a-SiC | 1-2-18 | −812 | −53 | 0.833 | ○ | ○ | ○ | ○ |
| CEx. 2-10 | a-SiC | HT-1 | −806 | −165 | 0.938 | ○ | x | — | — |
| CEx. 2-11 | a-SiC | HT-3 | −814 | −147 | 1.024 | ○ | x | — | — |

It was confirmed from the table that if the single-layer photosensitive layer is replaced by the multi-layer photosensitive layer, the same results as the above are obtained according to the compositions of the charge-transport layer defining the outermost portion of the electrophotosensitive material.

Specifically, it was found that both the electrophotosensitive materials of Comparative Examples 2-10, 2-11 suffered the delamination of the surface protective layer after the continuous production of 20,000 copies. This indicates that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 2-19 to 2-22 suffered no cracks nor delamination after the continuous production of 100,000 copies. It was thus confirmed that the use of the diphenylamine compound of the formula (1-2) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 2-23 to 2-26, Comparative Examples 2-12, 2-13

Electrophotosensitive materials of Examples 2-23 to 2-26 and Comparative Examples 2-12, 2-13 were fabricated the same way as in Examples 2-19 to 2-22 and Comparative Examples 2-10, 2-11 except that the same procedure as in Examples 1-13 to 1-24 and Comparative Examples 1-3, 1-4 was taken to form a surface protective layer of amorphous carbon (C) having a thickness of 0.5 μm, instead of the silicon-carbon composite film, over the surface of the multi-layer photosensitive layer.

The electrophotosensitive materials of these examples and comparative examples were subjected to the same photosensitivity test II and durability test II as the above and were evaluated for the characteristics thereof. The results are listed in Table 11.

TABLE 11

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 2-23 | a-C | 1-2-2 | −790 | −50 | 0.800 | ○ | ○ | ○ | ○ |
| Ex. 2-24 | a-C | 1-2-4 | −804 | −53 | 0.761 | ○ | ○ | ○ | ○ |

TABLE 11-continued

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 2-25 | a-C | 1-2-13 | −809 | −56 | 0.842 | ○ | ○ | ○ | ○ |
| Ex. 2-26 | a-C | 1-2-18 | −796 | −53 | 0.833 | ○ | ○ | ○ | ○ |
| CEx. 2-12 | a-C | HT-1 | −785 | −172 | 1.216 | ○ | x | — | — |
| CEx. 2-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, it was found that both the electrophotosensitive materials of Comparative Examples 2-12, 2-13 suffered the delamination of the surface protective layer after the continuous production of 20,000 copies. Particularly in the electrophotosensitive material of Comparative Example 2-13, cracks over the whole surface protective layer were already observed after the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 2-23 to 2-26 suffered no cracks nor delamination after the continuous production of 100,000 copies. It was thus confirmed that the use of the diphenylamine compound of the formula (1-2) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 2-27, 2-28, Comparative Example 2-14

Electrophotosensitive materials of Examples 2-27, 2-28 and Comparative Example 2-14 were fabricated the same way as in Examples 2-20, 2-21 and Comparative Example 2-11 except that the same procedure as in Examples 1-25, 1-26 and Comparative Examples 1-5 was taken to form a surface protective layer of amorphous silicon-nitrogen (SiN) composite film having a thickness of 0.5 $\mu$m, instead of the silicon-carbon composite film, over the surface of the multi-layer photosensitive layer.

Examples 2-29, 2-30, Comparative Example 2-15

Electrophotosensitive materials of Examples 2-29, 2-30 and Comparative Example 2-15 were fabricated the same way as in Examples 2-20, 2-21 and Comparative Example 2-11 except that the same procedure as in Examples 1-27, 1-28 and Comparative Examples 1-6 was taken to form a surface protective layer of amorphous carbon-nitrogen (CN) composite film having a thickness of 0.5 $\mu$m, instead of the silicon-carbon composite film, over the surface of the multi-layer photosensitive layer.

Examples 2-31, 2-32, Comparative Example 2-16

Electrophotosensitive materials of Examples 2-31, 2-32 and Comparative Example 2-16 were fabricated the same way as in Examples 2-20, 2-21 and Comparative Example 2-11 except that the same procedure as in Examples 1-29, 1-30 and Comparative Example 1-7 was taken to form a surface protective layer of amorphous carbon-boron (CB) composite film having a thickness of 0.5 $\mu$m, instead of the silicon-carbon composite film, over the surface of the multi-layer photosensitive layer.

Examples 2-33, 2-34, Comparative Example 2-17

Electrophotosensitive materials of Examples 2-33, 2-34 and Comparative Example 2-17 were fabricated the same way as in Examples 2-20, 2-21 and Comparative Example 2-11 except that the same procedure as in Examples 1-31, 1-32 and Comparative Examples 1-8 was taken to form a surface protective layer of amorphous carbon-fluorine (CF) composite film having a thickness of 0.5.m, instead of the silicon-carbon composite film, over the surface of the multi-layer photosensitive layer.

Examples 2-35, 2-36, Comparative Example 2-18

Electrophotosensitive materials of Examples 2-35, 2-36 and Comparative Example 2-18 were fabricated the same way as in Examples 2-20, 2-21 and Comparative Example 2-11 except that the same procedure as in Examples 1-33, 1-34 and Comparative Example 1-9 was taken to form a surface protective layer of amorphous boron-nitrogen (BN) composite film having a thickness of 0.5 $\mu$m, instead of the silicon-carbon composite film, over the surface of the multi-layer photosensitive layer.

The electrophotosensitive materials of these examples and comparative examples were subjected to the same photosensitivity test II and durability test II as the above and were evaluated for the characteristics thereof. The results are listed in Table 12.

TABLE 12

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 2-27 | a-SiN | 1-2-4 | −809 | −55 | 0.800 | ○ | ○ | ○ | ○ |
| Ex. 2-28 | a-SiN | 1-2-13 | −814 | −58 | 0.761 | ○ | ○ | ○ | ○ |
| C.Ex.2-14 | a-SiN | HT-3 | −785 | −149 | 1.095 | ○ | x | — | — |
| Ex. 2-29 | a-CN | 1-2-4 | −801 | −50 | 0.800 | ○ | ○ | ○ | ○ |
| Ex. 2-30 | a-CN | 1-2-13 | −801 | −53 | 0.761 | ○ | ○ | ○ | ○ |
| C.Ex.2-15 | a-CN | HT-3 | −793 | −148 | 1.155 | Δ | x | — | — |
| Ex. 2-31 | a-CB | 1-2-4 | −790 | −58 | 0.800 | ○ | ○ | ○ | ○ |
| Ex. 2-32 | a-CB | 1-2-13 | −798 | −55 | 0.761 | ○ | ○ | ○ | ○ |
| C.Ex.2-16 | a-CB | HT-3 | −793 | −137 | 0.979 | Δ | x | — | — |
| Ex. 2-33 | a-CF | 1-2-4 | −780 | −60 | 0.799 | ○ | ○ | ○ | ○ |
| Ex. 2-34 | a-CF | 1-2-13 | −790 | −48 | 0.761 | ○ | ○ | ○ | ○ |
| C.Ex.2-17 | a-CF | HT-3 | −793 | −139 | 1.021 | Δ | x | — | — |
| Ex. 2-35 | a-BN | 1-2-4 | −790 | −60 | 0.799 | ○ | ○ | ○ | ○ |
| Ex. 2-36 | a-BN | 1-2-13 | −780 | −55 | 0.761 | ○ | ○ | ○ | ○ |
| C.Ex.2-18 | a-BN | HT-3 | −780 | −117 | 0.904 | ○ | x | — | — |

It was confirmed from the table that if the type of the surface protective layer is further changed, the same results as the above are obtained according to the compositions of the charge transport layer of the multi-layer photosensitive layer as the base.

Specifically, it was found that all the electrophotosensitive materials of Comparative Examples 2-14 to 2-18 suffered the delamination of the surface protective layer after the continuous production of 20,000 copies. Particularly in the electrophotosensitive materials of Comparative Examples 2-15 to 2-17, cracks over the whole surface protective layer were already observed after the continuous production of 10,000 copies. These indicate that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 2-27 to 2-36 suffered no cracks nor delamination after the continuous production of 100,000 copies. It was thus confirmed that the use of the diphenylamine compound of the formula (1-2) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 2-19 to 2-36 but no surface protective layer, as well as on those of Examples 2-19 to 2-36, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

Similarly, the durability test II was conducted on electrophotosensitive materials having the same photosensitive layers as Comparative Examples 2-10 to 2-18 but no surface protective layer. The electrophotosensitive materials with the same photosensitive layers as Comparative Examples 2-10, 2-13 provided images which were decreased in image density after the production of 20,000 copies or so, whereas the other electrophotosensitive materials provided such images after the production of 30,000 to 50,000 copies. Such copies sustained white spots in solid black image areas. By comparing these results with the results of the durability test II on the corresponding comparative examples, it is found that the surface protective layers over the photosensitive layers of the comparative examples contribute no increase in the durability or rather reduce the durability.

In other words, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layer, the electrophotosensitive materials of Examples 2-19 to 2-36 wherein the multi-layer photosensitive layers contain the diphenylamine compound of the formula (1-2) accomplish a notable increase in the durability by virtue of the formation of the surface protective layer.

Single-Layer Electrophotosensitive Material

Example 3-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-3-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 μm.

Forming Surface Protective Layer

The plasma CVD process was performed under the same conditions as in Example 1-1, thereby forming a surface protective layer of amorphous silicon-carbon (SiC) composite film having a thickness of 0.5 μm over the surface of the single-layer photosensitive layer. Thus was fabricated an electrophotosensitive material of Example 3-1.

Examples 3-2 to 3-11

Electrophotosensitive materials of Examples 3-2 to 3-11 were fabricated the same way as in Example 3-1 except that each of the examples used 100 parts by weight of diphenylamine compound of the formula of a number listed in the following Table 13 as the positive-hole transport material.

The electrophotosensitive materials of the above examples were subjected to the same photosensitivity test I and durability test I as the above and were evaluated for the characteristics thereof. The results, along with the aforementioned results of Comparative Examples 1-1, 1-2, are listed in Table 13.

TABLE 13

| | SPL | P-H TM | SP $V_0$(V) | RP Vr(V) | HLE $E_{1/2}$(μJ/cm²) | Durability Test 10,000 copies | 20,000 copies | 50,000 copies | 100,000 copies |
|---|---|---|---|---|---|---|---|---|---|
| Ex. 3-1 | a-SiC | 1-3-1 | 817 | 157 | 1.001 | ○ | ○ | ○ | ○ |
| Ex. 3-2 | a-SiC | 1-3-2 | 804 | 146 | 0.909 | ○ | ○ | ○ | ○ |
| Ex. 3-3 | a-SiC | 1-3-4 | 780 | 155 | 1.021 | ○ | ○ | ○ | ○ |
| Ex. 3-4 | a-SiC | 1-3-5 | 817 | 159 | 1.010 | ○ | ○ | ○ | ○ |
| Ex. 3-5 | a-SiC | 1-3-11 | 782 | 153 | 1.021 | ○ | ○ | ○ | ○ |
| Ex. 3-6 | a-SiC | 1-3-12 | 796 | 167 | 1.053 | ○ | ○ | ○ | ○ |
| Ex. 3-7 | a-SiC | 1-3-17 | 788 | 151 | 1.011 | ○ | ○ | ○ | ○ |
| Ex. 3-8 | a-SiC | 1-3-20 | 817 | 192 | 1.235 | ○ | ○ | ○ | ○ |
| Ex. 3-9 | a-SiC | 1-3-23 | 806 | 188 | 1.205 | ○ | ○ | ○ | ○ |
| Ex. 3-10 | a-SiC | 1-3-25 | 812 | 158 | 1.021 | ○ | ○ | ○ | ○ |
| Ex. 3-11 | a-SiC | 1-3-26 | 793 | 158 | 1.042 | ○ | ○ | ○ | ○ |
| C.Ex.1-1 | a-SiC | HT-1 | 817 | 205 | 1.500 | ○ | x | — | — |
| C.Ex.1-2 | a-SiC | HT-3 | 804 | 232 | 1.667 | ○ | x | — | — |

As shown in the table, all the electrophotosensitive materials of Examples 3-1 to 3-11 suffered no cracks nor delamination after the continuous production of 100,000 copies. It was thus confirmed that the use of the diphenylamine compound of the formula (1-3) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 3-12 to 3-22

Electrophotosensitive materials of Examples 3-12 to 3-22 were fabricated the same way as in Examples 3-1 to 3-11 except that the same procedure as in Examples 1-33 to 1-24 and Comparative Examples 1-3, 1-4 was taken to form a surface protective layer of amorphous carbon (C) having a thickness of 0.5 μm, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 1-3, 1-4, are listed in Table 14.

TABLE 14

| | SPL | P-H TM | SP $V_0$(V) | RP Vr(V) | HLE $E_{1/2}$(μJ/cm²) | Durability Test 10,000 copies | 20,000 copies | 50,000 copies | 100,000 copies |
|---|---|---|---|---|---|---|---|---|---|
| Ex. 3-12 | a-C | 1-3-1 | 785 | 151. | 0.991 | ○ | ○ | ○ | ○ |
| Ex. 3-13 | a-C | 1-3-2 | 785 | 138 | 0.927 | ○ | ○ | ○ | ○ |
| Ex. 3-14 | a-C | 1-3-4 | 817 | 161 | 1.011 | ○ | ○ | ○ | ○ |
| Ex. 3-15 | a-C | 1-3-5 | 796 | 157 | 1.000 | ○ | ○ | ○ | ○ |
| Ex. 3-16 | a-C | 1-3-11 | 801 | 162 | 1.031 | ○ | ○ | ○ | ○ |
| Ex. 3-17 | a-C | 1-3-12 | 785 | 167 | 1.064 | ○ | ○ | ○ | ○ |
| Ex. 3-18 | a-C | 1-3-17 | 793 | 163 | 1.021 | ○ | ○ | ○ | ○ |
| Ex. 3-19 | a-C | 1-3-20 | 801 | 187 | 1.220 | ○ | ○ | ○ | ○ |
| Ex. 3-20 | a-C | 1-3-23 | 788 | 182 | 1.220 | ○ | ○ | ○ | ○ |
| Ex. 3-21 | a-C | 1-3-25 | 806 | 164 | 1.032 | ○ | ○ | ○ | ○ |
| Ex. 3-22 | a-C | 1-3-26 | 788 | 167 | 1.053 | ○ | ○ | ○ | ○ |
| C.Ex.1-3 | a-C | HT-1 | 793 | 208 | 1.563 | ○ | x | — | — |
| C.Ex.1-4 | a-C | HT-3 | 788 | 222 | 1.667 | Δ | x | — | — |

It was confirmed from the table that if the type of the surface protective layer is changed, the same results as the above are obtained according to the compositions of the single-layer photosensitive layer as the base.

Specifically, all the electrophotosensitive materials of Examples 3-12 to 3-22 suffered no cracks nor delamination after the continuous production of 100,000 copies. It was thus confirmed that the use of the diphenylamine compound of the formula (1-3) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 3-23 to 3-25

Electrophotosensitive materials of Examples 3-23, 3-24 and 3-25 were fabricated the same way as in Examples 3-1, 3-8, 3-10 except that the same procedure as in Examples 1-25, 1-26 and Comparative Example 1-5 was taken to form a surface protective layer of amorphous silicon-nitrogen (SiN) composite film having a thickness of 0.5 μm, instead of the silicon-carbon composite film, over the surface of the single-layer photosensitive layer.

Examples 3-26 to 3-28

Electrophotosensitive materials of Examples 3-26, 3-27 and 3-28 were fabricated the same way as in Examples 3-1, 3-8, 3-10 except that the same procedure as in Examples 1-27, 1-28 and Comparative Example 1-6 was taken to form a surface protective layer of amorphous carbon-nitrogen (CN) composite film having a thickness of 0.5 μm, instead of the silicon-carbon composite film, over the surface of the single-layer photosensitive layer.

Examples 3-29 to 3-31

Electrophotosensitive materials of Examples 3-29, 3-30 and 3-31 were fabricated the same way as in Examples 3-1, 3-8, 3-10 except that the same procedure as in Examples 1-29, 1-30 and Comparative Example 1-7 was taken to form a surface protective layer of amorphous carbon-boron (CB) composite film having a thickness of 0.5 μm, instead of the silicon-carbon composite film, over the surface of the single-layer photosensitive layer.

Examples 3-32 to 3-34

Electrophotosensitive materials of Examples 3-32, 3-33 and 3-34 were fabricated the same way as in Examples 3-1, 3-8, 3-10 except that the same procedure as in Examples 1-31, 1-32 and Comparative Example 1-8 was taken to form a surface protective layer of amorphous carbon-fluorine (CF) composite film having a thickness of 0.5 μm, instead of the silicon-carbon composite film, over the surface of the single-layer photosensitive layer.

Examples 3-35 to 3-37

Electrophotosensitive materials of Examples 3-35, 3-36 and 3-37 were fabricated the same way as in Examples 3-1, 3-8, 3-10 except that the same procedure as in Examples 1-33, 1-34 and Comparative Example 1-9 was taken to form a surface protective layer of amorphous boron-nitrogen (BN) composite film having a thickness of 0.5 μm, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 1-5 to 1-9, are listed in Table 15.

TABLE 15

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 3-23 | a-SiN | 1-3-1 | 782 | 165 | 1.053 | ○ | ○ | ○ | ○ |
| Ex. 3-24 | a-SiN | 1-3-20 | 785 | 192 | 1.282 | ○ | ○ | ○ | ○ |
| Ex. 3-25 | a-SiN | 1-3-25 | 801 | 173 | 1.087 | ○ | ○ | ○ | ○ |
| C.Ex.1-5 | a-SiN | HT-3 | 812 | 245 | 1.787 | ○ | x | — | — |
| Ex. 3-26 | a-CN | 1-3-1 | 785 | 156 | 1.042 | ○ | ○ | ○ | ○ |
| Ex. 3-27 | a-CN | 1-3-20 | 790 | 195 | 1.250 | ○ | ○ | ○ | ○ |
| Ex. 3-28 | a-CN | 1-3-25 | 809 | 171 | 1.112 | ○ | ○ | ○ | ○ |
| C.Ex.1-6 | a-CN | HT-3 | 790 | 252 | 1.875 | ○ | x | — | — |
| Ex. 3-29 | a-CB | 1-3-1 | 804 | 150 | 1.001 | ○ | ○ | ○ | ○ |
| Ex. 3-30 | a-CB | 1-3-20 | 785 | 183 | 1.205 | ○ | ○ | ○ | ○ |
| Ex. 3-31 | a-CB | 1-3-25 | 806 | 151 | 0.991 | ○ | ○ | ○ | |
| C.Ex.1-7 | a-CB | HT-3 | 801 | 222 | 1.667 | Δ | x | — | — |
| Ex. 3-32 | a-CF | 1-3-1 | 782 | 164 | 1.065 | ○ | ○ | ○ | ○ |
| Ex. 3-33 | a-CF | 1-3-20 | 790 | 189 | 1.266 | ○ | ○ | ○ | ○ |
| Ex. 3-34 | s-CF | 1-3-25 | 785 | 158 | 1.042 | ○ | ○ | ○ | ○ |
| C.Ex.1-8 | a-CF | HT-3 | 788 | 232 | 1.745 | Δ | x | — | — |
| Ex. 3-35 | a-BN | 1-3-1 | 790 | 161 | 1.011 | ○ | ○ | ○ | ○ |
| Ex. 3-36 | a-BN | 1-3-20 | 788 | 181 | 1.191 | ○ | ○ | ○ | ○ |
| Ex. 3-37 | a-BN | 1-3-25 | 790 | 159 | 1.032 | ○ | ○ | ○ | ○ |
| C.Ex.1-9 | a-BN | HT-3 | 785 | 203 | 1.595 | ○ | x | — | — |

It was confirmed from the table that if the type of the surface protective layer is further changed, the same results as the above are obtained according to the compositions of the single-layer photosensitive layer as the base.

Specifically, all the electrophotosensitive materials of Examples 3-23 to 3-37 suffered no cracks nor delamination after the continuous production of 100,000 copies. It was thus confirmed that the use of the diphenylamine compound of the formula (1-3) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 3-1 to 3-37 but no surface protective layer, as well as on those of Examples 3-1 to 3-37, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 1-1 to 1-9 that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 3-1 to 3-37 wherein the single-layer photosensitive layers contain the diphenylamine compound of the formula (1-3) accomplish a notable increase in the durability by virtue of the formation of the surface protective layer.

Multi-Layer Electrophotosensitive Material

Example 3-38

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 μm.

The ball mill was operated for dispersing by mixing 1 part by weight of diphenylamine compound as the positive-hole transport material represented by the formula (1-3-1), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 μm. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 μm. Thus was fabricated an electrophotosensitive material of Example 3-38.

Examples 3-39 to 3-48

Electrophotosensitive materials of Examples 3-39 to 3-48 were fabricated the same way as in Example 3-38 except that each of the examples used 1 part by weight of diphenylamine compound of the formula of a number listed in the following Table 16 as the positive-hole transport material.

The electrophotosensitive materials of the above examples were subjected to the same photosensitivity test II and durability test II as the above and were evaluated for the characteristics thereof. The results, along with the aforementioned results of Comparative Examples 1-10, 1-11, are listed in Table 16.

TABLE 16

| | | | | | | Durability Test | | | |
|---|---|---|---|---|---|---|---|---|---|
| | SPL | P-H TM | SP $V_0$(V) | RP Vr(V) | HLE $E_{1/2}$(μJ/cm$^2$) | 10,000 copies | 20,000 copies | 50,000 copies | 100,000 copies |
| Ex. 3-38 | a-SiC | 1-3-1 | −796 | −108 | 0.638 | ○ | ○ | ○ | ○ |
| Ex. 3-39 | a-SiC | 1-3-2 | −809 | −103 | 0.608 | ○ | ○ | ○ | ○ |
| Ex. 3-40 | a-SiC | 1-3-4 | −801 | −110 | 0.651 | ○ | ○ | ○ | ○ |
| Ex. 3-41 | a-SiC | 1-3-5 | −812 | −109 | 0.664 | ○ | ○ | ○ | ○ |
| Ex. 3-42 | a-SiC | 1-3-11 | −788 | −108 | 0.657 | ○ | ○ | ○ | ○ |
| Ex. 3-43 | a-SiC | 1-3-12 | −785 | −110 | 0.699 | ○ | ○ | ○ | ○ |
| Ex. 3-44 | a-SiC | 1-3-17 | −796 | −106 | 0.677 | ○ | ○ | ○ | ○ |
| Ex. 3-45 | a-SiC | 1-3-20 | −814 | −122 | 0.784 | ○ | ○ | ○ | ○ |
| Ex. 3-46 | a-SiC | 1-3-23 | −785 | −119 | 0.774 | ○ | ○ | ○ | ○ |
| Ex. 3-47 | a-SiC | 1-3-25 | −793 | −112 | 0.685 | ○ | ○ | ○ | ○ |
| Ex. 3-48 | a-SiC | 1-3-26 | −793 | −113 | 0.707 | ○ | ○ | ○ | ○ |
| C.Ex.1-10 | a-SiC | HT-1 | −806 | −165 | 0.938 | ○ | x | — | — |
| C.Ex.1-11 | a-SiC | HT-3 | −814 | −147 | 1.024 | Δ | x | — | — |

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, all the electrophotosensitive materials of Examples 3-38 to 3-48 suffered no cracks nor delamination after the continuous production of 100,000 copies. It was thus confirmed that the use of the diphenylamine compound of the formula (1-3) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 3-49 to 3-59

Electrophotosensitive materials of Examples 3-49 to 3-59 were fabricated the same way as in Examples 3-38 to 3-48 except that the same procedure as in Examples 1-13 to 1-24 and Comparative Examples 1-3, 1-4 was taken to form a surface protective layer of amorphous carbon (C) having a thickness of 0.5 μm, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 1-12, 1-13, are listed in Table 17.

TABLE 17

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 3-49 | a-C | 1-3-1 | −785 | −102 | 0.651 | ○ | ○ | ○ | ○ |
| Ex. 3-50 | a-C | 1-3-2 | −796 | −92 | 0.586 | ○ | ○ | ○ | ○ |
| Ex. 3-51 | a-C | 1-3-4 | −796 | −107 | 0.650 | ○ | ○ | ○ | ○ |
| Ex. 3-52 | a-C | 1-3-5 | −817 | −109 | 0.664 | ○ | ○ | ○ | ○ |
| Ex. 3-53 | a-C | 1-3-11 | −809 | −101 | 0.658 | ○ | ○ | ○ | ○ |
| Ex. 3-54 | a-C | 1-3-12 | −782 | −114 | 0.677 | ○ | ○ | ○ | ○ |
| Ex. 3-55 | a-C | 1-3-17 | −788 | −108 | 0.670 | ○ | ○ | ○ | ○ |
| Ex. 3-56 | a-C | 1-3-20 | −798 | −125 | 0.803 | ○ | ○ | ○ | ○ |
| Ex. 3-57 | a-C | 1-3-23 | −806 | −130 | 0.783 | ○ | ○ | ○ | ○ |
| Ex. 3-58 | a-C | 1-3-25 | −790 | −104 | 0.677 | ○ | ○ | ○ | ○ |
| Ex. 3-59 | a-C | 1-3-26 | −809 | −111 | 0.692 | ○ | ○ | ○ | ○ |
| C.Ex.1-12 | a-C | HT-1 | −785 | −172 | 1.216 | ○ | x | — | — |
| C.Ex.1-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, all the electrophotosensitive materials of Examples 3-49 to 3-59 suffered no cracks nor delamination after the continuous production of 100,000 copies. It was thus confirmed that the use of the diphenylamine compound of the formula (1-3) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 3-60 to 3-62

Electrophotosensitive materials of Examples 3-60 to 3-62 were fabricated the same way as in Examples 3-38, 3-45 and 3-47 except that the same procedure as in Examples 1-25, 1-26 and Comparative Example 1-5 was taken to form a surface protective layer of amorphous silicon-nitrogen (SiN) composite film having a thickness of 0.5 μm, instead of the silicon-carbon composite film, over the surface of the multi-layer photosensitive layer.

Examples 3-60 to 3-62

Electrophotosensitive materials of Examples 3-60 to 3-62 were fabricated the same way as in Examples 3-38, 3-45 and 3-47 except that the same procedure as in Examples 1-27, 1-28 and Comparative Example 1-6 was taken to form a surface protective layer of amorphous carbon-nitrogen (CN) composite film having a thickness of 0.5 μm, instead of the silicon-carbon composite film, over the surface of the multi-layer photosensitive layer.

Examples 3-66 to 3-68

Electrophotosensitive materials of Examples 3-66 to 3-68 were fabricated the same way as in Examples 3-38, 3-45 and 3-47 except that the same procedure as in Examples 1-29, 1-30 and Comparative Example 1-7 was taken to form a surface protective layer of amorphous carbon-boron (CB) composite film having a thickness of 0.5 μm, instead of the silicon-carbon composite film, over the surface of the multi-layer photosensitive layer.

Examples 3-69 to 3-71

Electrophotosensitive materials of Examples 3-69 to 3-71 were fabricated the same way as in Examples 3-38, 3-45 and 3-47 except that the same procedure as in Examples 1-31, 1-32 and Comparative Example 1-8 was taken to form a surface protective layer of amorphous carbon-fluorine (CF) composite film having a thickness of 0.5 μm, instead of the silicon-carbon composite film, over the surface of the multi-layer photosensitive layer.

Examples 3-72 to 3-74

Electrophotosensitive materials of Examples 3-72 to 3-74 were fabricated the same way as in Examples 3-38, 3-45 and 3-47 except that the same procedure as in Examples 1-33, 1-34 and Comparative Example 1-9 was taken to form a surface protective layer of amorphous boron-nitrogen (BN) composite film having a thickness of 0.5 μm, instead of the silicon-carbon composite film, over the surface of the multi-layer photosensitive layer.

The electrophotosensitive materials of the above examples were subjected to the same photosensitivity test II and durability test II and were evaluated for the characteristics thereof. The results, along with the aforementioned results of Comparative Examples 1-14 to 1-18, are listed in Table 18.

TABLE 18

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 3-60 | a-SiN | 1-3-1 | −801 | −104 | 0.663 | ○ | ○ | ○ | ○ |
| Ex. 3-61 | a-SiN | 1-3-20 | −793 | −135 | 0.813 | ○ | ○ | ○ | ○ |
| Ex. 3-62 | a-SiN | 1-3-25 | −790 | −109 | 0.714 | ○ | ○ | ○ | ○ |
| C.Ex.1-14 | a-SiN | HT-3 | −785 | −156 | 1.095 | ○ | x | — | — |
| Ex. 3-63 | a-CN | 1-3-1 | −801 | −113 | 0.671 | ○ | ○ | ○ | ○ |
| Ex. 3-64 | a-CN | 1-3-20 | −793 | −134 | 0.823 | ○ | ○ | ○ | ○ |
| Ex. 3-65 | a-CN | 1-3-25 | −806 | −108 | 0.707 | ○ | ○ | ○ | ○ |
| C.Ex.1-15 | a-CN | HT-3 | −793 | −153 | 1.154 | Δ | x | — | — |
| Ex. 3-66 | a-CB | 1-3-1 | −804 | −105 | 0.450 | ○ | ○ | ○ | ○ |
| Ex. 3-67 | a-CB | 1-3-20 | −809 | −103 | 0.442 | ○ | ○ | ○ | ○ |
| Ex. 3-68 | a-CB | 1-3-25 | −814 | −101 | 0.455 | ○ | ○ | ○ | ○ |
| C.Ex.1-16 | a-CB | HT-3 | −793 | −137 | 0.979 | Δ | x | — | — |
| Ex. 3-69 | a-CF | 1-3-1 | −806 | −117 | 0.530 | ○ | ○ | ○ | ○ |
| Ex. 3-70 | a-CF | 1-3-20 | −780 | −135 | 0.563 | ○ | ○ | ○ | ○ |
| Ex. 3-71 | s-CF | 1-3-25 | −796 | −103 | 0.464 | ○ | ○ | ○ | ○ |
| C.Ex.1-17 | a-CF | HT-3 | −793 | −141 | 1.020 | Δ | x | | |
| Ex. 3-72 | a-BN | 1-3-1 | −780 | −99 | 0.446 | ○ | ○ | ○ | ○ |
| Ex. 3-73 | a-BN | 1-3-20 | −804 | −97 | 0.438 | ○ | ○ | ○ | ○ |
| Ex. 3-74 | a-BN | 1-3-25 | −793 | −96 | 0.433 | ○ | ○ | ○ | ○ |
| C.Ex.1-18 | a-BN | HT-3 | −780 | −122 | 0.903 | ○ | x | — | — |

It was confirmed from the table that if the type of the surface protective layer is further changed, the same results as the above are obtained according to the compositions of the charge transport layer of the multi-layer photosensitive layer as the base.

Specifically, all the electrophotosensitive materials of Examples 3-60 to 3-74 suffered no cracks nor delamination after the continuous production of 100,000 copies. It was thus confirmed that the use of the diphenylamine compound of the formula (1-3) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 3-38 to 3-74 but no surface protective layer, as well as on those of Examples 3-38 to 3-74, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 1-10 to 1-18 that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layer, the electrophotosensitive materials of Examples 3-38 to 3-74 wherein the multi-layer photosensitive layers contain the diphenylamine compound of the formula (1-3) accomplish a notable increase in the durability by virtue of the formation of the surface protective layer.

Single-Layer Electrophotosensitive Material

Example 4-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-4a-8); 80 parts by weight of 2,6-dimethyl-2',6'-t-butylbenzoquinone as the electron transport material represented by the formula (ET-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 μm.

Forming Surface Protective Layer

The plasma CVD process was performed under the same conditions as in Example 1-1, thereby forming a surface protective layer of amorphous silicon-carbon (SiC) composite film having a thickness of 0.5 μm over the surface of the single-layer photosensitive layer. Thus was fabricated an electrophotosensitive material of Example 4-1.

Examples 4-2 to 4-4

Electrophotosensitive materials of Examples 4-2 to 4-4 were fabricated the same way as in Example 4-1 except that each of the examples used 100 parts by weight of diphenylamine compound of the formula of a number listed in the following Table 19 as the positive-hole transport material.

The electrophotosensitive materials of the above examples were subjected to the same photosensitivity test I and durability test I as the above and were evaluated for the characteristics thereof. The results, along with the aforementioned results of Comparative Examples 2-1, 2-2, are listed in Table 19.

TABLE 19

| | SPL | P-H TM | ETM | SP $V_0$(V) | RP Vr(V) | HLE $E_{1/2}$(μJ/cm²) | Durability Test 10,000 copies | 20,000 copies | 30,000 copies | 50,000 copies | 100,000 copies |
|---|---|---|---|---|---|---|---|---|---|---|---|
| Ex. 4-1 | a-SiC | 1-4a-8 | ET-1 | 801 | 90 | 0.859 | ○ | ○ | ○ | ○ | ○ |
| Ex. 4-2 | a-SiC | 1-4a-11 | ET-1 | 788 | 95 | 0.810 | ○ | ○ | ○ | ○ | ○ |
| Ex. 4-3 | a-SiC | 1-4b-2 | ET-1 | 782 | 94 | 0.895 | ○ | ○ | ○ | ○ | ○ |
| Ex. 4-4 | a-SiC | 1-4b-12 | ET-1 | 785 | 103 | 0.886 | ○ | ○ | ○ | ○ | ○ |
| C.Ex.2-1 | a-SiC | HT-1 | ET-1 | 814 | 154 | 1.112 | ○ | Δ | x | — | — |
| C.Ex.2-2 | a-SiC | HT-3 | ET-1 | 780 | 180 | 1.226 | ○ | x | — | — | — |

It was found from the table that all the electrophotosensitive materials of Examples 4-1 to 4-4 suffered no cracks nor delamination after the continuous production of 100,000 copies. It was thus confirmed that the use of the diphenylamine compound of the formula (1-4) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 4-5 to 4-8

Electrophotosensitive materials of Examples 4-5 to 4-8 were fabricated the same way as in Examples 4-1 to 4-4 except that the same procedure as in Examples 1-13 to 1-24 and Comparative Examples 1-3, 1-4 was taken to form a surface protective layer of amorphous carbon (C) having a thickness of 0.5 μm, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-1, 2-2, are listed in Table 20.

TABLE 20

| | SPL | P-H TM | ETM | SP $V_0$(V) | RP Vr(V) | HLE $E_{1/2}$(μJ/cm²) | Durability Test 10,000 copies | 20,000 copies | 30,000 copies | 50,000 copies | 100,000 copies |
|---|---|---|---|---|---|---|---|---|---|---|---|
| Ex. 4-5 | a-C | 1-4a-8 | ET-1 | 780 | 94 | 0.895 | ○ | ○ | ○ | ○ | ○ |
| Ex. 4-6 | a-C | 1-4a-11 | ET-1 | 793 | 96 | 0.842 | ○ | ○ | ○ | ○ | ○ |
| Ex. 4-7 | a-C | 1-4b-2 | ET-1 | 817 | 102 | 0.945 | ○ | ○ | ○ | ○ | ○ |
| Ex. 4-8 | a-C | 1-4b-12 | ET-1 | 814 | 102 | 0.925 | ○ | ○ | ○ | ○ | ○ |
| C.Ex.2-3 | a-C | HT-1 | ET-1 | 788 | 157 | 1.150 | ○ | Δ | x | — | — |
| C.Ex.2-4 | a-C | HT-3 | ET-1 | 809 | 167 | 1.218 | ○ | Δ | x | — | — |

It was confirmed from the table that if the type of the surface protective layer is changed, the same results as the above are obtained according to the compositions of the single-layer photosensitive layer as the base.

Specifically, all the electrophotosensitive materials of Examples 4-5 to 4-8 suffered no cracks nor delamination after the continuous production of 100,000 copies. It was thus confirmed that the use of the diphenylamine compound of the formula (1-4) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 4-9, 4-10

Electrophotosensitive materials of Examples 4-9, 4-10 were fabricated the same way as in Examples 4-1, 4-3 except that the same procedure as in Examples 1-25, 1-26 and Comparative Example 1-5 was taken to form a μm surface protective layer of amorphous silicon-nitrogen (SiN) composite film having a thickness of 0.5 μm, instead of the silicon-carbon composite film, over the surface of the single-layer photosensitive layer.

Examples 4-11, 4-12

Electrophotosensitive materials of Examples 4-11, 4-12 were fabricated the same way as in Examples 4-1, 4-3 except that the same procedure as in Examples 1-27, 1-28 and Comparative Example 1-6 was taken to form a μm surface protective layer of amorphous carbon-nitrogen (CN) composite film having a thickness of 0.5 μm, instead of the silicon-carbon composite film, over the surface of the single-layer photosensitive layer.

Examples 4-13, 4-14

Electrophotosensitive materials of Examples 4-13, 4-14 were fabricated the same way as in Examples 4-1, 4-3 except that the same procedure as in Examples 1-29, 1-30 and Comparative Example 1-7 was taken to form a μm surface protective layer of amorphous carbon-boron (CB) composite film having a thickness of 0.5 μm, instead of the silicon-carbon composite film, over the surface of the single-layer photosensitive layer.

Examples 4-15, 4-16

Electrophotosensitive materials of Examples 4-15, 4-16 were fabricated the same way as in Examples 4-1, 4-3 except that the same procedure as in Examples 1-31, 1-32 and Comparative Example 1-8 was taken to form a μm. surface protective layer of amorphous carbon-fluorine (CF) composite film having a thickness of 0.5 μm, instead of the silicon-carbon composite film, over the surface of the single-layer photosensitive layer.

Examples 4-17, 4-18

Electrophotosensitive materials of Examples 4-17, 4-18 were fabricated the same way as in Examples 4-1, 4-3 except that the same procedure as in Examples 1-33, 1-34 and Comparative Example 1-9 was taken to form a μm surface protective layer of amorphous boron-nitrogen (BN) composite film having a thickness of 0.5 μm, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-5 to 2-9, are listed in Table 21.

TABLE 21

| | | | | | | | Durability Test | | | | |
|---|---|---|---|---|---|---|---|---|---|---|---|
| | SPL | P-H TM | ETM | SP $V_0$(V) | RP Vr(V) | HLE $E_{1/2}$(μJ/cm$^2$) | 10,000 copies | 20,000 copies | 30,000 copies | 50,000 copies | 100,000 copies |
| Ex. 4-9 | a-SiN | 1-4a-8 | ET-1 | 780 | 113 | 1.000 | ○ | ○ | ○ | ○ | ○ |
| Ex. 4-10 | a-SiN | 1-4b-2 | ET-1 | 782 | 115 | 1.025 | ○ | ○ | ○ | ○ | ○ |
| C.Ex.2-5 | a-SiN | HT-3 | ET-1 | 798 | 187 | 1.334 | ○ | Δ | x | — | — |
| Ex. 4-11 | a-CN | 1-4a-8 | ET-1 | 782 | 91 | 0.868 | ○ | ○ | ○ | ○ | ○ |
| Ex. 4-12 | a-CN | 1-4b-2 | ET-1 | 796 | 99 | 0.895 | ○ | ○ | ○ | ○ | ○ |
| C.Ex.2-6 | a-CN | HT-3 | ET-1 | 801 | 194 | 1.389 | ○ | Δ | x | — | — |
| Ex. 4-13 | a-CB | 1-4a-8 | ET-1 | 809 | 99 | 0.868 | ○ | ○ | ○ | ○ | ○ |
| Ex. 4-14 | a-CB | 1-4b-2 | ET-1 | 809 | 94 | 0.895 | ○ | ○ | ○ | ○ | ○ |
| C.Ex.2-7 | a-CB | HT-3 | ET-1 | 798 | 166 | 1.235 | ○ | x | — | — | — |
| Ex. 4-15 | a-CF | 1-4a-8 | ET-1 | 809 | 99 | 0.868 | ○ | ○ | ○ | ○ | ○ |
| Ex. 4-16 | a-CF | 1-4b-2 | ET-1 | 801 | 104 | 0.895 | ○ | ○ | ○ | ○ | ○ |
| C.Ex.2-8 | a-CF | HT-3 | ET-1 | 782 | 180 | 1.284 | Δ | x | — | — | — |
| Ex. 4-17 | a-BN | 1-4a-8 | ET-1 | 788 | 99 | 0.868 | ○ | ○ | ○ | ○ | ○ |
| Ex. 4-18 | a-BN | 1-4b-2 | ET-1 | 798 | 102 | 0.895 | ○ | ○ | ○ | ○ | ○ |
| C.Ex.2-9 | a-BN | HT-3 | ET-1 | 788 | 155 | 1.165 | ○ | Δ | x | — | — |

It was confirmed from the table that if the type of the surface protective layer is further changed, the same results as the above are obtained according to the compositions of the single-layer photosensitive layer as the base.

Specifically, all the electrophotosensitive materials of Examples 4-9 to 4-18 suffered no cracks nor delamination after the continuous production of 100,000 copies. It was thus confirmed that the use of the diphenylamine compound of the formula (1-4) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 4-1 to 4-18 but no surface protective layer, as well as on those of Examples 4-1 to 4-18, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 2-1 to 2-9 that forming the surface protective layer on the organic photosensitive layer does not always result in the improvement of the durability of the electrophotosensitive material. If a suitable positive-hole transport material is not selected, the resultant electrophotosensitive material is rather decreased in durability.

Forming Surface Protective Layer

The plasma CVD process was performed under the same conditions as in Example 1-1, thereby forming a surface protective layer of amorphous silicon-carbon (SiC) composite film having a thickness of 0.5 μm. Thus was fabricated an electrophotosensitive material of Example 4-19.

Examples 4-20 to 4-22

Electrophotosensitive materials of Examples 4-20 to 4-22 were fabricated the same way as in Example 4-19 except that each of the examples used 0.8 parts by weight of diphenylamine compound of the formula of a number listed in the following Table 22 as the positive-hole transport material.

The electrophotosensitive materials of the above examples were subjected to the same photosensitivity test II and durability test II as the above and were evaluated for the characteristics thereof. The results, along with the aforementioned results of Comparative Examples 2-10, 2-11, are listed in Table 22.

TABLE 22

| | | | | | | Durability Test | | | |
|---|---|---|---|---|---|---|---|---|---|
| | SPL | P-H TM | SP $V_0$(V) | RP $V_r$(V) | HLE $E_{1/2}$(μJ/cm$^2$) | 10,000 copies | 20,000 copies | 50,000 copies | 100,000 copies |
| Ex. 4-19 | a-SiC | 1-4a-8 | −788 | −55 | 0.799 | ○ | ○ | ○ | ○ |
| Ex. 4-20 | a-SiC | 1-4a-11 | −780 | −48 | 0.762 | ○ | ○ | ○ | ○ |
| Ex. 4-21 | a-SiC | 1-4b-2 | −809 | −59 | 0.842 | ○ | ○ | ○ | ○ |
| Ex. 4-22 | a-SiC | 1-4b-12 | −812 | −53 | 0.833 | ○ | ○ | ○ | ○ |
| CEx.2-10 | a-SiC | HT-1 | −806 | −165 | 0.938 | ○ | x | — | — |
| CEx.2-11 | a-SiC | HT-3 | −814 | −147 | 1.024 | ○ | x | — | — |

The electrophotosensitive materials of Examples 4-1 to 4-18 wherein the single-layer photosensitive layers contain the diphenylamine compound of the formula (1-4) accomplish a notable increase in the durability by virtue of the formation of the surface protective layer.

Multi-Layer Electrophotosensitive Material

Example 4-19

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 μm.

The ball mill was operated for dispersing by mixing 0.8 parts by weight of diphenylamine compound as the positive-hole transport material represented by the formula (1-4a-8), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 μm. Thus was formed a negative-charge multi-layer photosensitive layer.

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, all the electrophotosensitive materials of Examples 4-19 to 4-22 suffered no cracks nor delamination after the continuous production of 100,000 copies. It was thus confirmed that the use of the diphenylamine compound of the formula (1-4) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 4-23 to 4-26

Electrophotosensitive materials of Examples 4-23 to 4-26 were fabricated the same way as in Examples 4-19 to 4-22 except that the same procedure as in Examples 1-13 to 1-24 and Comparative Examples 1-3, 1-4 was taken to form a μm surface protective layer of amorphous carbon (C) having a thickness of 0.5 μm, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 1-12, 1-13, are listed in Table 23.

TABLE 23

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 4-23 | a-C | 1-4a-8 | −790 | −50 | 0.800 | ○ | ○ | ○ | ○ |
| Ex. 4-24 | a-C | 1-4a-11 | −804 | −53 | 0.761 | ○ | ○ | ○ | ○ |
| Ex. 4-25 | a-C | 1-4b-2 | −809 | −56 | 0.842 | ○ | ○ | ○ | ○ |
| Ex. 4-26 | a-C | 1-4b-12 | −796 | −53 | 0.833 | ○ | ○ | ○ | ○ |
| CEx. 2-12 | a-C | HT-1 | −785 | −172 | 1.216 | ○ | x | — | — |
| CEx. 2-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, all the electrophotosensitive materials of Examples 4-23 to 4-26 suffered no cracks nor delamination after the continuous production of 100,000 copies. It was thus confirmed that the use of the diphenylamine compound of the formula (1-4) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 4-27, 4-28

Electrophotosensitive materials of Examples 4-27, 4-28 were fabricated the same way as in Examples 4-19, 4-21 except that the same procedure as in Examples 1-25, 1-26 and Comparative Example 1-5 was taken to form a $\mu$m surface protective layer of amorphous silicon-nitrogen (SiN) composite film having a thickness of 0.5 $\mu$m, instead of the silicon-carbon composite film, over the surface of the multi-layer photosensitive layer.

Examples 4-29, 4-30

Electrophotosensitive materials of Examples 4-29, 4-30 were fabricated the same way as in Examples 4-19, 4-21 except that the same procedure as in Examples 1-27, 1-28 and Comparative Example 1-6 was taken to form a $\mu$m surface protective layer of amorphous carbon-nitrogen (CN) composite film having a thickness of 0.5 $\mu$m, instead of the silicon-carbon composite film, over the surface of the multi-layer photosensitive layer.

Examples 4-31, 4-32

Electrophotosensitive materials of Examples 4-31, 4-32 were fabricated the same way as in Examples 4-19, 4-21 except that the same procedure as in Examples 1-29, 1-30 and Comparative Example 1-7 was taken to form a $\mu$m surface protective layer of amorphous carbon-boron (CB) composite film having a thickness of 0.5 $\mu$m, instead of the silicon-carbon composite film, over the surface of the multi-layer photosensitive layer.

Examples 4-33, 4-34

Electrophotosensitive materials of Examples 4-33, 4-34 were fabricated the same way as in Examples 4-19, 4-21 except that the same procedure as in Examples 1-31, 1-32 and Comparative Example 1-8 was taken to form a $\mu$m surface protective layer of amorphous carbon-fluorine (CF) composite film having a thickness of 0.5 $\mu$m, instead of the silicon-carbon composite film, over the surface of the multi-layer photosensitive layer.

Examples 4-35, 4-36

Electrophotosensitive materials of Examples 4-35, 4-36 were fabricated the same way as in Examples 4-19, 4-21 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-14 to 2-18, are listed in Table 24.

TABLE 24

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 4-27 | a-SiN | 1-4a-8 | −809 | −55 | 0.800 | ○ | ○ | ○ | ○ |
| Ex. 4-28 | a-SiN | 1-4b-2 | −814 | −58 | 0.761 | ○ | ○ | ○ | ○ |
| C.Ex.2-14 | a-SiN | HT-3 | −785 | −149 | 1.095 | ○ | x | — | — |
| Ex. 4-29 | a-CN | 1-4a-8 | −801 | −50 | 0.800 | ○ | ○ | ○ | ○ |
| Ex. 4-30 | a-CN | 1-4b-2 | −801 | −53 | 0.761 | ○ | ○ | ○ | ○ |
| C.Ex.2-15 | a-CN | HT-3 | −793 | −148 | 1.155 | Δ | x | — | — |
| Ex. 4-31 | a-CB | 1-4a-8 | −790 | −58 | 0.800 | ○ | ○ | ○ | ○ |
| Ex. 4-32 | a-CB | 1-4b-2 | −798 | −55 | 0.761 | ○ | ○ | ○ | ○ |
| C.Ex.2-16 | a-CB | HT-3 | −793 | −137 | 0.979 | Δ | x | — | — |
| Ex. 4-33 | a-CF | 1-4a-8 | −780 | −60 | 0.799 | ○ | ○ | ○ | ○ |
| Ex. 4-34 | a-CF | 1-4b-2 | −790 | −48 | 0.761 | ○ | ○ | ○ | ○ |
| C.Ex.2-17 | a-CF | HT-3 | −793 | −139 | 1.021 | Δ | x | — | — |
| Ex. 4-35 | a-BN | 1-4a-8 | −790 | −60 | 0.799 | ○ | ○ | ○ | ○ |
| Ex. 4-36 | a-BN | 1-4b-2 | −780 | −55 | 0.761 | ○ | ○ | ○ | ○ |
| C.Ex.2-18 | a-BN | HT-3 | −780 | −117 | 0.904 | ○ | x | — | — |

It was confirmed from the table that if the type of the surface protective layer is further changed, the same results as the above are obtained according to the compositions of the charge transport layer of the multi-layer photosensitive layer as the base.

Specifically, all the electrophotosensitive materials of Examples 4-27 to 4-36 suffered no cracks nor delamination after the continuous production of 100,000 copies. It was thus confirmed that the use of the diphenylamine compound of the formula (1-4) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 4-19 to 4-36 but no surface protective layer, as well as on those of Examples 4-19 to 4-36, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 2-10 to 2-18 that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layer, the electrophotosensitive materials of Examples 4-19 to 4-36 where in the multi-layer photosensitive layers contain the diphenylamine compound of the formula (1-4) accomplish a notable increase in the durability by virtue of the formation of the surface protective layer.

Single-Layer Electrophotosensitive Material

Example 5-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-5-2); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 $\mu$m.

Forming Surface Protective Layer

The plasma CVD process was performed under the same conditions as in Example 1-1, thereby forming a surface protective layer of amorphous silicon-carbon (SiC) composite film having a thickness of 0.5.m over the surface of the single-layer photosensitive layer. Thus was fabricated an electrophotosensitive material of Example 5-1.

Examples 5-2 to 5-7

Electrophotosensitive materials of Examples 5-2 to 5-7 were fabricated the same way as in Example 5-1 except that each of the examples used 100 parts by weight of diphenylamine compound of the formula of a number listed in the following Table 25 as the positive-hole transport material.

The electrophotosensitive materials of the above examples were subjected to the same photosensitivity test I and durability test I as the above and were evaluated for the characteristics thereof. The results, along with the aforementioned results of Comparative Examples 1-1, 1-2, are listed in Table 25.

TABLE 25

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 5-1 | a-SiC | 1-5-2 | 804 | 161 | 1.105 | ○ | ○ | ○ | ○ |
| Ex. 5-2 | a-SiC | 1-5-8 | 801 | 169 | 1.174 | ○ | ○ | ○ | ○ |
| Ex. 5-3 | a-SiC | 1-5-9 | 788 | 130 | 0.898 | ○ | ○ | ○ | ○ |
| Ex. 5-4 | a-SiC | 1-5-10 | 788 | 127 | 0.881 | ○ | ○ | ○ | ○ |
| Ex. 5-5 | a-SiC | 1-5-16 | 796 | 146 | 0.978 | ○ | ○ | ○ | ○ |
| Ex. 5-6 | a-SiC | 1-5-17 | 793 | 147 | 1.001 | ○ | ○ | ○ | ○ |
| Ex. 5-7 | a-SiC | 1-5-20 | 792 | 154 | 1.036 | ○ | ○ | ○ | ○ |
| C.Ex.1-1 | a-SiC | HT-1 | 817 | 205 | 1.500 | ○ | x | — | — |
| C.Ex.1-2 | a-SiC | HT-3 | 804 | 232 | 1.667 | ○ | x | — | — |

It was found from the table that all the electrophotosensitive materials of Examples 5-1 to 5-7 suffered no cracks nor delamination after the continuous production of 100,000 copies. It was thus confirmed that the use of the diphenylamine compound of the formula (1-5) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 5-8 to 5-14

Electrophotosensitive materials of Examples 4-8 to 5-14 were fabricated the same way as in Examples 5-1 to 5-7 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 1-3, 1-4, are listed in Table 26.

TABLE 26

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 5-8 | a-C | 1-5-2 | 788 | 165 | 1.128 | ○ | ○ | ○ | ○ |
| Ex. 5-9 | a-C | 1-5-8 | 796 | 176 | 1.190 | ○ | ○ | ○ | ○ |
| Ex. 5-10 | a-C | 1-5-9 | 782 | 131 | 0.927 | ○ | ○ | ○ | ○ |
| Ex. 5-11 | a-C | 1-5-10 | 817 | 132 | 0.898 | ○ | ○ | ○ | ○ |
| Ex. 5-12 | a-C | 1-5-16 | 785 | 139 | 0.967 | ○ | ○ | ○ | ○ |
| Ex. 5-13 | a-C | 1-5-17 | 785 | 145 | 1.024 | ○ | ○ | ○ | ○ |
| Ex. 5-14 | a-C | 1-5-20 | 780 | 153 | 1.048 | ○ | ○ | ○ | ○ |
| C.Ex.1-3 | a-C | HT-1 | 793 | 208 | 1.563 | ○ | x | — | — |
| C.Ex.1-4 | a-C | HT-3 | 788 | 222 | 1.667 | Δ | x | — | — |

It was confirmed from the table that if the type of the surface protective layer is changed, the same results as the above are obtained according to the compositions of the single-layer photosensitive layer as the base.

Specifically, all the electrophotosensitive materials of Examples 5-8 to 5-14 suffered no cracks nor delamination after the continuous production of 100,000 copies. It was thus confirmed that the use of the diphenylamine compound of the formula (1-5) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 5-15, 5-16

Electrophotosensitive materials of Examples 5-15, 5-16 were fabricated the same way as in Examples 5-3, 5-4 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the single-layer photosensitive layer.

Examples 5-17, 5-18

Electrophotosensitive materials of Examples 5-17, 5-18 were fabricated the same way as in Examples 5-3, 5-4 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the single-layer photosensitive layer.

Examples 5-19, 5-20

Electrophotosensitive materials of Examples 5-19, 5-20 were fabricated the same way as in Examples 5-3, 5-4 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the single-layer photosensitive layer.

Examples 5-21, 5-22

Electrophotosensitive materials of Examples 5-21, 5-22 were fabricated the same way as in Examples 5-3, 5-4 except that the same procedure as in Examples 1-31, 1-32 and Comparative Example 1-8 was taken to form a $\mu$m surface protective layer of amorphous carbon-fluorine (CF) composite film having a thickness of 0.5.m, instead of the silicon-carbon composite film, over the surface of the single-layer photosensitive layer.

Examples 5-23, 5-24

Electrophotosensitive materials of Examples 5-23, 5-24 were fabricated the same way as in Examples 5-3, 5-4 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 1-5 to 1-9, are listed in Table 27.

Specifically, all the electrophotosensitive materials of Examples 5-15 to 5-24 suffered no cracks nor delamination after the continuous production of 100,000 copies. It was thus confirmed that the use of the diphenylamine compound of the formula (1-5) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 5-1 to 5-24 but no surface protective layer, as well as on those of Examples 5-1 to 5-24, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 1-1 to 1-9 that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 5-1 to 5-24 wherein the single-layer photosensitive layers contain the diphenylamine compound of the formula (1-5) accomplish a notable increase in the durability by virtue of the formation of the surface protective layer.

TABLE 27

| | | | | | | Durability Test | | | |
|---|---|---|---|---|---|---|---|---|---|
| | SPL | P-H TM | SP $V_0$(V) | RP Vr(V) | HLE $E_{1/2}$($\mu$J/cm$^2$) | 10,000 copies | 20,000 copies | 50,000 copies | 100,000 copies |
| Ex. 5-15 | a-SiN | 1-5-9 | 814 | 143 | 0.957 | ○ | ○ | ○ | ○ |
| Ex. 5-16 | a-SiN | 1-5-10 | 782 | 139 | 0.946 | ○ | ○ | ○ | ○ |
| C.Ex.1-5 | a-SiN | HT-3 | 812 | 245 | 1.787 | ○ | x | — | — |
| Ex. 5-17 | a-CN | 1-5-9 | 780 | 145 | 0.989 | ○ | ○ | ○ | ○ |
| Ex. 5-18 | a-CN | 1-5-10 | 780 | 148 | 0.978 | ○ | ○ | ○ | ○ |
| C.Ex.1-6 | a-CN | HT-3 | 790 | 252 | 1.875 | ○ | x | — | — |
| Ex. 5-19 | a-CB | 1-5-9 | 788 | 121 | 0.839 | ○ | ○ | ○ | ○ |
| Ex. 5-20 | a-CB | 1-5-10 | 806 | 131 | 0.855 | ○ | ○ | ○ | ○ |
| C.Ex.1-7 | a-CB | HT-3 | 801 | 222 | 1.667 | Δ | x | — | — |
| Ex. 5-21 | a-CF | 1-5-9 | 806 | 127 | 0.881 | ○ | ○ | ○ | ○ |
| Ex. 5-22 | a-CF | 1-5-10 | 806 | 122 | 0.863 | ○ | ○ | ○ | ○ |
| C.Ex.1-8 | a-CF | HT-3 | 788 | 232 | 1.745 | Δ | x | — | — |
| Ex. 5-23 | a-BN | 1-5-9 | 804 | 121 | 0.800 | ○ | ○ | ○ | ○ |
| Ex. 5-24 | a-BN | 1-5-10 | 809 | 115 | 0.816 | ○ | ○ | ○ | ○ |
| C.Ex.1-9 | a-BN | HT-3 | 785 | 203 | 1.595 | ○ | x | — | — |

It was confirmed from the table that if the type of the surface protective layer is further changed, the same results as the above are obtained according to the compositions of the single-layer photosensitive layer as the base.

Multi-Layer Electrophotosensitive Material

Example 5-25

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 μm.

The ball mill was operated for dispersing by mixing 1 part by weight of diphenylamine compound as the positive-hole transport material represented by the formula (1-5-2), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 μm. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 μm. Thus was fabricated an electrophotosensitive material of Example 5-25.

Examples 5-26 to 5-31

Electrophotosensitive materials of Examples 5-26 to 5-31 were fabricated the same way as in Example 5-25 except that each of the examples used 1 part by weight of diphenylamine compound of the formula of a number listed in the following Table 28 as the positive-hole transport material.

The electrophotosensitive materials of the above examples were subjected to the same photosensitivity test II and durability test II as the above and were evaluated for the characteristics thereof. The results, along with the aforementioned results of Comparative Examples 1-10, 1-11, are listed in Table 28.

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, all the electrophotosensitive materials of Examples 5-25 to 5-31 suffered no cracks nor delamination after the continuous production of 100,000 copies. It was thus confirmed that the use of the diphenylamine compound of the formula (1-5) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 5-32 to 5-38

Electrophotosensitive materials of Examples 5-32 to 5-38 were fabricated the same way as in Examples 5-25 to 5-31 except that the same procedure as in Examples 1-13 to 1-24 and Comparative Examples 1-3, 1-4 was taken to form a μm surface protective layer of amorphous carbon (C) having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 1-12, 1-13, are listed in Table 29.

TABLE 28

| | | | | | | Durability Test | | | |
|---|---|---|---|---|---|---|---|---|---|
| | SPL | P-H TM | SP $V_0$(V) | RP Vr(V) | HLE $E_{1/2}$(μJ/cm$^2$) | 10,000 copies | 20,000 copies | 50,000 copies | 100,000 copies |
| Ex. 5-25 | a-SiC | 1-5-2 | −788 | −100 | 0.688 | ○ | ○ | ○ | ○ |
| Ex. 5-26 | a-SiC | 1-5-8 | −780 | −114 | 0.734 | ○ | ○ | ○ | ○ |
| Ex. 5-27 | a-SiC | 1-5-9 | −788 | −91 | 0.561 | ○ | ○ | ○ | ○ |
| Ex. 5-28 | a-SiC | 1-5-10 | −801 | −82 | 0.551 | ○ | ○ | ○ | ○ |
| Ex. 5-29 | a-SiC | 1-5-16 | −806 | −91 | 0.612 | ○ | ○ | ○ | ○ |
| Ex. 5-30 | a-SiC | 1-5-17 | −817 | −98 | 0.625 | ○ | ○ | ○ | ○ |
| Ex. 5-31 | a-SiC | 1-5-20 | −785 | −94 | 0.648 | ○ | ○ | ○ | ○ |
| C.Ex.1-10 | a-SiC | HT-1 | −806 | −165 | 0.938 | ○ | x | — | — |
| C.Ex.1-11 | a-SiC | HT-3 | −814 | −147 | 1.024 | Δ | x | — | — |

TABLE 29

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 5-32 | a-C | 1-5-2 | −814 | −105 | 0.705 | ○ | ○ | ○ | ○ |
| Ex. 5-33 | a-C | 1-5-8 | −780 | −108 | 0.744 | ○ | ○ | ○ | ○ |
| Ex. 5-34 | a-C | 1-5-9 | −788 | −91 | 0.580 | ○ | ○ | ○ | ○ |
| Ex. 5-35 | a-C | 1-5-10 | −788 | −81 | 0.561 | ○ | ○ | ○ | ○ |
| Ex. 5-36 | a-C | 1-5-16 | −809 | −87 | 0.605 | ○ | ○ | ○ | ○ |
| Ex. 5-37 | a-C | 1-5-17 | −790 | −98 | 0.640 | ○ | ○ | ○ | ○ |
| Ex. 5-38 | a-C | 1-5-20 | −788 | −100 | 0.655 | ○ | ○ | ○ | ○ |
| C.Ex.1-12 | a-C | HT-1 | −785 | −172 | 1.216 | ○ | x | — | — |
| C.Ex.1-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, all the electrophotosensitive materials of Examples 5-32 to 5-38 suffered no cracks nor delamination after the continuous production of 100,000 copies. It was thus confirmed that the use of the diphenylamine compound of the formula (1-5) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 5-39, 5-40

Electrophotosensitive materials of Examples 5-39, 5-40 were fabricated the same way as in Examples 5-27, 5-28 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the multi-layer photosensitive layer.

Examples 5-41, 5-42

Electrophotosensitive materials of Examples 5-41, 5-42 were fabricated the same way as in Examples 5-27, 5-28 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the multi-layer photosensitive layer.

Examples 5-43, 5-44

Electrophotosensitive materials of Examples 5-43, 5-44 were fabricated the same way as in Examples 5-27, 5-28 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the multi-layer photosensitive layer.

Examples 5-45, 5-46

Electrophotosensitive materials of Examples 5-45, 5-46 were fabricated the same way as in Examples 5-27, 5-28 except that the same procedure as in Examples 1-31, 1-32 and Comparative Example 1-8 was taken to form a $\mu$m surface protective layer of amorphous carbon-fluorine (CF) composite film having a thickness of 0.5.m, instead of the silicon-carbon composite film, over the surface of the multi-layer photosensitive layer.

Examples 5-47, 5-48

Electrophotosensitive materials of Examples 4-35, 4-36 were fabricated the same way as in Examples 5-27, 5-28 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 1-14 to 1-18, are listed in Table 30.

TABLE 30

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 5-39 | a-SiN | 1-5-9 | −804 | −99 | 0.618 | ○ | ○ | ○ | ○ |
| Ex. 5-40 | a-SiN | 1-5-10 | −782 | −91 | 0.612 | ○ | ○ | ○ | ○ |
| C.Ex.1-14 | a-SiN | HT-3 | −785 | −156 | 1.095 | ○ | x | — | — |

TABLE 30-continued

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 5-41 | a-CN | 1-5-9 | −790 | −78 | 0.525 | ○ | ○ | ○ | ○ |
| Ex. 5-42 | a-CN | 1-5-10 | −796 | −87 | 0.535 | ○ | ○ | ○ | ○ |
| C.Ex.1-15 | a-CN | HT-3 | −793 | −153 | 1.154 | Δ | x | — | — |
| Ex. 5-43 | a-CB | 1-5-9 | −782 | −82 | 0.551 | ○ | ○ | ○ | ○ |
| Ex. 5-44 | a-CB | 1-5-10 | −814 | −85 | 0.539 | ○ | ○ | ○ | ○ |
| C.Ex.1-16 | a-CB | HT-3 | −793 | −137 | 0.979 | Δ | x | — | — |
| Ex. 5-45 | a-CF | 1-5-9 | −790 | −75 | 0.500 | ○ | ○ | ○ | ○ |
| Ex. 5-46 | a-CF | 1-5-10 | −793 | −74 | 0.510 | ○ | ○ | ○ | ○ |
| C.Ex.1-17 | a-CF | HT-3 | −793 | −141 | 1.020 | Δ | x | | |
| Ex. 5-47 | a-BN | 1-5-9 | −817 | −79 | 0.496 | ○ | ○ | ○ | ○ |
| Ex. 5-48 | a-BN | 1-5-10 | −798 | −83 | 0.505 | ○ | ○ | ○ | ○ |
| C.Ex.1-18 | a-BN | HT-3 | −780 | −122 | 0.903 | ○ | x | — | — |

It was confirmed from the table that if the type of the surface protective layer is further changed, the same results as the above are obtained according to the compositions of the charge transport layer of the multi-layer photosensitive layer as the base.

Specifically, all the electrophotosensitive materials of Examples 5-39 to 5-48 suffered no cracks nor delamination after the continuous production of 100,000 copies. It was thus confirmed that the use of the diphenylamine compound of the formula (1-5) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 5-25 to 5-48 but no surface protective layer, as well as on those of Examples 5-25 to 5-48, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 1-10 to 1-18 that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layer, the electrophotosensitive materials of Examples 5-25 to 5-48 wherein the multi-layer photosensitive layers contain the diphenylamine compound of the formula (1-5) accomplish a notable increase in the durability by virtue of the formation of the surface protective layer.

Single-Layer Electrophotosensitive Material

Example 6-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-6-2); 80 parts by weight of 2,6-dimethyl-2',6'-t-butylbenzoquinone as the electron transport material represented by the formula (ET-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 $\mu$m.

Forming Surface Protective Layer

The plasma CVD process was performed under the same conditions as in Example 1-1, thereby forming a surface protective layer of amorphous silicon-carbon (SiC) composite film having a thickness of 0.5.m over the surface of the single-layer photosensitive layer. Thus was fabricated an electrophotosensitive material of Example 6-1.

Examples 6-2, 6-3

Electrophotosensitive materials of Examples 6-2, 6-3 were fabricated the same way as in Example 6-1 except that each of the examples used 100 parts by weight of diphenylamine compound of the formula of a number listed in the following Table 31 as the positive-hole transport material.

The electrophotosensitive materials of the above examples were subjected to the same photosensitivity test I and durability test I as the above and were evaluated for the characteristics thereof. The results, along with the aforementioned results of Comparative Examples 2-1, 2-2, are listed in Table 31.

TABLE 31

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 6-1 | a-SiC | 1-6-2 | ET-1 | 817 | 98 | 0.886 | ○ | ○ | ○ | ○ | ○ |
| Ex. 6-2 | a-SiC | 1-6-6 | ET-1 | 801 | 101 | 0.868 | ○ | ○ | ○ | ○ | ○ |
| Ex. 6-3 | a-SiC | 1-6-10 | ET-1 | 796 | 104 | 0.915 | ○ | ○ | ○ | ○ | ○ |
| C.Ex.2-1 | a-SiC | HT-1 | ET-1 | 814 | 154 | 1.112 | ○ | Δ | x | — | — |
| C.Ex.2-2 | a-SiC | HT-3 | ET-1 | 780 | 180 | 1.226 | ○ | x | — | — | — |

It was found from the table that all the electrophotosensitive materials of Examples 6-1 to 6-3 suffered no cracks nor delamination after the continuous production of 100,000 copies. It was thus confirmed that the use of the diphenylamine compound of the formula (1-6) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 6-4 to 6-6

Electrophotosensitive materials of Examples 6-4 to 6-6 were fabricated the same way as in Examples 6-1 to 6-3 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the single-layer photosensitive layer.

The electrophotosensitive materials of the above examples were subjected to same photosensitivity test I and durability test I as the above and were evaluated for the characteristics thereof. The results, along with the aforementioned results of Comparative Examples 2-3, 2-4, are listed in Table 32.

TABLE 32

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 6-4 | a-C | 1-6-2 | ET-1 | 785 | 99 | 0.895 | ○ | ○ | ○ | ○ | ○ |
| Ex. 6-5 | a-C | 1-6-6 | ET-1 | 801 | 102 | 0.877 | ○ | ○ | ○ | ○ | ○ |
| Ex. 6-6 | a-C | 1-6-10 | ET-1 | 801 | 105 | 0.924 | ○ | ○ | ○ | ○ | ○ |
| C.Ex.2-3 | a-C | HT-1 | ET-1 | 788 | 157 | 1.150 | ○ | Δ | x | — | — |
| C.Ex.2-4 | a-C | HT-3 | ET-1 | 809 | 167 | 1.218 | ○ | Δ | x | — | — |

It was confirmed from the table that if the type of the surface protective layer is changed, the same results as the above are obtained according to the compositions of the single-layer photosensitive layer as the base.

Specifically, all the electrophotosensitive materials of Examples 6-4 to 6-6 suffered no cracks nor delamination after the continuous production of 100,000 copies. It was thus confirmed that the use of the diphenylamine compound of the formula (1-6) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 6-7, 6-8

Electrophotosensitive materials of Examples 6-7, 6-8 were fabricated the same way as in Examples 6-1, 6-2 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the single-layer photosensitive layer.

Examples 6-9, 6-10

Electrophotosensitive materials of Examples 6-9, 6-10 were fabricated the same way as in Examples 6-1, 6-2 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the single-layer photosensitive layer.

Examples 6-11, 6-12

Electrophotosensitive materials of Examples 6-11, 6-12 were fabricated the same way as in Examples 6-1, 6-2 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the single-layer photosensitive layer.

Examples 6-13, 6-14

Electrophotosensitive materials of Examples 6-13, 6-14 were fabricated the same way as in Examples 6-1, 6-2 except that the same procedure as in Examples 1-31, 1-32 and Comparative Example 1-8 was taken to form a μm surface protective layer of amorphous carbon-fluorine (CF) composite film having a thickness of 0.5.m, instead of the silicon-carbon composite film, over the surface of the single-layer photosensitive layer.

Examples 6-15, 6-16

Electrophotosensitive materials of Examples 6-15, 6-16 were fabricated the same way as in Examples 6-1, 6-2 except that the same procedure as in Examples 1-33, 1-34 and Comparative Example 1-9 was taken to form a μm surface protective layer of amorphous boron-nitrogen (BN) composite film having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-5 to 2-9, are listed in Table 33.

were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 2-1 to 2-9 that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 6-1 to 6-16 wherein the single-layer photosensitive layers contain the diphenylamine compound of the formula (1-6) accomplish a notable increase in the durability by virtue of the formation of the surface protective layer.

TABLE 33

| | | | | | | | Durability Test | | | | |
|---|---|---|---|---|---|---|---|---|---|---|---|
| | SPL | P-H TM | ETM | SP $V_0$(V) | RP Vr(V) | HLE $E_{1/2}$(μJ/cm$^2$) | 10,000 copies | 20,000 copies | 30,000 copies | 50,000 copies | 100,000 copies |
| Ex. 6-7 | a-SiN | 1-6-2 | ET-1 | 806 | 110 | 1.024 | ○ | ○ | ○ | ○ | ○ |
| Ex. 6-8 | a-SiN | 1-6-6 | ET-1 | 809 | 106 | 0.935 | ○ | ○ | ○ | ○ | ○ |
| C.Ex.2-5 | a-SiN | HT-3 | ET-1 | 798 | 187 | 1.334 | ○ | Δ | x | — | — |
| Ex. 6-9 | a-CN | 1-6-2 | ET-1 | 780 | 93 | 0.885 | ○ | ○ | ○ | ○ | ○ |
| Ex. 6-10 | a-CN | 1-6-6 | ET-1 | 788 | 100 | 0.904 | ○ | ○ | ○ | ○ | ○ |
| C.Ex.2-6 | a-CN | HT-3 | ET-1 | 801 | 194 | 1.389 | ○ | Δ | x | — | — |
| Ex. 6-11 | a-CB | 1-6-2 | ET-1 | 788 | 96 | 0.886 | ○ | ○ | ○ | ○ | ○ |
| Ex. 6-12 | a-CB | 1-6-6 | ET-1 | 798 | 100 | 0.904 | ○ | ○ | ○ | ○ | ○ |
| C.Ex.2-7 | a-CB | HT-3 | ET-1 | 798 | 166 | 1.235 | ○ | x | — | — | — |
| Ex. 6-13 | a-CF | 1-6-2 | ET-1 | 812 | 101 | 0.886 | ○ | ○ | ○ | ○ | ○ |
| Ex. 6-14 | a-CF | 1-6-6 | ET-1 | 804 | 100 | 0.924 | ○ | ○ | ○ | ○ | ○ |
| C.Ex.2-8 | a-CF | HT-3 | ET-1 | 782 | 180 | 1.284 | Δ | x | — | — | — |
| Ex. 6-15 | a-BN | 1-6-2 | ET-1 | 812 | 101 | 0.868 | ○ | ○ | ○ | ○ | ○ |
| Ex. 6-16 | a-BN | 1-6-6 | ET-1 | 812 | 104 | 0.895 | ○ | ○ | ○ | ○ | ○ |
| C.Ex.2-9 | a-BN | HT-3 | ET-1 | 788 | 155 | 1.165 | ○ | Δ | x | — | — |

It was confirmed from the table that if the type of the surface protective layer is further changed, the same results as the above are obtained according to the compositions of the single-layer photosensitive layer as the base.

Specifically, all the electrophotosensitive materials of Examples 6-7 to 6-16 suffered no cracks nor delamination after the continuous production of 100,000 copies. It was thus confirmed that the use of the diphenylamine compound of the formula (1-6) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 6-1 to 6-16 but no surface protective layer, as well as on those of Examples 6-1 to 6-16, and produced images Multi-Layer Electrophotosensitive Material Example 6-17

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 μm.

The ball mill was operated for dispersing by mixing 0.8 parts by weight of diphenylamine compound as the positive-hole transport material represented by the formula (1-6-2), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 μm. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 μm. Thus was fabricated an electrophotosensitive material of Example 6-17.

Examples 6-18, 6-19

Electrophotosensitive materials of Examples 6-18, 6-19 were fabricated the same way as in Example 6-17 except that each of the examples used 1 part by weight of diphenylamine compound of the formula of a number listed in the following Table 34 as the positive-hole transport material.

The electrophotosensitive materials of the above examples were subjected to the same photosensitivity test II and durability test II as the above and were evaluated for the characteristics thereof. The results, along with the aforementioned results of Comparative Examples 2-10, 2-11, are listed in Table 34.

TABLE 34

| | SPL | P-H TM | SP $V_0$(V) | RP Vr(V) | HLE $E_{1/2}$(μJ/cm²) | Durability Test 10,000 copies | 20,000 copies | 50,000 copies | 100,000 copies |
|---|---|---|---|---|---|---|---|---|---|
| Ex. 6-17 | a-SiC | 1-6-2 | −798 | −60 | 0.914 | ○ | ○ | ○ | ○ |
| Ex. 6-18 | a-SiC | 1-6-6 | −814 | −66 | 0.885 | ○ | ○ | ○ | ○ |
| Ex. 6-19 | a-SiC | 1-6-10 | −814 | −70 | 0.944 | ○ | ○ | ○ | ○ |
| CEx.2-10 | a-SiC | HT-1 | −806 | −165 | 0.938 | ○ | x | — | — |
| CEx.2-11 | a-SiC | HT-3 | −814 | −147 | 1.024 | ○ | x | — | — |

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, all the electrophotosensitive materials of Examples 6-17 to 6-19 suffered no cracks nor delamination after the continuous production of 100,000 copies. It was thus confirmed that the use of the diphenylamine compound of the formula (1-6) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 6-20 to 6-22

Electrophotosensitive materials of Examples 6-20 to 6-22 were fabricated the same way as in Examples 6-17 to 6-19 except that the same procedure as in Examples 1-13 to 1-24 and Comparative Examples 1-3, 1-4 was taken to form a μm surface protective layer of amorphous carbon (C) having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-12, 2-13, are listed in Table 35.

TABLE 35

| | SPL | P-H TM | SP $V_0$(V) | RP Vr(V) | HLE $E_{1/2}$(μJ/cm²) | Durability Test 10,000 copies | 20,000 copies | 50,000 copies | 100,000 copies |
|---|---|---|---|---|---|---|---|---|---|
| Ex. 6-20 | a-C | 1-6-2 | −793 | −67 | 0.933 | ○ | ○ | ○ | ○ |
| Ex. 6-21 | a-C | 1-6-6 | −785 | −65 | 0.904 | ○ | ○ | ○ | ○ |
| Ex. 6-22 | a-C | 1-6-10 | −780 | −74 | 0.965 | ○ | ○ | ○ | ○ |
| CEx.2-12 | a-C | HT-1 | −785 | −172 | 1.216 | ○ | x | — | — |
| CEx.2-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, all the electrophotosensitive materials of Examples 6-20 to 6-22 suffered no cracks nor delamination after the continuous production of 100,000 copies. It was thus confirmed that the use of the diphenylamine compound of the formula (1-6) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 6-23, 6-24

Electrophotosensitive materials of Examples 6-23, 6-24 were fabricated the same way as in Examples 6-17, 6-18 except that the same procedure as in Examples 1-25, 1-26 and Comparative Example 1-5 was taken to form a μm surface protective layer of amorphous silicon-nitrogen (SiN) composite film having a thickness of 0.5.m, instead of the silicon-carbon composite film, over the surface of the multi-layer photosensitive layer.

Examples 6-25, 6-26

Electrophotosensitive materials of Examples 6-25, 6-26 were fabricated the same way as in Examples 6-17, 6-18 except that the same procedure as in Examples 1-27, 1-28 and Comparative Example 1-6 was taken to form a μm surface protective layer of amorphous carbon-nitrogen (CN) composite film having a thickness of 0.5.m, instead of the silicon-carbon composite film, over the surface of the multi-layer photosensitive layer.

Examples 6-27, 6-28

Electrophotosensitive materials of Examples 6-27, 6-28 were fabricated the same way as in Examples 6-17, 6-18 except that the same procedure as in Examples 1-29, 1-30 and Comparative Example 1-7 was taken to form a μm surface protective layer of amorphous carbon-boron (CB) composite film having a thickness of 0.5.m, instead of the silicon-carbon composite film, over the surface of the multi-layer photosensitive layer.

Examples 6-29, 6-30

Electrophotosensitive materials of Examples 6-29, 6-30 were fabricated the same way as in Examples 6-17, 6-18 except that the same procedure as in Examples 1-31, 1-32 and Comparative Example 1-8 was taken to form a μm surface protective layer of amorphous carbon-fluorine (CF) composite film having a thickness of 0.5.m, instead of the silicon-carbon composite film, over the surface of the multi-layer photosensitive layer.

Examples 6-31, 6-32

Electrophotosensitive materials of Examples 6-31, 6-32 were fabricated the same way as in Examples 6-17, 6-18 except that the same procedure as in Examples 1-33, 1-34 and Comparative Example 1-9 was taken to form a μm surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-14 to 2-18, are listed in Table 36.

TABLE 36

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 6-23 | a-SiN | 1-6-2 | −814 | −64 | 0.934 | ○ | ○ | ○ | ○ |
| Ex. 6-24 | a-SiN | 1-6-6 | −793 | −70 | 0.903 | ○ | ○ | ○ | ○ |
| C.Ex.2-14 | a-SiN | HT-3 | −785 | −149 | 1.095 | ○ | x | — | — |
| Ex. 6-25 | a-CN | 1-6-2 | −812 | −62 | 0.934 | ○ | ○ | ○ | ○ |
| Ex. 6-26 | a-CN | 1-6-6 | −785 | −60 | 0.903 | ○ | ○ | ○ | ○ |
| C.Ex.2-15 | a-CN | HT-3 | −793 | −148 | 1.155 | Δ | x | — | — |
| Ex. 6-27 | a-CB | 1-6-2 | −806 | −66 | 0.924 | ○ | ○ | ○ | ○ |
| Ex. 6-28 | a-CB | 1-6-6 | −798 | −66 | 0.895 | ○ | ○ | ○ | ○ |
| C.Ex.2-16 | a-CB | HT-3 | −793 | −137 | 0.979 | Δ | x | — | — |
| Ex. 6-29 | a-CF | 1-6-2 | −780 | −64 | 0.923 | ○ | ○ | ○ | ○ |
| Ex. 6-30 | a-CF | 1-6-6 | −785 | −70 | 0.914 | ○ | ○ | ○ | ○ |
| C.Ex.2-17 | a-CF | HT-3 | −793 | −139 | 1.021 | Δ | x | — | — |
| Ex. 6-31 | a-BN | 1-6-2 | −814 | −70 | 0.913 | ○ | ○ | ○ | ○ |
| Ex. 6-32 | a-BN | 1-6-6 | −804 | −66 | 0.885 | ○ | ○ | ○ | ○ |
| C.Ex.2-18 | a-BN | HT-3 | −780 | −117 | 0.904 | ○ | x | — | — |

It was confirmed from the table that if the type of the surface protective layer is further changed, the same results as the above are obtained according to the compositions of the charge transport layer of the multi-layer photosensitive layer as the base.

Specifically, all the electrophotosensitive materials of Examples 6-23 to 6-32 suffered no cracks nor delamination after the continuous production of 100,000 copies. It was thus confirmed that the use of the diphenylamine compound of the formula (1-6) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 6-17 to 6-32 but no surface protective layer, as well as on those of Examples 6-17 to 6-32, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 2-10 to 2-18 that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layer, the electrophotosensitive materials of Examples 6-17 to 6-32 wherein the multi-layer photosensitive layers contain the diphenylamine compound of the formula (1-6) accomplish a notable increase in the durability by virtue of the formation of the surface protective layer.

Forming Surface Protective Layer

The plasma CVD process was performed under the same conditions as in Example 1-1, thereby forming a surface protective layer of amorphous silicon-carbon (SiC) composite film having a thickness of 0.5.m over the surface of the single-layer photosensitive layer. Thus was fabricated an electrophotosensitive material of Example 7-1.

Examples 7-2, 7-3

Electrophotosensitive materials of Examples 7-2, 7-3 were fabricated the same way as in Example 7-1 except that each of the examples used 100 parts by weight of diphenylamine compound of the formula of a number listed in the following Table 37 as the positive-hole transport material.

The electrophotosensitive materials of the above examples were subjected to the same photosensitivity test I and durability test I as the above and were evaluated for the characteristics thereof. The results, along with the aforementioned results of Comparative Examples 2-1, 2-2, are listed in Table 37.

TABLE 37

| | | | | | | | Durability Test | | | | |
|---|---|---|---|---|---|---|---|---|---|---|---|
| | SPL | P-HTM | ETM | SP $V_0$(V) | RP Vr(V) | HLE $E_{1/2}$($\mu$J/cm$^2$) | 10,000 copies | 20,000 copies | 30,000 copies | 50,000 copies | 100,000 copies |
| Ex. 7-1 | a-SiC | 1-7-12 | ET-1 | 817 | 120 | 0.800 | ○ | ○ | ○ | ○ | ○ |
| Ex. 7-2 | a-SiC | 1-7-14 | ET-1 | 803 | 129 | 0.870 | ○ | ○ | ○ | ○ | ○ |
| Ex. 7-3 | a-SiC | 1-7-22 | ET-1 | 792 | 125 | 0.842 | ○ | ○ | ○ | ○ | ○ |
| C.Ex.2-1 | a-SiC | HT-1 | ET-1 | 814 | 154 | 1.112 | ○ | Δ | x | — | — |
| C.Ex.2-2 | a-SiC | HT-3 | ET-1 | 780 | 180 | 1.226 | ○ | x | — | — | — |

Single-Layer Electrophotosensitive Material

Example 7-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-7-12); 80 parts by weight of 2,6-dimethyl-2,6'-t-butylbenzoquinone as the electron transport material represented by the formula (ET-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 $\mu$m.

It was found from the table that all the electrophotosensitive materials of Examples 7-1 to 7-3 suffered no cracks nor delamination after the continuous production of 100,000 copies. It was thus confirmed that the use of the diphenylamine compound of the formula (1-7) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 7-4 to 7-6

Electrophotosensitive materials of Examples 7-4 to 7-6 were fabricated the same way as in Examples 7-1 to 7-3 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-3, 2-4, are listed in Table 38.

TABLE 38

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 7-4 | a-C | 1-7-12 | ET-1 | 809 | 115 | 0.820 | ○ | ○ | ○ | ○ | ○ |
| Ex. 7-5 | a-C | 1-7-14 | ET-1 | 804 | 121 | 0.882 | ○ | ○ | ○ | ○ | ○ |
| Ex. 7-6 | a-C | 1-7-22 | ET-1 | 798 | 120 | 0.855 | ○ | ○ | ○ | ○ | ○ |
| C.Ex.2-3 | a-C | HT-1 | ET-1 | 788 | 157 | 1.150 | ○ | Δ | x | — | — |
| C.Ex.2-4 | a-C | HT-3 | ET-1 | 809 | 167 | 1.218 | ○ | Δ | x | — | — |

It was confirmed from the table that if the type of the surface protective layer is changed, the same results as the above are obtained according to the compositions of the single-layer photosensitive layer as the base.

Specifically, all the electrophotosensitive materials of Examples 7-4 to 7-6 suffered no cracks nor delamination after the continuous production of 100,000 copies. It was thus confirmed that the use of the diphenylamine compound of the formula (1-7) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 7-7, 7-8

Electrophotosensitive materials of Examples 7-7, 7-8 were fabricated the same way as in Examples 7-1, 7-3 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the single-layer photosensitive layer.

Examples 7-9, 7-10

Electrophotosensitive materials of Examples 7-9, 7-10 were fabricated the same way as in Examples 7-1, 7-3 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the single-layer photosensitive layer.

Examples 6-11, 6-12

Electrophotosensitive materials of Examples 7-11, 7-12 were fabricated the same way as in Examples 7-1, 7-3 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the single-layer photosensitive layer.

Examples 7-13, 7-14

Electrophotosensitive materials of Examples 7-13, 7-14 were fabricated the same way as in Examples 7-1, 7-3 except that the same procedure as in Examples 1-31, 1-32 and Comparative Example 1-8 was taken to form a $\mu$m surface protective layer of amorphous carbon-fluorine (CF) composite film having a thickness of 0.5.m, instead of the silicon-carbon composite film, over the surface of the single-layer photosensitive layer.

Examples 7-15, 7-16

Electrophotosensitive materials of Examples 7-15, 7-16 were fabricated the same way as in Examples 7-1, 7-3 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-5 to 2-9, are listed in Table 39.

TABLE 39

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 7-7 | a-SiN | 1-7-12 | ET-1 | 804 | 128 | 0.861 | ○ | ○ | ○ | ○ | ○ |
| Ex. 7-8 | a-SiN | 1-7-22 | ET-1 | 794 | 129 | 0.890 | ○ | ○ | ○ | ○ | ○ |
| C.Ex.2-5 | a-SiN | HT-3 | ET-1 | 798 | 187 | 1.334 | ○ | Δ | x | — | — |
| Ex. 7-9 | a-CN | 1-7-12 | ET-1 | 812 | 125 | 0.897 | ○ | ○ | ○ | ○ | ○ |
| Ex. 7-10 | a-CN | 1-7-22 | ET-1 | 814 | 136 | 0.927 | ○ | ○ | ○ | ○ | ○ |

TABLE 39-continued

| | SPL | P-HTM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| C.Ex.2-6 | a-CN | HT-3 | ET-1 | 801 | 194 | 1.389 | ○ | Δ | x | — | — |
| Ex. 7-11 | a-CB | 1-7-12 | ET-1 | 801 | 114 | 0.797 | ○ | ○ | ○ | ○ | ○ |
| Ex. 7-12 | a-CB | 1-7-22 | ET-1 | 809 | 113 | 0.824 | ○ | ○ | ○ | ○ | ○ |
| C.Ex.2-7 | a-CB | HT-3 | ET-1 | 798 | 166 | 1.235 | ○ | x | — | — | — |
| Ex. 7-13 | a-CF | 1-7-12 | ET-1 | 814 | 116 | 0.829 | ○ | ○ | ○ | ○ | ○ |
| Ex. 7-14 | a-CF | 1-7-22 | ET-1 | 804 | 127 | 0.857 | ○ | ○ | ○ | ○ | ○ |
| C.Ex.2-8 | a-CF | HT-3 | ET-1 | 782 | 180 | 1.284 | Δ | x | — | — | — |
| Ex. 7-15 | a-BN | 1-7-12 | ET-1 | 801 | 109 | 0.767 | ○ | ○ | ○ | ○ | ○ |
| Ex. 7-16 | a-BN | 1-7-22 | ET-1 | 780 | 114 | 0.787 | ○ | ○ | ○ | ○ | ○ |
| C.Ex.2-9 | a-BN | HT-3 | ET-1 | 788 | 155 | 1.165 | ○ | Δ | x | — | — |

It was confirmed from the table that if the type of the surface protective layer is further changed, the same results as the above are obtained according to the compositions of the single-layer photosensitive layer as the base.

Specifically, all the electrophotosensitive materials of Examples 7-7 to 7-16 suffered no cracks nor delamination after the continuous production of 100,000 copies. It was thus confirmed that the use of the diphenylamine compound of the formula (1-7) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 7-1 to 7-16 but no surface protective layer, as well as on those of Examples 7-1 to 7-16, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 2-1 to 2-9 that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 7-1 to 7-16 wherein the single-layer photosensitive layers contain the diphenylamine compound of the formula (1-7) accomplish a notable increase in the durability by virtue of the formation of the surface protective layer.

Multi-Layer Electrophotosensitive Material

Example 1-17

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 $\mu$m.

The ball mill was operated for dispersing by mixing 0.8 parts by weight of diphenylamine compound as the positive-hole transport material represented by the formula (1-7-12), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 $\mu$m. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 $\mu$m. Thus was fabricated an electrophotosensitive material of Example 7-17.

Examples 7-18, 7-19

Electrophotosensitive materials of Examples 7-18, 7-19 were fabricated the same way as in Example 7-17 except that each of the examples used 0.8 parts by weight of diphenylamine compound of the formula of a number listed in the following Table 40 as the positive-hole transport material.

The electrophotosensitive materials of the above examples were subjected to the same photosensitivity test II and durability test II as the above and were evaluated for the characteristics thereof. The results, along with the aforementioned results of Comparative Examples 2-10, 2-11, are listed in Table 40.

TABLE 40

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 7-17 | a-SiC | 1-7-12 | −793 | −75 | 0.667 | ○ | ○ | ○ | ○ |
| Ex. 7-18 | a-SiC | 1-7-14 | −801 | −70 | 0.654 | ○ | ○ | ○ | ○ |
| Ex. 7-19 | a-SiC | 1-7-22 | −814 | −77 | 0.681 | ○ | ○ | ○ | ○ |
| CEx.2-10 | a-SiC | HT-1 | −806 | −165 | 0.938 | ○ | x | — | — |
| CEx.2-11 | a-SiC | HT-3 | −814 | −147 | 1.024 | ○ | x | — | — |

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, all the electrophotosensitive materials of Examples 7-17 to 7-19 suffered no cracks nor delamination after the continuous production of 100,000 copies. It was thus confirmed that the use of the diphenylamine compound of the formula (1-7) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 7-20 to 7-22

Electrophotosensitive materials of Examples 7-20 to 7-22 were fabricated the same way as in Examples 7-17 to 7-19 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-12, 2-13, are listed in Table 41.

TABLE 41

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 7-20 | a-C | 1-7-12 | −806 | −69 | 0.672 | ○ | ○ | ○ | ○ |
| Ex. 7-21 | a-C | 1-7-14 | −790 | −73 | 0.674 | ○ | ○ | ○ | ○ |
| Ex. 7-22 | a-C | 1-7-22 | −812 | −77 | 0.680 | ○ | ○ | ○ | ○ |
| CEx.2-12 | a-C | HT-1 | −785 | −172 | 1.216 | ○ | x | — | — |
| CEx.2-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, all the electrophotosensitive materials of Examples 7-20 to 7-22 suffered no cracks nor delamination after the continuous production of 100,000 copies. It was thus confirmed that the use of the diphenylamine compound of the formula (1-7) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 7-23, 7-24

Electrophotosensitive materials of Examples 7-23, 7-24 were fabricated the same way as in Examples 7-17, 7-19 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the multi-layer photosensitive layer.

Examples 7-25, 7-26

Electrophotosensitive materials of Examples 7-25, 7-26 were fabricated the same way as in Examples 7-17, 7-19 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the multi-layer photosensitive layer.

Examples 7-27, 7-28

Electrophotosensitive materials of Examples 7-27, 7-28 were fabricated the same way as in Examples 7-17, 7-19 except that the same procedure as in Examples 1-29, 1-30 and Comparative Example 1-7 was taken to form a μm surface protective layer of amorphous carbon-boron (CB) composite film having a thickness of 0.5.m, instead of the silicon-carbon composite film, over the surface of the multi-layer photosensitive layer.

Examples 7-29, 7-30

Electrophotosensitive materials of Examples 7-29, 7-30 were fabricated the same way as in Examples 7-17, 7-19 except that the same procedure as in Examples 1-31, 1-32 and Comparative Example 1-8 was taken to form a μm surface protective layer of amorphous carbon-fluorine (CF) composite film having a thickness of 0.5.m, instead of the silicon-carbon composite film, over the surface of the multi-layer photosensitive layer.

Examples 7-31, 7-32

Electrophotosensitive materials of Examples 7-31, 7-32 were fabricated the same way as in Examples 7-17, 7-18 except that the same procedure as in Examples 1-33, 1-34 and Comparative Example 1-9 was taken to form a μm surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-14 to 2-18, are listed in Table 42.

TABLE 42

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 7-23 | a-SiN | 1-7-12 | −806 | −68 | 0.674 | ○ | ○ | ○ | ○ |
| Ex. 7-24 | a-SiN | 1-7-22 | −817 | −69 | 0.678 | ○ | ○ | ○ | ○ |
| C.Ex.2-14 | a-SiN | HT-3 | −785 | −149 | 1.095 | ○ | x | — | — |
| Ex. 7-25 | a-CN | 1-7-12 | −812 | −71 | 0.688 | ○ | ○ | ○ | ○ |
| Ex. 7-26 | a-CN | 1-7-22 | −785 | −74 | 0.695 | ○ | ○ | ○ | ○ |
| C.Ex.2-15 | a-CN | HT-3 | −793 | −148 | 1.155 | Δ | x | — | — |
| Ex. 7-27 | a-CB | 1-7-12 | −806 | −70 | 0.602 | ○ | ○ | ○ | ○ |
| Ex. 7-28 | a-CB | 1-7-22 | −798 | −68 | 0.613 | ○ | ○ | ○ | ○ |
| C.Ex.2-16 | a-CB | HT-3 | −793 | −137 | 0.979 | Δ | x | — | — |
| Ex. 7-29 | a-CF | 1-7-12 | −780 | −75 | 0.672 | ○ | ○ | ○ | ○ |
| Ex. 7-30 | a-CF | 1-7-22 | −785 | −78 | 0.632 | ○ | ○ | ○ | ○ |
| C.Ex.2-17 | a-CF | HT-3 | −793 | −139 | 1.021 | Δ | x | — | — |
| Ex. 7-31 | a-BN | 1-7-12 | −814 | −58 | 0.590 | ○ | ○ | ○ | ○ |
| Ex. 7-32 | a-BN | 1-7-22 | −804 | −60 | 0.604 | ○ | ○ | ○ | ○ |
| C.Ex.2-18 | a-BN | HT-3 | −780 | −117 | 0.904 | ○ | x | — | — |

It was confirmed from the table that if the type of the surface protective layer is further changed, the same results as the above are obtained according to the compositions of the charge transport layer of the multi-layer photosensitive layer as the base.

Specifically, all the electrophotosensitive materials of Examples 7-23 to 7-32 suffered no cracks nor delamination after the continuous production of 100,000 copies. It was thus confirmed that the use of the diphenylamine compound of the formula (1-7) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 7-17 to 7-32 but no surface protective layer, as well as on those of Examples 7-17 to 7-32, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 2-10 to 2-18 that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 7-17 to 7-32 wherein the multi-layer photosensitive layers contain the diphenylamine compound of the formula (1-7) accomplish a notable increase in the durability by virtue of the formation of the surface protective layer similarly to the examples with the single-layer photosensitive layer.

Single-Layer Electrophotosensitive Material

Example 8-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 80 parts by weight of diphenylamine compound as the positive-hole transport material represented by the formula (1-8-2); 40 parts by weight of 2,6-dimethyl-2',6'-t-butylbenzoquinone as the electron transport material represented by the formula (ET-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 μm.

Forming Surface Protective Layer

The plasma CVD process was performed under the same conditions as in Example 1-1, thereby forming a surface protective layer of amorphous silicon-carbon (SiC) composite film having a thickness of 0.5.m over the surface of the single-layer photosensitive layer. Thus was fabricated an electrophotosensitive material of Example 8-1.

Examples 8-2 to 8-4

Electrophotosensitive materials of Examples 8-2 to 8-4 were fabricated the same way as in Example 8-1 except that each of the examples used 80 parts by weight of diphenylamine compound of the formula of a number listed in the following Table 43 as the positive-hole transport material.

Comparative Example 8-1

An electrophotosensitive material of Comparative Example 8-1 was fabricated the same way as in Example 8-1, except that 100 parts by weight of polyvinylcarbazole (number-average molecular weight Mn=9,500) was used instead of 80 parts by weight of diphenylamine compound as the positive-hole transport material and 100 parts by weight of Z-type polycarbonate as the binder resin, the polyvinylcarbazole serving not only as the positive-hole transport material but also as the binder resin and having the repeated unit represented by the formula (HT-1).

Comparative Example 8-2

An electrophotosensitive material of Comparative Example 8-2 was fabricated the same way as in Example 8-1, except that 100 parts by weight of diethylaminobenzaldehyde diphenylhydrazone represented by the formula (HT-3) was used as the positive-hole transport material.

The electrophotosensitive materials of the above examples and comparative examples were subjected to the same photosensitivity test I and durability test I as the above and were evaluated for the characteristics thereof. The results are listed in Table 43.

TABLE 43

| | SPL | P-H TM | ETM | SP $V_0$(V) | RP Vr(V) | HLE $E_{1/2}$(μJ/cm²) | Durability Test 10,000 copies | 20,000 copies | 30,000 copies | 50,000 copies | 100,000 copies |
|---|---|---|---|---|---|---|---|---|---|---|---|
| Ex. 8-1 | a-SiC | 1-8-2 | ET-1 | 793 | 128 | 0.661 | ○ | ○ | ○ | ○ | ○ |
| Ex. 8-2 | a-SiC | 1-8-4 | ET-1 | 809 | 119 | 0.629 | ○ | ○ | ○ | ○ | ○ |
| Ex. 8-3 | a-SiC | 1-8-6 | ET-1 | 798 | 129 | 0.696 | ○ | ○ | ○ | ○ | ○ |
| Ex. 8-4 | a-SiC | 1-8-10 | ET-1 | 804 | 122 | 0.688 | ○ | ○ | ○ | ○ | ○ |
| C.Ex.8-1 | a-SiC | HT-1 | ET-1 | 814 | 154 | 1.112 | ○ | Δ | x | — | — |
| C.Ex.8-2 | a-SiC | HT-3 | ET-1 | 780 | 180 | 1.226 | ○ | x | — | — | — |

It was found from the table that the electrophotosensitive material of Comparative Example 8-1 and that of Comparative Example 8-2 suffered the delamination of the surface protective layer after the continuous production of 30,000 copies and of 20,000 copies, respectively. This indicates that the compounds used in these comparative examples were not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 8-1 to 8-4 suffered no cracks nor delamination of the surface protective layer after the continuous production of 100,000 copies. It was thus confirmed that the use of the diphenylamine compound of the formula (1-8) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 8-5 to 8-8, Comparative Examples 8-3, 8-4

Electrophotosensitive materials of Examples 8-5 to 8-8 and Comparative Examples 8-3, 8-4 were fabricated the same way as in Examples 8-1 to 8-4 and Comparative Examples 8-1, 8-2 except that the same procedure as in Examples 1-13 to 1-24 and Comparative Examples 1-3, 1-4 was taken to form a μm surface protective layer of amorphous carbon (C) having a thickness of 0.5.m, instead of the silicon-carbon composite film, over the surface of the single-layer photosensitive layer.

The electrophotosensitive materials of the above examples and comparative examples were subjected to the same photosensitivity test I and durability test I as the above and were evaluated for the characteristics thereof. The results are listed in Table 44.

TABLE 44

| | SPL | P-HTM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 8-5 | a-C | 1-8-2 | ET-1 | 785 | 130 | 0.680 | ○ | ○ | ○ | ○ | ○ |
| Ex. 8-6 | a-C | 1-8-4 | ET-1 | 782 | 129 | 0.648 | ○ | ○ | ○ | ○ | ○ |
| Ex. 8-7 | a-C | 1-8-6 | ET-1 | 788 | 139 | 0.716 | ○ | ○ | ○ | ○ | ○ |
| Ex. 8-8 | a-C | 1-8-10 | ET-1 | 814 | 138 | 0.708 | ○ | ○ | ○ | ○ | ○ |
| C.Ex.8-3 | a-C | HT-1 | ET-1 | 788 | 157 | 1.150 | ○ | Δ | x | — | — |
| C.Ex.8-4 | a-C | HT-3 | ET-1 | 809 | 167 | 1.218 | ○ | Δ | x | — | — |

It was confirmed from the table that if the type of the surface protective layer is changed, the same results as the above are obtained according to the compositions of the single-layer photosensitive layer as the base.

Specifically, it was found that both the electrophotosensitive materials of Comparative Examples 8-3, 8-4 already sustained cracks spread over the surface protective layer after the continuous production of 20,000 copies and suffered the delamination of the surface protective layer after the continuous production of 30,000 copies. These indicate that the compounds used in these comparative examples are not effective to improve the physical stability of the inorganic surface protective layer.

Additionally, the electrophotosensitive materials of these comparative examples were found to be seriously decreased in photosensitivity when formed with the surface protective layer, because they presented high residual potentials after light exposure and large half-life exposures.

In contrast, all the electrophotosensitive materials of Examples 8-5 to 8-8 suffered no cracks nor delamination after the continuous production of 100,000 copies. It was thus confirmed that the use of the diphenylamine compound of the formula (1-8) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 8-9, 8-10, Comparative Example 8-5

Electrophotosensitive materials of Examples 8-9, 8-10 and Comparative Example 8-5 were fabricated the same way as in Examples 8-1, 8-2 and Comparative Example 8-2 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the single-layer photosensitive layer.

Examples 8-11, 8-12, Comparative Example 8-6

Electrophotosensitive materials of Examples 8-11, 8-12 and Comparative Example 8-6 were fabricated the same way as in Examples 8-1, 8-2 and Comparative Example 8-2 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the single-layer photosensitive layer.

Examples 8-13, 8-14, Comparative Example 8-7

Electrophotosensitive materials of Examples 8-13, 8-14 and Comparative Example 8-7 were fabricated the same way as in Examples 8-1, 8-2 and Comparative Example 8-2except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the single-layer photosensitive layer.

Examples 8-15, 8-16, Comparative Example 8-8

Electrophotosensitive materials of Examples 8-15, 8-16 and Comparative Example 8-8 were fabricated the same way as in Examples 8-1, 8-2 and Comparative Example 8-2 except that the same procedure as in Examples 1-31 , 1-32 and Comparative Example 1-8 was taken to form a $\mu$m surface protective layer of amorphous carbon-fluorine (CF) composite film having a thickness of 0.5.m, instead of the silicon-carbon composite film, over the surface of the single-layer photosensitive layer.

Examples 8-17, 8-18, Comparative Example 8-9

Electrophotosensitive materials of Examples 8-17, 8-18 and Comparative Example 8-9 were fabricated the same way as in Examples 8-1, 8-2 and Comparative Example 8-2 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the single-layer photosensitive layer.

The electrophotosensitive materials of the above examples and comparative examples were subjected to the same photosensitivity test I and durability test I as the above and were evaluated for the characteristics thereof. The results are listed in Table 45.

TABLE 45

| | SPL | P-HTM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 8-9 | a-SiN | 1-8-2 | ET-1 | 793 | 155 | 0.681 | ○ | ○ | ○ | ○ | ○ |
| Ex. 8-10 | a-SiN | 1-8-4 | ET-1 | 809 | 148 | 0.648 | ○ | ○ | ○ | ○ | ○ |
| C.Ex.8-5 | a-SiN | HT-3 | ET-1 | 798 | 187 | 1.334 | ○ | Δ | x | — | — |
| Ex. 8-11 | a-CN | 1-8-2 | ET-1 | 804 | 157 | 0.75 | ○ | ○ | ○ | ○ | ○ |
| Ex. 8-12 | a-CN | 1-8-4 | ET-1 | 790 | 155 | 0.715 | ○ | ○ | ○ | ○ | ○ |
| C.Ex.8-6 | a-CN | HT-3 | ET-1 | 801 | 194 | 1.389 | ○ | Δ | x | — | — |
| Ex. 8-13 | a-CB | 1-8-2 | ET-1 | 785 | 153 | 0.601 | ○ | ○ | ○ | ○ | ○ |
| Ex. 8-14 | a-CB | 1-8-4 | ET-1 | 814 | 150 | 0.572 | ○ | ○ | ○ | ○ | ○ |
| C.Ex.8-7 | a-CB | HT-3 | ET-1 | 798 | 166 | 1.235 | ○ | x | — | — | — |
| Ex. 8-15 | a-CF | 1-8-2 | ET-1 | 806 | 165 | 0.681 | ○ | ○ | ○ | ○ | ○ |
| Ex. 8-16 | a-CF | 1-8-4 | ET-1 | 785 | 152 | 0.648 | ○ | ○ | ○ | ○ | ○ |
| C.Ex.8-8 | a-CF | HT-3 | ET-1 | 782 | 180 | 1.284 | Δ | x | — | — | — |
| Ex. 8-17 | a-BN | 1-8-2 | ET-1 | 782 | 135 | 0.550 | ○ | ○ | ○ | ○ | ○ |
| Ex. 8-18 | a-BN | 1-8-4 | ET-1 | 788 | 123 | 0.524 | ○ | ○ | ○ | ○ | ○ |
| C.Ex.8-9 | a-BN | HT-3 | ET-1 | 788 | 155 | 1.165 | ○ | Δ | x | — | — |

It was confirmed from the table that if the type of the surface protective layer is further changed, the same results as the above are obtained according to the compositions of the single-layer photosensitive layer as the base.

Specifically, it was found that both the electrophotosensitive materials of Comparative Examples 8-7, 8-8 already sustained cracks spread over the surface protective layer after the continuous production of 20,000 copies and that those of Comparative Examples 8-5, 8-6, 8-9 suffered the delamination of the surface protective layer after the continuous production of 30,000 copies. Particularly in the electrophotosensitive material of Comparative Example 8-8, cracks spread over the surface protective layer were already observed after the continuous production of 10,000 copies. These indicate that the compounds used in these comparative examples are not effective to improve the physical stability of the inorganic surface protective layer.

Additionally, the electrophotosensitive materials of these comparative examples were found to be seriously decreased in photosensitivity when formed with the surface protective layer, because they presented high residual potentials after light exposure and large half-life exposures.

In contrast, all the electrophotosensitive materials of Examples 8-9 to 8-18 suffered no cracks nor delamination after the continuous production of 100,000 copies. It was thus confirmed that the use of the diphenylamine compound of the formula (1-8) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 8-1 to 8-18 but no surface protective layer, as well as on those of Examples 8-1 to 8-18, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

Similarly, the durability test I was conducted on the electrophotosensitive materials having the same photosensitive layers as Comparative Examples 8-1 to 8-9 but no surface protective layer. The electrophotosensitive materials having the same photosensitive layers as Comparative Examples 8-1, 8-3 provided images which were decreased in image density to suffer white spots in solid black image areas after the production of about 20,000 copies. The other electrophotosensitive materials provided such images after the production of 30,000 to 50,000 copies. By comparing these results with the results of the durability test I on the corresponding comparative examples, it is found that the surface protective layers over the photosensitive layers of the comparative examples contribute no increase in the durability or rather reduce the durability.

In other words, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 8-1 to 8-18 wherein the single-layer photosensitive layers contain the diphenylamine compound of the formula (1-8) accomplish a notable increase in the durability by virtue of the formation of the surface protective layer.

Multi-Layer Electrophotosensitive Material

Example 8-19

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 $\mu$m.

The ball mill was operated for dispersing by mixing 0.8 parts by weight of diphenylamine compound as the positive-hole transport material represented by the formula (1-8-2), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 μm. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 μm. Thus was fabricated an electrophotosensitive material of Example 8-19.

Examples 8-20 to 8-22

Electrophotosensitive materials of Examples 8-20 to 8-22 were fabricated the same way as in Example 8-19 except that each of the examples used 0.8 parts by weight of diphenylamine compound of the formula of a number listed in the following Table 46 as the positive-hole transport material.

The electrophotosensitive materials of the above examples were subjected to the same photosensitivity test II and durability test II as the above and were evaluated for the characteristics thereof. The results, along with the aforementioned results of Comparative Examples 2-10, 2-11, are listed in Table 46.

Specifically, all the electrophotosensitive materials of Examples 8-19 to 8-22 suffered no cracks nor delamination after the continuous production of 100,000 copies. It was thus confirmed that the use of the diphenylamine compound of the formula (1-8) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 8-23 to 8-26

Electrophotosensitive materials of Examples 8-23 to 8-26 were fabricated the same way as in Examples 8-19 to 8-22 except that the same procedure as in Examples 1-13 to 1-24 and Comparative Examples 1-3, 1-4 was taken to form a μm surface protective layer of amorphous carbon (C) having a thickness of 0.5.m, instead of the silicon-carbon composite film, over the surface of the multi-layer photosensitive layer.

TABLE 46

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 8-19 | a-SiC | 1-8-2 | −814 | −110 | 0.699 | ○ | ○ | ○ | ○ |
| Ex. 8-20 | a-SiC | 1-8-4 | −782 | −103 | 0.666 | ○ | ○ | ○ | ○ |
| Ex. 8-21 | a-SiC | 1-8-6 | −793 | −106 | 0.736 | ○ | ○ | ○ | ○ |
| Ex. 8-22 | a-SiC | 1-8-10 | −817 | −108 | 0.729 | ○ | ○ | ○ | ○ |
| CEx.2-10 | a-SiC | HT-1 | −806 | −165 | 0.938 | ○ | x | — | — |
| CEx.2-11 | a-SiC | HT-3 | −814 | −147 | 1.024 | ○ | x | — | — |

It was confirmed from the table that if the single-layer photosensitive layer is replaced by the multi-layer photosensitive layer, the same results as the above are obtained according to the compositions of the charge-transport layer defining the outermost part of the electrophotosensitive material.

The electrophotosensitive materials of the above examples were subjected to the same photosensitivity test II and durability test II as the above and were evaluated for the characteristics thereof. The results, along with the aforementioned results of Comparative Examples 2-12, 2-13, are listed in Table 47.

TABLE 47

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 8-23 | a-C | 1-8-2 | −809 | −113 | 0.749 | ○ | ○ | ○ | ○ |
| Ex. 8-24 | a-C | 1-8-4 | −790 | −108 | 0.714 | ○ | ○ | ○ | ○ |
| Ex. 8-25 | a-C | 1-8-6 | −782 | −117 | 0.789 | ○ | ○ | ○ | ○ |
| Ex. 8-26 | a-C | 1-8-10 | −785 | −110 | 0.781 | ○ | ○ | ○ | ○ |
| CEx.2-12 | a-C | HT-1 | −785 | −172 | 1.216 | ○ | x | — | — |
| CEx.2-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, all the electrophotosensitive materials of Examples 8-23 to 8-26 suffered no cracks nor delamination after the continuous production of 100,000 copies. It was thus confirmed that the use of the diphenylamine compound of the formula (1-8) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 8-27, 8-28

Electrophotosensitive materials of Examples 8-27, 8-28 were fabricated the same way as in Examples 8-19, 8-20 except that the same procedure as in Examples 1-25, 1-26 and Comparative Example 1-5 was taken to form a μm surface protective layer of amorphous silicon-nitrogen (SiN) composite film having a thickness of 0.5.m, instead of the silicon-carbon composite film, over the surface of the multi-layer photosensitive layer.

Examples 8-29, 8-30

Electrophotosensitive materials of Examples 8-29, 8-30 were fabricated the same way as in Examples 8-19, 8-20 except that the same procedure as in Examples 1-27, 1-28 and Comparative Example 1-6 was taken to form a μm surface protective layer of amorphous carbon-nitrogen (CN) composite film having a thickness of 0.5.m, instead of the silicon-carbon composite film, over the surface of the multi-layer photosensitive layer.

Examples 8-31, 8-32

Electrophotosensitive materials of Examples 8-31, 8-32 were fabricated the same way as in Examples 8-19, 8-20 except that the same procedure as in Examples 1-29, 1-30 and Comparative Example 1-7 was taken to form a μm surface protective layer of amorphous carbon-boron (CB) composite film having a thickness of 0.5.m, instead of the silicon-carbon composite film, over the surface of the multi-layer photosensitive layer.

Examples 8-33, 8-34

Electrophotosensitive materials of Examples 8-33, 8-34 were fabricated the same way as in Examples 8-19, 8-20 except that the same procedure as in Examples 1-31, 1-32 and Comparative Example 1-8 was taken to form a μm surface protective layer of amorphous carbon-fluorine (CF) composite film having a thickness of 0.5.m, instead of the silicon-carbon composite film, over the surface of the multi-layer photosensitive layer.

Examples 8-35, 8-36

Electrophotosensitive materials of Examples 8-35, 8-36 were fabricated the same way as in Examples 8-19, 8-20 except that the same procedure as in Examples 1-33, 1-34 and Comparative Example 1-9 was taken to form a μm surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-14 to 2-18, are listed in Table 48.

TABLE 48

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 8-27 | a-SiN | 1-8-2 | −817 | −115 | 0.749 | ○ | ○ | ○ | ○ |
| Ex. 8-28 | a-SiN | 1-8-4 | −814 | −100 | 0.714 | ○ | ○ | ○ | ○ |
| C.Ex.2-14 | a-SiN | HT-3 | −785 | −149 | 1.095 | ○ | x | — | — |
| Ex. 8-29 | a-CN | 1-8-2 | −796 | −108 | 0.749 | ○ | ○ | ○ | ○ |
| Ex. 8-30 | a-CN | 1-8-4 | −812 | −110 | 0.714 | ○ | ○ | ○ | ○ |
| C.Ex.2-15 | a-CN | HT-3 | −793 | −148 | 1.155 | Δ | x | — | — |
| Ex. 8-31 | a-CB | 1-8-2 | −806 | −110 | 0.680 | ○ | ○ | ○ | ○ |
| Ex. 8-32 | a-CB | 1-8-4 | −812 | −95 | 0.647 | ○ | ○ | ○ | ○ |
| C.Ex.2-16 | a-CB | HT-3 | −793 | −137 | 0.979 | Δ | x | — | — |
| Ex. 8-33 | a-CF | 1-8-2 | −780 | −108 | 0.680 | ○ | ○ | ○ | ○ |
| Ex. 8-34 | a-CF | 1-8-4 | −785 | −103 | 0.647 | ○ | ○ | ○ | ○ |
| C.Ex.2-17 | a-CF | HT-3 | −793 | −139 | 1.021 | Δ | x | — | |
| Ex. 8-35 | a-BN | 1-8-2 | −817 | −90 | 0.600 | ○ | ○ | ○ | ○ |
| Ex. 8-36 | a-BN | 1-8-4 | −796 | −88 | 0.571 | ○ | ○ | ○ | ○ |
| C.Ex.2-18 | a-BN | HT-3 | −780 | −117 | 0.904 | ○ | x | — | — |

It was confirmed from the table that if the type of the surface protective layer is further changed, the same results as the above are obtained according to the compositions of the charge transport layer of the multi-layer photosensitive layer as the base.

Specifically, all the electrophotosensitive materials of Examples 8-27 to 8-36 suffered no cracks nor delamination after the continuous production of 100,000 copies. It was thus confirmed that the use of the diphenylamine compound of the formula (1-8) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 8-19 to 8-36 but no surface protective layer, as well as on those of Examples 8-19 to 8-36, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

It was discovered from the results as well as the results of the analogous study on Comparative Examples 2-10 to 2-18 that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 8-19 to 8-36 wherein the multi-layer photosensitive layers contain the diphenylamine compound of the formula (1-8) accomplish a notable increase in the durability by virtue of the formation of the surface protective layer similarly to the examples with the single-layer photosensitive layer.

Single-Layer Electrophotosensitive Material

Example 9-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-9-3); 80 parts by weight of 2,6-dimethyl-2',6'-t-butylbenzoquinone as the electron transport material represented by the formula (ET-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 $\mu$m.

Forming Surface Protective Layer

The plasma CVD process was performed under the same conditions as in Example 1-1, thereby forming a surface protective layer of amorphous silicon-carbon (SiC) composite film having a thickness of 0.5.m over the surface of the single-layer photosensitive layer. Thus was fabricated an electrophotosensitive material of Example 9-1.

Examples 9-2 to 9-6

Electrophotosensitive materials of Examples 9-2 to 9-6 were fabricated the same way as in Example 9-1 except that each of the examples used 100 parts by weight of diphenylamine compound of the formula of a number listed in the following Table 49 as the positive-hole transport material.

Comparative Example 9-1

An electrophotosensitive material of Comparative Example 9-1 was fabricated the same way as in Example 9-1, except that 100 parts by weight of diethylaminobenzaldehyde diphenylhydrazone represented by the formula (HT-3) was used as the positive-hole transport material.

Comparative Example 9-2

An electrophotosensitive material of Comparative Example 9-2 was fabricated the same way as in Example 9-1, except that 100 parts by weight of tris(3-methylphenyl) amine represented by a formula (HT-4) was used as the positive-hole transport material.

The electrophotosensitive materials of the above examples and comparative examples were subjected to the same photosensitivity test I and durability test I as the above and were evaluated for the characteristics thereof. The results are listed in Table 49.

TABLE 49

| | | | | | | | Durability Test | | | | |
|---|---|---|---|---|---|---|---|---|---|---|---|
| | SPL | P-H TM | ETM | SP $V_0$(V) | RP Vr(V) | HLE $E_{1/2}$($\mu$J/cm$^2$) | 10,000 copies | 20,000 copies | 30,000 copies | 50,000 copies | 100,000 copies |
| Ex. 9-1 | a-SiC | 1-9-3 | ET-1 | 782 | 123 | 0.930 | ○ | ○ | ○ | ○ | ○ |
| Ex. 9-2 | a-SiC | 1-9-10 | ET-1 | 780 | 127 | 0.921 | ○ | ○ | ○ | ○ | ○ |
| Ex. 9-3 | a-SiC | 1-9-18 | ET-1 | 801 | 123 | 0.930 | ○ | ○ | ○ | ○ | ○ |
| Ex. 9-4 | a-SiC | 1-9-22 | ET-1 | 796 | 130 | 0.912 | ○ | ○ | ○ | ○ | ○ |
| Ex. 9-5 | a-SiC | 1-9-25 | ET-1 | 804 | 123 | 0.910 | ○ | ○ | ○ | ○ | ○ |
| Ex. 9-6 | a-SiC | 1-9-29 | ET-1 | 806 | 122 | 0.883 | ○ | ○ | ○ | ○ | ○ |
| C.Ex.9-1 | a-SiC | HT-3 | ET-1 | 780 | 180 | 1.226 | ○ | x | — | — | — |
| C.Ex.9-2 | a-SiC | HT-4 | ET-1 | 805 | 176 | 1.198 | Δ | x | — | — | — |

It was found from the table that both the electrophotosensitive materials of Comparative Examples 9-1, 9-2 suffered the delamination of the surface protective layer after the continuous production of 20,000 copies. This indicates that the compounds used in these comparative examples are not effective to improve the physical stability of the inorganic surface protective layer.

It was also found that the electrophotosensitive materials of these comparative examples were significantly decreased in photosensitivity when formed with the surface protective layer, because they presented large residual potentials after light exposure and large half-life exposures.

In contrast, all the electrophotosensitive materials of Examples 9-1 to 9-6 suffered no cracks nor delamination of the surface protective layer after the continuous production of 100,000 copies. It was thus confirmed that the use of the diphenylamine compound of the formula (1-9) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 9-7 to 9-12, Comparative Examples 9-3, 9-4

Electrophotosensitive materials of Examples 9-7 to 9-12 and Comparative Examples 9-3, 9-4 were fabricated the same way as in Examples 9-1 to 9-6 and Comparative Examples 9-1, 9-2 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the single-layer photosensitive layer.

The electrophotosensitive materials of the above examples and comparative examples were subjected to the same photosensitivity test I and durability test I as the above and were evaluated for the characteristics thereof. The results are listed in Table 50.

TABLE 50

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 9-7 | a-C | 1-9-3 | ET-1 | 809 | 129 | 0.919 | ○ | ○ | ○ | ○ | ○ |
| Ex. 9-8 | a-C | 1-9-10 | ET-1 | 782 | 121 | 0.891 | ○ | ○ | ○ | ○ | ○ |
| Ex. 9-9 | a-C | 1-9-18 | ET-1 | 782 | 123 | 0.929 | ○ | ○ | ○ | ○ | ○ |
| Ex. 9-10 | a-C | 1-9-22 | ET-1 | 812 | 118 | 0.892 | ○ | ○ | ○ | ○ | ○ |
| Ex. 9-11 | a-C | 1-9-25 | ET-1 | 814 | 132 | 0.919 | ○ | ○ | ○ | ○ | ○ |
| Ex. 9-12 | a-C | 1-9-29 | ET-1 | 785 | 126 | 0.891 | ○ | ○ | ○ | ○ | ○ |
| C.Ex.9-3 | a-C | HT-3 | ET-1 | 809 | 167 | 1.218 | ○ | Δ | x | — | — |
| C.Ex.9-4 | a-C | HT-4 | ET-1 | 801 | 165 | 1.201 | ○ | x | — | — | — |

It was confirmed from the table that if the type of the surface protective layer is changed, the same results as the above are obtained according to the compositions of the single-layer photosensitive layer as the base.

Specifically, it was found that the electrophotosensitive material of Comparative Example 9-3 sustained cracks spread over the surface protective layer after the continuous production of 20,000 copies and suffered the delamination of the surface protective layer after the continuous production of 30,000 copies.

On the other hand, the electrophotosensitive material of Comparative Example 9-4 was found to suffer the delamination of the surface protective layer after the continuous production of 30,000 copies. These indicate that the compounds used in these comparative examples are not effective to improve the physical stability of the inorganic surface protective layer.

Additionally, the electrophotosensitive materials of these comparative examples were found to be seriously decreased in photosensitivity when formed with the surface protective layer, because they presented high residual potentials after light exposure and large half-life exposures.

In contrast, all the electrophotosensitive materials of Examples 9-7 to 9-12 suffered no cracks nor delamination after the continuous production of 100,000 copies. It was thus confirmed that the use of the diphenylamine compound of the formula (1-9) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 9-13 to 9-15, Comparative Example 9-5

Electrophotosensitive materials of Examples 9-13 to 9-15 and Comparative Example 9-5 were fabricated the same way as in Examples 9-2, 9-4, 9-6 and Comparative Example 9-2 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the single-layer photosensitive layer.

Examples 9-16 to 9-18, Comparative Example 9-6

Electrophotosensitive materials of Examples 9-16, 9-17, 9-18 and Comparative Example 9-6 were fabricated the same way as in Examples 9-2, 9-4, 9-6 and Comparative Example 9-2 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the single-layer photosensitive layer.

Examples 9-19 to 9-21, Comparative Example 9-7

Electrophotosensitive materials of Examples 9-19, 9-20, 9-21 and Comparative Example 9-7 were fabricated the same way as in Examples 9-2, 9-4, 9-6 and Comparative Example 9-2 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the single-layer photosensitive layer.

Examples 9-22 to 9-24, Comparative Example 9-8

Electrophotosensitive materials of Examples 9-22, 9-23, 9-24 and Comparative Example 9-8 were fabricated the same way as in Examples 9-2, 9-4, 9-6 and Comparative Example 9-2 except that the same procedure as in Examples 1-31, 1-32 and Comparative Example 1-8 was taken to form a μm surface protective layer of amorphous carbon-fluorine (CF) composite film having a thickness of 0.5.m, instead of the silicon-carbon composite film, over the surface of the single-layer photosensitive layer.

Examples 9-25 to 9-27, Comparative Example 9-9

Electrophotosensitive materials of Examples 9-25, 9-26, 9-27 and Comparative Example 9-9 were fabricated the same way as in Examples 9-2, 9-4, 9-6 and Comparative Example 9-2 except that the same procedure as in Examples 1-33, 1-34 and Comparative Example 1-9 was taken to form a μm surface protective layer of amorphous boron-nitrogen (BN) composite film having a thickness of 0.5.m, instead of the silicon-carbon composite film, over the surface of the single-layer photosensitive layer.

The electrophotosensitive materials of the above examples and comparative examples were subjected to the same photosensitivity test I and durability test I as the above and were evaluated for the characteristics thereof. The results are listed in Table 51.

TABLE 51

| | SPL | P-H TM | ETM | SP $V_0$(V) | RP Vr(V) | HLE $E_{1/2}$(μJ/cm$^2$) | Durability Test 10,000 copies | 20,000 copies | 30,000 copies | 50,000 copies | 100,000 copies |
|---|---|---|---|---|---|---|---|---|---|---|---|
| Ex. 9-13 | a-SiN | 1-9-10 | ET-1 | 801 | 130 | 0.873 | ○ | ○ | ○ | ○ | ○ |
| Ex. 9-14 | a-SiN | 1-9-22 | ET-1 | 798 | 126 | 0.898 | ○ | ○ | ○ | ○ | ○ |
| Ex. 9-15 | a-SiN | 1-9-29 | ET-1 | 808 | 137 | 0.910 | ○ | ○ | ○ | ○ | ○ |
| C.Ex.9-5 | a-SiN | HT-4 | ET-1 | 802 | 184 | 1.310 | ○ | x | — | — | — |
| Ex. 9-16 | a-CN | 1-9-10 | ET-1 | 803 | 138 | 0.905 | ○ | ○ | ○ | ○ | ○ |
| Ex. 9-17 | a-CN | 1-9-22 | ET-1 | 798 | 139 | 0.911 | ○ | ○ | ○ | ○ | ○ |
| Ex. 9-18 | a-CN | 1-9-29 | ET-1 | 812 | 141 | 0.943 | ○ | ○ | ○ | ○ | ○ |
| C.Ex.9-6 | a-CN | HT-4 | ET-1 | 806 | 196 | 1.375 | ○ | Δ | x | — | — |
| Ex. 9-19 | a-CB | 1-9-10 | ET-1 | 796 | 126 | 0.927 | ○ | ○ | ○ | ○ | ○ |
| Ex. 9-20 | a-CB | 1-9-22 | ET-1 | 814 | 127 | 0.920 | ○ | ○ | ○ | ○ | ○ |
| Ex. 9-21 | a-CB | 1-9-29 | ET-1 | 817 | 121 | 0.906 | ○ | ○ | ○ | ○ | ○ |
| C.Ex.9-7 | a-CB | HT-4 | ET-1 | 811 | 160 | 1.223 | ○ | x | — | — | — |
| Ex. 9-22 | a-CF | 1-9-10 | ET-1 | 812 | 125 | 0.854 | ○ | ○ | ○ | ○ | ○ |
| Ex. 9-23 | a-CF | 1-9-22 | ET-1 | 780 | 119 | 0.865 | ○ | ○ | ○ | ○ | ○ |
| Ex. 9-24 | a-CF | 1-9-29 | ET-1 | 809 | 130 | 0.871 | ○ | ○ | ○ | ○ | ○ |
| C.Ex.9-8 | a-CF | HT-4 | ET-1 | 792 | 174 | 1.263 | Δ | x | — | — | — |
| Ex. 9-25 | a-BN | 1-9-10 | ET-1 | 804 | 118 | 0.874 | ○ | ○ | ○ | ○ | ○ |
| Ex. 9-26 | a-BN | 1-9-22 | ET-1 | 806 | 120 | 0.868 | ○ | ○ | ○ | ○ | ○ |
| Ex. 9-27 | a-BN | 1-9-29 | ET-1 | 796 | 121 | 0.854 | ○ | ○ | ○ | ○ | ○ |
| C.Ex.9-9 | a-BN | HT-4 | ET-1 | 798 | 150 | 1.153 | ○ | Δ | x | — | — |

It was confirmed from the table that if the type of the surface protective layer is further changed, the same results as the above are obtained according to the compositions of the single-layer photosensitive layer as the base.

Specifically, it was found that a electrophotosensitive material group of Comparative Examples 9-5, 9-7, 9-8 and that of Comparative Examples 9-6, 9-9 suffered the delamination of the surface protective layer after the continuous production of 20,000 copies and of 30,000 copies, respectively. Particularly in the electrophotosensitive material of Comparative Example 9-8, cracks spread over the surface protective layer were observed after the continuous production of 10,000 copies. These indicate that the compounds used in these comparative examples are not effective to improve the physical stability of the inorganic surface protective layer.

Additionally, the electrophotosensitive materials of these comparative examples were found to be seriously decreased in photosensitivity when formed with the surface protective layer, because they presented high residual potentials after light exposure and large half-life exposures.

In contrast, all the electrophotosensitive materials of Examples 9-13 to 9-27 suffered no cracks nor delamination after the continuous production of 100,000 copies. It was thus confirmed that the use of the diphenylamine compound of the formula (1-9) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 9-1 to 9-27 but no surface protective layer, as well as on those of Examples 9-1 to 9-27, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

Similarly, the durability test I was conducted on the electrophotosensitive materials having the same photosensitive layers as Comparative Examples 9-1 to 9-9 but no surface protective layer. The electrophotosensitive materials having the same photosensitive layers as Comparative Examples 9-1, 9-3 provided images which were decreased in image density to suffer white spots in solid black image areas after the production of about 20,000 copies. The other electrophotosensitive materials provided such images after the production of 30,000 to 50,000 copies. By comparing these results with the results of the durability test I on the corresponding comparative examples, it is found that the surface protective layers over the photosensitive layers of the comparative examples contribute no increase in the durability or rather reduce the durability.

In other words, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 9-1 to 9-27 wherein the single-layer photosensitive layers contain the diphenylamine compound of the formula (1-9) accomplish a notable increase in the durability by virtue of the formation of the surface protective layer.

Multi-Layer Electrophotosensitive Material

Example 9-28

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 μm.

The ball mill was operated for dispersing by mixing 0.8 parts by weight of diphenylamine compound as the positive-hole transport material represented by the formula (1-9-3), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 μm. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (Sic) composite film having a thickness of 0.5 μm. Thus was fabricated an electrophotosensitive material of Example 9-28.

Examples 9-29 to 9-33

Electrophotosensitive materials of Examples 9-29 to 9-33 were fabricated the same way as in Example 9-28 except that each of the examples used 0.8 parts by weight of diphenylamine compound of the formula of a number listed in the following Table 52 as the positive-hole transport material.

Comparative Example 9-10

An electrophotosensitive material of Comparative Example 9-10 was fabricated the same way as in Example 9-28 except that 0.8 parts by weight of diethylaminobenzaldehyde diphenylhydrazone represented by the formula (HT-3) was used as the positive-hole transport material.

Comparative Example 9-11

An electrophotosensitive material of Comparative Example 9-11 was fabricated the same way as in Example 9-28 except that 0.8 parts by weight of tris(3-methylphenyl) amine represented by the formula (HT-4) was used as the positive-hole transport material.

The electrophotosensitive materials of the above examples and comparative examples were subjected to the same photosensitivity test II and durability test II as the above and were evaluated for the characteristics thereof. The results are listed in Table 52.

TABLE 52

| | | | | | | Durability Test | | | |
|---|---|---|---|---|---|---|---|---|---|
| | SPL | P-H TM | SP $V_0$(V) | RP Vr(V) | HLE $E_{1/2}$(μJ/cm$^2$) | 10,000 copies | 20,000 copies | 50,000 copies | 100,000 copies |
| Ex. 9-28 | a-SiC | 1-9-3 | −793 | −81 | 0.752 | ○ | ○ | ○ | ○ |
| Ex. 9-29 | a-SiC | 1-9-10 | −817 | −80 | 0.746 | ○ | ○ | ○ | ○ |
| Ex. 9-30 | a-SiC | 1-9-18 | −801 | −79 | 0.758 | ○ | ○ | ○ | ○ |
| Ex. 9-31 | a-SiC | 1-9-22 | −796 | −73 | 0.732 | ○ | ○ | ○ | ○ |
| Ex. 9-32 | a-SiC | 1-9-25 | −798 | −86 | 0.760 | ○ | ○ | ○ | ○ |
| Ex. 9-33 | a-SiC | 1-9-29 | −796 | −78 | 0.731 | ○ | ○ | ○ | ○ |
| CEx.9-10 | a-SiC | HT-3 | −814 | −147 | 1.024 | ○ | x | — | — |
| CEx.9-11 | a-SiC | HT-4 | −803 | −145 | 1.011 | ○ | x | — | — |

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, it was found that both the electrophotosensitive materials of Comparative Examples 9-10, 9-11 suffered the delamination of the surface protective layer after the continuous production of 20,000 copies. This indicates that the compounds used in these comparative examples are not effective to improve the physical stability of the inorganic surface protective layer.

Additionally, the electrophotosensitive materials of these comparative examples were found to be seriously decreased in photosensitivity when formed with the surface protective layer, because they presented high residual potentials after light exposure and large half-life exposures.

In contrast, all the electrophotosensitive materials of Examples 9-23 to 9-33 suffered no cracks nor delamination after the continuous production of 100,000 copies. It was thus confirmed that the use of the diphenylamine compound of the formula (1-9) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 9-34 to 9-39, Comparative Examples 9-12, 9-13

Electrophotosensitive materials of these examples and comparative examples were fabricated the same way as in Examples 9-28 to 9-33 and Comparative Examples 9-10, 9-11 except that the same procedure as in Examples 1-13 to 1-24 and Comparative Examples 1-3, 1-4 was taken to form a μm surface protective layer of amorphous carbon (C) having a thickness of 0.5.m, instead of the silicon-carbon composite film, over the surface of the multi-layer photosensitive layer.

The electrophotosensitive materials of the above examples and comparative examples were subjected to the same photosensitivity test II and durability test II as the above and were evaluated for the characteristics thereof. The results are listed in Table 53.

TABLE 53

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 9-34 | a-C | 1-9-3 | −780 | −83 | 0.790 | ○ | ○ | ○ | ○ |
| Ex. 9-35 | a-C | 1-9-10 | −785 | −86 | 0.802 | ○ | ○ | ○ | ○ |
| Ex. 9-36 | a-C | 1-9-18 | −806 | −79 | 0.784 | ○ | ○ | ○ | ○ |
| Ex. 9-37 | a-C | 1-9-22 | −814 | −76 | 0.778 | ○ | ○ | ○ | ○ |
| Ex. 9-38 | a-C | 1-9-25 | −780 | −82 | 0.787 | ○ | ○ | ○ | ○ |
| Ex. 9-39 | a-C | 1-9-29 | −801 | −76 | 0.777 | ○ | ○ | ○ | ○ |
| CEx.9-12 | a-C | HT-3 | −817 | −146 | 1.098 | Δ | x | — | — |
| CEx.9-13 | a-C | HT-4 | −803 | −142 | 1.074 | Δ | x | — | — |

It was confirmed from the table that if the type of the surface protective layer is changed, the same results as the above are obtained according to the compositions of the charge transport layer of the multi-layer photosensitive layer as the base.

Specifically, it was found that both the electrophotosensitive materials of Comparative Examples 9-12, 9-13 suffered cracks spread over the surface protective layer after the continuous production of 10,000 copies and the delamination of the surface protective layer after the continuous production of 20,000 copies. This indicates that the compounds used in these comparative examples are not effective to improve the physical stability of the inorganic surface protective layer.

Additionally, the electrophotosensitive materials of these comparative examples were found to be seriously decreased in photosensitivity when formed with the surface protective layer, because they presented high residual potentials after light exposure and large half-life exposures.

In contrast, all the electrophotosensitive materials of Examples 9-34 to 9-39 suffered no cracks nor delamination after the continuous production of 100,000 copies. It was thus confirmed that the use of the diphenylamine compound of the formula (1-9) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 9-40 to 9-42, Comparative Example 9-14

Electrophotosensitive materials of these examples and comparative example were fabricated the same way as in Examples 9-29, 9-31, 9-33 and Comparative Example 9-11 except that the same procedure as in Examples 1-25, 1-26 and Comparative Example 1-5 was taken to form a μm surface protective layer of amorphous silicon-nitrogen (SiN) composite film having a thickness of 0.5.m, instead of the silicon-carbon composite film, over the surface of the multi-layer photosensitive layer.

Examples 9-43 to 9-45, Comparative Example 9-15

Electrophotosensitive materials of these examples and comparative example were fabricated the same way as in Examples 9-29, 9-31, 9-33 and Comparative Example 9-11 except that the same procedure as in Examples 1-27, 1-28 and Comparative Example 1-6 was taken to form a μm surface protective layer of amorphous carbon-nitrogen (CN) composite film having a thickness of 0.5.m, instead of the silicon-carbon composite film, over the surface of the multi-layer photosensitive layer.

Examples 9-46 to 9-48, Comparative Example 9-16

Electrophotosensitive materials of these examples and comparative example were fabricated the same way as in Examples 9-29, 9-31, 9-33 and Comparative Example 9-11 except that the same procedure as in Examples 1-29, 1-30 and Comparative Example 1-7 was taken to form a μm surface protective layer of amorphous carbon-boron (CB) composite film having a thickness of 0.5.m, instead of the silicon-carbon composite film, over the surface of the multi-layer photosensitive layer.

Examples 9-49 to 9-51, Comparative Example 9-17

Electrophotosensitive materials of these examples and comparative example were fabricated the same way as in Examples 9-29, 9-31, 9-33 and Comparative Example 9-11 except that the same procedure as in Examples 1-31, 1-32 and Comparative Example 1-8 was taken to form a μm surface protective layer of amorphous carbon-fluorine (CF) composite film having a thickness of 0.5.m, instead of the silicon-carbon composite film, over the surface of the multi-layer photosensitive layer.

Examples 9-52 to 9-54, Comparative Example 9-18

Electrophotosensitive materials of these examples and comparative example were fabricated the same way as in Examples 9-29, 9-31, 9-33 and Comparative Example 9-11 except that the same procedure as in Examples 1-33, 1-34 and Comparative Example 1-9 was taken to form a μm surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples and comparative examples were subjected to the same photosensitivity test II and durability test II as the above and were evaluated for the characteristics thereof. The results are listed in Table 54.

TABLE 54

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 9-40 | a-SiN | 1-9-10 | −809 | −102 | 0.827 | ○ | ○ | ○ | ○ |
| Ex. 9-41 | a-SiN | 1-9-22 | −801 | −100 | 0.813 | ○ | ○ | ○ | ○ |
| Ex. 9-42 | a-SiN | 1-9-29 | −814 | −102 | 0.792 | ○ | ○ | ○ | ○ |
| C.Ex.9-14 | a-SiN | HT-4 | −795 | −144 | 1.091 | ○ | x | — | — |
| Ex. 9-43 | a-CN | 1-9-10 | −804 | −106 | 0.849 | ○ | ○ | ○ | ○ |
| Ex. 9-44 | a-CN | 1-9-22 | −798 | −95 | 0.835 | ○ | ○ | ○ | ○ |
| Ex. 9-45 | a-CN | 1-9-29 | −812 | −96 | 0.823 | ○ | ○ | ○ | ○ |
| C.Ex.9-15 | a-CN | HT-4 | −796 | −143 | 1.143 | Δ | x | — | — |
| Ex. 9-46 | a-CB | 1-9-10 | −806 | −86 | 0.637 | ○ | ○ | ○ | ○ |
| Ex. 9-47 | a-CB | 1-9-22 | −801 | −78 | 0.629 | ○ | ○ | ○ | ○ |
| Ex. 9-48 | a-CB | 1-9-29 | −809 | −80 | 0.622 | ○ | ○ | ○ | ○ |
| C.Ex.9-16 | a-CB | HT-4 | −805 | −135 | 0.968 | Δ | x | — | — |
| Ex. 9-49 | a-CF | 1-9-10 | −809 | −86 | 0.670 | ○ | ○ | ○ | ○ |
| Ex. 9-50 | a-CF | 1-9-22 | −801 | −80 | 0.666 | ○ | ○ | ○ | ○ |
| Ex. 9-51 | a-CF | 1-9-29 | −790 | −79 | 0.657 | ○ | ○ | ○ | ○ |
| C.Ex.9-17 | a-CF | HT-4 | −807 | −134 | 0.992 | Δ | x | — | — |
| Ex. 9-52 | a-BN | 1-9-10 | −793 | −71 | 0.686 | ○ | ○ | ○ | ○ |
| Ex. 9-53 | a-BN | 1-9-22 | −782 | −70 | 0.682 | ○ | ○ | ○ | ○ |
| Ex. 9-54 | a-BN | 1-9-29 | −809 | −77 | 0.611 | ○ | ○ | ○ | ○ |
| C.Ex.9-18 | a-BN | HT-4 | −790 | −113 | 0.894 | ○ | x | — | — |

It was confirmed from the table that if the type of the surface protective layer is further changed, the same results as the above are obtained according to the compositions of the charge transport layer of the multi-layer photosensitive layer as the base.

Specifically, it was found that all the electrophotosensitive materials of Comparative Examples 9-14 to 9-18 suffered the delamination of the surface protective layer after the continuous production of 20,000 copies. Particularly in the electrophotosensitive materials of Comparative Examples 9-15 to 9-17, cracks spread over the surface protective layer were already observed after the continuous production of 10,000 copies. These indicate that the compounds used in these comparative examples are not effective to improve the physical stability of the inorganic surface protective layer.

Additionally, the electrophotosensitive materials of these comparative examples were found to be seriously decreased in photosensitivity when formed with the surface protective layer, because they presented high residual potentials after light exposure and large half-life exposures.

In contrast, all the electrophotosensitive materials of Examples 9-40 to 9-54 suffered no cracks nor delamination after the continuous production of 100,000 copies. It was thus confirmed that the use of the diphenylamine compound of the formula (1-9) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 9-28 to 9-54 but no surface protective layer, as well as on those of Examples 9-28 to 9-54, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

Similarly, the durability test II was conducted on the electrophotosensitive materials having the same photosensitive layers as Comparative Examples 9-10 to 9-18 but no surface protective layer. The electrophotosensitive materials having the same photosensitive layers as Comparative Examples 9-10, 9-12 provided images which were decreased in image density to suffer white spots in solid black image areas after the production of about 20,000 copies. The other electrophotosensitive materials provided such images after the production of 30,000 to 50,000 copies. By comparing these results with the results of the durability test I on the corresponding comparative examples, it is found that the surface protective layers over the photosensitive layers of the comparative examples contribute no increase in the durability or rather reduce the durability.

In other words, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layer, the electrophotosensitive materials of Examples 9-28 to 9-54 wherein the multi-layer photosensitive layers contain the diphenylamine compound of the formula (1-9) accomplish a notable increase in the durability by virtue of the formation of the surface protective layer.

Single-Layer Electrophotosensitive Material

Example 10-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-10-1); 80 parts by weight of 2,6-dimethyl-2',6'-t-butylbenzoquinone as the electron transport material represented by the formula (ET-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 $\mu$m.

Forming Surface Protective Layer

The plasma CVD process was performed under the same conditions as in Example 1-1, thereby forming a surface protective layer of amorphous silicon-carbon (SiC) composite film having a thickness of 0.5.m over the surface of the single-layer photosensitive layer. Thus was fabricated an electrophotosensitive material of Example 10-1.

Examples 10-2 to 10-4

Electrophotosensitive materials of Examples 10-2 to 10-4 were fabricated the same way as in Example 10-1 except that each of the examples used 100 parts by weight of diphenylamine compound of the formula of a number listed in the following Table 55 as the positive-hole transport material.

The electrophotosensitive materials of the above examples were subjected to the same photosensitivity test I and durability test I as the above and were evaluated for the characteristics thereof. The results are listed in Table 55.

TABLE 55

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 10-1 | a-SiC | 1-10-1 | ET-1 | 812 | 144 | 1.037 | ○ | ○ | ○ | ○ | ○ |
| Ex. 10-2 | a-SiC | 1-10-3 | ET-1 | 796 | 163 | 1.218 | ○ | ○ | ○ | ○ | ○ |
| Ex. 10-3 | a-SiC | 1-10-5 | ET-1 | 804 | 170 | 1.247 | ○ | ○ | ○ | ○ | ○ |
| Ex. 10-4 | a-SiC | 1-10-8 | ET-1 | 806 | 156 | 1.150 | ○ | ○ | ○ | ○ | ○ |
| C.Ex.2-1 | a-SiC | HT-1 | ET-1 | 814 | 154 | 1.112 | ○ | Δ | x | — | — |
| C.Ex.2-2 | a-SiC | HT-3 | ET-1 | 780 | 180 | 1.226 | ○ | x | — | — | — |

It was found from the table that all the electrophotosensitive materials of Examples 10-1 to 10-4 suffered no cracks nor delamination of the surface protective layer after the continuous production of 100,000 copies. It was thus confirmed that the use of the diphenylamine compound of the formula (1-10) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 10-5 to 10-8

Electrophotosensitive materials of Examples 10-5 to 10-8 were fabricated the same way as in Examples 10-1 to 10-4 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-3, 2-4, are listed in Table 56.

TABLE 56

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 10-5 | a-C | 1-10-1 | ET-1 | 804 | 140 | 0.999 | ○ | ○ | ○ | ○ | ○ |
| Ex. 10-6 | a-C | 1-10-3 | ET-1 | 798 | 159 | 1.145 | ○ | ○ | ○ | ○ | ○ |
| Ex. 10-7 | a-C | 1-10-5 | ET-1 | 809 | 164 | 1.220 | ○ | ○ | ○ | ○ | ○ |
| Ex. 10-8 | a-C | 1-10-8 | ET-1 | 809 | 155 | 1.123 | ○ | ○ | ○ | ○ | ○ |
| C.Ex.2-3 | a-C | HT-1 | ET-1 | 788 | 157 | 1.150 | ○ | Δ | x | — | — |
| C.Ex.2-4 | a-C | HT-3 | ET-1 | 809 | 167 | 1.218 | ○ | Δ | x | — | — |

It was confirmed from the table that if the type of the surface protective layer is changed, the same results as the above are obtained according to the compositions of the single-layer photosensitive layer as the base.

Specifically, it was found that all the electrophotosensitive materials of Examples 10-5 to 10-8 suffered no cracks nor delamination after the continuous production of 100,000 copies. It was thus confirmed that the use of the diphenylamine compound of the formula (1-10) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 10-9 to 10-12

Electrophotosensitive materials of Examples 10-9 to 10-12 were fabricated the same way as in Examples 10-1 to 10-4 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the single-layer photosensitive layer.

Examples 10-13 to 10-16

Electrophotosensitive materials of Examples 10-13 to 10-16 were fabricated the same way as in Examples 10-1 to 10-4 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the single-layer photosensitive layer.

Examples 10-17 to 10-20

Electrophotosensitive materials of Examples 10-17 to 10-20 were fabricated the same way as in Examples 10-1 to 10-4 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the single-layer photosensitive layer.

Examples 10-21 to 10-24

Electrophotosensitive materials of Examples 10-21 to 10-24 were fabricated the same way as in Examples 10-1 to 10-4 except that the same procedure as in Examples 1-31, 1-32 and Comparative Example 1-8 was taken to form a $\mu$m surface protective layer of amorphous carbon-fluorine (CF) composite film having a thickness of 0.5.m, instead of the silicon-carbon composite film, over the surface of the single-layer photosensitive layer.

Examples 10-25 to 10-28

Electrophotosensitive materials of Examples 10-25 to 10-28 were fabricated the same way as in Examples 10-1 to 10-4 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-5 to 2-9, are listed in Table 57.

TABLE 57

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 10-9 | a-SiN | 1-10-1 | ET-1 | 798 | 165 | 1.139 | ○ | ○ | ○ | ○ | ○ |
| Ex. 10-10 | a-SiN | 1-10-3 | ET-1 | 814 | 169 | 1.192 | ○ | ○ | ○ | ○ | ○ |
| Ex. 10-11 | a-SiN | 1-10-5 | ET-1 | 809 | 177 | 1.214 | ○ | ○ | ○ | ○ | ○ |
| Ex. 10-12 | a-SiN | 1-10-8 | ET-1 | 814 | 172 | 1.160 | ○ | ○ | ○ | ○ | ○ |
| C.Ex.2-5 | a-SiN | HT-3 | ET-1 | 798 | 187 | 1.334 | ○ | Δ | x | — | — |
| Ex. 10-13 | a-CN | 1-10-1 | ET-1 | 795 | 175 | 1.196 | ○ | ○ | ○ | ○ | ○ |
| Ex. 10-14 | a-CN | 1-10-3 | ET-1 | 790 | 178 | 1.25 | ○ | ○ | ○ | ○ | ○ |
| Ex. 10-15 | a-CN | 1-10-5 | ET-1 | 803 | 181 | 1.274 | ○ | ○ | ○ | ○ | ○ |

TABLE 57-continued

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 10-16 | a-CN | 1-10-8 | ET-1 | 792 | 175 | 1.218 | ○ | ○ | ○ | ○ | ○ |
| C.Ex.2-6 | a-CN | HT-3 | ET-1 | 801 | 194 | 1.389 | ○ | Δ | x | — | — |
| Ex. 10-17 | a-CB | 1-10-1 | ET-1 | 800 | 146 | 1.064 | ○ | ○ | ○ | ○ | ○ |
| Ex. 10-18 | a-CB | 1-10-3 | ET-1 | 790 | 147 | 1.113 | ○ | ○ | ○ | ○ | ○ |
| Ex. 10-19 | a-CB | 1-10-5 | ET-1 | 796 | 150 | 1.133 | ○ | ○ | ○ | ○ | ○ |
| Ex. 10-20 | a-CB | 1-10-8 | ET-1 | 792 | 144 | 1.082 | ○ | ○ | ○ | ○ | ○ |
| C.Ex.2-7 | a-CB | HT-3 | ET-1 | 798 | 166 | 1.235 | ○ | x | — | — | — |
| Ex. 10-21 | a-CF | 1-10-1 | ET-1 | 812 | 156 | 1.099 | ○ | ○ | ○ | ○ | ○ |
| Ex. 10-22 | a-CF | 1-10-3 | ET-1 | 790 | 163 | 1.149 | ○ | ○ | ○ | ○ | ○ |
| Ex. 10-23 | a-CF | 1-10-5 | ET-1 | 792 | 171 | 1.170 | ○ | ○ | ○ | ○ | ○ |
| Ex. 10-24 | a-CF | 1-10-8 | ET-1 | 809 | 156 | 1.118 | ○ | ○ | ○ | ○ | ○ |
| C.Ex.2-8 | a-CF | HT-3 | ET-1 | 782 | 180 | 1.284 | Δ | x | — | — | — |
| Ex. 10-25 | a-BN | 1-10-1 | ET-1 | 801 | 140 | 1.003 | ○ | ○ | ○ | ○ | ○ |
| Ex. 10-26 | a-BN | 1-10-3 | ET-1 | 806 | 141 | 1.049 | ○ | ○ | ○ | ○ | ○ |
| Ex. 10-27 | a-BN | 1-10-5 | ET-1 | 790 | 146 | 1.068 | ○ | ○ | ○ | ○ | ○ |
| Ex. 10-28 | a-BN | 1-10-8 | ET-1 | 798 | 137 | 1.021 | ○ | ○ | ○ | ○ | ○ |
| C.Ex.2-9 | a-BN | HT-3 | ET-1 | 788 | 155 | 1.165 | ○ | Δ | x | — | — |

It was confirmed from the table that if the type of the surface protective layer is further changed, the same results as the above are obtained according to the compositions of the single-layer photosensitive layer as the base.

Specifically, it was found that all the electrophotosensitive materials of Examples 10-9 to 10-28 suffered no cracks nor delamination after the continuous production of 100,000 copies. It was thus confirmed that the use of the diphenylamine compound of the formula (1-10) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 10-1 to 10-28 but no surface protective layer, as well as on those of Examples 10-1 to 10-28, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

By comparing these results with the results of the aforesaid analogous study on Comparative Examples 2-1 to 2-9, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 10-1 to 10-28 wherein the single-layer photosensitive layers contain the diphenylamine compound of the formula (1-10) accomplish a notable increase in the durability by virtue of the formation of the surface protective layer.

Multi-Layer Electrophotosensitive Material

Example 10-29

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 $\mu$m.

The ball mill was operated for dispersing by mixing 0.8 parts by weight of diphenylamine compound as the positive-hole transport material represented by the formula (1-10-1), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 $\mu$m. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 $\mu$m. Thus was fabricated an electrophotosensitive material of Example 10-29.

Examples 10-30 to 10-32

Electrophotosensitive materials of Examples 10-30 to 10-32 were fabricated the same way as in Example 10-29 except that each of the examples used 0.8 parts by weight of diphenylamine compound of the formula of a number listed in the following Table 58 as the positive-hole transport material.

The electrophotosensitive materials of the above examples were subjected to the same photosensitivity test II and durability test II as the above and were evaluated for the characteristics thereof. The results, along with the aforementioned results of Comparative Examples 2-10, 2-11, are listed in Table 58.

TABLE 58

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 10-29 | a-SiC | 1-10-1 | −788 | −127 | 0.839 | ○ | ○ | ○ | ○ |
| Ex. 10-30 | a-SiC | 1-10-3 | −789 | −135 | 0.922 | ○ | ○ | ○ | ○ |
| Ex. 10-31 | a-SiC | 1-10-5 | −813 | −137 | 0.939 | ○ | ○ | ○ | ○ |
| Ex. 10-32 | a-SiC | 1-10-8 | −788 | −132 | 0.877 | ○ | ○ | ○ | ○ |
| CEx.2-10 | a-SiC | HT-1 | −806 | −165 | 0.938 | ○ | x | — | — |
| CEx.2-11 | a-SiC | HT-3 | −814 | −147 | 1.024 | ○ | x | — | — |

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, it was found that all the electrophotosensitive materials of Examples 10-29 to 10-32 suffered no cracks nor delamination after the continuous production of 100,000 copies. It was thus confirmed that the use of the diphenylamine compound of the formula (1-10) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 10-33 to 10-36

Electrophotosensitive materials of these examples were fabricated the same way as in Examples 10-29 to 10-32 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-12, 2-13, are listed in Table 59.

TABLE 59

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 10-33 | a-C | 1-10-1 | −806 | −125 | 0.837 | ○ | ○ | ○ | ○ |
| Ex. 10-34 | a-C | 1-10-3 | −801 | −133 | 0.901 | ○ | ○ | ○ | ○ |
| Ex. 10-35 | a-C | 1-10-5 | −794 | −140 | 0.920 | ○ | ○ | ○ | ○ |
| Ex. 10-36 | a-C | 1-10-8 | −812 | −126 | 0.861 | ○ | ○ | ○ | ○ |
| CEx.2-12 | a-C | HT-1 | −785 | −172 | 1.216 | ○ | x | — | — |
| CEx.2-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, it was found that all the electrophotosensitive materials of Examples 10-33 to 10-36 suffered no cracks nor delamination after the continuous production of 100,000 copies. It was thus confirmed that the use of the diphenylamine compound of the formula (1-10) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 10-37 to 10-40

Electrophotosensitive materials of these examples were fabricated the same way as in Examples 10-29 to 10-32 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the multi-layer photosensitive layer.

Examples 10-41 to 10-44

Electrophotosensitive materials of these examples were fabricated the same way as in Examples 10-29 to 10-32 except that the same procedure as in Examples 1-27, 1-28 and Comparative Example 1-6 was taken to form a μm surface protective layer of amorphous carbon-nitrogen (CN) composite film having a thickness of 0.5.m, instead of the silicon-carbon composite film, over the surface of the multi-layer photosensitive layer.

Examples 10-45 to 10-48

Electrophotosensitive materials of these examples were fabricated the same way as in Examples 10-29 to 10-32 except that the same procedure as in Examples 1-29, 1-30 and Comparative Example 1-7 was taken to form a μm surface protective layer of amorphous carbon-boron (CB) composite film having a thickness of 0.5.m, instead of the silicon-carbon composite film, over the surface of the multi-layer photosensitive layer.

Examples 10-49 to 10-52

Electrophotosensitive materials of these examples were fabricated the same way as in Examples 10-29 to 10-32 except that the same procedure as in Examples 1-31, 1-32 and Comparative Example 1-8 was taken to form a μm surface protective layer of amorphous carbon-fluorine (CF) composite film having a thickness of 0.5.m, instead of the silicon-carbon composite film, over the surface of the multi-layer photosensitive layer.

Examples 10-53 to 10-56

Electrophotosensitive materials of these examples were fabricated the same way as in Examples 10-29 to 10-32 except that the same procedure as in Examples 1-33, 1-34 and Comparative Example 1-9 was taken to form a μm surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-14 to 2-18, are listed in Table 60.

TABLE 60

| | SPL | P-H TM | SP $V_0$(V) | RP Vr(V) | HLE $E_{1/2}$(μJ/cm$^2$) | Durability Test 10,000 copies | 20,000 copies | 50,000 copies | 100,000 copies |
|---|---|---|---|---|---|---|---|---|---|
| Ex. 10-37 | a-SiN | 1-10-1 | −786 | −121 | 0.950 | ○ | ○ | ○ | ○ |
| Ex. 10-38 | a-SiN | 1-10-3 | −789 | −121 | 0.995 | ○ | ○ | ○ | ○ |
| Ex. 10-39 | a-SiN | 1-10-5 | −810 | −129 | 1.014 | ○ | ○ | ○ | ○ |
| Ex. 10-40 | a-SiN | 1-10-8 | −812 | −125 | 0.969 | ○ | ○ | ○ | ○ |
| C.Ex.2-14 | a-SiN | HT-3 | −785 | −149 | 1.095 | ○ | x | — | — |
| Ex. 10-41 | a-CN | 1-10-1 | −808 | −117 | 0.996 | ○ | ○ | ○ | ○ |
| Ex. 10-42 | a-CN | 1-10-3 | −814 | −125 | 1.042 | ○ | ○ | ○ | ○ |
| Ex. 10-43 | a-CN | 1-10-5 | −787 | −125 | 1.06 | ○ | ○ | ○ | ○ |
| Ex. 10-44 | a-CN | 1-10-8 | −810 | −117 | 1.013 | ○ | ○ | ○ | ○ |
| C.Ex.2-15 | a-CN | HT-3 | −793 | −148 | 1.155 | Δ | x | — | — |
| Ex. 10-45 | a-CB | 1-10-1 | −802 | −118 | 0.846 | ○ | ○ | ○ | ○ |
| Ex. 10-46 | a-CB | 1-10-3 | −800 | −123 | 0.882 | ○ | ○ | ○ | ○ |
| Ex. 10-47 | a-CB | 1-10-5 | −804 | −118 | 0.897 | ○ | ○ | ○ | ○ |
| Ex. 10-48 | a-CB | 1-10-8 | −790 | −117 | 0.860 | ○ | ○ | ○ | ○ |
| C.Ex.2-16 | a-CB | HT-3 | −793 | −137 | 0.979 | Δ | x | — | — |
| Ex. 10-49 | a-CF | 1-10-1 | −799 | −110 | 0.866 | ○ | ○ | ○ | ○ |
| Ex. 10-50 | a-CF | 1-10-3 | −792 | −122 | 0.902 | ○ | ○ | ○ | ○ |
| Ex. 10-51 | a-CF | 1-10-5 | −785 | −122 | 0.919 | ○ | ○ | ○ | ○ |
| Ex. 10-52 | a-CF | 1-10-8 | −785 | −119 | 0.881 | ○ | ○ | ○ | ○ |
| C.Ex.2-17 | a-CF | HT-3 | −793 | −139 | 1.021 | Δ | x | — | — |
| Ex. 10-53 | a-BN | 1-10-1 | −811 | −94 | 0.864 | ○ | ○ | ○ | ○ |
| Ex. 10-54 | a-BN | 1-10-3 | −795 | −101 | 0.904 | ○ | ○ | ○ | ○ |
| Ex. 10-55 | a-BN | 1-10-5 | −790 | −100 | 0.919 | ○ | ○ | ○ | ○ |
| Ex. 10-56 | a-BN | 1-10-8 | −805 | −100 | 0.796 | ○ | ○ | ○ | ○ |
| C.Ex.2-18 | a-BN | HT-3 | −780 | −117 | 0.904 | ○ | x | — | — |

It was confirmed from the table that if the type of the surface protective layer is further changed, the same results as the above are obtained according to the compositions of the charge transport layer of the multi-layer photosensitive layer as the base.

Specifically, it was found that all the electrophotosensitive materials of Examples 10-37 to 10-56 suffered no cracks nor delamination after the continuous production of 100,000 copies. It was thus confirmed that the use of the diphenylamine compound of the formula (1-10) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 10-29 to 10-56 but no surface protective layer, as well as on those of Examples 10-29 to 10-56, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

By comparing these results with the results of the aforesaid analogous study on Comparative Examples 2-10 to 2-18, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

Similarly to the examples with the single-layer photosensitive layer, the electrophotosensitive materials of Examples 10-29 to 10-56 wherein the multi-layer photosensitive layers contain the diphenylamine compound of the formula (1-10) accomplish a notable increase in the durability by virtue of the formation of the surface protective layer.

Single-Layer Electrophotosensitive Material

Example 11-1

Forming Single-Layer Photosensitive Layer

The ball mill was operated for 50 hours for dispersing by mixing 5 parts by weight of crystalline X-type metal-free phthalocyanine as the charge generating material represented by the formula (CG-1); 100 parts by weight of diphenylamine compound as the positive-hole transport material represented by the formula (1-11-3); 80 parts by weight of 2,6-dimethyl-2',6'-t-butylbenzoquinone as the electron transport material represented by the formula (ET-1); and 100 parts by weight of Z-type polycarbonate (weight-average molecular weight Mw=20,000) as the binder resin in 800 parts by weight of tetrahydrofuran, thereby to prepare a coating solution for single-layer photosensitive layer.

Subsequently, the resultant coating solution was dip coated on the aluminum tube as the conductive substrate and then was air dried at 100° C. for 30 minutes. Thus was obtained a single-layer photosensitive layer having a thickness of 25 $\mu$m.

Forming Surface Protective Layer

The plasma CVD process was performed under the same conditions as in Example 1-1, thereby forming a surface protective layer of amorphous silicon-carbon (SiC) composite film having a thickness of 0.5.m over the surface of the single-layer photosensitive layer. Thus was fabricated an electrophotosensitive material of Example 11-1.

Examples 11-2, 11-3

Electrophotosensitive materials of Examples 11-2, 11-3 were fabricated the same way as in Example 11-1 except that each of the examples used 100 parts by weight of diphenylamine compound of the formula of a number listed in the following Table 61 as the positive-hole transport material.

The electrophotosensitive materials of the above examples were subjected to the same photosensitivity test I and durability test I as the above and were evaluated for the characteristics thereof. The results, along with the aforementioned results of Comparative Examples 2-1, 2-2, are listed in Table 61.

TABLE 61

| | | | | | | | Durability Test | | | | |
|---|---|---|---|---|---|---|---|---|---|---|---|
| | SPL | P-H TM | ETM | SP $V_0$(V) | RP Vr(V) | HLE $E_{1/2}$($\mu$J/cm$^2$) | 10,000 copies | 20,000 copies | 30,000 copies | 50,000 copies | 100,000 copies |
| Ex. 11-1 | a-SiC | 1-11-1 | ET-1 | 812 | 118 | 0.810 | ○ | ○ | ○ | ○ | ○ |
| Ex. 11-2 | a-SiC | 1-11-12 | ET-1 | 793 | 130 | 0.881 | ○ | ○ | ○ | ○ | ○ |
| Ex. 11-3 | a-SiC | 1-11-23 | ET-1 | 817 | 116 | 0.853 | ○ | ○ | ○ | ○ | ○ |
| C.Ex.2-1 | a-SiC | HT-1 | ET-1 | 814 | 154 | 1.112 | ○ | Δ | x | — | — |
| C.Ex.2-2 | a-SiC | HT-3 | ET-1 | 780 | 180 | 1.226 | ○ | x | — | — | — |

It was found from the table that all the electrophotosensitive materials of Examples 11-1 to 11-3 suffered no cracks nor delamination of the surface protective layer after the continuous production of 100,000 copies. It was thus confirmed that the use of the diphenylamine compound of the formula (1-11) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 11-4 to 11-6

Electrophotosensitive materials of Examples 11-4 to 11-6 were fabricated the same way as in Examples 11-1 to 11-3 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-3, 2-4, are listed in Table 62.

TABLE 62

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 11-4 | a-C | 1-11-3 | ET-1 | 796 | 116 | 0.831 | ○ | ○ | ○ | ○ | ○ |
| Ex. 11-5 | a-C | 1-11-12 | ET-1 | 801 | 127 | 0.893 | ○ | ○ | ○ | ○ | ○ |
| Ex. 11-6 | a-C | 1-11-23 | ET-1 | 785 | 128 | 0.865 | ○ | ○ | ○ | ○ | ○ |
| C.Ex.2-3 | a-C | HT-1 | ET-1 | 788 | 157 | 1.150 | ○ | Δ | x | — | — |
| C.Ex.2-4 | a-C | HT-3 | ET-1 | 809 | 167 | 1.218 | ○ | Δ | x | — | — |

It was confirmed from the table that if the type of the surface protective layer is changed, the same results as the above are obtained according to the compositions of the single-layer photosensitive layer as the base.

Specifically, it was found that all the electrophotosensitive materials of Examples 11-4 to 11-6 suffered no cracks nor delamination after the continuous production of 100,000 copies. It was thus confirmed that the use of the diphenylamine compound of the formula (1-11) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 11-7, 11-8

Electrophotosensitive materials of Examples 11-7, 11-8 were fabricated the same way as in Examples 11-1, 11-2 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the single-layer photosensitive layer.

Examples 11-9, 11-10

Electrophotosensitive materials of Examples 11-9, 11-10 were fabricated the same way as in Examples 11-1, 11-2 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the single-layer photosensitive layer.

Examples 11-11, 11-12

Electrophotosensitive materials of Examples 11-11, 11-12 were fabricated the same way as in Examples 11-1, 11-2 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the single-layer photosensitive layer.

Examples 11-13, 11-14

Electrophotosensitive materials of Examples 11-13, 11-14 were fabricated the same way as in Examples 11-1, 11-2 except that the same procedure as in Examples 1-31, 1-32 and Comparative Example 1-8 was taken to form a $\mu$m surface protective layer of amorphous carbon-fluorine (CF) composite film having a thickness of 0.5.m, instead of the silicon-carbon composite film, over the surface of the single-layer photosensitive layer.

Examples 11-15, 11-16

Electrophotosensitive materials of Examples 11-15, 11-16 were fabricated the same way as in Examples 11-1, 11-2 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the single-layer photosensitive layer.

The electrophotosensitive materials of the above examples were subjected to the same photosensitivity test I and durability test I as the above and were evaluated for the characteristics thereof. The results, along with the aforementioned results of Comparative Examples 2-5 to 2-9, are listed in Table 63.

TABLE 63

| | SPL | P-H TM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 11-7 | a-SiN | 1-11-3 | ET-1 | 810 | 122 | 0.855 | ○ | ○ | ○ | ○ | ○ |
| Ex. 11-8 | a-SiN | 1-11-12 | ET-1 | 793 | 133 | 0.884 | ○ | ○ | ○ | ○ | ○ |
| C.Ex.2-5 | a-SiN | HT-3 | ET-1 | 798 | 187 | 1.334 | ○ | Δ | x | — | — |
| Ex. 11-9 | a-CN | 1-11-3 | ET-1 | 790 | 128 | 0.902 | ○ | ○ | ○ | ○ | ○ |
| Ex. 11-10 | a-CN | 1-11-12 | ET-1 | 793 | 130 | 0.933 | ○ | ○ | ○ | ○ | ○ |
| C.Ex.2-6 | a-CN | HT-3 | ET-1 | 801 | 194 | 1.389 | ○ | Δ | x | — | — |
| Ex. 11-11 | a-CB | 1-11-3 | ET-1 | 803 | 112 | 0.803 | ○ | ○ | ○ | ○ | ○ |
| Ex. 11-12 | a-CB | 1-11-12 | ET-1 | 812 | 116 | 0.830 | ○ | ○ | ○ | ○ | ○ |
| C.Ex.2-7 | a-CB | HT-3 | ET-1 | 798 | 166 | 1.235 | ○ | x | — | — | — |

TABLE 63-continued

| | SPL | P-HTM | ETM | SP $V_0$(V) | RP Vr(V) | HLE $E_{1/2}$($\mu$J/cm$^2$) | Durability Test 10,000 copies | 20,000 copies | 30,000 copies | 50,000 copies | 100,000 copies |
|---|---|---|---|---|---|---|---|---|---|---|---|
| Ex. 11-13 | a-CF | 1-11-3 | ET-1 | 802 | 115 | 0.824 | ○ | ○ | ○ | ○ | ○ |
| Ex. 11-14 | a-CF | 1-11-12 | ET-1 | 809 | 119 | 0.851 | ○ | ○ | ○ | ○ | |
| C.Ex.2-8 | a-CF | HT-3 | ET-1 | 782 | 180 | 1.284 | Δ | x | — | — | — |
| Ex. 11-15 | a-BN | 1-11-3 | ET-1 | 812 | 112 | 0.772 | ○ | ○ | ○ | ○ | ○ |
| Ex. 11-16 | a-BN | 1-11-12 | ET-1 | 791 | 105 | 0.793 | ○ | ○ | ○ | ○ | ○ |
| C.Ex.2-9 | a-BN | HT-3 | ET-1 | 788 | 155 | 1.165 | ○ | Δ | x | — | — |

It was confirmed from the table that if the type of the surface protective layer is further changed, the same results as the above are obtained according to the compositions of the single-layer photosensitive layer as the base.

Specifically, it was found that all the electrophotosensitive materials of Examples 11-7 to 11-16 suffered no cracks nor delamination after the continuous production of 100,000 copies. It was thus confirmed that the use of the diphenylamine compound of the formula (1-11) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test I was conducted on electrophotosensitive materials having the same photosensitive layers as Examples 11-1 to 11-16 but no surface protective layer, as well as on those of Examples 11-1 to 11-16, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It was thus confirmed that the durability of the electrophotosensitive materials was improved by forming the surface protective layer.

By comparing these results with the results of the aforesaid analogous study on Comparative Examples 2-1 to 2-9, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 11-1 to 11-16 wherein the single-layer photosensitive layers contain the diphenylamine compound of the formula (1-11) accomplish a notable increase in the durability by virtue of the formation of the surface protective layer.

Multi-Layer Electrophotosensitive Material

Example 11-17

Forming Multi-Layer Photosensitive Layer

The ball mill was operated for dispersing by mixing 2.5 parts by weight of crystalline X-type metal-free phthalocyanine as the charge generating material represented by the formula (CG-1), and 1 part by weight of polyvinylbutyral as the binder resin in 15 parts by weight of tetrahydrofuran, thereby to prepare a coating solution for charge generating layer of the multi-layer photosensitive layer.

Subsequently, the resultant coating solution was dip coated on the aluminum tube as the conductive substrate and then was air dried at 110° C. for 30 minutes. Thus was formed a charge generating layer having a thickness of 0.5 $\mu$m.

The ball mill was operated for dispersing by mixing 0.8 parts by weight of diphenylamine compound as the positive-hole transport material represented by the formula (1-11-3), and 1 part by weight of Z-type polycarbonate (weight-average molecular weight Mw=20,000) as the binder resin in 10 parts by weight of tetrahydrofuran, thereby to prepare a coating solution for charge transport layer of the multi-layer photosensitive layer.

Subsequently, the resultant coating solution was dip coated on the above charge generating layer and then was air dried at 110° C. for 30 minutes, thereby to form a charge transport layer having a thickness of 20 $\mu$m. Thus was formed a negative-charge multi-layer photosensitive layer.

Forming Surface Protective Layer

The plasma CVD process was performed under the same conditions as in Example 1-1, thereby forming a surface protective layer of amorphous silicon-carbon (SiC) composite film having a thickness of 0.5 $\mu$m. Thus was fabricated an electrophotosensitive material of Example 11-17.

Examples 11-18, 11-19

Electrophotosensitive materials of Examples 11-18, 11-19 were fabricated the same way as in Example 11-17 except that each of the examples used 0.8 parts by weight of diphenylamine compound of the formula of a number listed in the following Table 64 as the positive-hole transport material.

The electrophotosensitive materials of the above examples were subjected to the same photosensitivity test II and durability test II as the above and were evaluated for the characteristics thereof. The results, along with the aforementioned results of Comparative Examples 2-10, 2-11, are listed in Table 64.

TABLE 64

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 11-17 | a-SiC | 1-11-3 | −804 | −73 | 0.671 | ○ | ○ | ○ | ○ |
| Ex. 11-18 | a-SiC | 1-11-12 | −798 | −76 | 0.675 | ○ | ○ | ○ | ○ |
| Ex. 11-19 | a-SiC | 1-11-23 | −812 | −73 | 0.674 | ○ | ○ | ○ | ○ |
| CEx.2-10 | a-SiC | HT-1 | −806 | −165 | 0.938 | ○ | x | — | — |
| CEx.2-11 | a-SiC | HT-3 | −814 | −147 | 1.024 | ○ | x | — | — |

It was confirmed from the table that if the single-layer photosensitive layer is replaced by the multi-layer photosensitive layer, the same results as the above are obtained according to the compositions of the charge-transport layer defining the outermost part of the electrophotosensitive material.

Specifically, it was found that all the electrophotosensitive materials of Examples 11-17 to 11-19 suffered no cracks nor delamination after the continuous production of 100,000 copies. It was thus confirmed that the use of the diphenylamine compound of the formula (1-11) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 11-20 to 11-22

Electrophotosensitive materials of these examples were fabricated the same way as in Examples 11-17 to 11-19 except that the same procedure as in Examples 1-13 to 1-24 and Comparative Examples 1-3, 1-4 was taken to form a $\mu$m surface protective layer of amorphous carbon (C) having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-12, 2-13, are listed in Table 65.

TABLE 65

| | SPL | P-H TM | SP $V_0$(V) | RP Vr(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 11-20 | a-C | 1-11-3 | −788 | −70 | 0.682 | ○ | ○ | ○ | ○ |
| Ex. 11-21 | a-C | 1-11-12 | −812 | −68 | 0.683 | ○ | ○ | ○ | ○ |
| Ex. 11-22 | a-C | 1-11-23 | −801 | −75 | 0.681 | ○ | ○ | ○ | ○ |
| CEx.2-12 | a-C | HT-1 | −785 | −172 | 1.216 | Δ | x | — | — |
| CEx.2-13 | a-C | HT-3 | −817 | −146 | 1.098 | Δ | x | — | — |

It was confirmed from the table that if the type of the surface protective layer is changed, the same results as the above are obtained according to the compositions of the charge transport layer of the multi-layer photosensitive layer as the base.

Specifically, it was found that all the electrophotosensitive materials of Examples 11-20 to 11-22 suffered no cracks nor delamination after the continuous production of 100,000 copies. It was thus confirmed that the use of the diphenylamine compound of the formula (1-11) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

Examples 11-23, 11-24

Electrophotosensitive materials of these examples were fabricated the same way as in Examples 11-17, 11-18 except that the same procedure as in Examples 1-25, 1-26 and Comparative Example 1-5 was taken to form a $\mu$m surface protective layer of amorphous silicon-nitrogen (SiN) composite film having a thickness of 0.5.m, instead of the silicon-carbon composite film, over the surface of the multi-layer photosensitive layer.

Examples 11-25, 11-26

Electrophotosensitive materials of these examples were fabricated the same way as in Examples 11-17, 11-18 except that the same procedure as in Examples 1-27, 1-28 and Comparative Example 1-6 was taken to form a $\mu$m surface protective layer of amorphous carbon-nitrogen (CN) composite film having a thickness of 0.5.m, instead of the silicon-carbon composite film, over the surface of the multi-layer photosensitive layer.

Examples 11-27, 11-28

Electrophotosensitive materials of these examples were fabricated the same way as in Examples 11-17, 11-18 except that the same procedure as in Examples 1-29, 1-30 and Comparative Example 1-7 was taken to form a $\mu$m surface protective layer of amorphous carbon-boron (CB) composite film having a thickness of 0.5.m, instead of the silicon-carbon composite film, over the surface of the multi-layer photosensitive layer.

Examples 11-29, 11-30

Electrophotosensitive materials of these examples were fabricated the same way as in Examples 11-17, 11-18 except that the same procedure as in Examples 1-31, 1-32 and Comparative Example 1-8 was taken to form a $\mu$m surface protective layer of amorphous carbon-fluorine (CF) composite film having a thickness of 0.5.m, instead of the silicon-carbon composite film, over the surface of the multi-layer photosensitive layer.

Examples 11-31, 11-32

Electrophotosensitive materials of these examples were fabricated the same way as in Examples 11-17, 11-18 except that the same procedure as in Examples 1-33, 1-34 and Comparative Example 1-9 was taken to form a $\mu$m surface protective layer of amorphous boron-nitrogen (BN) composite film having a thickness of 0.5.m, instead of the silicon-carbon composite film, over the surface of the multi-layer photosensitive layer.

The electrophotosensitive materials of the above examples were subjected to the same photosensitivity test II and durability test II as the above and were evaluated for the characteristics thereof. The results, along with the aforementioned results of Comparative Examples 2-14 to 2-18, are listed in Table 66.

TABLE 66

| | SPL | P-H TM | SP $V_0$(V) | RP $V_r$(V) | HLE $E_{1/2}$($\mu$J/cm$^2$) | Durability Test 10,000 copies | 20,000 copies | 50,000 copies | 100,000 copies |
|---|---|---|---|---|---|---|---|---|---|
| Ex. 11-23 | a-SiN | 1-11-3 | −817 | −76 | 0.577 | ○ | ○ | ○ | ○ |
| Ex. 11-24 | a-SiN | 1-11-12 | −793 | −79 | 0.584 | ○ | ○ | ○ | ○ |
| C.Ex.2-14 | a-SiN | HT-3 | −785 | −149 | 1.095 | ○ | x | — | — |
| Ex. 11-25 | a-CN | 1-11-3 | −788 | −75 | 0.621 | ○ | ○ | ○ | ○ |
| Ex. 11-26 | a-CN | 1-11-12 | −817 | −74 | 0.600 | ○ | ○ | ○ | ○ |
| C.Ex.2-15 | a-CN | HT-3 | −793 | −148 | 1.155 | Δ | x | — | — |
| Ex. 11-27 | a-CB | 1-11-3 | −793 | −68 | 0.504 | ○ | ○ | ○ | ○ |
| Ex. 11-28 | a-CB | 1-11-12 | −793 | −71 | 0.509 | ○ | ○ | ○ | ○ |
| C.Ex.2-16 | a-CB | HT-3 | −793 | −137 | 0.979 | Δ | x | — | — |
| Ex. 11-29 | a-CF | 1-11-3 | −814 | −66 | 0.520 | ○ | ○ | ○ | ○ |
| Ex. 11-30 | a-CF | 1-11-12 | −817 | −68 | 0.531 | ○ | ○ | ○ | ○ |
| C.Ex.2-17 | a-CF | HT-3 | −793 | −139 | 1.021 | Δ | x | — | — |
| Ex. 11-31 | a-BN | 1-11-3 | −785 | −50 | 0.469 | ○ | ○ | ○ | ○ |
| Ex. 11-32 | a-BN | 1-11-12 | −812 | −61 | 0.471 | ○ | ○ | ○ | ○ |
| C.Ex.2-18 | a-BN | HT-3 | −780 | −117 | 0.904 | ○ | x | — | — |

It was confirmed from the table that if the type of the surface protective layer is further changed, the same results as the above are obtained according to the compositions of the charge transport layer of the multi-layer photosensitive layer as the base.

Specifically, it was found that all the electrophotosensitive materials of Examples 11-23 to 11-32 suffered no cracks nor delamination after the continuous production of 100,000 copies. It was thus confirmed that the use of the diphenylamine compound of the formula (1-11) contributed the improvement of the physical stability of the inorganic surface protective layer, resulting in the electrophotosensitive materials further improved in durability as compared with the prior-art products.

It was also found that all the electrophotosensitive materials of these examples did not suffer serious decrease in photosensitivity when formed with the surface protective layer and accomplished high photosensitivity, because they had small residual potentials after light exposure and small half-life exposures.

The durability test II was conducted on electrophotosensitive materials having the same photosensitive layers as Examples 11-17 to 11-32 but no surface protective layer, as well as on those of Examples 11-17 to 11-32, and produced images were evaluated. The former electrophotosensitive materials provided images which were decreased in image density after the production of 20,000 to 80,000 copies, so that white spots were observed in solid black image areas. However, the latter electrophotosensitive materials provided no defective images after the production of 100,000 copies. It -was thus confirmed that the durability of the electrophotosensitive materials was improved by forming the surface protective layer.

By comparing these results with the results of the aforesaid analogous study on Comparative Examples 2-10 to 2-18, it is clarified that forming the surface protective layer on the organic photosensitive layer does not always result in the improvement of the durability of the electrophotosensitive material. If a suitable positive-hole transport material is not selected, the resultant electrophotosensitive material is rather decreased in durability.

The electrophotosensitive materials of Examples 11-17 to 11-32 wherein the multi-layer photosensitive layers contain the diphenylamine compound of the formula (1-11) accomplish a notable increase in the durability by virtue of the formation of the surface protective layer similarly to the examples with the single-layer photosensitive layer.

What is claimed is:

1. An electrophotosensitive material comprising an organic photosensitive layer and an inorganic surface protective layer laid over a conductive substrate in this order, wherein at least an outermost part of the organic photosensitive layer that contacts the surface protective layer contains a diphenylamine compound represented by a formula (1):

(1)

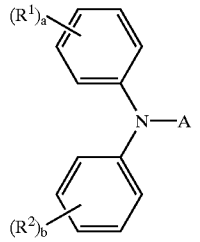

wherein 'A' denotes a group having at least one of aromatic groups, heterocyclic groups, double bond groups and conjugated double bond groups combined with two phenyl groups in the formula in a manner to jointly form a π-electron conjugated system, provided that when 'A' is the only one phenyl group that is directly combined with nitrogen atom in the formula, this phenyl group further possesses a group including one or more aromatic groups, heterocyclic groups, double bond groups or conjugated double bond groups which form the π-electron conjugated system jointly with these groups, or that when 'A' possesses a double bond group directly combined with nitirogen atom in the formula and one phenyl group attached to its end, this phenyl group further possesses a group including one or more aromatic groups, heterocyclic groups, double bond groups or conjugated double bond groups which form the π-electron conjugated system jointly with these groups; $R^1$ and $R^2$ are the same or different and each denote a hydrogen atom, alkyl group, alkoxy group, aralkyl group, aromatic group or halogen atom; $R^1$ or $R^2$ may form a condensed ring jointly with the phenyl group; and 'a' and 'b' are the same or different and each denote an integer of 0 to 5.

2. An electrophotosensitive material according to claim 1, wherein 'A' in the formula (1) is a group represented by a formula (A1):

$$—Ar^1—(R^3)_c \quad (A1)$$

in which $Ar^1$ denotes an aromatic group, heterocyclic group or group represented by a formula (A1a):

$$—Ar^2—CH=CH—Ar^3—CH=E— \quad (A1a)$$

in which formula (A1a), $Ar^2$ and $Ar^3$ are the same or different and each denote an aromatic group, and 'E' denotes a nitrogen atom or a group represented by a formula (A1b):

$$=CH—Ar^4— \quad (A1b)$$

in which formula (A1b), $Ar^4$ denotes an aromatic group; $R^3$ denotes a hydrogen atom, aromatic group, heterocyclic group or group represented by a formula (A1c):

(A1c)

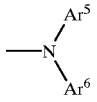

provided that when $Ar^1$ is an aromatic group derived from a benzene ring, $R^3$ is not a hydrogen atom; 'c' is an integer of 1 or 2; $Ar^5$ and $Ar^6$ in the formula (A1c) are the same or different and each denote an aromatic group.

3. An electrophotosensitive material according to claim 1, wherein 'A' in the formula (1) is a group represented by a formula (A2):

$$—N=CH—R^4 \quad (A2)$$

in which $R^4$ denotes an aromatic group having 7 to 16 carbon atoms, heterocyclic group or group represented by a formula (A2a):

(A2a)

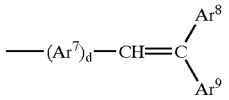

in which formula (A2a), $Ar^7$ denotes an aromatic group or two or more aromatic groups forming a π-electron conjugated system, $Ar^8$ and $Ar^9$ are the same or different and each denote an aromatic group, and 'd' denotes an integer of 0 or 1.

4. An electrophotosensitive material according to claim 1, wherein the surface protective layer is a layer formed by a vapor deposition method.

5. An electrophotosensitive material according to claim 1, wherein the surface protective layer comprises at least one element selected from the group consisting of metallic elements and carbon or an inorganic compound containing any one of these elements.

6. An electrophotosensitive material according to claim 1, wherein the organic photosensitive layer is a single-layer photosensitive layer comprising a binder resin containing therein a charge generating material and a diphenylamine compound as a positive-hole transport material represented by the formula (1).

7. An electrophotosensitive material according to claim 1, wherein the organic photosensitive layer is a multi-layer photosensitive layer comprising a charge generating layer and a charge transport layer laminated in this order, the charge generating layer containing a charge generating material, the charge transport layer comprising a binder resin containing therein a diphenylamine compound as a positive-hole transport material represented by the formula (1).

8. An electrophotosensitive material according to claim 1, wherein the diphenylamine compound is a compound represented by a formula (1-1):

(1-1)

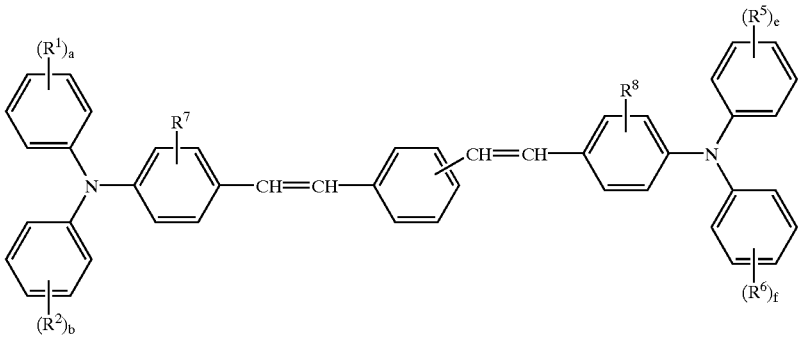

wherein $R^1$, $R^2$, $R^5$ and $R^6$ are the same or different and each denote a hydrogen atom, alkyl group, alkoxy group, aralkyl group, aromatic group or halogen atom; $R^1$ or $R^2$ may form a condensed ring jointly with the phenyl group; 'a', 'b', 'e' and 'f' are the same or different and each denote an integer of 0 to 5; and $R^7$ and $R^8$ are the same or different and each denote a hydrogen atom or alkyl group.

9. An electrophotosensitive material according to claim 1, wherein the diphenylamine compound is a compound represented by a formula (1-2):

(1-2)

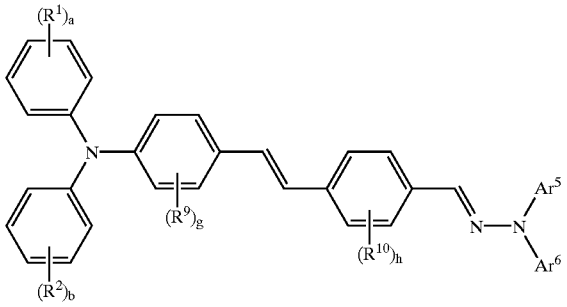

wherein $R^1$, $R^2$, $R^9$ and $R^{10}$ are the same or different and each denote a hydrogen atom, alkyl group, alkoxy group, aralkyl group, aromatic group or halogen atom; $R^1$ or $R^2$ may form a condensed ring jointly with the phenyl group; 'a' and 'b' are the same or different and each denote an integer of 0 to 5; 'g' and 'h' are the same or different and each denote an integer of 0 to 4; and $Ar^5$ and $Ar^6$ are the same or different and each denote an aromatic group.

10. An electrophotosensitive material according to claim 1, wherein the diphenylamine compound is a compound represented by a formula (1-3):

(1-3)

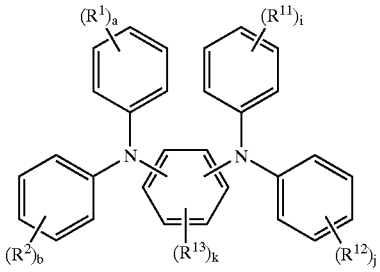

wherein $R^1$, $R^2$, $R^{11}$, $R^{12}$ and $R^{13}$ are the same or different and each denote a hydrogen atom, alkyl group, alkoxy group, aralkyl group, aromatic group or halogen atom; $R^1$ or $R^2$ may form a condensed ring jointly with the phenyl group; 'a', 'b', 'i' and 'j' are the same or different and each denote an integer of 0 to 5; and 'k' denotes an integer of 0 to 4.

11. An electrophotosensitive material according to claim 1, wherein the diphenylamine compound is a compound represented by a formula (1-4):

(1-4)

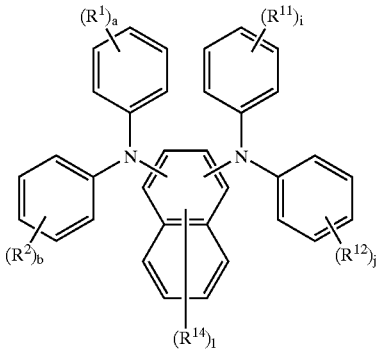

wherein $R^1$, $R^2$, $R^{11}$, $R^{12}$ and $R^{14}$ are the same or different and each denote a hydrogen atom, alkyl group, alkoxy group, aralkyl group, aromatic group or halogen atom; $R^1$ or $R^2$ may form a condensed ring jointly with the phenyl group; 'a', 'b', 'i' and 'j' are the same or different and each denote an integer of 0 to 5; and '1' denotes an integer of 0 to 6.

12. An electrophotosensitive material according to claim 1, wherein the diphenylamine compound is a compound represented by a formula (1-5):

(1-5)

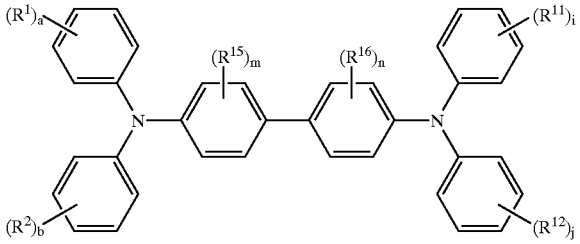

wherein $R^1$, $R^2$, $R^{11}$, $R^{12}$, $R^{15}$ and $R^{16}$ are the same or different and each denote a hydrogen atom, alkyl group, alkoxy group, aralkyl group, aromatic group or halogen atom; $R^1$ or $R^2$ may form a condensed ring jointly with the phenyl group; 'a', 'b', 'i' and 'j' are the same or different and each denote an integer of 0 to 5; and 'm' and 'n' are the same or different and denote an integer of 0 to 4.

13. An electrophotosensitive material according to claim 1, wherein the diphenylamine compound is a compound represented by a formula (1-6):

(1-6)

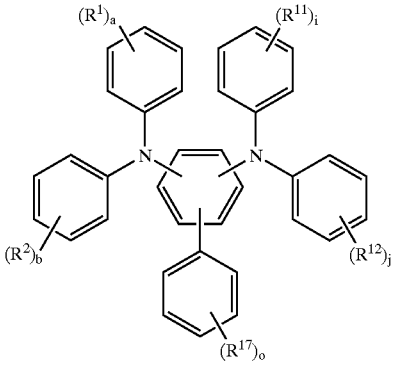

wherein $R^1$, $R^2$, $R^{11}$, $R^{12}$ and $R^{17}$ are the same or different and each denote hydrogen atom, alkyl group, alkoxy group, aralkyl group, aromatic group or halogen atom; $R^1$ or $R^2$ may form a condensed ring jointly with the phenyl group; and 'a', 'b', 'i', 'j' and 'o' are the same or different and each denote an integer of 0 to 5.

14. An electrophotosensitive material according to claim 1, wherein the diphenylamine compound is a compound represented by a formula (1-7):

(1-7)

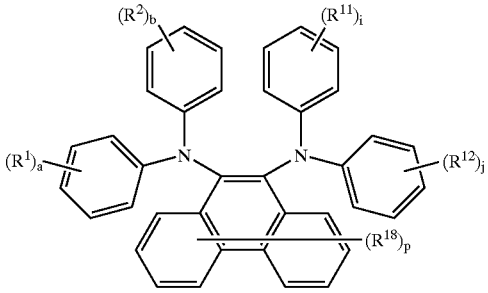

wherein $R^1$, $R^2$, $R^{11}$, $R^{12}$ and $R^{18}$ are the same or different and each denote a hydrogen atom, alkyl group, alkoxy group, aralkyl group, aromatic group or halogen atom; $R^1$, or $R^2$ may form a condensed ring jointly with the phenyl group; 'a', 'b', 'i' and 'j' are the same or different and each denote an integer of 0 to 5; and 'p' denotes an integer of 0 to 8.

15. An electrophotosensitive material according to claim 1, wherein the diphenylamine compound is a compound represented by a formula (1-8):

(1-8)

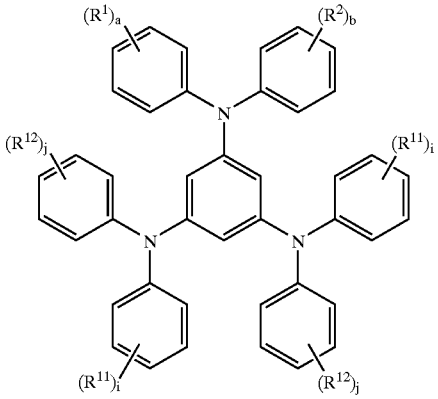

wherein $R^1$, $R^2$, $R^{11}$ and $R^{12}$ are the same or different and each denote a hydrogen atom, alkyl group, alkoxy group, aralkyl group, aromatic group or halogen atom; $R^1$ or $R^2$ may form a condensed ring jointly with the phenyl group; and 'a', 'b', 'i' and 'j' are the same or different and each denote an integer of 0 to 5.

16. An electrophotosensitive material according to claim 1, wherein the diphenylamine compound is a compound represented by a formula (1):

(1)

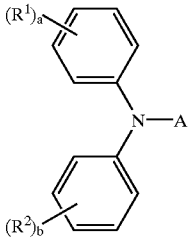

wherein $R^1$ and $R^2$ are the same or different and each denote a hydrogen atom, alkyl group, alkoxy group, aralkyl group, aromatic group or halogen atom; $R^1$ or $R^2$ may form a condensed ring jointly with the phenyl group; 'a' and 'b' are the same or different and each denote an integer of 0 to 5; and 'A' denotes a group represented by a formula (A1):

$$—Ar^1—(R^3)_c \quad (A1)$$

in which $Ar^1$ denotes an aromatic group or heterocyclic group; $R^3$ denotes a hydrogen atom, aromatic group or heterocyclic group; and 'c' denote an integer of 1.

17. An electrophotosensitive material according to claim 1, wherein the diphenylamine compound is a compound represented by a formula (1):

(1)

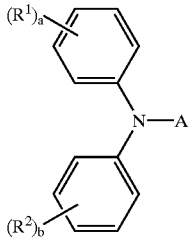

wherein $R^1$ and $R^2$ are the same or different and each denote a hydrogen atom, alkyl group, alkoxy group, aralkyl group, aromatic group or halogen atom; $R^1$ or $R^2$ may form a condensed ring jointly with the phenyl group; 'a' and 'b' are the same or different and each denote an integer of 0 to 5; and 'A' denotes a group represented by a formula (A2):

$$—N=CH—R^4 \quad (A2)$$

in which $R^4$ denotes an aromatic group having 7 to 16 carbon atoms, heterocyclic group or group represented by a formula (A2a):

(A2a)

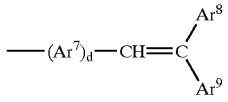

in which 'd' denotes an integer of 0 and $Ar^8$ and $Ar^9$ are the same or different and each denote an aromatic group.

18. An electrophotosensitive material according to claim 1, wherein the diphenylamine compound is a compound represented by a formula (1):

(1)

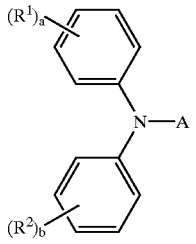

wherein $R^1$ and $R^2$ are the same or different and each denote a hydrogen atom, alkyl group, alkoxy group, aralkyl group, aromatic group or halogen atom; $R^1$ or $R^2$ may form a condensed ring jointly with the phenyl group; 'a' and 'b' are the same or different and each denote an integer of 0 to 5; 'A' denotes a group represented by a formula (A2):

$$—N=CH—R^4 \quad (A2)$$

in which $R^4$ denotes an aromatic group having 7 to 16 carbon atoms, heterocyclic group or group represented by a formula (A2a):

(A2a)

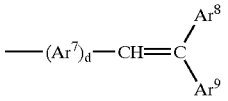

in which $Ar^7$ denotes an aromatic group or two or more aromatic groups forming a π-electron conjugated system; $Ar^8$ and $Ar^9$ are the same or different and each denote an aromatic group; and 'd' denotes an integer of 1.

* * * * *

UNITED STATES PATENT AND TRADEMARK OFFICE

CERTIFICATE OF CORRECTION

PATENT NO. : 6,489,071 B2 
DATED : December 3, 2002
INVENTOR(S) : Eiichi Miyamoto, Yoshio Inagaki and Hideaki Fukunaga It is certified that error appears in the above-identified patent and that said Letters Patent is hereby corrected as shown below:

Title page,
Item [73], Assignee, add -- Kyocera Corporation, Kyoto (JP) --

Signed and Sealed this

Twenty-fourth Day of June, 2003

JAMES E. ROGAN
*Director of the United States Patent and Trademark Office*